US005756269A

United States Patent [19]

Ishikawa et al.

[11] Patent Number: 5,756,269

[45] Date of Patent: May 26, 1998

[54] METHOD OF FORMING IMAGES

[75] Inventors: Shun-ichi Ishikawa; Kazuhiko Matsumoto; Toshiki Taguchi, all of Kanagawa, Japan

[73] Assignee: Fuji Photo Film Co., Ltd., Kanagawa, Japan

[21] Appl. No.: 701,018

[22] Filed: Aug. 21, 1996

[30] Foreign Application Priority Data

| | | | |
|---|---|---|---|
| Aug. 22, 1995 | [JP] | Japan | 7-234600 |
| Sep. 22, 1995 | [JP] | Japan | 7-268045 |
| Jan. 25, 1996 | [JP] | Japan | 8-030103 |

[51] Int. Cl.[6] ..... G03C 7/407; G03C 8/32

[52] U.S. Cl. ..... 430/351; 430/404

[58] Field of Search ..... 430/351, 404

[56] References Cited

U.S. PATENT DOCUMENTS

| | | | |
|---|---|---|---|
| 4,957,848 | 9/1990 | Takahashi et al. | 430/351 |
| 5,064,742 | 11/1991 | Aono et al. | 430/203 |
| 5,306,597 | 4/1994 | Aono | 430/203 |

FOREIGN PATENT DOCUMENTS

| | | |
|---|---|---|
| 0210660 | 2/1987 | European Pat. Off. . |
| 0317826 | 5/1989 | European Pat. Off. . |
| 0385496 | 9/1990 | European Pat. Off. . |
| 0526931 | 2/1993 | European Pat. Off. . |
| 2193216 | 2/1974 | France . |
| 2056103 | 3/1981 | United Kingdom . |

*Primary Examiner*—Hoa Van Le

*Attorney, Agent, or Firm*—Sughrue, Mion, Zinn, Macpeak & Seas, PLLC

[57] ABSTRACT

Methods of forming color images having excellent graininess and sharpness by simple heat development processing are disclosed.

2 Claims, No Drawings

METHOD OF FORMING IMAGES

FIELD OF THE INVENTION

The present invention relates to a method of providing color prints using a photosensitive material for photographing use.

BACKGROUND OF THE INVENTION

In a method known as conventional color photography, a color photosensitive material for photographing use (the so-called color negative) generally comprises a layer capable of recording blue light to form a yellow image, a layer capable of recording green light to form a magenta image and a layer capable of recording red light to form a cyan image. When such a material undergoes development-processing after exposure, the silver halide grains having latent images formed by the exposure are reduced to silver, while the developing agent is oxidized. The oxidized developing agent reacts with dye-providing couplers (that is, undergoes coupling reaction) to form dye images. From the resultant material, the undeveloped silver halide and the developed silver are removed in a bleach-fix step subsequent to the development step. The negative dye images thus obtained are projected onto a color photosensitive material for printing use, and the thus exposed printing material is subjected to development and bleach-fix steps similar to the above, thereby obtaining a color print.

The so-called color negative photosensitive material further contains colloidal silver and dyes having a filtering function for imparting spectral sensitivity differences to the three kinds of sensitive layers, and fine-grain silver or dyes for the anti-halation purpose. Of these additives, the metal silver, such as colloidal silver, is removed in a bleaching step.

Also, another method of forming color images in a printing material is known, wherein the image information present in a color negative as described above is read by a photoelectric means, subjected to image processing to be converted into image information for recording, and then recorded in a printing material.

In particular, the development of digital photoprinters has been advanced as an embodiment of the foregoing method. An example of such photoprinters is described in JP-A-7-015593 (The term "JP-A" as used herein means an "unexamined published Japanese patent application"). In a digital photoprinter, the image information of a color negative is converted into digital signals, and recording light modulated in accordance with those digital signals is used for scanning exposure of photosensitive materials, such as color paper, to provide finished prints.

The methods cited above presuppose usual development, bleach and fixation steps, and so their processing steps are complex.

In the conversion of image information into digital signals, however, the image information as original is not required in principle to be dye images. For instance, EP 526,931 describes the method in which a multilayer photosensitive material constituted of a layer forming a silver image alone and a layer forming both silver and dye images is exposed and then developed, and the thus obtained image information is read. Further, JP-A-6-266066 describes the method in which all the three layers constituting a multilayer photosensitive material are free from dyes, and the information as to residual silver halide and developed silver is read.

Although the above-cited methods simplify photographic processing, they presuppose digitized image processing. Therefore, in contrast to conventional dye images, the images obtained by those methods cannot be used for the exposure by direct projection onto color paper and the like. Even when the digital processing is performed, however, the developed silver and the silver halide are lower in concentration than dyes. Thus, a smaller amount of information is derived therefrom; as a result, the image quality is lowered. In addition, as usual color couplers are used as coloring material, colors are gradually developed in the Dmin area unless any processing is given to the couplers after development. Therefore, a certain processing for fixation or stopping the development is carried out.

As other coloring materials used in a method of forming images, there are known nondiffusible compounds of the kind which release diffusible dyes responding positively or negatively to silver development. For instance, such compounds are described, e.g., in EP-A2-0220746, U.S. Pat. No. 4,783,396, Kokai Giho 87-6199, JP-A-64-13546, U.S. Pat. No. 4,500,626 and U.S. Pat. No. 4,639,408. Those compounds are mainly used for transferring diffusible dyes into an image-receiving material to form a print.

On the other hand, as a processing method of a photosensitive material using a silver halide, a simple rapid process using a heat development has been developed and as the examples, goods such as Dry silver (trade mark) by Minnesota Mining and Manufacturing Company, PICTROGRAPHY (trade mark) by Fuji Photo Film Co., Ltd, and PICTROSTAT (trade name) by Fuji Photo Film Co., Ltd., have been known. However, they are black and white or color printing materials and photosensitive materials for photographing use by a conventional heat development have not been known.

Also, as a form of heat development, a process of heat-developing in the presence of a small amount of water and a base and/or a base precursor is known, for example, an example of the process is described in JP-B-2-51494 (the term "JP-B" as used herein means an "examined Japanese patent publication"). However, the image-forming method described in the above patent is a process that dye-providing substances, which are reductive to a light-sensitive silver halide and release hydrophilic dyes by causing a reaction when heated together with a light-sensitive silver halide, are used, the dyes released at the heat-development is transferred onto an image-receiving material, and the image-receiving material having thus transferred dyes is used as a color print.

As mentioned above, conventional methods for color photographic processing are complex, and so more simplified methods are desired to be developed. Further, disposal of processing solutions used in bleaching and fixing steps is required. The methods described in EP 526,931 and JP-A-6-266066, though they are simplified, presuppose digitalized image processing, and so the images obtained thereby cannot be used for the exposure performed by direct projection onto color paper or the like.

SUMMARY OF THE INVENTION

Therefore, an object of the present invention is to provide a method of forming color prints using a photosensitive material for photographing use, which is suitable for digital processing as well as projection exposure, and that in a more simplified processing process.

More specifically, a first aspect of the present invention (called Present Invention (1) hereinafter) is to provide an image formation method comprising the steps of:

(1) carrying out imagewise exposure and development-processing of a photosensitive material comprising a support provided thereon at least three light-sensitive layers, which each comprise light-sensitive silver halide, a binder and a nondiffusible coloring material capable of releasing a diffusible dye responding positively or negatively to silver development, and which have their individual sensitivities in different wavelength regions, the coloring materials present in the layers being different from one another in hue after development;

(2) removing part or all of the released diffusible dyes from the photosensitive material to form at least three dye images of different colors in the photosensitive material;

(3) converting image information into optical or electric information, with the image information being obtained from the photosensitive material which, after the step (2), undergoes neither additional processing step for stopping the development nor additional processing step for removing silver halide and developed silver; and (4) forming color-images in a separate recording material by making use of the thus converted information.

A second aspect of the present invention (called Present Invention (2) hereinafter) is to provide an image formation method which comprises exposing imagewise and developing a photosensitive material comprising a support provided thereon at least three light-sensitive layers which have their individual sensitivities in different wavelength regions, each of the layers comprising light-sensitive silver halide, a binder and a dye-providing coupler, and the dyes formed from dye-providing couplers in the layers being different in hue, thereby forming at least three dye images of different colors; converting the image information thus obtained into optical or electric information without performing additional processing of removal of the residual silver halide and the developed silver from the photosensitive material; and making use of the thus converted information to form color images in a separate recording material.

A third aspect of the present invention is to provide an image formation method which comprises the steps of:

(1) carrying out imagewise exposure of a photosensitive material which comprises a transparent support provided thereon at least three light-sensitive layers, which each comprise light-sensitive silver halide, a color developing agent, a coupler and a binder, and which have their individual sensitivities in different wavelength regions, the absorption wavelength region of each dye formed by reacting the color developing agent with the coupler being different from each other;

(2) providing said photosensitive material or a processing material with water in an amount corresponding to the amount of from 0.1 to 1 times the amount required for maximally swelling the total coated layers of said photosensitive material and said processing material excluding a back layer, wherein said processing material comprises on a support a processing layer containing at least a base and/or a base precursor;

(3) then superposing said photosensitive material on said processing material such that the photosensitive layer faces the processing layer;

(4) heating the material to a temperature of from 60° C. to 100° C. for a time of from 5 seconds to 60 seconds to form an image based on at least three-color nondiffusible dyes on said photosensitive material; and (5) forming color images in a separate recording material based on the image information obtained in the step (4).

DETAILED DESCRIPTION OF THE INVENTION

Also, it is preferred that the foregoing color developing agent is at least one compound of the compounds represented by the following general formulae (I) to (V).

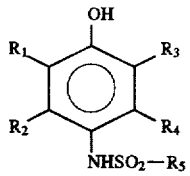

(I)

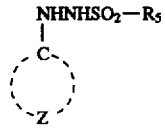

(II)

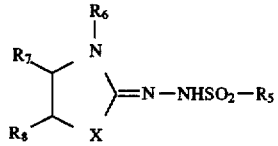

(III)

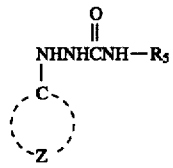

(IV)

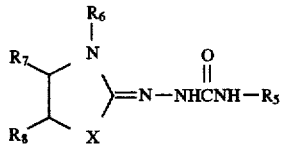

(V)

In the above formulae, $R_1$, $R_2$, $R_3$, and $R_4$ each represents a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents a substituted or unsubstituted alkyl group, a substituted or unsubstituted aryl group, or a substituted or unsubstituted heterocyclic group; Z represents an atomic group forming an aromatic ring (including a heterocyclic aromatic ring) and when Z is a benzene ring, the total value of the Hammett's constant ($\sigma$) of the substituent is at least 1; $R_6$ represents a substituted or unsubstituted alkyl group; X represents an oxygen atom, a sulfur atom, a selenium atom, or an alkyl-substituted or aryl-substituted tertiary nitrogen atom; and $R_7$ and $R_8$ each represents a hydrogen atom or a substituent and $R_7$ and $R_8$ may combine each other to form a double bond or a ring.

The coloring materials used in Present Invention (1) are nondiffusible compounds which each include a dye moiety in their individual structures and the capability to release a diffusible dye responding positively or negatively to the developed silver. Simultaneously with or subsequently to the release, part or all of the diffusible dye are removed from the photosensitive material. Although images are obtained from the coloring materials remaining after development, images of this kind have never been put to positive use. As a result of our studies, however, it has been found that those images were fairly stable even if they didn't undergo additional processing steps for stopping development and removing silver halide and developed silver, so that color prints of good quality were obtainable by employing as an exposure means the projection of those images onto color paper or the like. Further, it has been found that the information of dye images, including the information of developed silver, was converted into digital signals by photoelectric reading thereof and these digital signals enabled the formation of quality images in a separate recording material, such as color paper, a heat-developable digital color print material, a thermal sublimation transfer material, an ink jet recording material, a full-color direct heat-sensitive recording material, or a color display (e.g., CRT, LCD).

The development-processing of silver halide in Present Invention (1) may be carried out by passing an optically exposed photosensitive material through a solution containing a reducing agent and a base or a solution containing a base alone, but it is preferable in view of simple processing to apply heat development thereto. The image data obtained by heat development may be transferred to a heat-developable color print material, e.g., PCTROSTAT 300, trade name, a product of Fuji Photo Film Co., Ltd. Also, the image information obtained by heat development may be converted into digital signals, and transmitted to a heat-developable digital color print system, e.g., PICTROGRAPHY 3000, trade name, a product of Fuji Photo Film Co., Ltd. In these cases, the entire process, from a photographing step to a printing step, can be accomplished without using any of processing solutions used in conventional color photography. Moreover, in the case where image information is converted into digital signals, the signals can be freely processed and edited, so that the photographed image freely retouched, deformed or processed can be obtained as output signals.

In reading photoelectrically the image information of a photosensitive material, it is desirable to adopt a method which comprises subjecting the photosensitive material to overall exposure to or slit scanning with at least three colored lights and measuring the quantities of those colored lights reflected from or transmitted by the photosensitive material. In particular, the measurement of the quantity of transmitted light is preferred because a wide density range is ensured therein. When the photosensitive material used therein is a photosensitive material suitable for Present Invention (1), the use of diffused light is preferable to the use of parallel rays of light since the former light is superior to the latter light in graininess of the finished print. In a light receiving part, it is desirable to use a semidonductor image sensor (e.g., CCD of two-dimensional or one-dimensional type).

In Present Invention (1), it is desirable that a difference in absorbance between the coloring material after development and the dye be within 10% at the wavelength employed for measuring the quantity of the foregoing transmitted light. If the absorbance difference is in such a range, a slight change is caused in image density by the reaction taking place subsequently to the development, so that consistent reading becomes possible. As the coloring materials used in Present Invention (1) enable the adjustment to the aforesaid range, they have an advantage over the coloring materials of coupling type.

The color images in Present Invention (1) can be rendered positive as well as negative to an object by properly choosing the kind of silver halide (a negative emulsion or a positive emulsion) and the kind of a coloring material (a negative mode or a positive mode). When digital processing is adopted in Present Invention 1, positive image is preferred. This is because, although noises are more noticeable in highlight areas when they are present on a print, the highlight areas of the print correspond to the highlight areas of the photosensitive material, so that reduced noises are made upon reading of image information to result in ensuring a desirable image in the print. In Present Invention (1), it is preferable to form a positive image to an object by the use of combinations of negative emulsions with coloring materials capable of releasing diffusible dyes in exposed areas.

Next, Present Invention (2) is explained below.

There has never been known the embodiment of projecting, onto color paper or the like, color images formed by exposure and subsequent development together with both silver halide and developed silver left over. As a result of our study, however, it has been found that good prints having almost no problems about graininess, sharpness and color reproduction can be obtained when, after development, each of three dyes having different colors has, in a transmission mode, Dmin of no higher than 2.0, Dmax of no higher than 4.0, and Dmax–Dmin of no smaller than 1.0 at the absorption maximum wavelength thereof. When Dmin and Dmax are higher than the aforementioned values, there is caused an increase in quantity of light to which color paper or the like is exposed, so that print-out effect produced at the time of exposure becomes great.

In addition, it is desired that irradiation preventing dyes, filter dyes and antihalation dyes necessary for the so-called color negative photosensitive materials be removed in the development-processing step because those dyes needlessly increase Dmin and Dmax of image information if they remain after processing.

In Present Invention (2), information of dye images, including developed silver information, may be read photoelectrically to be converted into digital signals. When this reading is performed by the density measurement of transmitted light, the density of each dye image at its absorption maximum wavelength is desirably at least three times the density of developed silver at that wavelength. Further, it is desirable that silver halide be used in an amount larger than the amount required stoichiometrically for the dye-image formation by a factor of at least 5 so that a difference in density between unexposed and exposed areas is not greater than 20 % of the original density. Furthermore, it is desirable that the sum of a silver halide density and a developed silver density be not greater than 2.0. If such conditions as described above are satisfied, an original image can be faithfully reproduced by image processing of the signals obtained by photoelectric reading. In this case, the signal-output receiving material may not be a photosensitive material, but it may be, for example, a thermal sublimation transfer material, an ink jet recording material, a full-color direct heat-sensitive recording material, a color CRT or a color LCD. In particular, quality print images can be obtained with ease when the output receiving material is a heat-developable color print material, e.g., PICTROGRAPHY 3000, trade name, a product of Fuji Photo Film Co., Ltd. Moreover, the digital image signals can be freely processed and edited, and so the photographed image freely retouched, deformed or processed can be obtained as output signals.

While the development-processing of silver halide in Present Invention (2) may be carried out by passing an optically exposed photosensitive material through a solution containing a base, or the combination of a base and a reducing agent, it is preferably performed by the use of a heat development method wherein the development temperature is within the range of 60° to 150° C. The color negative image information obtained by such heat development is converted into digital signals, and thereby the above-cited heat developable photosensitive material is printed. In this case, the entire process, from a photographing step to a printing step, can be accomplished without using any of processing solutions used in conventional color photography.

Also, from photographing to printing can be performed without using any processing solutions when a heat-developable color print material, PICTROSTAT 300, trade name, a product of Fuji Photo Film Co., Ltd., is used, and thereto the image information read photoelectrically is given as output signals by means of NSE (Negative/Slide Enlarging) unit.

Silver halides usable in the present invention may be any of silver chloride, silver bromide, silver iodobromide, silver chlorobromide, silver chloroiodide and silver chloroiodobromide.

Silver halide emulsions used in the present invention may be those of surface latent image type in which a latent image is formed predominantly at the surface of the grains, or those of internal latent image type in which a latent image is formed mainly in the interior of the grains. The emulsions of the internal latent image type are combined with a nucleating agent or fogging with light, and thereby they are used as direct reversal emulsions. Also, they may be the so-called core/shell emulsions comprising grains which differ in phase between the inner part and the surface layer thereof. Further, silver halide phases different in composition may be fused together by forming an epitaxial junction. The silver halide emulsions used may have either monodisperse or polydisperse distribution with respect to grain size. However, as described in JP-A-1-167743 and JP-A-4-223463, it is desirable to adopt the method of mixing monodisperse emulsions to control the gradation. It is desirable for the grain size to be from 0.1 to 2 μm, particularly from 0.2 to 1.5 μm. As for the crystal habit, silver halide grains may have a regular crystal form, such as that of a cube, an octahedron or a tetradecahedron, a irregular crystal form, such as that of a sphere or a tablet having a high aspect ratio, a crystal form having defects such as twinning plane(s), or a composite form thereof.

More specifically, the present invention can use any of silver halide emulsions prepared using various methods as described, e.g., in U.S. Pat. No. 4,500,626 (column 50), U.S. Pat. No. 4,628,021, *Research Disclosure* (abbreviated as "RD", hereinafter) No. 17029 (1978), RD No. 17643, pp. 22–23 (Dec., 1978), RD No. 18716, p. 648 (Nov., 1979), RD No. 307105, pp. 863–865 (Nov., 1989), JP-A-62-253159, JP-A-64-13546, JP-A-2-236546, JP-A-3-110555; and further, P. Grafkides, *Chemie et Phisque Photographique*, Paul Montel, Paris (1967); G. F. Duffin, *Photographic Emulsion Chemistry*, The Focal Press, London (1966); V. L. Zelikman et al., *Making and Coating Photographic Emulsion*, The Focal Press, London (1964); and so on.

In a process of preparing the present light-sensitive silver halide emulsions, it is desirable to carry out the so-called desalting operation, that is, removal of excess salts from the silver halide emulsions. The removal can be effected using the noodle washing method which comprises gelling the gelatin, or using a flocculation method which takes advantage of a polyvalent anion-containing inorganic salt (such as sodium sulfate), an anionic surfactant, an anionic polymer (such as sodium polystyrenesulfonate), or a gelatin derivative (such as an aliphatic acylated gelatin, an aromatic acylated gelatin or an aromatic carbamoylated gelatin). Preferably, such a flocculation method is employed in the present invention.

To the light-sensitive silver halide emulsions used in the present invention, heavy metal ions such as iridium, rhodium, platinum, cadmium, zinc, thallium, lead, iron and osmium ions can be added for various purposes. Such metal ions may be used alone, or as combination of two or more thereof. The amount of heavy metal ions added, though it depends on their intended purpose, is generally of the order of $10^{-9}$–$10^{-3}$ mole per mole of silver halide. Those metal ions may be introduced into emulsion grains so that the distribution thereof is uniform throughout the grains or localized in the inner or surface part of the grains. Specifically, the emulsions described, e.g., in JP-A-2-236542, JP-A-1-116637 and JP-A-5-181246 are preferably used.

In the step for the formation of silver halide grains for the present light-sensitive silver halide emulsions, a thiocyanate, ammonia, a tetra-substituted thiourea compound, an organic thioether compound as described in JP-B-47-11386, a sulfur containing compound as described in JP-A-53-144319 or so on can be used as a silver halide solvent.

For details of other conditions under which silver halide emulsions used in the present invention can be prepared, descriptions in the above-cited books, namely P. Grafkides, *Chemie et Phisique Photographique*, Paul Montel, Paris (1967); G. F. Duffin, *Photographic Emulsion Chemistry*, The Focal Press, London (1966); and V. L. Zelikman et al., *Making and Coating Photographic Emulsion*, The Focal Press, London (1964); can be referred to. Specifically, the present silver halide emulsions can be prepared by any of an acid process, a neutral process and an ammonia process. Further, a method suitably employed for reacting a water-soluble silver salt with a water-soluble halide can be any of a single jet method, a double jet method and a combination thereof. In order to obtain a monodisperse emulsion, a double jet method is preferably adopted.

Also, a reverse mixing method in which silver halide grains are produced in the presence of excess silver ion can be employed. In addition, the so-called controlled double jet method, in which the pAg of the liquid phase in which silver halide grains are to be precipitated is maintained constant, can also be used.

Moreover, for the purpose of increasing the speed of grain growth, the concentrations, the amounts and the speeds in adding a silver salt and a halide salt respectively can be increased (as described in JP-A-55-142329, JP-A-55-158124 and U.S. Pat. No. 3,650,757).

Further, the agitation of a reaction solution may be carried out by any of known methods. On the other hand, the temperature and the pH of a reaction solution during the formation of silver halide grains can be chosen properly depending on the intended purpose. An appropriate pH range is from 2.2 to 7.0, especially from 2.5 to 6.0.

Light-sensitive silver halide emulsions are, in general, chemically sensitized silver halide emulsions. In chemically sensitizing silver halide emulsions used in the present invention, known chemical sensitization processes for emulsions of general photosensitive materials, such as a chalcogen sensitization process, including a sulfur sensitization process, a selenium sensitization process and a tellurium sensitization process, a precious metal sensitization process using gold, platinum, palladium or the like, and a reduction sensitization process, can be employed alone or in combination of two or more thereof (as described, e.g., in JP-A-3-110555 and JP-A-5-241267). Such chemical sensitization can be also carried out in the presence of a nitrogen-containing heterocyclic compound (as described in JP-A-62-253159). Further, an antifoggant recited hereinafter can be added after the conclusion of chemical sensitization. The addition of an antifoggant can be performed in the ways as described in JP-A-5-45833 and JP-A-62-40446.

The pH during the chemical sensitization is preferably from 5.3 to 10.5, and more preferably from 5.5 to 8.5; while the pAg is preferably from 6.0 to 10.5, and more preferably from 6.8 to 9.0.

The coverage range of light-sensitive silver halide used in the present invention is within the range of 1 mg/m$^2$ to 10 g/m$^2$ on a silver basis.

In order to confer color sensitivities, including green sensitivity, red sensitivity and infrared sensitivity, upon light-sensitive silver halide used in the present invention, light-sensitive silver halide emulsions are spectrally sensitized with methane dyes or other dyes. Further, a light-sensitive silver halide emulsion may be spectrally sensitized in a blue region to be rendered blue-sensitive, if needed.

Suitable dyes which can be used for the foregoing purpose include cyanine dyes, merocyanine dyes, complex cyanine dyes, complex merocyanine dyes, holopolar cyanine dyes, hemicyanine dyes, stylyl dyes and hemioxonol dyes.

Specific examples of such sensitizing dyes are recited in U.S. Pat. No. 4,617,257, JP-A-59-180550, JP-A-64 -13546, JP-A-5-45828, JP-A-5-45834, and so on.

These sensitizing dyes may be employed individually or in combination. In particular, combinations of sensitizing dyes are often used for the purpose of supersensitization and adjustment to the intended spectral sensitization wavelengths.

Dyes which themselves do not spectrally sensitize silver halide emulsions, or compounds which do not substantially absorb light in the visible region, but which each can exhibit a supersensitizing effect in combination with a certain sensitizing dye, may be incorporated into silver halide emulsions (as described, e.g., in U.S. Pat. No. 3,615,641 and JP-A-63-23145).

These sensitizing dyes may be added to silver halide emulsions during, before or after the chemical ripening, or before or after the nucleation of silver halide grains according to the embodiments of U.S. Pat. Nos. 4,183,756 and 4,225,666. Additionally, those sensitizing dyes and supersensitizing materials may be added in the form of solution dissolved in an organic solvent, such as methanol, or in the form of dispersion in gelatin, or in the form of solution comprising a surfactant. A suitable amount of each of such ingredients added is generally of the order of from $10^{-8}$ to $10^{-2}$ mole per mole of silver halide.

The other additives used in the aforementioned steps and known photographic additives which can be used in the present invention are described in the above-cited RD No. 17643, RD No. 18716 and RD No. 307105. The following is a list of those additives and the locations of their descriptions in the above-cited references.

| Additives | RD 17643 | RD 18716 | RD 307105 |
|---|---|---|---|
| 1. Chemical Sensitizer | p. 23 | p. 648, right column | p. 866 |
| 2. Sensitivity Rising Agent | | p. 648, right column | |
| 3. Spectral Sensitizer, and Supersensitizing Agent | pp. 23–24 | p. 648, right column, to p. 649, right column | pp. 866–868 |
| 4. Brightening Agent | p. 24 | p. 648, right column | p. 868 |
| 5. Antifoggant and Stabilizer | pp. 24–26 | p. 649, right column | pp. 868–870 |
| 6. Light Absorbent, Filter Dye, and UV Absorbent | pp. 25–26 | p. 649, right column, to p. 650, left column | p. 873 |
| 7. Dye Image Stabilizer | p. 25 | p. 650, left column | p. 872 |
| 8. Hardener | p. 26 | p. 651, left column | pp. 874–875 |
| 9. Binder | p. 26 | p. 651, left column | pp. 873–874 |
| 10. Plasticizer, and Lubricant | p. 27 | p. 650, right column | p. 876 |
| 11. Coating Aid, and Surfactant | pp. 26–27 | p. 650, right column | pp. 875–876 |
| 12. Antistatic Agent | p. 27 | p. 650, right column | pp. 876–877 |
| 13. Matting Agent | | | pp. 878–879 |

In the present invention, organometal salts can be used as oxidizer together with light-sensitive silver halide. Of organometal salts, organosilver salts are preferred in particular.

As for the organic compounds usable for forming organosilver salt oxidizers, the benzotriazoles described, e.g., in U.S. Pat. No. 4,500,626, and fatty acids are examples thereof. In addition, the acetylene silver described in U.S. Pat. No. 4,775,613 is also useful. Organosilver salts may be used as a mixture of two or more thereof.

Those organosilver salts can be used in an amount of from 0.01 to 10 moles, preferably from 0.01 to 1 mole, per mole of light-sensitive silver halide. An appropriate total coverage of light-sensitive silver halide and organosilver salts is in the range of 0.05 to 10 g/m$^2$, preferably 0.1 to 4 g/m$^2$, based on silver.

As for the binder used in constituent layers of the photosensitive material, hydrophilic binders are preferred. As examples of such a binder, mention may be made of those described in RD, supra, and those described at pages 71–75 of JP-A-64-13546. Specifically, transparent or translucent hydrophilic binders are desirable, and examples thereof include natural compounds, for example, proteins, such as gelatin and gelatin derivatives, and polysuccharides, such as cellulose derivatives, starch, gum arabic, dextran and pulluran, as well as synthetic high molecular compounds, such as polyvinyl alcohol, polyvinyl pyrrolidone and acrylamide polymers. Further, it is possible to use as the binder the highly water-absorbing polymers described, e.g., in U.S. Pat. No. 4,960,681 and JP-A-62-245260. More specifically, those polymers are homo- or copolymers of vinyl monomers having —COOM or —$SO_3M$ (wherein M is a hydrogen atom or an alkali metal), such as sodium methacrylate and ammonium methacrylate, and copolymers of a vinyl monomer having the foregoing group and other vinyl monomers (e.g., Sumikagel L-5H, trade name, a product of Sumitomo Chemical Co., Ltd.). The binders recited above can be used as combination of two or more thereof. In particular, it is desirable to combine gelatin with some of the foregoing binders. As for the gelatin, lime-processed gelatin, acid-processed gelatin or delimed gelatin having reduced contents of calcium and the like may be properly chosen depending on the intended purpose. Also, it is desirable that those gelatins be used in combination.

An appropriate binder coverage in the present invention is 1 to 20 g/m$^2$, particularly 2 to 10 g/m$^2$.

Moreover, Present Invention (1) is illustrated below in greater detail.

Present Invention (1) requires a reducing agent for silver halide. The reducing agent may be incorporated in a developing solution. The materials which can be used in such a case are described in *Shashin Kogaku no Kiso—Ginen Shashin Hen* (which means "The Fundamentals of Photographic Engineering—The volume of Silver Salt Photography"), pages 323–327 and pages 345–355, Corona Publisher (1979).

In the case of using a heat-developable photosensitive material, it is preferable to incorporate a reducing agent in the photosensitive material. Therein, reducing agents known in the field of heat-developable photosensitive materials can be used. In addition, the coloring material may function as a reducing agent, too. Further, it is possible to use precursors of a reducing agent, or compounds which themselves have no reducing power, but can acquire a reducing power when a nucleophilic reagent or heat acts thereon in the development step.

Specific examples of a reducing agent which can be used in Present Invention (1) include the reducing agents and precursors thereof as described in U.S. Pat. No. 4,500,626 (columns 49–50), U.S. Pat. Nos. 4,839,272, 4,330,617, 4,590,152, 5,017,454 and 5,139,919, JP-A-60-140335 (pages 17–18), JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-244044, JP-A-62-131253, JP-A-62-131256, JP-A-64-13546 (pages 40–57), JP-A-1-120553, and EP-A2-0220746 (pages 78–96).

Also, the combinations of various reducing agents as disclosed in U.S. Pat. No. 3,039,869 can be used.

When a nondiffusible reducing agent is used, an electron transmitting agent or/and a precursor thereof can optionally be used together therewith in order to promote the electron transfer between the nondiffusible reducing agent and a developable silver halide. In particular, those agents described in U.S. Pat. No. 5,139,919 cited above and EP-A-0418743 are used to advantage. Further, it is desirable to adopt the methods of introducing such agents stably into layers, as described in JP-A-2-230143 and JP-A-2-235044.

The electron transmitting agent and the precursor thereof can be selected from the above-recited reducing agents and their precursors. For the electron transmitting agent or the precursor thereof, it is desirable that its mobility be greater than that of a nondiffusible reducing agent (electron donor). Especially useful electron transmitting agents are 1-phenyl-3-pyrazolidones or aminophenols.

The nondiffusible reducing agent (electron donor) used in combination with an electron transmitting agent can be a reducing agent selected from the above-recited reducing agents, provided that the selected one does not have substantial mobility in constituent layers of a photosensitive material. Suitable examples of such a reducing agent include hydroquinones, sulfonamidophenols, sulfonamidonaphthols, the compounds described as electron donors in JP-A-53-110827 and U.S. Pat. Nos. 5,032,487, 5,026,634 and 4,839,272, and the dye-providing compounds having diffusion resistance and reducing power, which are described hereinafter.

In addition, the electron donor precursors as described in JP-A-3-160443 are also used to advantage.

Further, the above-described reducing agents can be used in interlayers and protective layers for various purposes, including the prevention of colors from mixing and the improvement in color reproduction. Suitable examples of such a reducing agent include those described in EP-A-0524649, EP-A-0357040, JP-A-2-249245, JP-A-2-46450 and JP-A-63-186240. In addition, the development inhibitor releasing reducer compounds as described in JP-B-3-63733, JP-A-1-150135, JP-A-2-46450, JP-A-2-64634, JP-A-3-43735 and EP-A-0451833 can also be employed.

The total amount of reducing agents added in Present Invention (1) is from 0.01 to 20 moles, particularly preferably from 0.1 to 10 moles, per mole of silver.

Present Invention (1) uses nondiffusible coloring materials capable of releasing diffusible dyes responding positively or negatively to silver development. These coloring materials can be represented by the following general formula (LI):

$$((\text{Dye})_m\text{—Y})_n\text{—Z} \qquad \text{(LI)}$$

wherein Dye represents a diffusible dye moiety, Y represents merely a linkage group, Z represents a group having the property of enabling the imagewise release of a diffusible moiety $(\text{Dye})_m$—Y in positive or negative response to a latent image formed in the light-sensitive silver halide and, at the same time, rendering the coloring material (LI) itself nondiffusible, m is an integer of from 1 to 5, and n is an integer of 1 or 2. When neither m nor n is 1, a plurality of Dye moieties may be the same or different.

Specific examples of a coloring material of the foregoing formula (LI) include the compounds classified into the following Groups (1) to (4). Additionally, the compounds classified as Groups (1) to (3) have the property of releasing a diffusible dye responding negatively to the development of silver halide, and the compounds classified as Group (4) have the property of releasing a diffusible dye responding positively to the development of silver halide.

The Group (1) includes the dye developers which each contain a hydroquinone developer attached to a dye moiety, as described, e.g., in U.S. Pat. Nos. 3,134,764, 3,362,819, 3,597,200, 3,544,545 and 3,482,972, and JP-B-3-68387. These dye developers are diffusible under an alkaline condition, but become nondiffusible by the reaction with silver halide.

The Group (2) includes, as described, e.g., in U.S. Pat. No. 4,503,137, nondiffusible compounds of the type which have a capability of releasing a diffusible dye under an alkaline condition but lose the capability by reacting with silver halide. As examples of such compounds, mention may be made of the compounds which release diffusible dyes by the intramolecular nucleophilic substitution reaction, as described, e.g., in U.S. Pat. No. 3,980,479; and the compounds which release diffusible dyes by the intramolecular rearrangement reaction of an isooxazolone ring, as described, e.g., in U.S. Pat. No. 4,199,354.

The Group (3) includes, as described, e.g., in U.S. Pat. No. 4,559,290, EP-A2-0220746, U.S. Pat. No. 4,783,396, Kokai Giho 87-6199 and JP-A-64-13546, nondiffusible compounds of the type which release diffusible dyes by the reaction with a reducing agent remaining without undergoing oxidation upon development.

As examples of such compounds, mention may be made of the compounds which, after undergoing the reduction, release diffusible dyes by the intramolecular nucleophilic substitution reaction, as described, e.g., in U.S. Pat. Nos. 4,139,389 and 4,139,379, JP-A-59-185333 and JP-A-57-84453; the compounds which, after undergoing reduction, release diffusible dyes by the intramolecular electron transfer reaction, as described, e.g., in U.S. Pat. No. 4,232,107, JP-A-59-101649, JP-A-61-88257 and RD No. 24,025 (1984); the compounds which, after undergoing reduction, release diffusible dyes by the single bond cleavage, as described, e.g., in West German Patent 3,008,588 A, JP-A-56-142530, and U.S. Pat. Nos. 4,343,893 and 4,619,884; the nitro compounds which release diffusible dyes after electron acceptance, as described, e.g., in U.S. Pat. No. 4,450,223; and the compounds which release diffusible dyes after electron acceptance, as described, e.g., in U.S. Pat. No. 4,609,610.

Further, the compounds described in EP-A2-0220746, Kokai Giho 87-6199, U.S. Pat. No. 4,783,396, JP-A-63-201653, JP-A-63-201654, JP-A-64-13546 and so on, which each have both N—X bond (X represents an oxygen, sulfur or nitrogen atom) and electron-attracting group; the compounds described in JP-A-1-26842, which each have both $SO_2$—X bond (X has the same meaning as the above) and electron-attracting group; the compounds described in JP-A-63-271344, which each have both PO—X bond (X has the same meaning as the above) and electron attracting group; and the compounds described in JP-A-63-271341, which each have both C—X' bond (X' has the same meaning as X, or represents —$SO_2$—) and electron-attracting group are more appropriate for the Group (3) compounds. In addition, the compounds described in JP-A-1-161237 and JP-A-1-161342, which each release a diffusible dye as a result of the cleavage of a single bond caused by the π-bond conjugated with an electron-accepting group after reduction, can also be employed.

Of those compounds, the compounds having both N—X bond (X=O, S or N) and electron-attracting group in each molecule are preferred over the others. Specific examples thereof include Compounds (1)–(3), (7)–(10), (12), (13), (15), (23)–(26), (31), (32), (35), (36), (40), (41), (44), (53)–(59), (64) and (70) described in EP-A2-0220746 or U.S. Pat. No. 4,783,396, Compounds (1)–(23) described in Kokai Giho 87-6199, and Compounds (1)–(84) described in JP-A-64-13546.

The Group (4) includes compounds of the type which can cause reduction in silver halide or an organosilver salt and release diffusible dyes when silver halide or an organosilver salt is reduced thereby (DRR compounds). These compounds have an advantage in that they can prevent images from being stained by oxidative decomposition products of a reducing agent since they don't require any other reducing agents. The representatives thereof are described, e.g., in U.S. Pat. Nos. 3,928,312, 4,053,312, 4,055,428 and 4,336,322, JP-A-59-65839, JP-A-59-69839, JP-A-53-3819, JP-A-51-104343, RD No. 17465, U.S. Pat. Nos. 3,725,062, 3,728,113 and 3,443,939, JP-A-58-116537, JP-A-57-179840, and U.S. Pat. No. 4,500,626. Specific examples of a DDR compound include the compounds described on columns 22 to 44 in the above-cited U.S. Pat. No. 4,500,626. Of these compounds, Compounds (1)–(3), (10)–(13), (16)–(19), (28)–(30), (33)–(35), (38)–(40) and (42)–(64) illustrated in the foregoing U.S. Patent are preferred over the others. In addition, the compounds illustrated on columns 37–39 in U.S. Pat. No. 4,639,408 are also useful.

In Present Invention (1), hydrophobic additives, such as a coloring material and a nondiffusible reducing agent, can be introduced into constituent layers of a photosensitive material according to known methods, including the method described in U.S. Pat. No. 2,322,027. Therein, the high boiling organic solvents as described, e.g., in U.S. Pat. Nos. 4,555,470, 4,536,466, 4,536,467, 4,587,206, 4,555,476 and 4,599,296, and JP-B-3-62256 can be used, if necessary, together with a low boiling organic solvent having a boiling point of 50°–160° C. Additionally, each additive, including a dye-providing compound and a nondiffusible reducing agent, and a high boiling organic solvent, can be employed as a mixture of two or more compounds.

The suitable amount of a high boiling organic solvent used is not higher than 10 g, preferably not higher than 5 g, and more preferably from 1 g to 0.1 g, per gram of a dye-providing compound. To 1 g of a binder, on the other hand, it is appropriate to use no more than 1 cc, preferably no more than 0.5 cc, particularly preferably no more than 0.3 cc, of a high boiling organic solvent.

Further, the polymer-utilized dispersion methods as described in JP-B-51-39853 and JP-A-51-59943, and the method of adding a hydrophobic additive in the form of fine-grain dispersion, as described in JP-A-62-30242, can be applied.

Furthermore, when the compounds to be introduced into a constituent layer are substantially insoluble in water, they can be first dispersed in the form of fine grains into a binder, and then introduced.

In dispersing a hydrophobic compound into a hydrophilic colloid, various types of surfactants can be used. Specifically, the surfactants described at pages 37 to 38 in JP-A-59-157636 and those described in the above-cited RD Nos. 17643, 18716 and 307105 can be employed. In addition, the surfactants of phosphate type described in JP-A-7-56267, JP-A-7-228589 and West German Patent Application (OLS) No. 1,932,299 can also be used.

In Present Invention (1), compounds capable of activating the development and, at the same time, stabilizing images can be introduced into a photosensitive material. Suitable examples of such a compound are described on columns 51 and 52 in U.S. Pat. No. 4,500,626.

The photosensitive material of Present Invention (1) comprises at least three light-sensitive layers which differ from one another in spectral sensitivity and hue of a coloring material incorporated therein. Each light-sensitive layer may be constituted of two or more silver halide emulsion layers which have substantially the same color sensitivity, but differ in photographic speed. Additionally, it is desirable that the aforesaid three light-sensitive layers be the layers sensitive to blue light, green light and red light, respectively. As for the arranging order of those layers, a red-sensitive layer, a green-sensitive layer and a blue sensitive layer are generally arranged in that order on the support side. However, other arranging orders may be adopted depending on intended purposes. For instance, the arrangement as described on column 162 in JP-A-7-152129 may be adopted.

In Present Invention (1), silver halide and a coloring material may be incorporated in the same layer, but they can also be separately incorporated in different layers so far as they can react with each other. For example, the lowering of the sensitivity can be prevented by arranging the coloring material-containing layer underneath the silver halide-containing layer.

The relationship between the spectral sensitivity and the hue of a coloring material in each layer can be arbitrarily chosen. However, when a cyan coloring material is incorporated in a red-sensitive layer, a magenta coloring material in a green-sensitive layer, and a yellow coloring material in a blue-sensitive layer, it becomes possible to subject conventional color paper and the like to direct projection exposure.

In the photosensitive material, various layers insensitive to light, such as a protective layer, an undercoat layer, an interlayer, a yellow filter layer and an antihalation layer, may be provided between silver halide emulsion layers described above, or as the topmost or lowest layer; while, on the back side of the support, various auxiliary layers, such as a backing layer, can be provided. Specific examples of those layers include the undercoat layer described in U.S. Pat. No. 5,051,335, the solid pigment-containing interlayers as described in JP-A-1-167838 and JP-A-61-20943, the interlayers containing a reducing agent and a DIR compound as described in JP-A-1-120553, JP-A-5-34884 and JP-A-2-64634, the electron transmitter-containing interlayers as described in U.S. Pat. No. 5,017,454, U.S. Pat. No. 5,139,919 and JP-A-2-235044, the reducer-containing protective layers as described in JP-A-4-249245, and the combination of two or more of the layers recited above.

The photosensitive material of Present Invention (1) is processed similarly to usual color negatives, a camera is loaded therewith, and photographs can be taken directly using this camera. Also, it is desirable to use this photosensitive material in the lens-attached film units described in JP-B-2-32615 and JP-B-U-3-39784 (The term "JP-B-U" as used herein means an "examined Japanese utility model publication").

The photosensitive material which has undergone an exposure operation is developed using, as described hereinbefore, a heat development method, or a processing solution containing an alkali salt if a reducing agent is incorporated in the photosensitive material, or a processing solution containing both a reducing agent and a base. When liquid development methods are adopted, diffusible dyes released upon development can be removed by the diffusion into a processing solution. In the case of heat development, on the other hand, it is desirable to adopt a method of causing dyes to diffuse into a mordant-containing layer simultaneously with the development. As for the form which the mordant-containing layer may take, that layer and the photosensitive material may have separate supports or the same support. However, the form of having separate supports is preferred. Herein, a sheet having the mordant-containing layer is called "a processing sheet". Such a processing sheet has at least one layer containing a mordant and a binder. As for the mordant, those known in the photographic arts can be employed, with specific examples including the mordants described in U.S. Pat. No. 4,500,626 (on columns 58–59) and JP-A-61-88256 (at pages 32≅41), and those described in JP-A-62-244043 and JP-A-62-244036. Further, the dye-accepting high molecular compounds as described in U.S. Pat. No. 4,463,079 may be used.

As for the binder of a processing sheet, the same binder used in the photosensitive material can be employed. In addition, it is useful to provide the processing sheet with a protective layer.

In the removal of dyes from the photosensitive material by the dye diffusion taking place simultaneously with heat development, it is advantageous to carry out the heating in the presence of a small amount of water.

In the photosensitive material according to Present Invention (1), it is desirable to use a base or its precursor for the purpose of promoting the silver development and the dye formation.

As for the precursors of bases, there are known the salts formed by bases and organic acids capable of undergoing decarboxylation upon heating, and the compounds capable of releasing amines by intramolecular nucleophilic substitution reaction, Lossen rearrangement or Beckmann rearrangement. Specific examples of such precursors of bases are described in U.S. Pat. Nos. 4,514,493 and 4,657,848, and *Kochi Gijutsu* No.5, pp. 55–86 (published in May 22, 1991, by Azutec Company Inc.)

The amount of a base or its precursor used is from 0.1 to 20 g $m^2$, preferably from 1 to 10 g/$m^2$.

In the case where the heat development and the dye transfer are carried out at the same time in the presence of a small amount of water, it is preferable to incorporate a base and/or a precursor of bases in a processing sheet from a viewpoint of heightening the keeping quality of the photosensitive material.

In Present Invention (1), as described in EP-A-0210660 and U.S. Pat. No. 4,740,445, it is effective to adopt the method of producing a base by the use of the combination of a basic metal compound slightly soluble in water with the so-called complexing compound, or a compound capable of complexing the metal ion, which constitutes the basic metal compound, in water as a medium. In this case, it is desirable from the viewpoint of freshness keeping quality that the basic metal compound slightly soluble in water and the complexing compound be incorporated in the photosensitive material and the processing sheet, respectively.

To the photosensitive material according to Present Invention (1), a thermal solvent may further be added for the purpose of promoting the heat development and the diffusion transfer of dyes. As examples of such a thermal solvent, mention may be made of the polar organic compounds as described in U.S. Pat. Nos. 3,347,675 and 3,667,959. More specifically, amide derivatives (such as benzamide), urea derivatives (such as methyl urea and ethyl urea), the sulfonamide derivatives (such as the compounds described in JP-B-1-40974 and JP-B-4-13701), polyol compounds (such as sorbitols) and polyethylene glycols can be used as thermal solvent.

When a thermal solvent used is insoluble in water, it is desirable for the solvent to be used in the form of solid dispersion. The layer to which a thermal solver is added may be chosen from light-sensitive layers or light-insensitive layers depending on the intended purpose.

The proportion of a thermal solvent added is from 10 to 500 weight %, preferably from 20 to 300 weight %, to the binder in the layer to which the thermal solvent is added.

For the photosensitive material and the processing sheet according to Present Invention (1), it is desirable to be hardened with a hardener.

As examples of such a hardener, mention may be made of the hardeners described, e.g., in U.S. Pat. No. 4,678,739 (on column 41), U.S. Pat. No. 4,791,042, JP-A-59-116655, JP-A-62-245261, JP-A-61-18942, and JP-A-4-218044. More specifically, the hardener can be selected from among aldehyde hardeners (such as formaldehyde), aziridine hardeners, epoxy hardeners, vinylsulfone hardeners (e.g., N,N'-ethylenebis(vinylsulfonylacetamido)ethane), N-methylol hardeners (such as dimethylol urea), boric acid, metaboric acid and polymeric hardeners (such as the compounds described in JP-A-62-234157).

These hardeners can be used in a proportion of 0.001 to 1 g, preferably 0.005 to 0.5 g, to 1 g of a hydrophilic binder.

In the photosensitive material can be used various antifoggants, photographic stabilizer and precursors thereof. Specific examples of such agents include the compounds described, e.g., in RD, supra, U.S. Pat. Nos. 5,089,378, 4,500,627 and 4,614,702, JP-A-64-13564 (pages 7–9, 57–71 and 81–97), U.S. Pat. Nos. 4,775,610, 4,626,500 and 4,983,494, JP-A-62-174747, JP-A-62-239148, JP-A-1-150135, JP-A-2-110557, JP-A-2-178650, and RD No. 17643, pages 24–25 (1978).

Those compounds are used in an amount of $5\times10^{-6}$ to $1\times10^{-1}$ mole, preferably $1\times10^{-5}$ to $1\times10^{-2}$ mole, per mole of silver.

The photosensitive material and the processing sheet used in Present Invention (1) can contain various surfactants for a wide variety of purposes, for instance, as a coating aid, improvements in releasability and slippability, prevention of generation of static charges, acceleration of development, and so on. Specific examples of such surfactants are described, e.g., in *Kochi Gijutsu* No.5, pp. 136–138 (published in May 22, 1991, by Azutec Company Inc.), JP-A-62-173463 and JP-A-62-183457.

Also, organic fluorinated compounds may be added to the photosensitive material and the processing sheet with the intentions of making improvements in slippability and releasability, preventing static charges from generating, and so on. Typical examples of an organic fluorinated compound usable for such intentions include fluorine-containing surfactants as described in JP-B-57-9053 (columns 8–17), JP-A-61-20944 and JP-A-62-135826, and hydrophobic fluorine-containing compounds, such as oily fluorinated compounds, including fluorine-containing oils, and solid fluorinated compound resins such as a tetrafluoroethylene resin.

In the photosensitive material can be used a matting agent. Suitable examples of a matting agent include silicon dioxide, the compounds described in JP-A-61-88256 (page 29), such as polyolefin and polymethacrylate, the compounds described in JP-A-63-274944 and JP-A-63-274952, such as benzoguanamine resin beads, polycarbonate resin beads and AS resin beads, and the compounds described in RD, supra.

Supports for the photosensitive material and the processing sheet used in Present Invention (1) are chosen from those which can withstand processing temperatures. In general, photographic supports, including various types of paper and synthetic polymer films, as described in *Shashin Kogaku no Kiso—Gin-en Shashin Hen* (which means "Fundamentals of Photographic Engineering—The Volume of Silver Salt Photography"), pages 223–240, compiled by Japanese Photographic Society, published by Corona Publishing Co., Ltd., in 1979, can be used. Specific examples of such photographic supports include films of polyethylene terephthalate, polyethylene naphthalate, polycarbonate, polyvinyl chloride, polystyrene, polypropylene, polyimide and celluloses (e.g., triacetyl cellulose); the above-recited films to which pigments, such as titanium oxide, are added; synthetic paper made from polypropylene or the like by a film process; paper made from mixed pulp, e.g., a mixture of synthetic resin pulp, such as polyethylene pulp, with natural wood pulp; Yankee paper; baryta paper; coated paper (especially, cast coat paper); and metal, cloth and glass sheets. These types of paper and films can be used alone, or a paper or film laminated with a synthetic polymer on one side or both sides can be used as a support.

Other supports which can be employed are those described, e.g., in JP-A-62-253159 (pages 29–31), JP-A-1-161236 (pages 14–17), JP-A-63-316848, JP-A-2-22651, JP-A-3-56955, and U.S. Pat. No. 5,001,033.

To the surface of a support as recited above, a hydrophilic binder, alumina sol, a semiconductive metal oxide, such as tin oxide, and an antistatic agent, such as carbon black, may be applied.

In particular, the supports described in JP-A-6-41281, JP-A-6-43581, JP-A-6-51426, JP-A-6-51437, JP-A-6-51442, JP-A-6-82961, JP-A-6-82960, JP-A-6-82959, JP-A-6-67346, JP-A-6-202277, JP-A-6-175282, JP-A-6-118561, JP-A-7-219129 and JP-A-7-219144, and Japanese Patent Application Nos. 4-253545, 4-221538 and 5-21625 can be appropriate for the photosensitive material because of their excellent anticurling properties.

Also, the support constituted mainly of a syndiotactic styrene polymer can be used to advantage.

Further, it is desirable to use the support provided with a magnetic layer, such as those described in JP-A-4-124645, JP-A-5-40321, JP-A-6-35092, JP-A-6-317875, and Japanese Patent Application No. 5-58221, since photographic information can be recorded thereon.

The photosensitive material and/or the processing sheet used in Present Invention (1) may be provided with an electrically conductive heat-generating layer as a heating means for heat development and diffusion transfer of dyes. For the heat-generating element in this case, the material described in JP-A-61-145544 and so on can be utilized.

The heating temperature in the process of heat development ranges between about 50° C. to about 250° C., but the range of about 60° C. to 180° C. is especially useful therefor. The diffusion transfer of dyes may be performed simultaneously with heat development, or subsequently to the conclusion of heat development. In the latter case, the heating temperature in the process of transfer can be chosen from the range of room temperature to the temperature adopted in the step of heat development. In particular, it is desirable to choose the heating temperature from the range of about 50° C. to the temperature lower than the heat development temperature by about 10° C.

Although the transfer of dyes can be caused by heating alone, it may be promoted by the use of a solvent. For instance, as described, e.g., in U.S. Pat. No. 4,704,345, U.S. Pat. No. 4,740,445 and JP-A-61-238056, it is useful to adopt the method of simultaneously or successively performing development and transfer steps by heating in the presence of a small amount of solvent (especially water). in this method, the heating temperature is appropriately from 50° C. to the boiling point of a solvent used. In the case of using water as the solvent, a desirable heating temperature is from 50° C. to 100° C.

As examples of a solvent used for acceleration of development and/or diffusion transfer of dyes, mention may be made of water, a basic water solution containing an inorganic alkali metal salt or an organic base (examples of these bases include those recited in the description of an image formation accelerator), low boiling solvents, and mixed solutions of low boiling solvents with water or the aforementioned basic water solutions. Further, those solvents may contain a surfactant, an antifoggant, a compound with which a sparingly soluble metal salt can be complexed, antimolds and antibacterial agents.

As the solvent used in the steps of heat development and/or diffusion transfer, water is preferred, and any types of water may be employed. Specifically, distilled water, tap water, well water, mineral water and so on can be used. In an apparatus used for heat development of the photosensitive material of the type which is combined with an image-receiving element, water may be used only once and then discarded, or water may be circulated and used repeatedly. In the latter case, the water used comes to contain ingredients eluted from the material. Also, the apparatus and water as described, e.g., in JP-A-63-144354, JP-A-63-144355, JP-A-62-38460 or JP-A-3-210555 may be employed.

The solvents as recited above can be supplied to the photosensitive material, the processing sheet or both of them. It is adequate to use a solvent in an amount lower than the weight of the solvent having a volume corresponding to the maximum swelling volume of the total coated layers.

As for the method of supplying water, the methods described, e.g., in JP-A-62-253159 (page 5) and JP-A-63-85544 are used to advantage. In addition, it is possible to adopt the method in which a solvent previously microencapsulated or made into the form of hydrate is incorporated into a photosensitive material, a dye-fixing element, or both of them.

The temperature of the supplied water is adequately from 30° C. to 60° C., as described in JP-A-63-85544 cited above.

As for the way of heating in the steps of development and/or transfer, the heating can be effected, e.g., by contact with a heated block or plate, with a heating means such as a heating plate, a hot presser, a heating roller, a heating drum, a halogen lamp heater, an infrared lamp heater or a far infrared lamp heater, or by passage through a high temperature atmosphere.

In superposing the photosensitive material and the processing sheet upon each other, the methods described in JP-A-62-253159 and JP-A-61-147244 (page 27) can be applied.

For the processing of the photosensitive material in Present Invention (1), any of conventional apparatuses for heat development can be used. For instance, the apparatuses described in JP-A-59-75247, JP-A-59-177547, JP-A-59-181353, JP-A-60-18951, JP-A-6-130509, JP-A-6-95338, JP-A-6-95267 and JP-A-U-62-25944 can be used to advantage. As for the commercial apparatuses on the market, the apparatuses made by Fuji Photo Film Co., Ltd., e.g., Pictrostat 100, Pictrostat 200, Pictrostat 300, Pictrography 3000 and Pictrography 2000, can be applied.

After the development-processing, no additional process for stopping the development is required in Present Invention (1). By the incorporation of a development stopper in a processing sheet, however, the stopper may be made to work simultaneously with the development.

The term "development stopper" as used herein is intended to include compounds capable of stopping development by rapidly neutralizing or reacting with a base after the proper development to lower a base concentration in the coated layers, and compounds capable of inhibiting the development by interaction with silver and a silver salt. Specific examples of those compounds include acid precursors capable of releasing acids by heating, electrophilic compounds capable of causing the substitution reaction with a base contained in coated layers by heating, nitrogen-containing heterocyclic compounds, mercapto compounds and precursors of those compounds. Further details of the development stopper are described in JP-A-62-253159, pages 31–32.

In addition, the combination of a photosensitive element, in which the zinc mercaptocarboxylates described in JP-A-8-54705 is incorporated, with a processing sheet containing a complexing compound as recited above can be employed to advantage.

On the other hand, another form may be taken, in which an agent for inhibiting silver halide from being printed out (or a print-out inhibitor) is incorporated in advance in a processing sheet and made to perform its function upon development. Examples of a print-out inhibitor include the monohalogenated compounds described in JP-B-54-164, the trihalogenated compounds described in JP-A-53-46020, the compounds containing halogen-attached aliphatic carbon atoms described in JP-A-48-45228, and the polyhalogenated compounds, a representative of which is tetrabromoxylene, described in JP-A-57-8454. In addition, the development inhibitors described in British Patent 1,005,144, such as 1-phenyl-5-mercaptotetrazole, are also effective as print-out inhibitor.

Also, the viologen compounds described in Japanese Patent Application No. 6-337531 are used effectively.

It is preferable for such a print-out inhibitor to be used in an amount of from $10^{-4}$ to 1 mole per mole of Ag, particularly from $10^{-3}$ to $10^{-1}$ mole per mole of Ag.

In the next place, Present Invention (2) is illustrated below in detail.

Both four-equivalent couplers and two-equivalent couplers can be used as dye-providing couplers in Present Invention (2). Their nondiffusible groups may have the form of a polymer chain. Specific examples of such couplers are described in detail in T. H. James, *The Theory of the Photographic Process*, 4th edition, pages 291–334 and 354–361, and JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474, JP-A-60-66249, and JP-A-8-110608, and Japanese Patent Application Nos. 6-307049 and 6-312380.

In addition, it is also desirable to use the couplers recited below.

As for the yellow couplers, suitable ones are the couplers represented by formulae (I) and (II) respectively in EP-A-502424, the couplers represented by formulae (1) and (2) respectively in EP-A-513496, the coupler represented by formula (I) in claim 1 of JP-A-5-307248, the coupler represented by formula D on column 1, lines 45–55, of U.S. Pat. No. 5,066,576, the coupler represented by formula D in paragraph [0008] of JP-A-4-274425, the coupler described in claim 1 (at page 40) of EP-A1-049838, the coupler represented by formula (Y) at page 4 of EP-A1-0447969, and the couplers represented by formulae (I) to (IV) on column 7, lines 36–58, of U.S. Pat. No. 4,476,219.

As for the magenta couplers, suitable ones are the couplers described in JP-A-3-39737, JP-A-6-43611, JP-A-5-204106 and JP-A-4-3626.

As for the cyan couplers, suitable ones are the couplers described in JP-A-4-204843, JP-A-4-43345 and Japanese Patent Application No. 4-23633.

As for the polymeric couplers, suitable ones are the couplers described in JP-A-2-44345.

As for the couplers which can provide colored dyes having moderate diffusibility, those described in U.S. Pat. No. 4,366,237, British Patent 2,125,570, European Patent No. 96570 and German Patent No. 3,234,533 are preferable.

Further, the following functional couplers may be incorporated in the photosensitive material used in Present Invention (2).

As for the couplers capable of correcting unnecessary absorption of colored dyes, the yellow colored cyan couplers described in EP-A1-456257, the yellow colored magenta couplers described in EP, supra, the magenta colored cyan couplers described in U.S. Pat. No. 4,833,069, and the colorless masking couplers represented by (2) of U.S. Pat. No. 4,837,136 and Formula (A) in claim 1 of WO 92/11575 (especially, the exemplified compounds at pages 36–45) are examples thereof.

As for the compounds (including couplers) capable of releasing photographically useful compound residues by the reaction with the oxidation product of a developing agent, examples thereof are development inhibitor releasing compounds, the compounds represented by formulae (I) to (IV) in EP-A1-0378236 (page 11), the compound represented by formula (I) in EP-A2-0436938 (page 7), the compound represented by formula (1) in JP-A-5-307248, the compounds represented by formulae (I), (II) and (III) in EP-A2-0440195 (pages 5–6), the compound (ligand releasing compound) represented by formula (I) in claim 1 of JP-A-6-59411, and the compound represented by LIG-X in claim 1 of U.S. Pat. No. 4,555,478.

In Present Invention (2), the coupler is contained in an amount of preferably 0.01 to 10 g/m$^2$, more preferably 0.1 to 2 g/m$^2$.

In Present Invention (2), for the purpose of reducing a development time, making improvements in sensitivity, raising image densities and so on, it is desirable that a color developing agent which, when oxidized by silver development, can produce dyes by coupling with the above-recited couplers be incorporated in the photosensitive material.

In this case, the combination of a p-phenylenediamine developing agent with a phenol or active methylene coupler, as described in U.S. Pat. No. 3,531,256, and the combination of a p-aminophenol developing agent with an active methylene coupler, as described in U.S. Pat. No. 3,761,270, can be employed.

Further, the combinations of sulfonamidophenol with four-equivalent couplers as described in U.S. Pat. No. 4,021,240 and JP-A-60-128438 are used to advantage, because they can have excellent freshness-keeping properties when incorporated in a photosensitive material.

In incorporating a color developing agent into a photosensitive material, a precursor thereof may be used. Examples of such a precursor include the indoaniline compounds described in U.S. Pat. No. 3,342,597, the Schiff base type compounds described in U.S. Pat. No. 3,342,599, RD Nos. 14850 and 15159, the aldol compounds described in RD No. 13924, the metal complexes described in U.S. Pat. No. 3,719,492, and the urethane compounds described in JP-A-53-135628.

Further, the combinations of couplers with the sulfonamidophenol developing agent described in Japanese Patent Application No. 7-180568, and the combinations of couplers with the hydrazine developing agent described in Japanese Patent Application Nos. 7-49287 and 7-63572 are preferably used in the photosensitive material according to Present Invention (2).

When a nondiffusible developing agent is used, an electron transmitting agent and/or a precursor thereof can be used in combination therewith, if needed, in order to promote the electron transmission between the nondiffusible developing agent and developable silver halide. In particular, electron transmitting agents described in U.S. Pat. No. 5,139,919 and EP-A-0418743 can be preferably employed. As for the method of introducing such an agent into a photosensitive material, it is desirable to adopt the methods described in JP-A-2-230143 and JP-A-2-235044, because they can ensure the stable introduction into layers.

The electron transmitting agent or a precursor thereof can be chosen from the aforementioned developing agents or precursors thereof. It is desirable for them that their mobilities be greater than that of a nondiffusible developing agent (electron donor). Especially useful electron transmitting agents are 1-phenyl-3-pyrazolidones and aminophenols.

Also, the precursors of an electron donor, as described in JP-A-3-160443, can be employed to advantage.

In interlayers and protective layer, various kinds of reducing agents can be incorporated with the intentions of prevention of color mixing, improvement in color reproduction, and so on. Specifically, the reducing agents described in EP-A-0524649, EP-A-0357040, JP-A-4-249245, JP-A-2-46450 and JP-A-63-186240 can be used to advantage. In addition, the development inhibitor-releasing reducer compounds described in JP-B-3-63733, JP-A-1-150135, JP-A-2-46450, JP-A-2-64634, JP-A-3-43735 and EP-A-0451833 can be also employed.

In the case of using a heat-developable photosensitive material, it is particularly preferable to incorporate a reducing agent in the photosensitive material. Therein, reducing agents known in the field of heat-developable photosensitive materials can be used. Further, it is possible to use precursors of a developing agent which themselves have no reducing power, but can acquire a reducing power when a nucleophilic reagent or heat acts thereon in the development step.

As the color developing agent, it is preferred to use the compounds represented by the foregoing general formulae (I) to (V), although p-phenylenediamine or p-aminophenols may be used.

The compounds represented by general formula (I) are compounds generically named sulfonamidophenols and known in the art.

In general formula (I), $R_1$ to $R_4$ each represents a hydrogen atom, a halogen atom (for example, chlorine or bromine), an alkyl group (for example, methyl, ethyl, isopropyl, n-butyl or t-butyl), an aryl group (for example, phenyl, tolyl or xylyl), an alkylcarbonamido group (for example, acetylamino, propionylamino or butyroylamino), an arylcarbonamido group (benzoylamino), an alkylsulfonamido group (for example, methanesulfonylamino or ethanesulfonylamino), an arylsulfonamido group (for example, benzenesulfonylamino or toluenesulfonylamino), an alkoxyl group (for example, methoxy, ethoxy or butoxy), an aryloxy group (for example, phenoxy), an alkylthio group (for example, methylthio, ethylthio or butylthio), an arylthio group (for example, phenylthio or tolylthio), an alkylcarbamoyl group (for example, methylcarbamoyl, dimethylcarbamoyl, ethylcarbamoyl, diethylcarbamoyl, dibutylcarbamoyl, piperidylcarbamoyl or morpholylcarbamoyl), an arylcarbamoyl group (for example, phenylcarbamoyl, methylphenylcarbamoyl, ethylphenylcarbamoyl or benzylphenylcarbamoyl), a carbamoyl group, an alkylsulfamoyl group (for example, methylsulfamoyl, dimethylsulfamoyl, ethylsulfamoyl, diethylsulfamoyl, dibutylsulfamoyl, piperidylsulfamoyl or morpholylsulfamoyl), an arylsulfamoyl group (for example, phenylsulfamoyl, methylphenylsulfamoyl, ethylphenylsulfamoyl or benzylphenylsulfamoyl), a sulfamoyl group, a cyano group, an alkylsulfonyl group (for example, methanesulfonyl or ethanesulfonyl), an arylsulfonyl group (for example, phenylsulfonyl, 4-chlorophenylsulfonyl or p-toluenesulfonyl), an alkoxycarbonyl group (for example, methoxycarbonyl, ethoxycarbonyl or butoxycarbonyl), an aryloxycarbonyl group (for example, phenoxycarbonyl), an alkylcarbonyl group (for example, acetyl, propionyl or butyroyl), an arylcarbonyl group (for example, benzoyl or alkylbenzoyl) or an acyloxy group (for example, acetyloxy, propionyloxy or butyroyloxy). Of $R_1$ to $R_4$, $R_2$ and $R_4$ are preferably hydrogen atoms. It is preferred that the sum of the Hammett constants ($\sigma_P$) of $R_1$ to $R_4$ amounts to 0 or more.

$R_5$ represents an alkyl group (for example, methyl, ethyl, butyl, octyl, lauryl, cetyl or stearyl), an aryl group (for example, phenyl, tolyl, xylyl, 4-methoxyphenyl, dodecylphenyl, chlorophenyl, trichlorophenyl, nitrochlorophenyl, triisopropylphenyl, 4-dodecyloxyphenyl or 3,5-di(methoxycarbonyl)phenyl) or a heterocyclic group (for example, pyridyl).

The compounds represented by general formula (II) are compounds generically named sulfonylhydrazines. Further, the compounds represented by general formula (IV) are compounds generically named carbamoylhydrazines.

In general formulas (II) and (IV), Z represents an atomic group forming an aromatic ring. The aromatic ring formed by Z is required to be sufficiently electron-attractive to impart the silver development activity to this compound. Accordingly, a nitrogen-containing aromatic ring or an aromatic ring into which an electron-attractive group is introduced is preferably used. Preferred examples of such aromatic rings include pyridine, pyrazine, pyrimidine, quinoline and quinoxaline rings.

For the benzene ring, a substituent group thereof is an alkylsulfonyl group (for example, methanesulfonyl or ethane-sulfonyl), a halogen atom (for example, chlorine or bromine), an alkylcarbamoyl group (for example, methylcarbamoyl, dimethylcarbamoyl, ethylcarbamoyl, diethylcarbamoyl, dibutyl-carbamoyl, piperidylcarbamoyl or morpholylcarbamoyl), an arylcarbamoyl group (for example, phenylcarbamoyl, methyl-phenylcarbamoyl, ethylphenylcarbamoyl or benzylphenyl-carbamoyl), a carbamoyl group, an alkylsulfamoyl group (for example, methylsulfamoyl, dimethylsulfamoyl, ethylsulfamoyl, diethylsulfamoyl, dibutylsulfamoyl, piperidylsulfamoyl or morpholylsulfamoyl), an arylsulfamoyl group (for example, phenylsulfamoyl, methylphenylsulfamoyl, ethylphenylsulfamoyl or benzylphenylsulfamoyl), a sulfamoyl group, a cyano group, an alkylsulfonyl group (for example, methanesulfonyl or ethanesulfonyl), an arylsulfonyl group (for example, phenylsulfonyl, 4-chlorophenylsulfonyl or p-toluenesulfonyl), an alkoxycarbonyl group (for example, methoxycarbonyl, ethoxycarbonyl or butoxycarbonyl), an aryloxycarbonyl group (for example, phenoxycarbonyl), an alkylcarbonyl group (for example, acetyl, propionyl or butyroyl) or an arylcarbonyl group (for example, benzoyl or alkylbenzoyl). The sum of the Hammett constants of the above substituent group amounts to 1 or more.

The compounds represented by general formula (III) are compounds generically named sulfonylhydrazones. Further, the compounds represented by general formula (V) are compounds generically named carbamoylhydrazones.

In general formulas (III) and (V), $R_6$ represents a substituted or unsubstituted alkyl group (for example, methyl or ethyl), and X represents an oxygen atom, a sulfur atom, a selenium atom or an alkyl-substituted or aryl-substituted tertiary nitrogen atom. An alkyl-substituted tertiary nitrogen atom is preferred. $R_7$ and $R_8$, which may be combined with each other to form a double bond or a ring, each represents a hydrogen atom or a substituent group.

Examples of the compounds represented by general formulas (I) to (V) are shown below, but the compounds used in the present invention are not, of course, limited thereby.

D-1

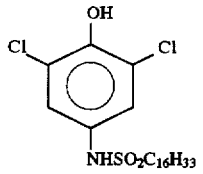

D-2

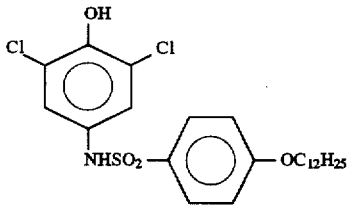

D-3

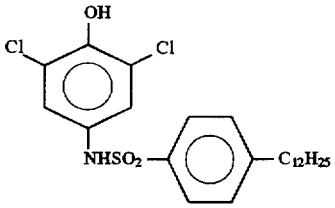

D-4

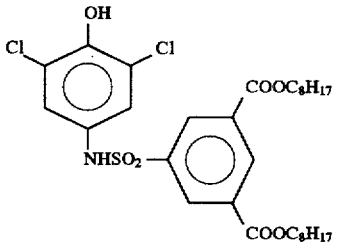

D-5

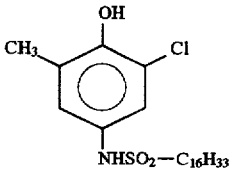

D-6

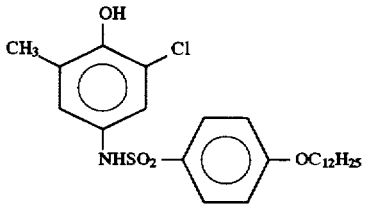

D-7

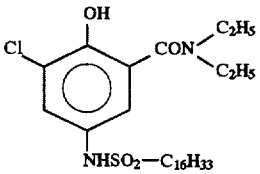

D-8

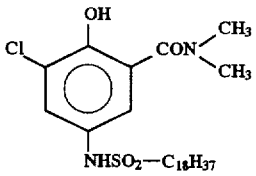

-continued
D-9
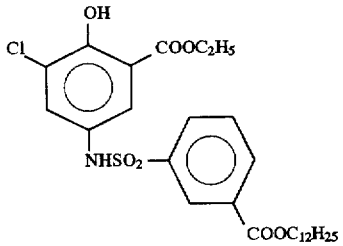
D-10
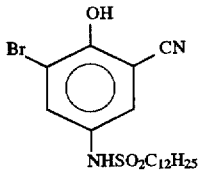
D-11
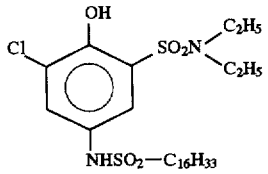
D-12
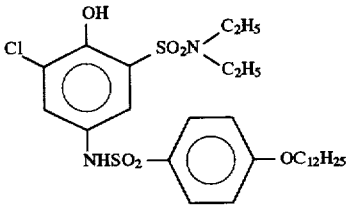
D-13
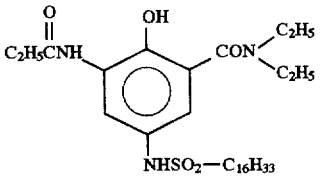
D-14
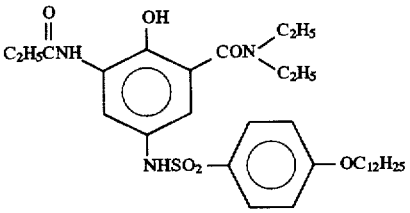
D-15
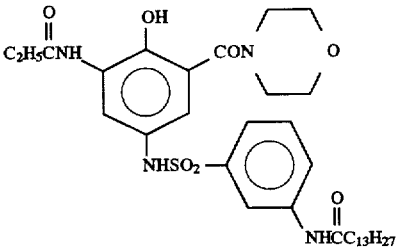
D-16
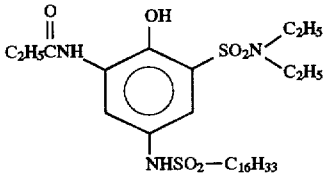
D-17
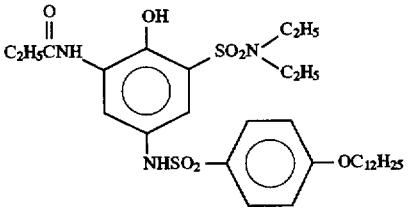
D-18
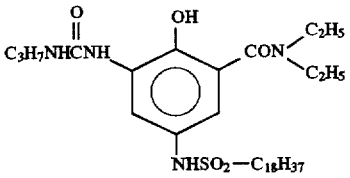
D-19
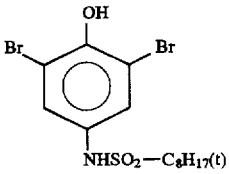
D-20
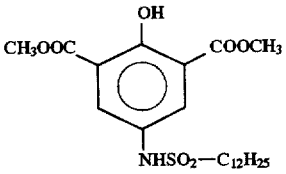
D-21
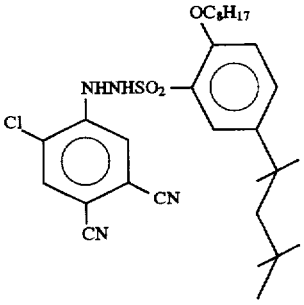
D-22
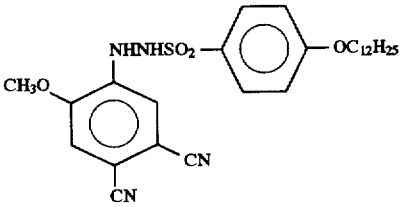

-continued
D-23
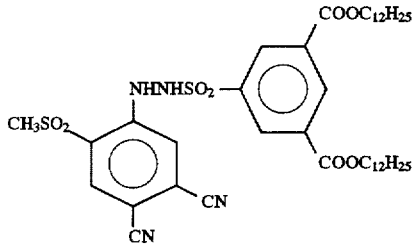
D-24
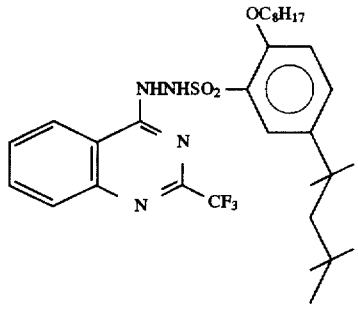
D-25
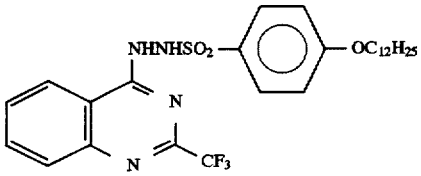
D-26
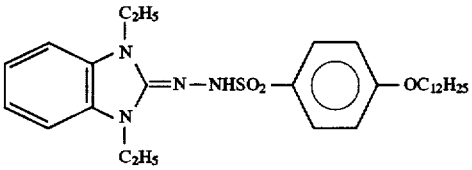
D-27
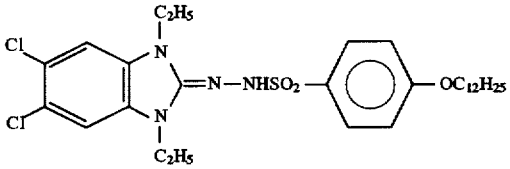
D-28
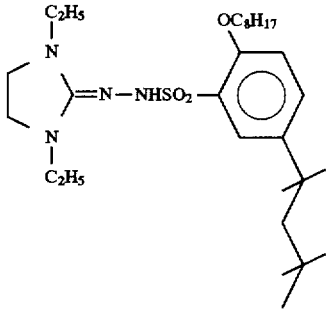
D-29
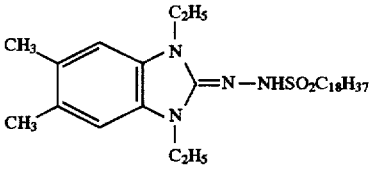
D-30
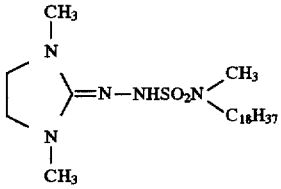
D-31
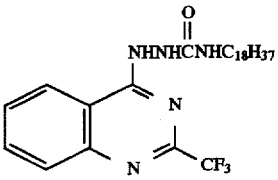
D-32
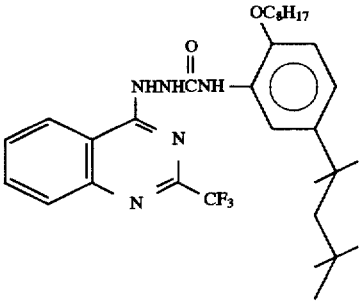
D-33
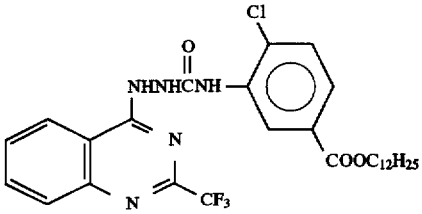
D-34
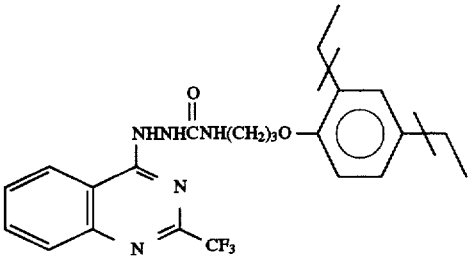

-continued
D-35
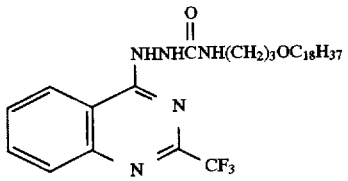
D-36
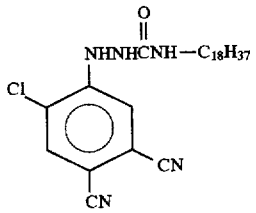
D-37
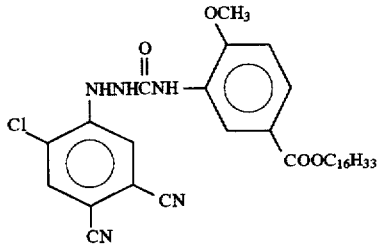
D-38
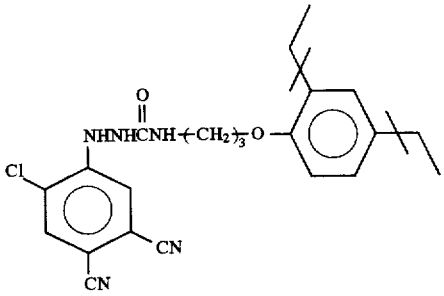
D-39
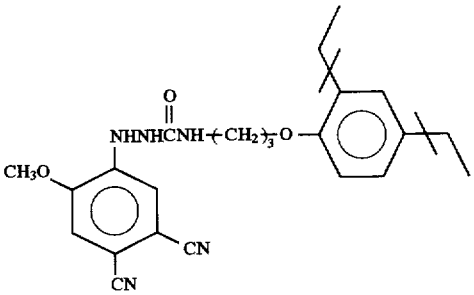
D-40
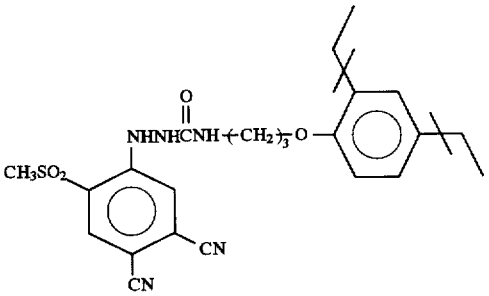
D-41
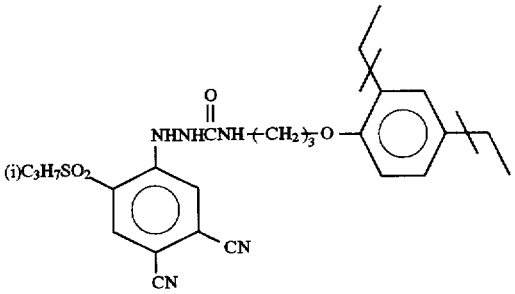
D-42
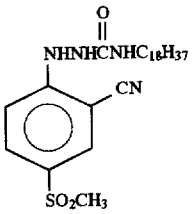
D-43
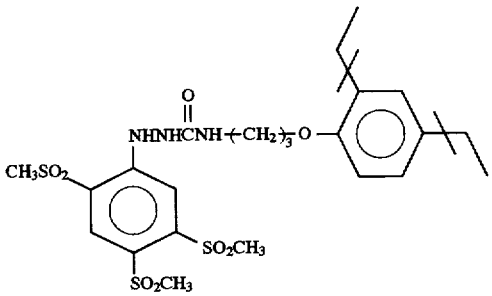
D-44
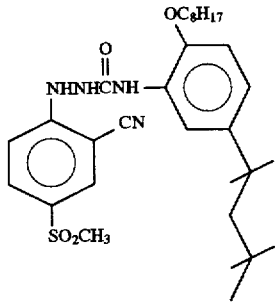
D-45
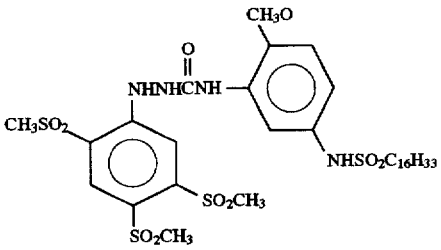
D-46
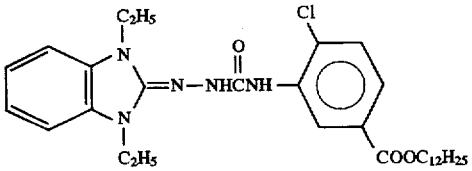

-continued
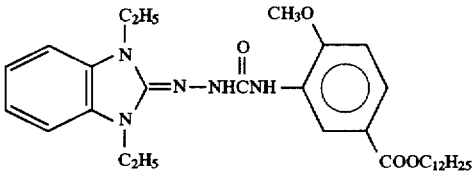
D-47
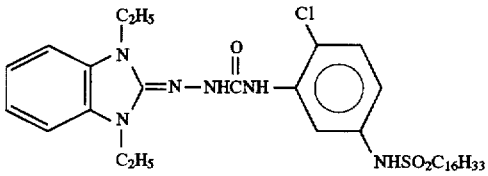
D-48
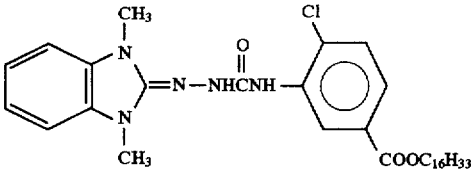
D-49
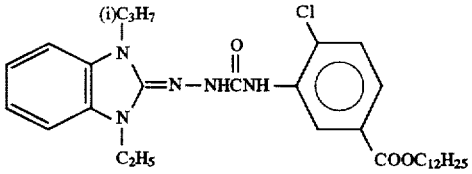
D-50
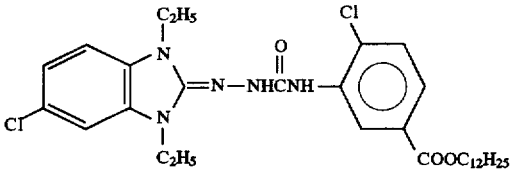
D-51
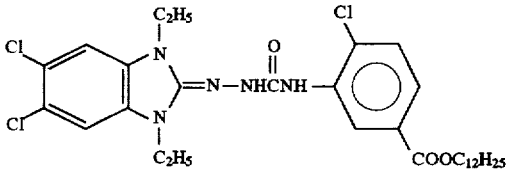
D-52
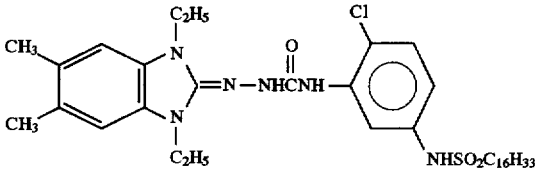
D-53
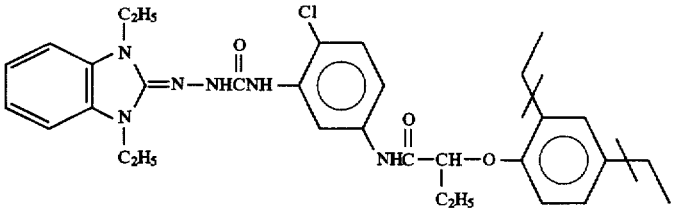
D-54
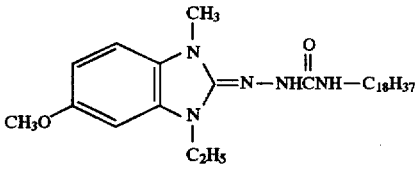
D-55
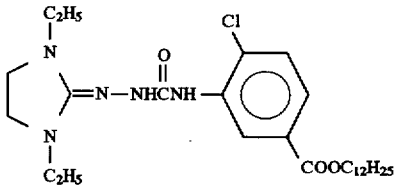
D-56
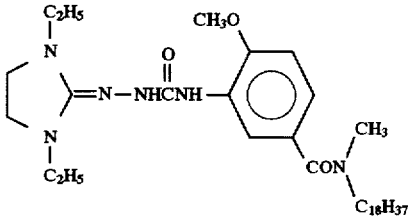
D-57
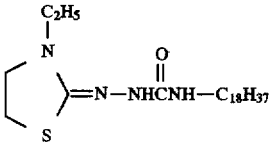
D-58
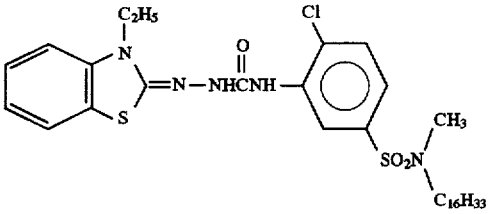
D-59
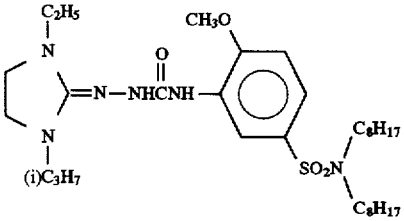
D-60

Next, the couplers used in the present invention are illustrated below. In the present invention, the couplers are compounds which form dyes by the coupling reaction with the above oxidized developing agents.

Compounds having structures as represented by the following general formulas (VI) to (XVII) are preferably used as the couplers in the present invention. These are compounds which are generically named active methylene, pyrazolone, pyrazoloazole, phenol, naphthol and pyrrolotriazole, respectively.

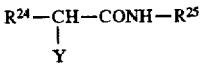
(VI)

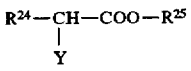
(VII)

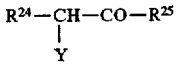
(VIII)

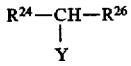
(IX)

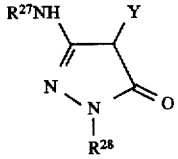
(X)

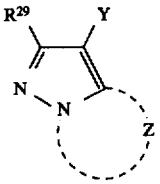
(XI)

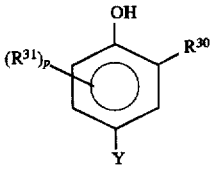
(XII)

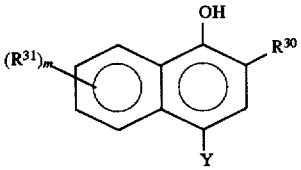
(XIII)

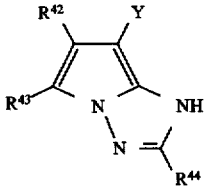
(XIV)

-continued

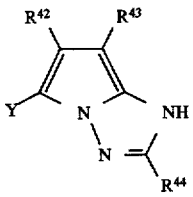
(XV)

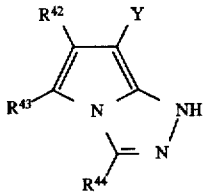
(XVI)

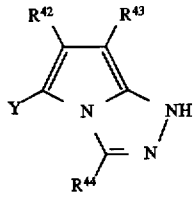
(XVII)

General formulas (VI) to (IX) indicate couplers referred to as active methylene couplers, wherein $R^{24}$ is an acyl group, a cyano group, a nitro group, an aryl group, a heterocyclic group, an alkoxycarbonyl group, an aryloxycarbonyl group, a carbamoyl group, a sulfamoyl group, an alkylsulfonyl group or an arylsulfonyl group, which may have a substituent group.

In general formulas (VI) to (IX), $R^{25}$ is an alkyl group, an aryl group or a heterocyclic group, which may have a substituent group. In general formula (IX), $R^{26}$ is an aryl group or a heterocyclic group, which may have a substituent group. The substituent groups which $R^{24}$, $R^{25}$ and $R^{26}$ may have include various substituent groups such as alkyl, cycloalkyl, alkenyl alkynyl, aryl, heterocyclic, alkoxyl, aryloxy, cyano, acylamino, sulfonamido, carbamoyl, sulfamoyl, alkoxycarbonyl, aryloxycarbonyl, alkylamino, arylamino, hydroxyl and sulfo groups and halogen atoms. Preferred examples of $R^{24}$ include acyl, cyano, carbamoyl and alkoxycarbonyl groups.

In general formulas (VI) to (IX), Y is a hydrogen atom or a group which is removable by the coupling reaction with a developing agent oxidant. Examples of the groups represented by Y functioning as anionic removable groups of the 2-equivalent couplers include halogen atoms (for example, chlorine and bromine), an aryloxy group (for example, phenoxy, 4-cyanophenoxy or 4-alkoxycarbonylphenyl), an alkylthio group (for example, methylthio, ethylthio or butylthio), an arylthio group (for example, phenylthio or tolylthio), an alkylcarbamoyl group (for example, methylcarbamoyl, dimethylcarbamoyl, ethylcarbamoyl, diethylcarbamoyl, dibutylcarbamoyl, piperidylcarbamoyl or morpholyl-carbamoyl), an arylcarbamoyl group (for example, phenyl-carbamoyl, methylphenylcarbamoyl, ethylphenylcarbamoyl or benzylphenylcarbamoyl), a carbamoyl group, an alkylsulfamoyl group (for example, methylsulfamoyl, dimethylsulfamoyl, ethylsulfamoyl, diethylsulfamoyl, dibutylsulfamoyl, piperidylsulfamoyl or morpholylsulfamoyl), an arylsulfamoyl group (for example, phenylsulfamoyl, methylphenylsulfamoyl, ethylphenylsulfamoyl or benzylphenylsulfamoyl), a sulfamoyl group, a cyano group, an alkylsulfonyl group (for example, methanesulfonyl or ethanesulfonyl), an arylsulfonyl group (for example, phenylsulfonyl, 4-chlorophenylsulfonyl or p-toluenesulfonyl), an alkylcarbonyloxy group (for example, acetyloxy, propionyloxy or butyroyloxy), an arylcarbonyloxy group (for example, benzoyloxy, tolyloxy or anisyloxy) and a nitrogen-containing heterocyclic group (for example, imidazolyl or benzotriazolyl).

Further, the groups functioning as the cationic removable groups of the 4-equivalent couplers include a hydrogen atom, a formyl group, a carbamoyl group, a methylene group having a substituent group (an aryl group, a sulfamoyl group, a carbamoyl group, an alkoxyl group, an amino group, a hydroxyl group or the like as the substituent group), an acyl group and a sulfonyl group.

In general formulas (VI) to (IX), $R^{24}$ and $R^{25}$, or $R^{24}$ and $R^{26}$ may be combined with each other to form a ring.

General formula (X) represents couplers called 5-pyrazolone magenta couplers. In general formula (X), $R^{27}$ represents an alkyl group, an aryl group, an acyl group or a carbamoyl group. $R^{28}$ represents a phenyl group or a phenyl group having at least one halogen atom, or at least one alkyl, cyano, alkoxyl, alkoxycarbonyl or acylamino group as a substituent group. Y has the same meaning as with general formulas (VI) to (IX).

Of the 5-pyrazolone magenta couplers represented by general formula (X), couplers are preferred in which $R^{27}$ is an aryl group or an acyl group, $R^{28}$ is a phenyl group having at least one halogen atom as a substituent group.

These preferred groups are described in detail. $R^{27}$ is an aryl group such as phenyl, 2-chlorophenyl, 2-methoxyphenyl, 2-chloro-5-tetradecaneamidophenyl, 2-chloro-5-(3-octadecenyl-1-succinimido)phenyl, 2-chloro-5-octadecylsulfon-amidophenyl or 2-chloro-5-[2-(4-hydroxy-3-t-butylphenoxy)-tetradecaneamido]phenyl, or an acyl group such as acetyl, pivaloyl, tetradecanoyl, 2-(2,4-di-t-pentylphenoxy)acetyl, 2 -(2,4-di-t-pentylphenoxy) butanoyl, benzoyl or 3-(2,4-di-t-amylphenoxyacetamido) benzoyl. These groups may further have substituent groups, each of which is an organic substituent group linked through a carbon atom, a oxygen atom, a nitrogen atom or a sulfur atom, or a halogen atom.

$R^{28}$ is preferably a substituted phenyl group such as 2,4,6-trichlorophenyl, 2,5-dichlorophenyl or 2-chlorophenyl.

General formula (XI) represents couplers called pyrazoloazole couplers. In general formula (XI), $R^{29}$ represents a hydrogen atom or a substituent group. Z represents a group of nonmetal atoms necessary for forming a 5-membered azole ring containing 2 to 4 nitrogen atoms, and said azole ring may have a substituent group (including a condensed ring). Y has the same meaning as with general formulas (VI) to (IX).

Of the pyrazoloazole couplers represented by general formula (XI), imidazo[1,2-b]pyrazoles described in U.S. Pat. No. 4,500,630, pyrazolo[1,5-b][1,2,4]triazoles described in U.S. Pat. No. 4,540,654 and pyrazolo[5,1-c][1,2,4]triazoles described in U.S. Pat. No. 3,725,067 are preferred in respect to absorption characteristics of color developing dyes. Of these, pyrazolo[1,5-b][1,2,4]triazoles are preferred in respect to light fastness.

Details of the substituent groups of the azole ring represented by $R^{29}$, Y and Z are described, for example, in U.S. Pat. No. 4,540,654, the second column, line 41 to the eighth column, line 27. Preferred examples thereof include pyrazoloazole couplers in each of which a branched alkyl group is directly connected to the 2-, 3- or 6-position of a pyrazolotriazole ring as described in JP-A-61-65245, pyrazoloazole couplers containing sulfonamido groups in their molecules described in JP-A-61-65245, pyrazoloazole couplers having alkoxyphenylsulfonamido ballast groups described in JP-A-61-147254, pyrazolotriazole couplers each having an alkoxyl group or an aryloxy group at the 6-position described in JP-A-62-209457 or JP-A-63-307453, and pyrazolotriazole couplers having carbonamido groups in their molecules described in JP-A-2-201443.

General formulas (XII) and (XIII) represent couplers called phenol couplers and naphthol couplers, respectively. In formulas (XII) and (XIII), $R^{30}$ represents a hydrogen atom or a group selected from the group consisting of $—NHCOR^{32}$, $—SO_2NR^{32}R^{33}$, $—NHSO_2R^{32}$, $—NHCOR^{32}$, $—NHCONR^{32}R^{33}$ and $—NHSO_2NR^{32}R^{33}$. $R^{32}$ and $R^{33}$ each represents a hydrogen atom or a substituent group. In general formulas (XII) and (XIII), $R^{31}$ represents a substituent group, l represents an integer selected from 0 to 2, and m is an integer selected from 0 to 4. Y has the same meaning as with general formulas (VI) to (IX). The substituent groups represented by $R^{31}$ to $R^{33}$ include the substituent groups for $R^{24}$ to $R^{26}$ described above.

Preferred examples of the phenol couplers represented by general formula (XII) include 2-alkylamino-5-alkylphenol couplers described in U.S. Pat. Nos. 2,369,929, 2,801,171, 2,772,162, 2,895,826 and 3,772,002, 2,5-diacylaminophenol couplers described in U.S. Pat. Nos. 2,772,162, 3,758,308, 4,126,396, 4,334,011 and 4,327,173, West German Patent Application (OLS) 3,329,729 and JP-A-59-166956, and 2-phenylureido-5-acylaminophenol couplers described in U.S. Pat. Nos. 3,446,622, 4,333,999, 4,451,559 and 4,427,767.

Preferred examples of the naphthol couplers represented by general formula (XIII) include 2-carbamoyl-1-naphthol couplers described in U.S. Pat. Nos. 2,474,293, 4,052,212, 4,146,396, 4,228,233 and 4,296,200, and 2-carbamoyl-5-amido-1-naphthol couplers described in U.S. Pat. No. 4,690,889.

General formulas (XIV) to (XVII) represent couplers called pyrrolotriazole couplers. In general formulas (XIV) to (XVII), $R^{42}$, $R^{43}$ and $R^{44}$ each represents a hydrogen atom or a substituent group. Y has the same meaning as with general formulas (VI) to (IX). The substituent groups represented by $R^{42}$, $R^{43}$ and $R^{44}$ include the substituent groups for $R^{24}$ to $R^{26}$ described above. Preferred examples of the pyrrolotriazole couplers represented by general formulas (XIV) to (XVII) include couplers in each of which at least one of $R^{42}$ and $R^{43}$ is an electron attractive group, which are described in European Patents 488,248A1, 491,197A1 and 545,300.

In addition, couplers having structures such as cyclocondensed phenol, imidazole, pyrrole, 3-hydroxypyridine, active methine, 5,5-cyclocondensed heterocycles and 5,6-cyclocondensed heterocycles can be used.

As the cyclocondensed phenol couplers, couplers described in U.S. Pat. Nos. 4,327,173, 4,564,586 and 4,904,575 can be used.

As the imidazole couplers, couplers described in U.S. Pat. Nos. 4,818,672 and 5,051,347 can be used.

As the pyrrole couplers, couplers described in JP-A-4-188137 and JP-A-190347 can be used.

As the 3-hydroxypyridine couplers, couplers described in JP-A-1-315736 can be used.

As the active methine couplers, couplers described in U.S. Pat. Nos. 5,104,783 and 5,162,196 can be used.

As the 5,5-cyclocondensed heterocyclic couplers, pyrrolopyrazole couplers described in U.S. Pat. No. 5,164,289 and pyrroloimidazole couplers described in JP-A-4-174429 can be used.

As the 5,6-cyclocondensed heterocyclic couplers, pyrazolopyrimidine couplers described in U.S. Pat. No. 4,950, 585, pyrrolotriazine couplers described in JP-A-4-204730, and couplers described in European Patent 556,700 can be used.

In the present invention, besides the above-mentioned couplers, couplers can also be used which are described in West German Patents 3,819,051A and 3,823,049, U.S. Pat. Nos. 4,840,883, 5,024,930, 5,051,347 and 4,481,268, European Patents 304,856A2, 329,036, 354,549A2, 374,781A2, 379,110A2 and 386,930A1, JP-A-63-141055, JP-A-64-32260, JP-A-64-32261, JP-A-2-297547, JP-A-2-44340, JP-A-2-110555, JP-A-3-7938, JP-A-3-160440, JP-A-3-172839, JP-A-4-172447, JP-A-4-179949, JP-A-4-182645, JP-A-4-184437, JP-A-4-188138, JP-A-4-188139, JP-A-4-194847, JP-A-4-204532, JP-A-4-204731 and JP-A-4-204732.

Examples of the couplers which can be used in the present invention are shown below, but the present invention are not, of course, limited thereby.

Examples of 4-Equivalent Couplers

C-1

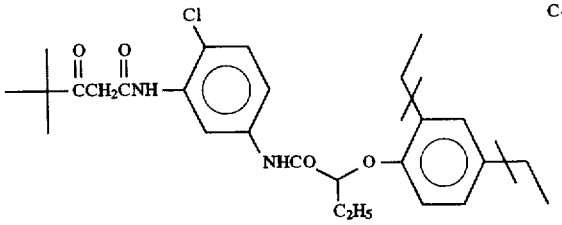

C-2

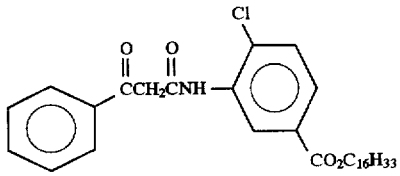

C-3

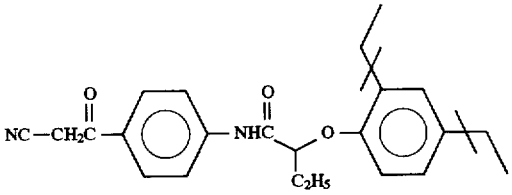

C-4

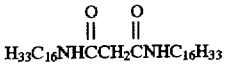

C-5

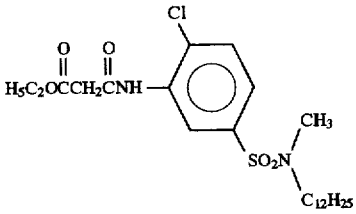

C-6

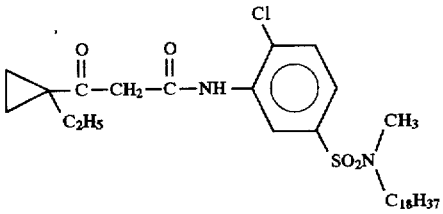

C-7

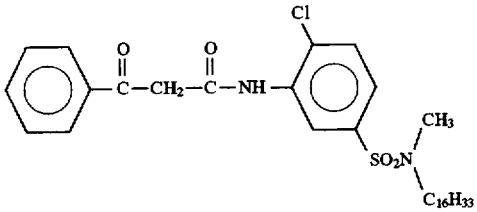

C-8

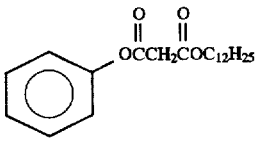

C-9

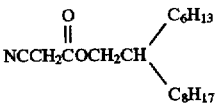

C-10

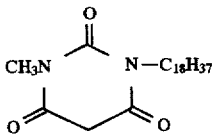

C-11

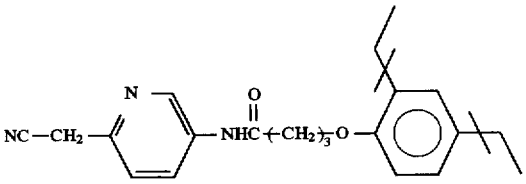

C-12

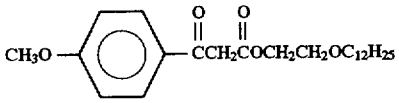

-continued
Examples of 4-Equivalent Couplers
C-13
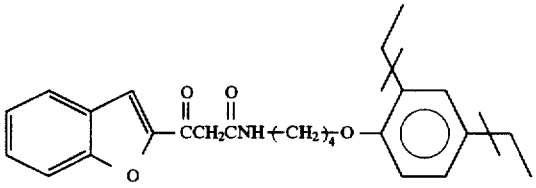
C-14
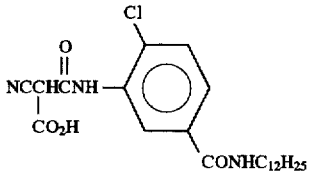
C-15
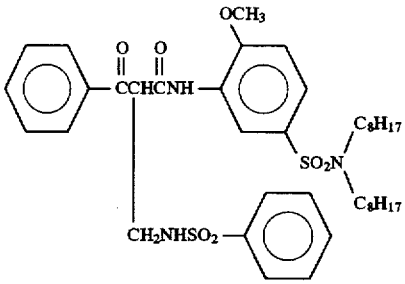
C-16
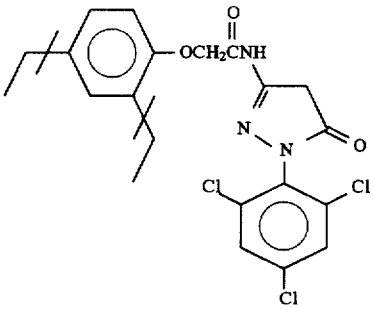
C-17
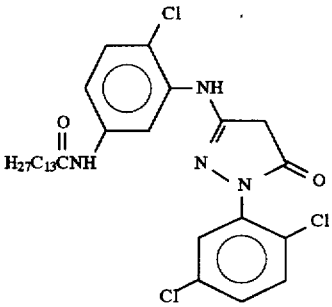
C-18
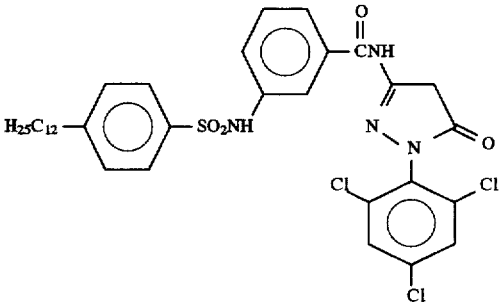
C-19
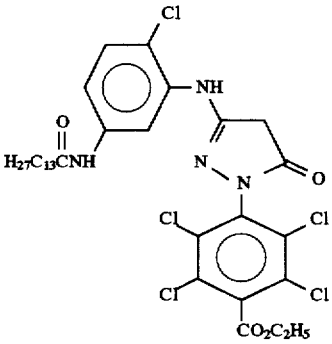
C-20
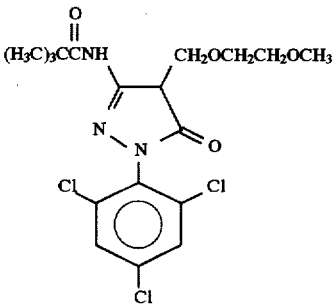
C-21
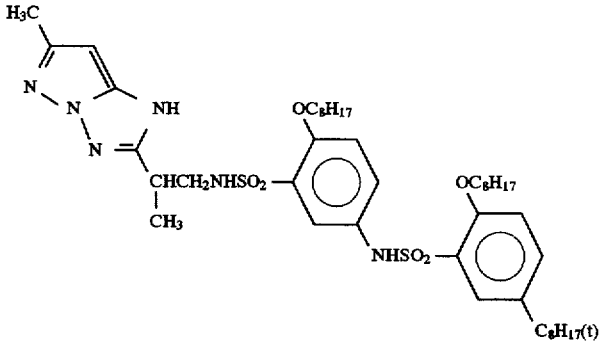

-continued
Examples of 4-Equivalent Couplers
C-22
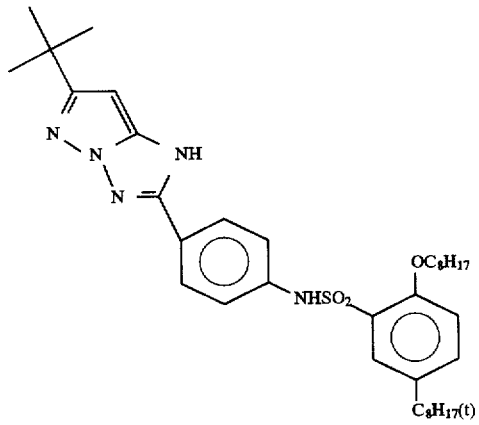
C-23
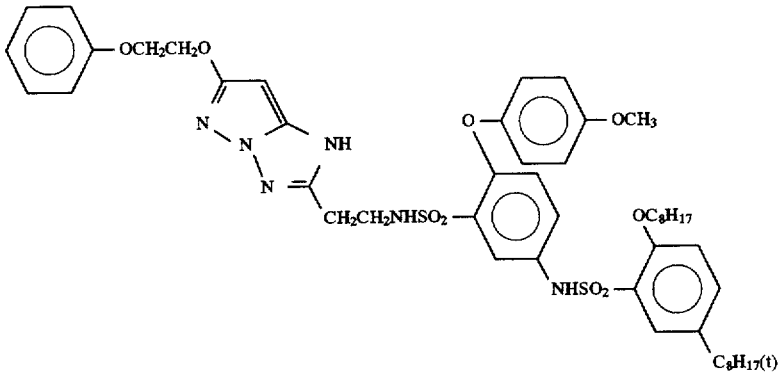
C-24
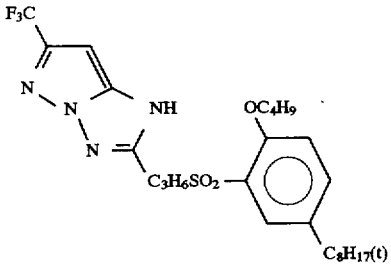
C-25
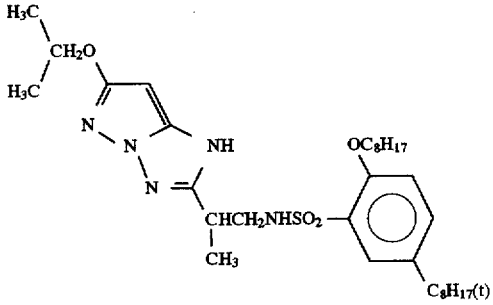
C-26
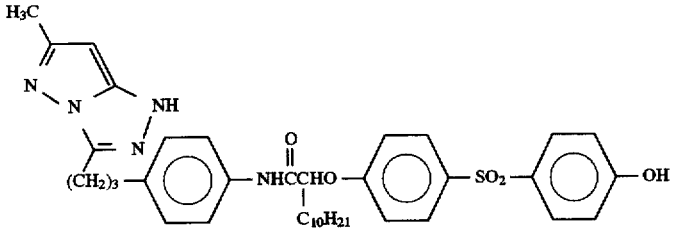

-continued
Examples of 4-Equivalent Couplers
C-27
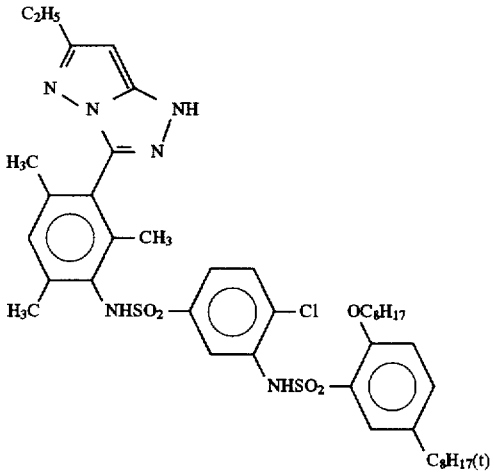
C-28
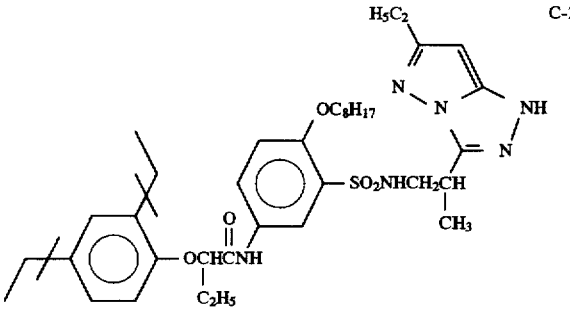
C-29
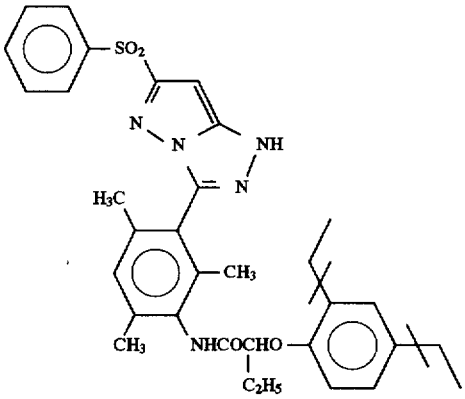
C-30
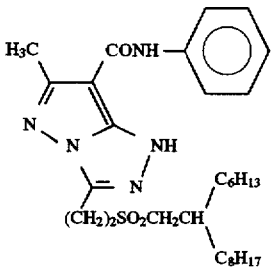
C-31
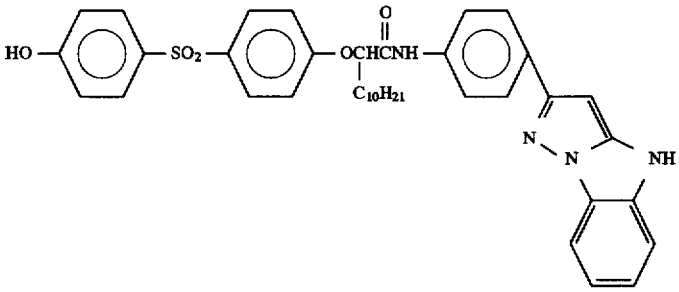

-continued
Examples of 4-Equivalent Couplers
C-32
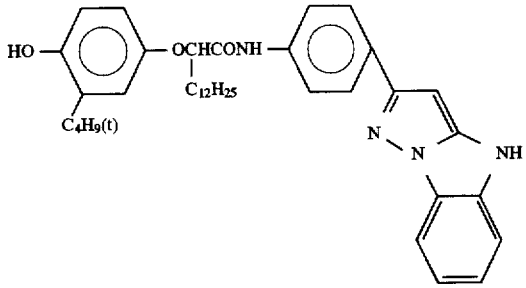
C-33
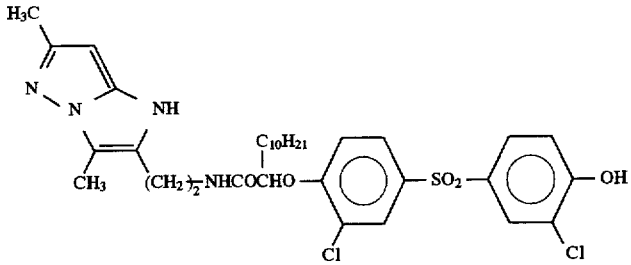
C-34
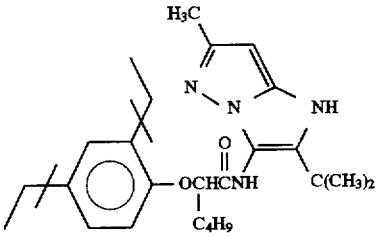
C-35
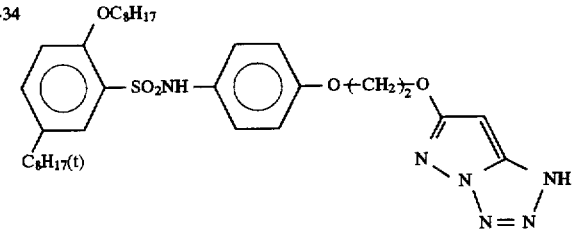
C-36
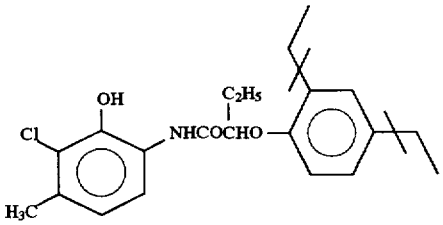
C-37
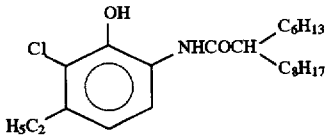
C-38
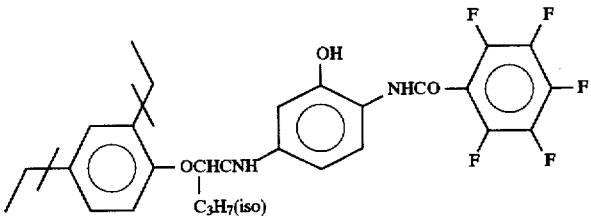
C-39
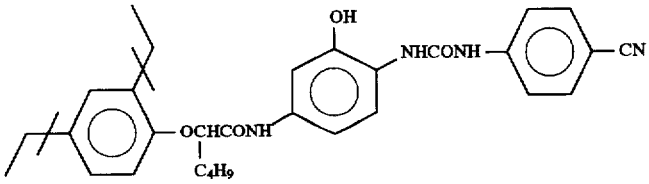

-continued
Examples of 4-Equivalent Couplers
C-40
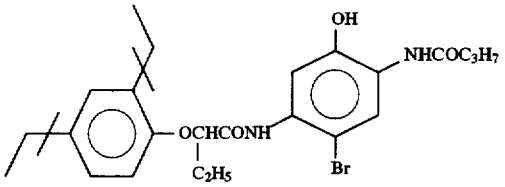
C-41
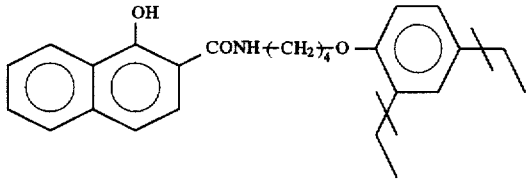
C-42
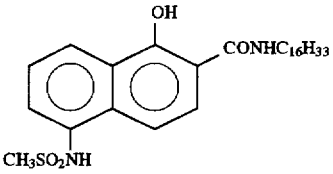
C-43
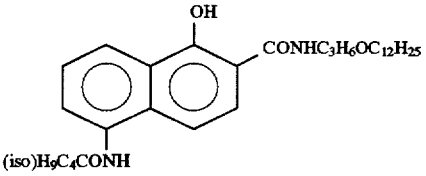
C-44
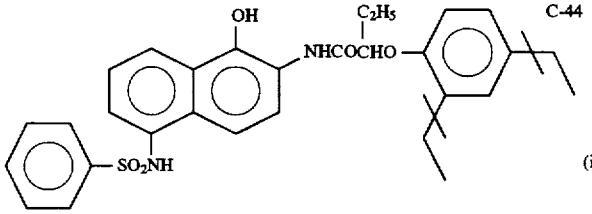
C-45
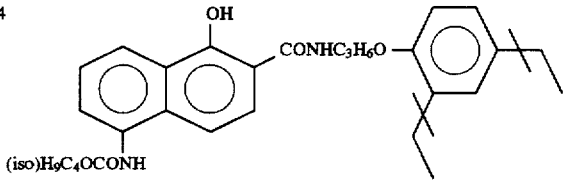
C-46
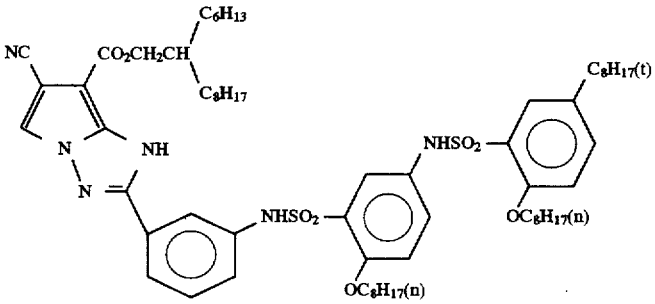
C-47
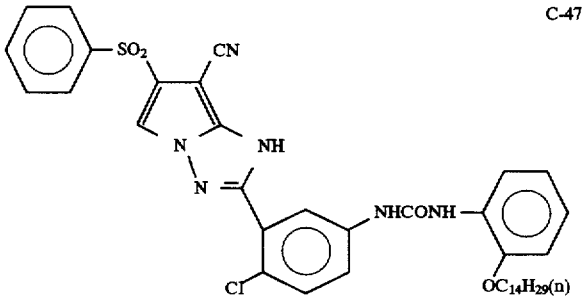
C-48
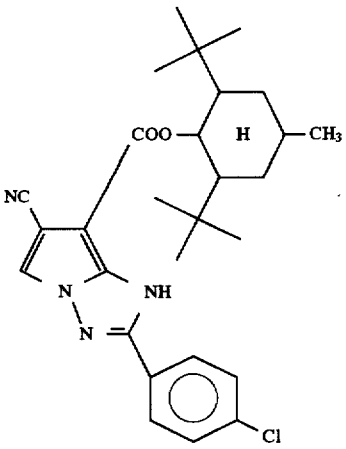
C-49
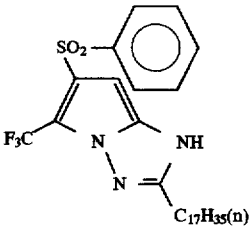
C-50
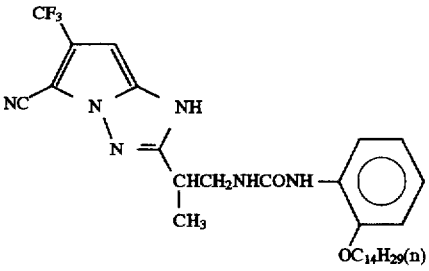

-continued
Examples of 4-Equivalent Couplers
C-51
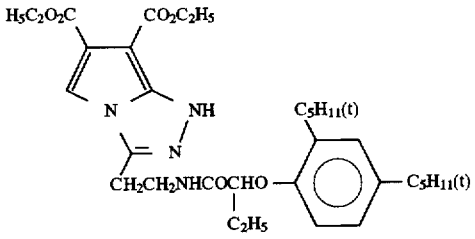
C-52
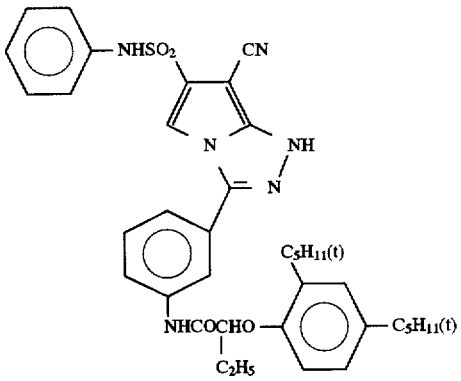
C-53
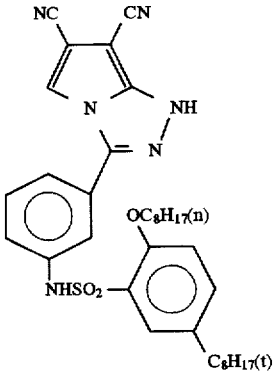
C-54
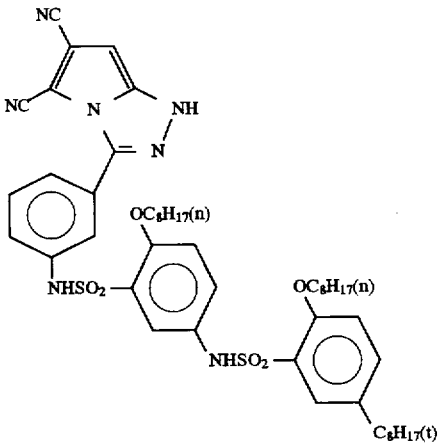
C-55
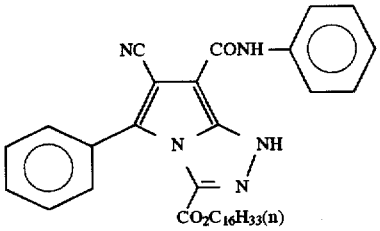
C-56
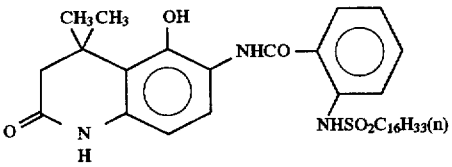
C-57
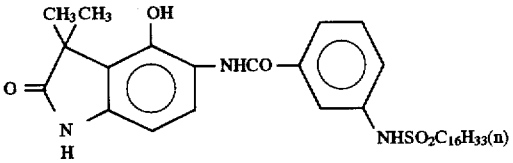

-continued
Examples of 4-Equivalent Couplers
C-58
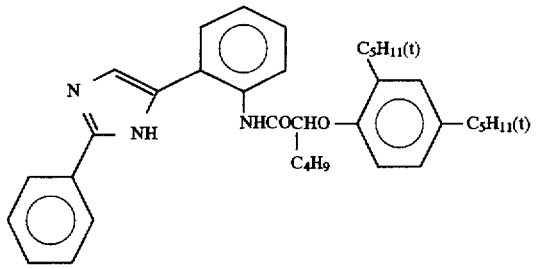
C-59
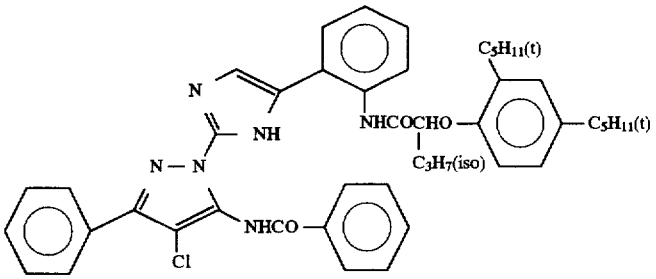
C-60
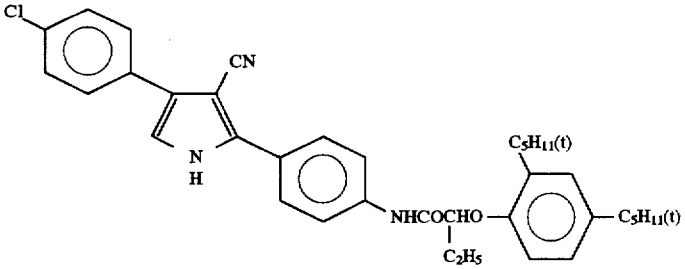
C-61
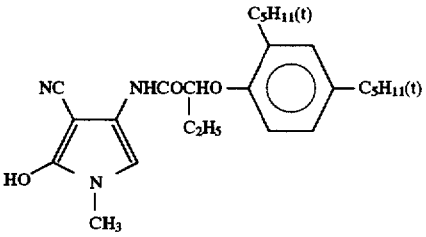
C-62
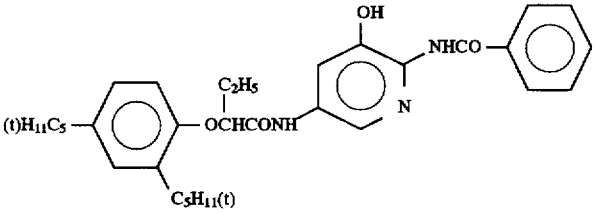
C-63
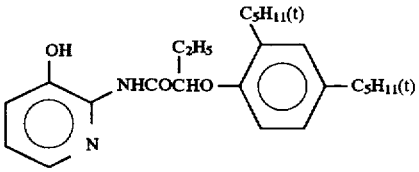
C-64
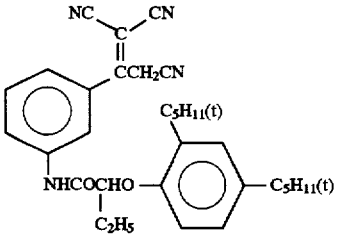

-continued
Examples of 4-Equivalent Couplers
C-65
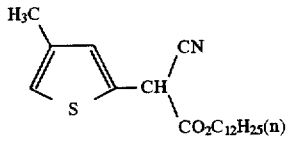
C-66
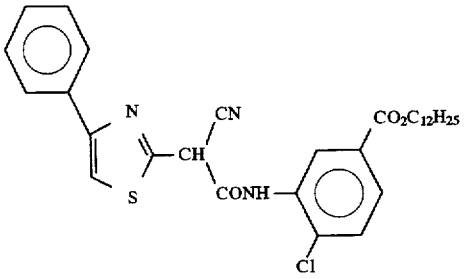
C-67
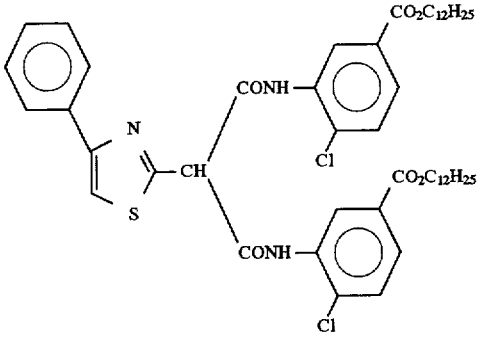
C-68
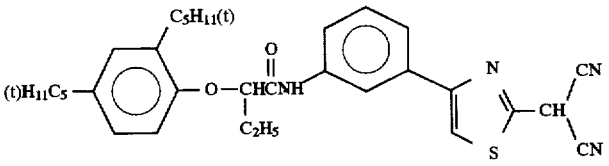
C-69
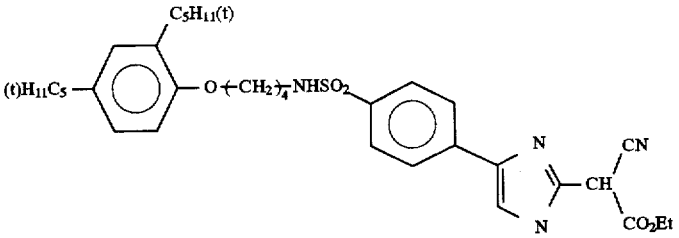
C-70
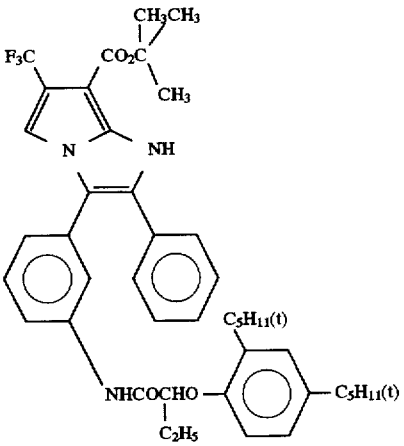
C-71
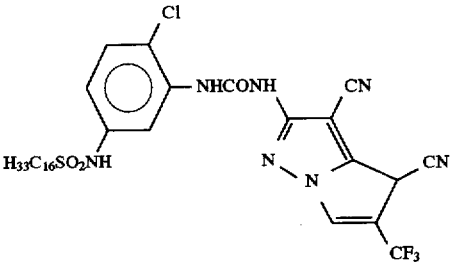

-continued
Examples of 4-Equivalent Couplers
C-72
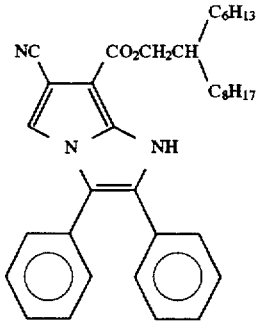
C-73
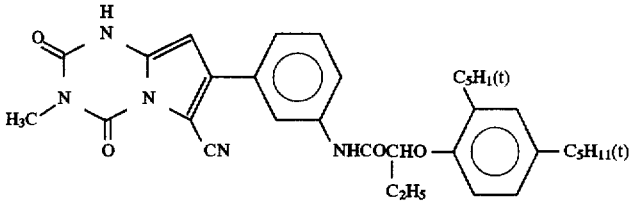
C-74
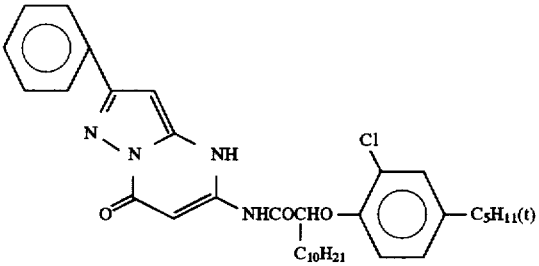
C-75
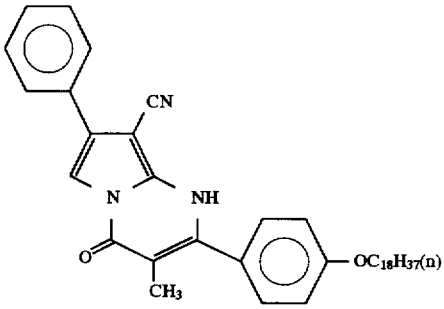
Examples of 2-Equivalent Couplers
C-76
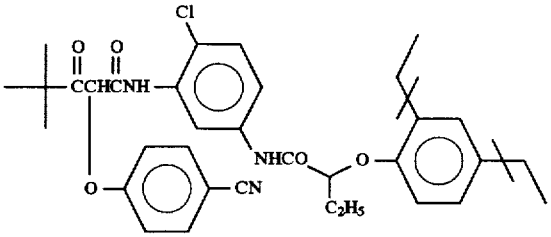
C-77
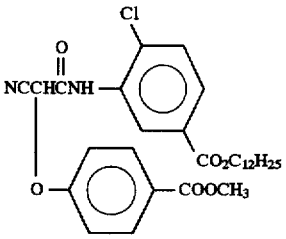
C-78
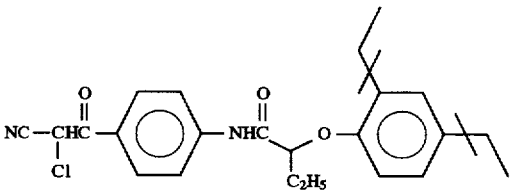

-continued
Examples of 2-Equivalent Couplers
C-79
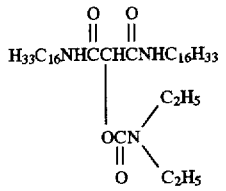
C-80
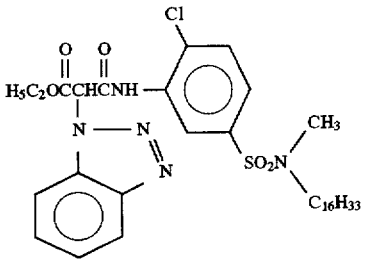
C-81
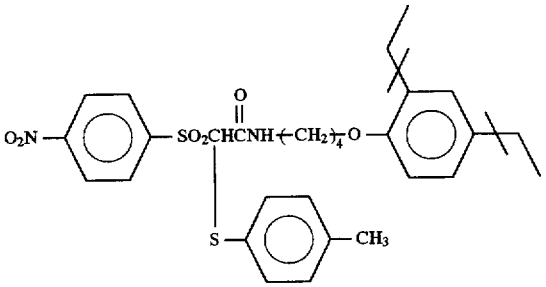
C-82
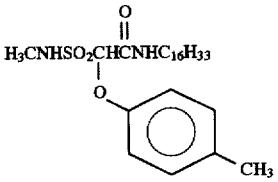
C-83
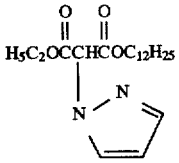
C-84
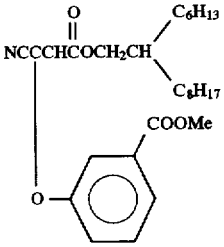
C-85
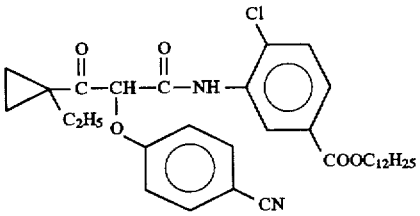
C-86
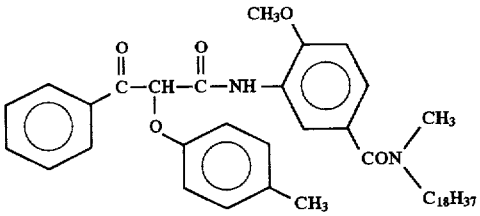
C-87
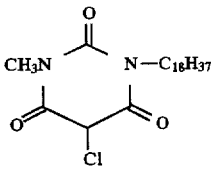
C-88
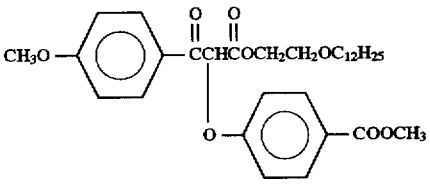
C-89
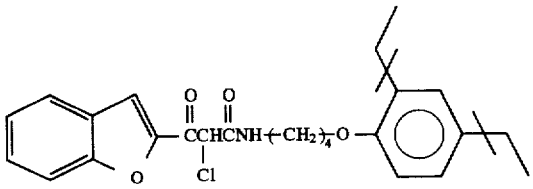

-continued
Examples of 2-Equivalent Couplers
C-90
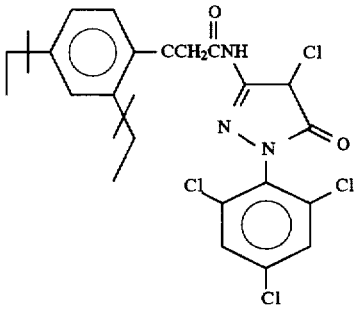
C-91
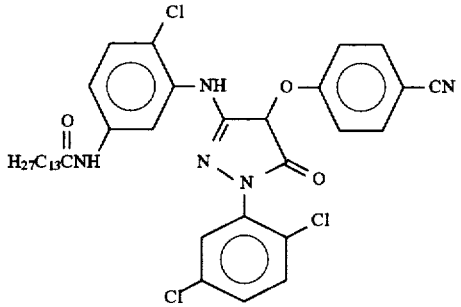
C-92
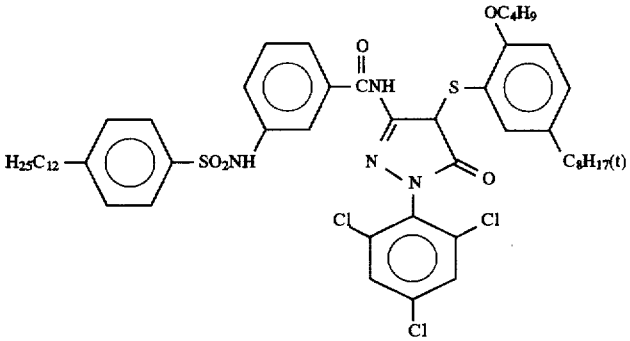
C-93
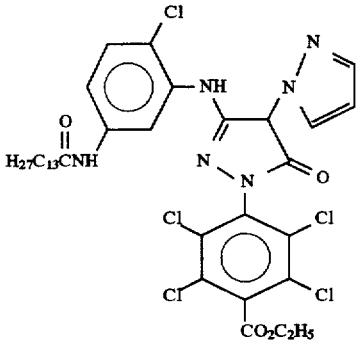
C-94
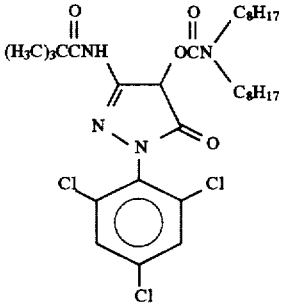
C-95
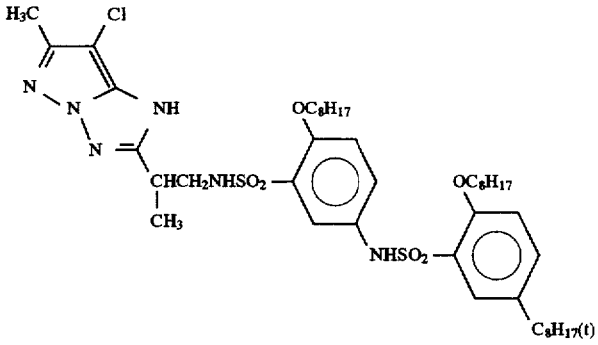

-continued
Examples of 2-Equivalent Couplers
C-96
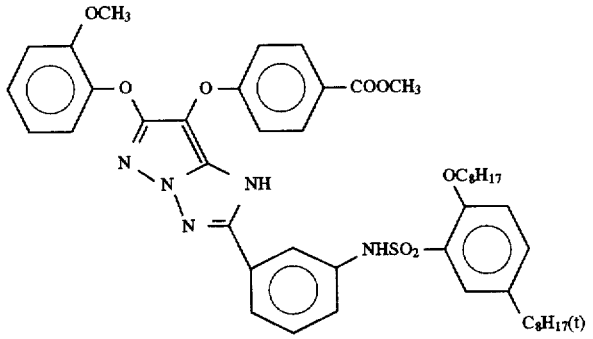
C-97
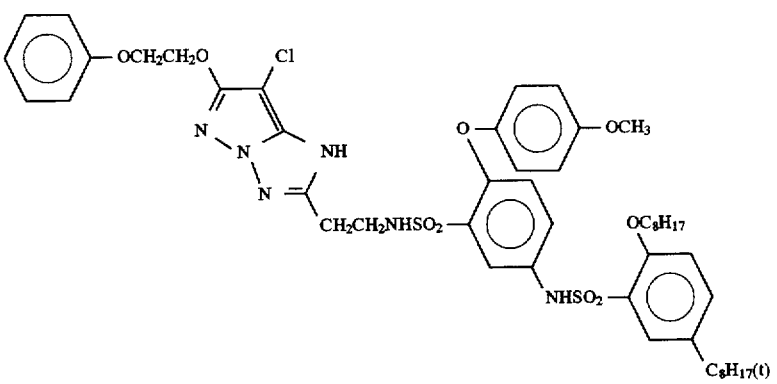
C-98
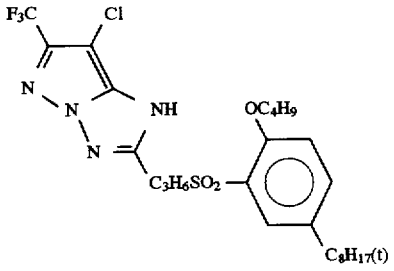
C-99
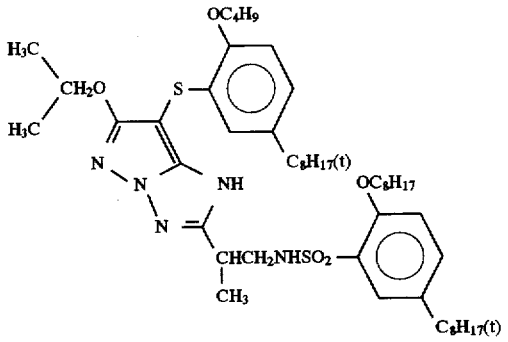
C-100
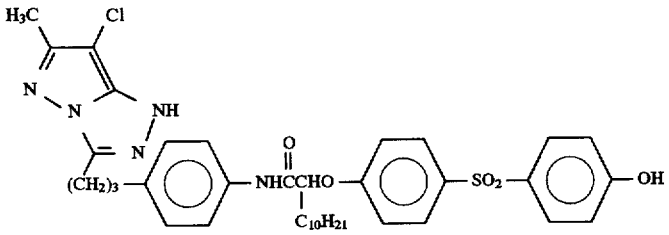

-continued
Examples of 2-Equivalent Couplers
C-101
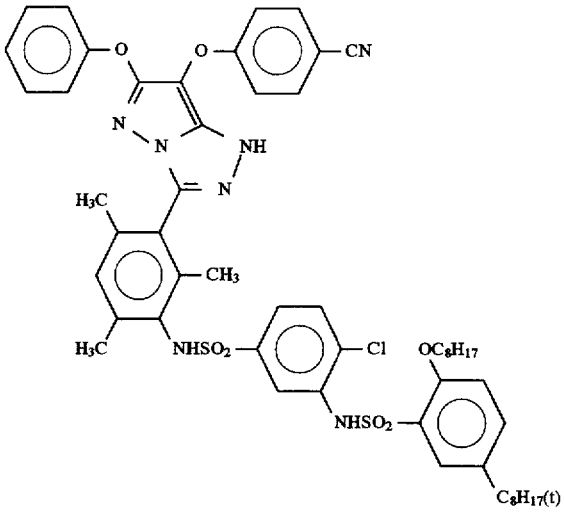
C-102
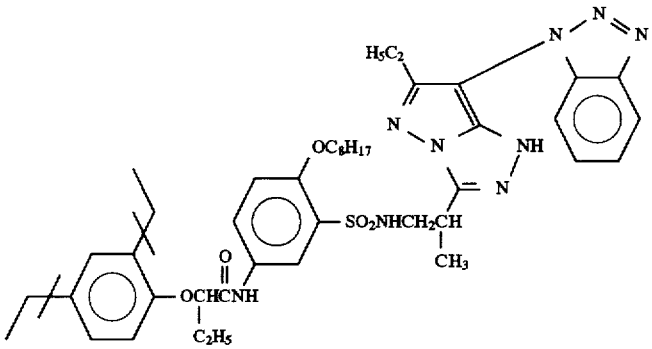
C-103
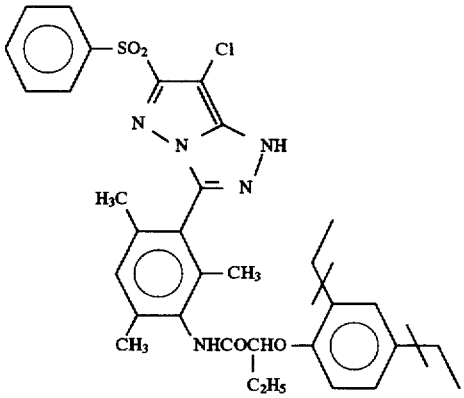
C-104
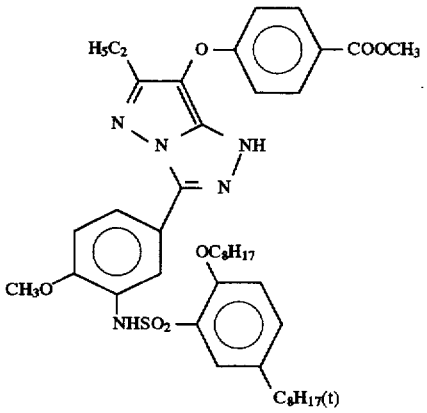
C-105
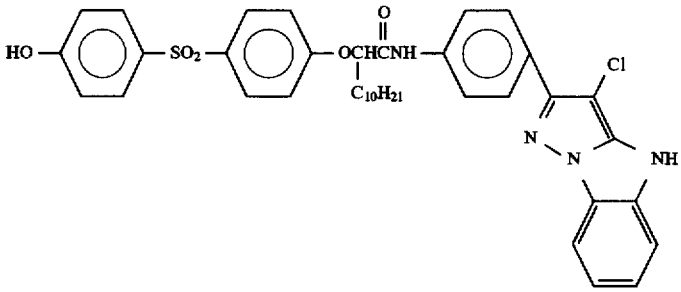

-continued
Examples of 2-Equivalent Couplers
C-106
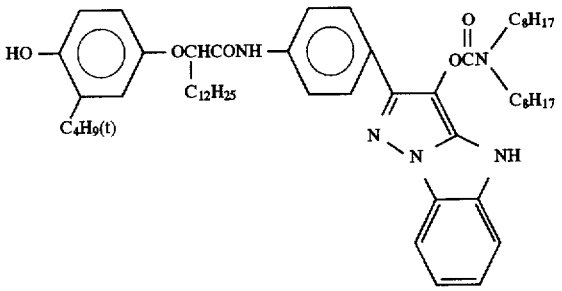
C-107
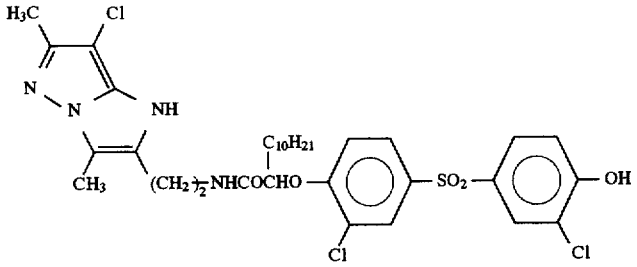
C-108
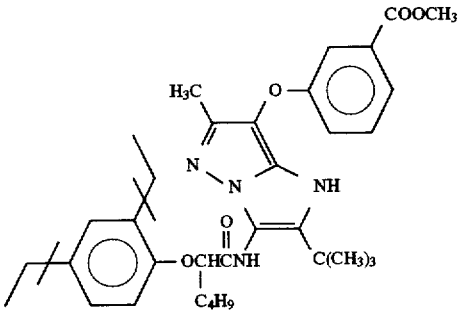
C-109
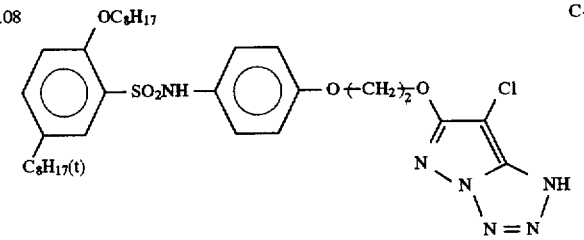
C-110
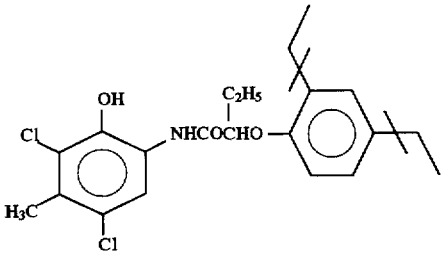
C-111
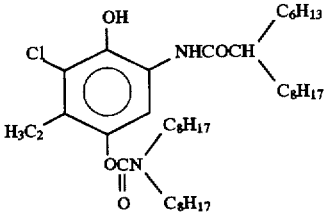
C-112
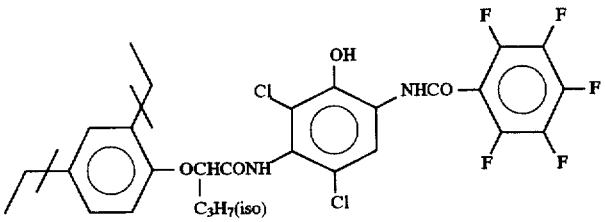
C-113
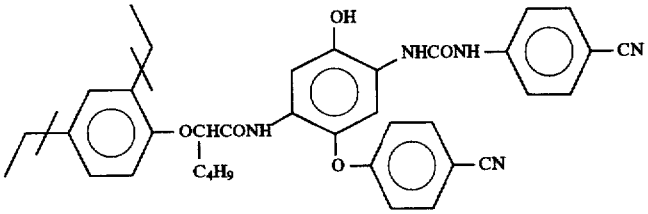

-continued
Examples of 2-Equivalent Couplers
C-114
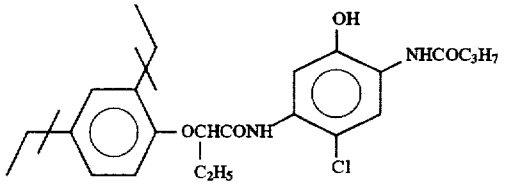
C-115
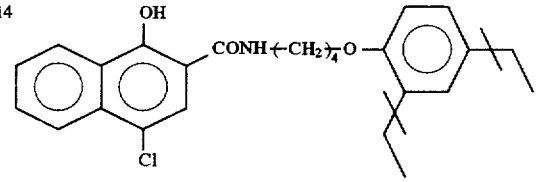
C-116
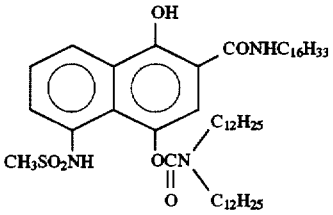
C-117
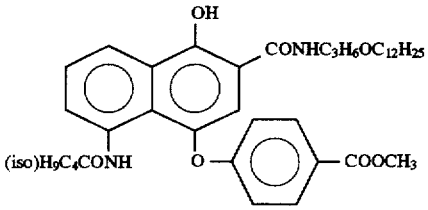
C-118
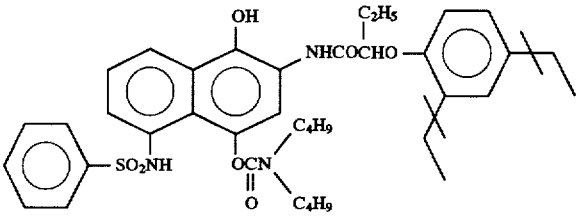
C-119
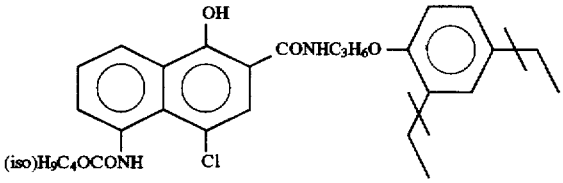
C-120
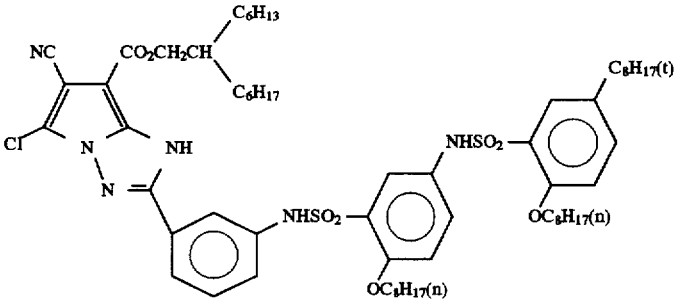
C-121
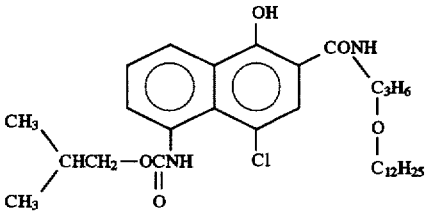

-continued
Examples of 2-Equivalent Couplers
C-122
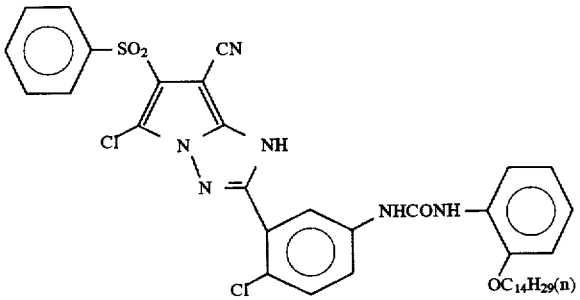
C-123
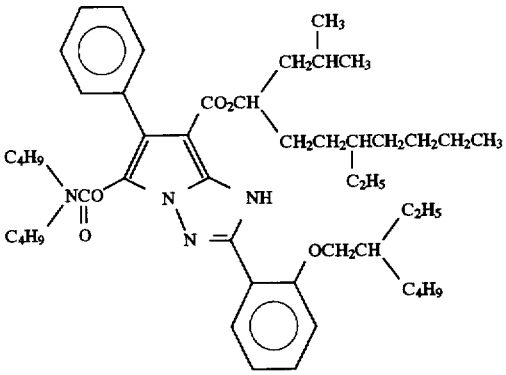
C-124
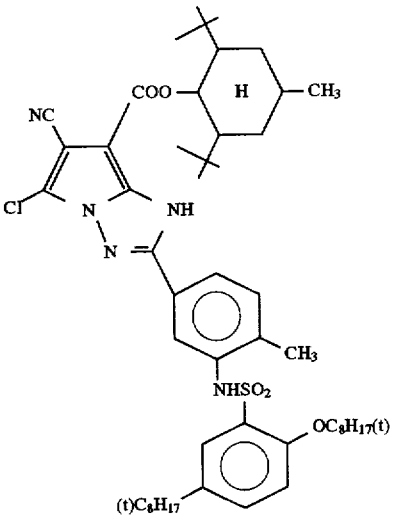
C-125
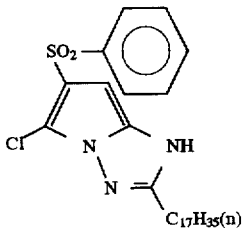
C-126
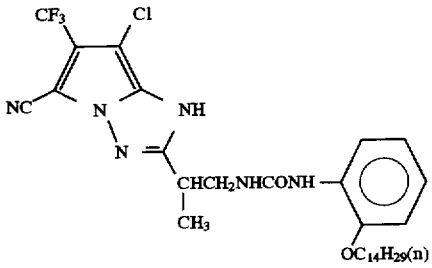
C-127
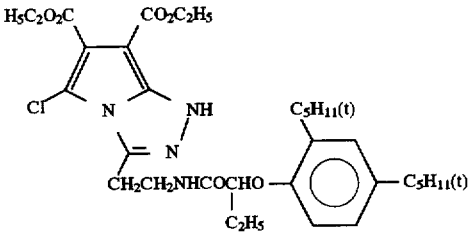
C-128
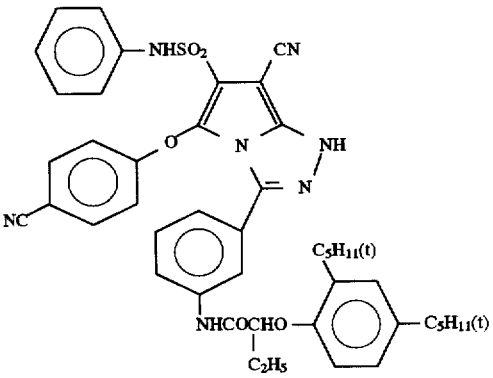

-continued
Examples of 2-Equivalent Couplers
C-129
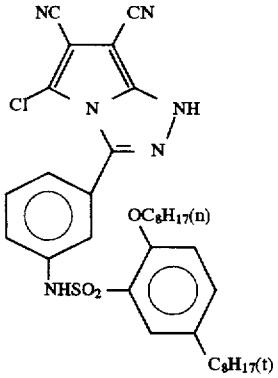
C-130
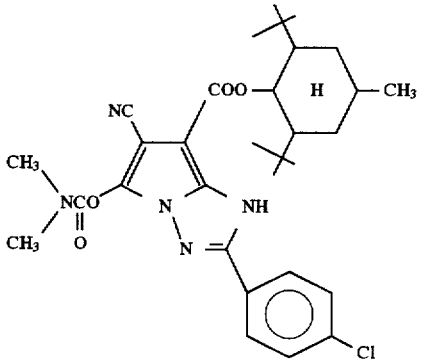
C-131
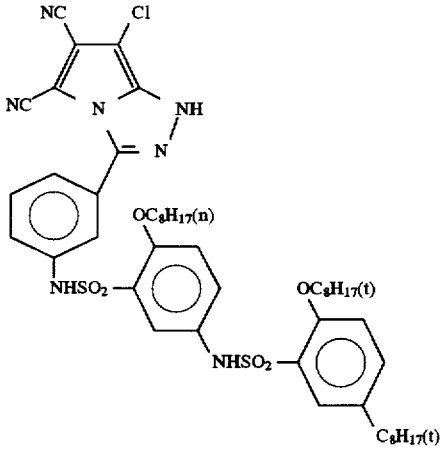
C-132
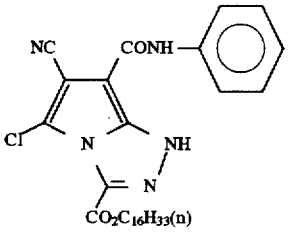
C-133
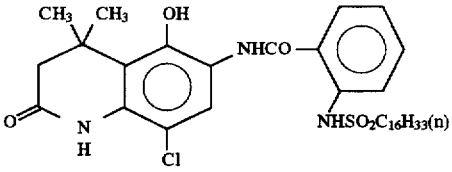
C-134
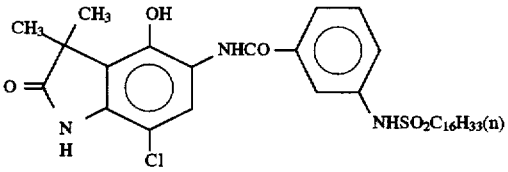
C-135
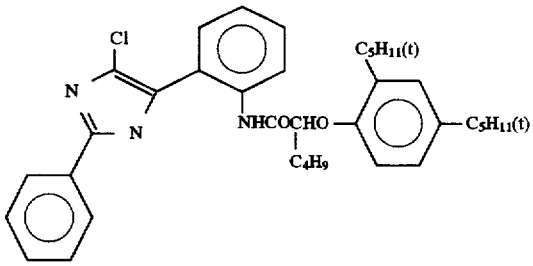

-continued
Examples of 2-Equivalent Couplers
C-136
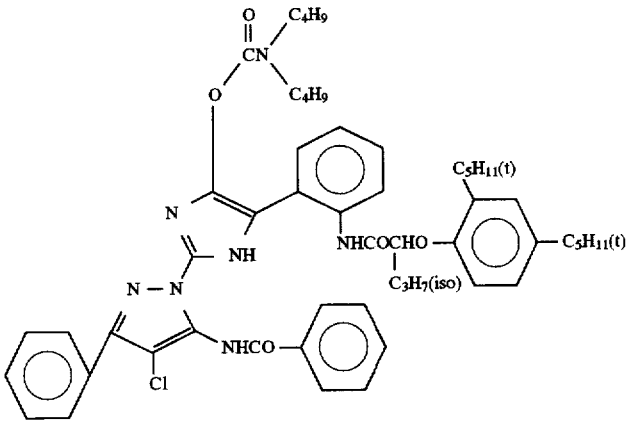
C-137
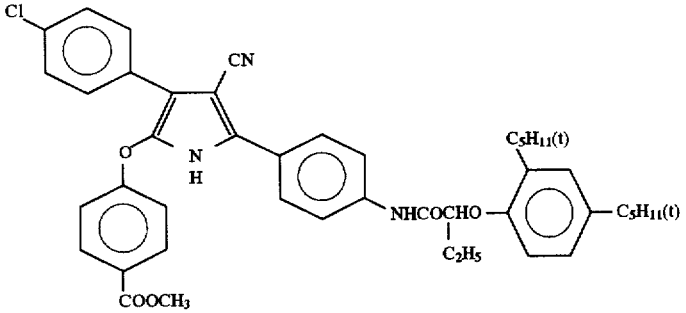
C-138
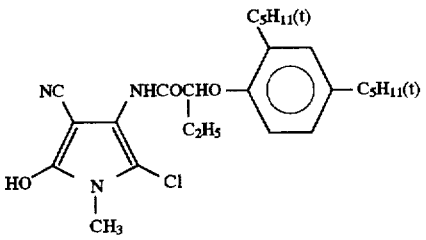
C-139
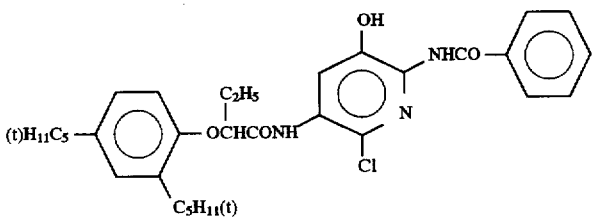
C-140
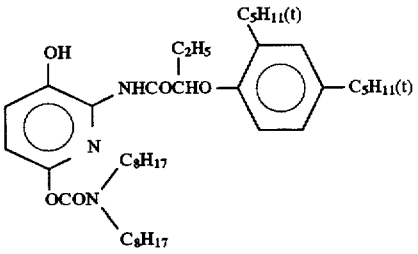
C-141
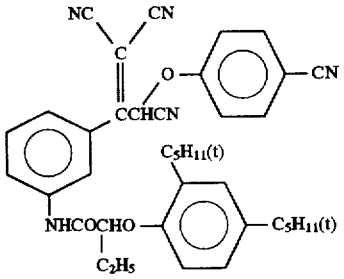

-continued
Examples of 2-Equivalent Couplers
C-142
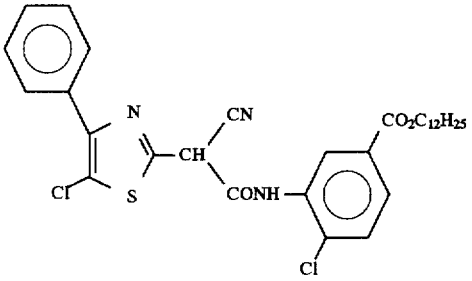
C-143
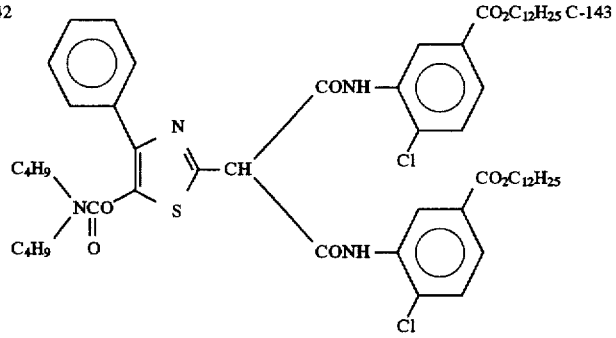
C-144
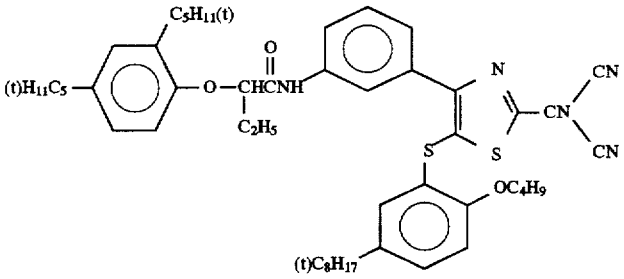
C-145
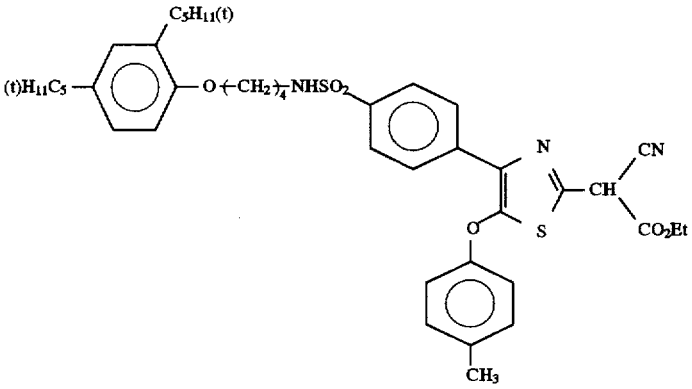
C-146
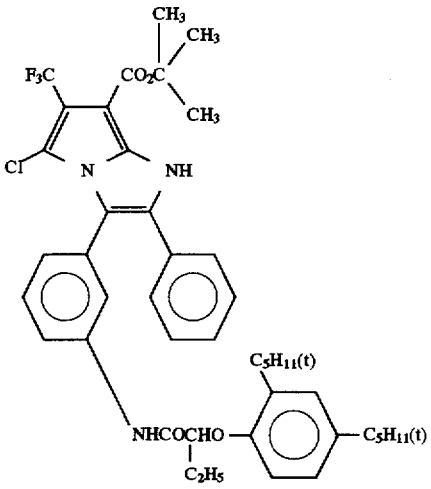

-continued
Examples of 2-Equivalent Couplers
C-147
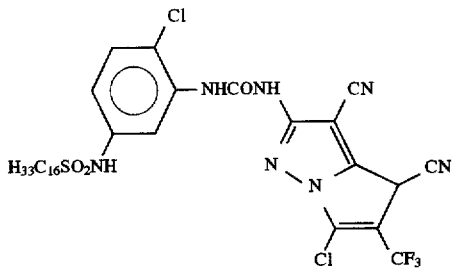
C-148
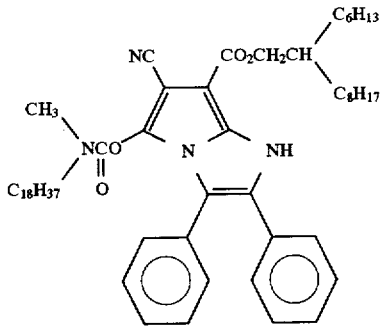
C-149
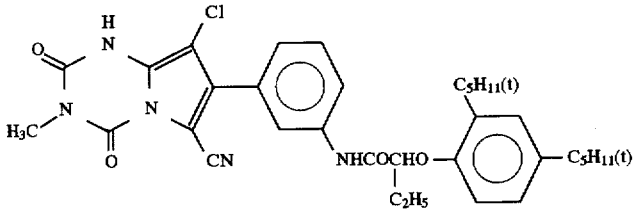
C-150
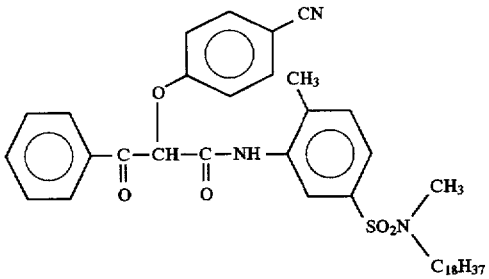
C-151
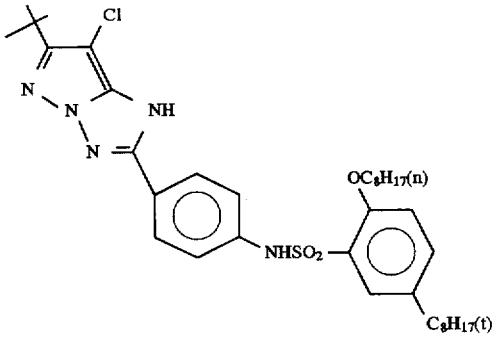
C-152
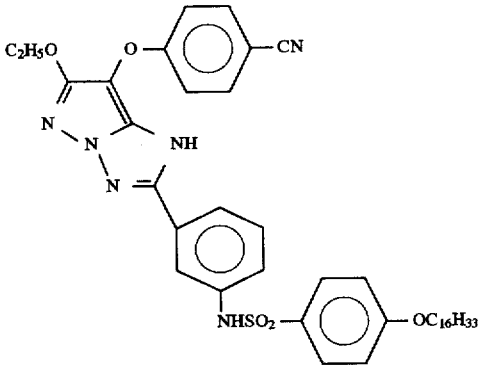
C-153
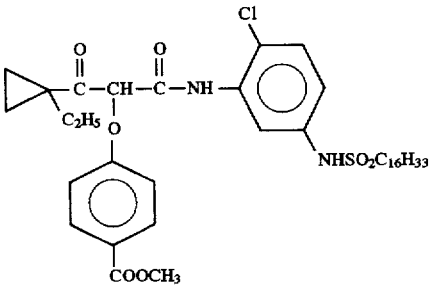
C-154
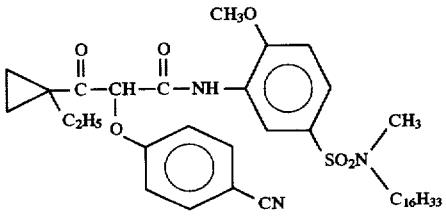

-continued
Examples of 2-Equivalent Couplers
C-155
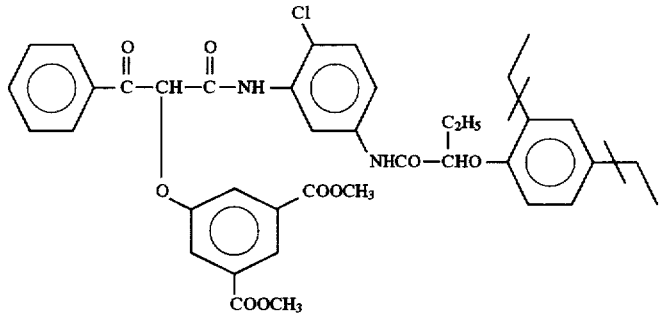
C-156
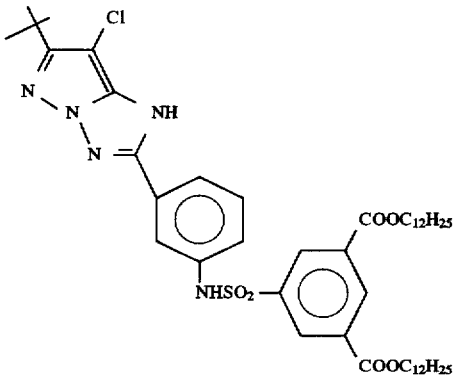
C-157
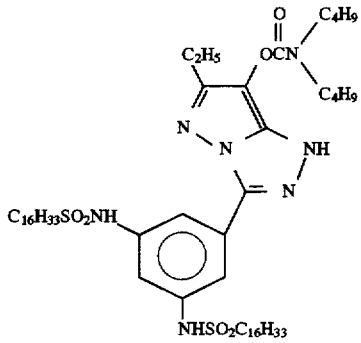
C-158
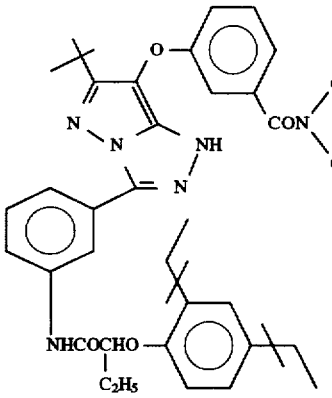
C-159
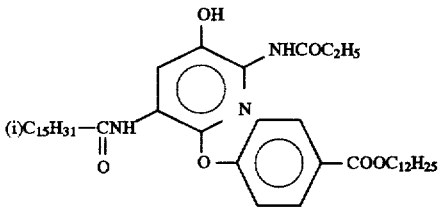
C-160
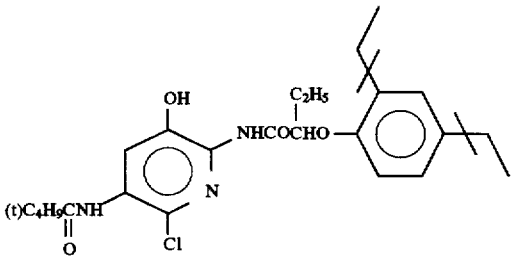
C-161
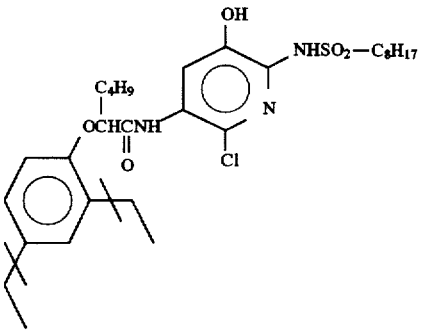

-continued

Examples of 2-Equivalent Couplers

C-162

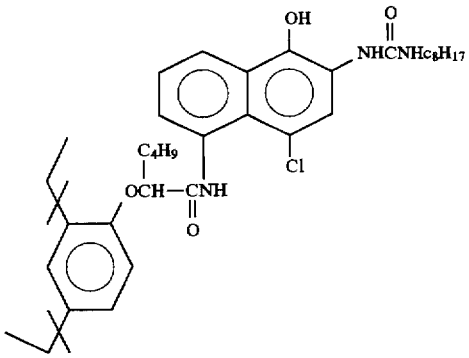

C-163

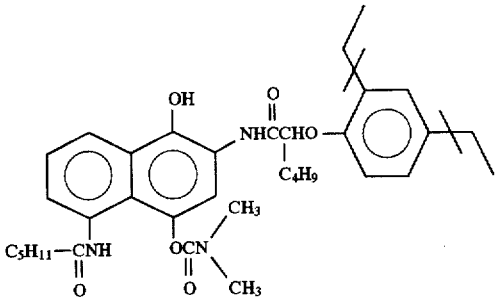

C-164

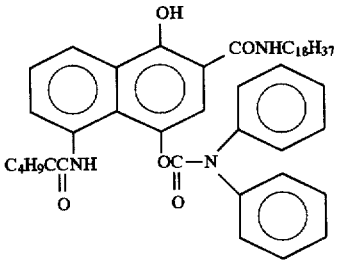

C-165

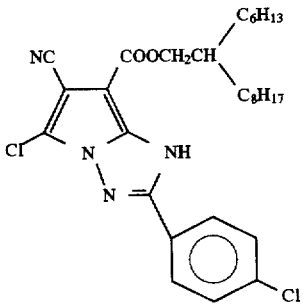

C-166

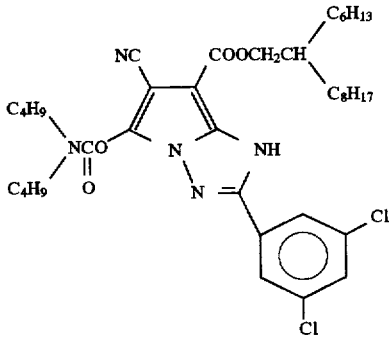

C-167

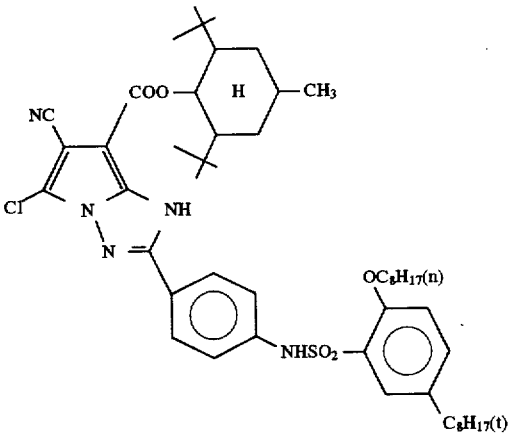

C-168

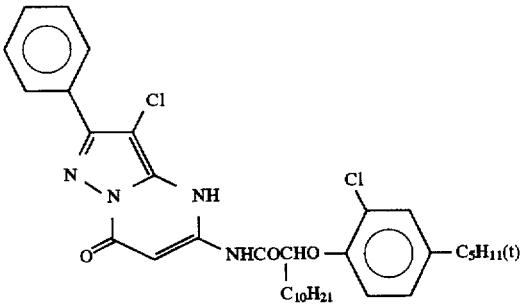

C-169

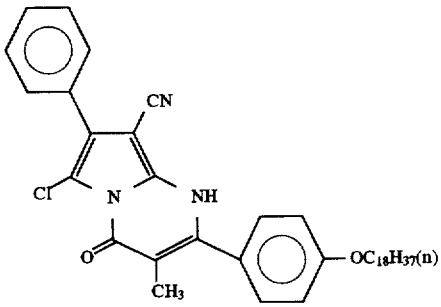

Furthermore, reducing agents as recited below may be incorporated in a photosensitive material.

Specific examples of a reducing agent which can be used in Present Invention (2) include the reducing agents and precursors thereof as described in U.S. Pat. No. 4,500,626 (columns 49–50), U.S. Pat. Nos. 4,839,272, 4,330,617, 4,590,152, 5,017,454 and 5,139,919, JP-A-60-140335 (pages 17–18), JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-244044, JP-A-62-131253, JP-A-62-131256, JP-A-64-13546 (pages 40–57), JP-A-1-120553, and EP-A2-0220746 (pages 78–96).

Also, the combinations of various reducing agents as disclosed in U.S. Pat. No. 3,039,869 can be used.

In the case of a heat-developable photosensitive material, a developing agent or a reducing agent may be incorporated in either a processing sheet described hereinafter or the photosensitive material.

In Present Invention (2), the total amount of the developing agent and the reducing agent used is in the range of 0.01–20 moles, particularly preferably 0.1–10 moles, per mole of silver.

Hydrophobic additives, such as a coupler, a developing agent and a nondiffusible reducing agent, can be introduced into constituent layers of a photosensitive material according to known methods, including the method described in U.S. Pat. No. 2,322,027. Therein, the high boiling organic solvents as described, e.g., in U.S. Pat. Nos. 4,555,470, 4,536,466, 4,536,467, 4,587,206, 4,555,476 and 4,599,296, and JP-B-3-62256 can be used, if necessary, together with a low boiling organic solvent having a boiling point of 50°–160° C. Additionally, each additive, including a dye-providing compound and a nondiffusible reducing agent, and a high boiling organic solvent can be employed as a mixture of two or more compounds.

The suitable amount of a high boiling organic solvent used is not higher than 10 g, preferably not higher than 5 g, and more preferably from 1 g to 0.1 g, per gram of hydrophobic additives. To 1 g of a binder, on the other hand, it is appropriate to use no more than 1 cc, preferably no more than 0.5 cc, particularly preferably no more than 0.3 cc, of a high boiling organic solvent.

Further, the polymer-utilized dispersion methods as described in JP-B-51-39853 and JP-A-51-59943, and the method of adding a hydrophobic additive in the form of fine-grain dispersion, as described in JP-A-62-30242, can be applied.

Furthermore, when the compounds to be introduced into a constituent layer are substantially insoluble in water, they can be first dispersed in the form of fine grains into a binder, and then introduced.

In dispersing a hydrophobic compound into a hydrophilic colloid, various types of surfactants can be used. Specifically, the surfactants described in JP-A-59-157636 (pages 37 and 38) and tho se described in *RD*, supra, can be employed. In addition, the surfactants of phosphate type described in JP-A-7-56267, JP-A-7-2285895 and West German Patent Application (OLS) No. 1,932,299 can also be used.

In Present Invention (2), compounds capable of activating the development and, at the same time, stabilizing images can be introduced into a photosensitive material. Suitable examples of such a compound are described in U.S. Pat. No. 4,500,626 (columns 51 and 52).

The photosensitive material of Present Invention (2) comprises at least three light-sensitive layers which differ from one another in spectral sensitivity and hue of the dye colored therein. Each light-sensitive layer may be constituted of two or more silver halide emulsion layers which have substantially the same color sensitivity, but differ in photographic speed. Additionally, it is desirable that the aforesaid three light-sensitive layers be the layers sensitive to blue light, green light and red light, respectively. As for the arranging order of those layers, a red-sensitive layer, a green-sensitive layer and a blue sensitive layer are generally arranged in that order on the support side. However, other arranging orders may be adopted depending on intended purposes. For instance, the arrangement as described on column 162 in JP-A-7-152129 may be adopted. In Present Invention (2), silver halide, a dye-providing coupler and a developing agent may be incorporated in the same layer, but they can also be separately incorporated in different layers so far as they can react with each other. For example, the freshness keeping quality of a photosensitive material can be heightened by incorporating a developing agent and silver halide in different layers, respectively.

The relationship between the spectral sensitivity and the hue of a coupler in each layer can be arbitrarily chosen. However, when a cyan coupler is incorporated in a red-sensitive layer, a magenta coupler in a green-sensitive layer, and a yellow coupler in a blue-sensitive layer, it becomes possible to subject conventional color paper and the like to direct projection exposure.

In the photosensitive material, various layers insensitive to light, such as a protective layer, an undercoat layer, an interlayer, a yellow filter layer and an antihalation layer, may be provided between silver halide emulsion layers described above, or as the topmost or lowest layer; while, on the back side of the support, various auxiliary layers, such as a backing layer, can be provided. Specific examples of those layers include the undercoat layer described in U.S. Pat. No. 5,051,335, the solid pigment-containing interlayers as described in JP-A-1-167838 and JP-A-61-20943, the interlayers containing a reducing agent and a DIR compound as described in JP-A-1-120553, JP-A-5-34884 and JP-A-2-64634, the electron transmitter-containing interlayers as described in U.S. Pat. No. 5,017,454, U.S. Pat. No. 5,139,919 and JP-A-2-235044, the reducer-containing protective layers as described in JP-A-4-249245, and the combination of two or more of the layers recited above.

As for the dyes used in a yellow filter layer and an antihalation layer, dyes of the type which are decolorized or eluted upon development to have no contribution to the density after processing are suitable therefor.

The expression "the dye in a yellow filter Layer or an antihalation layer is decolorized or removed upon development" means that the dye remains in that layer after processing in an amount of no greater than one-third, preferably no greater than one-tenth, its content just before processing. In the course of development, the dye component may be eluted from the photosensitive material, or it may be transferred into a processing material, or it may undergo a reaction to be converted into a colorless compound.

In the photosensitive material of Present Invention (2), known dyes can be used. For instance, dyes soluble in alkalis contained in a developer and dyes of the type which lose their colors by reacting with a component in a developer, such as a sulfite ion, a developing agent or an alkali, can be employed.

Specific examples of such dyes include the dyes described in EP-A-0549489 and the dyes, ExF 2 to ExF 6, described in JP-A-7-152129. Also, as described in JP-A-8-101487, dyes dispersed in a solid condition can be used. Although these dyes can be used in the case of developing with a processing solution, they are especially suitable for the case where heat development is carried out using a processing sheet described hereinafter.

Further, dyes may be mordanted in advance with a mordant and a binder. In this case, mordants and dyes known in the photographic arts can be employed. Specifically, the mordants described, e.g., in U.S. Pat. No. 4,500,626 (columns 58–59), JP-A-61-88256 (pages 32–41), JP-A-62-244043 and JP-A-62-244036 can be recited.

Furthermore, it is possible to use a compound capable of releasing a diffusible dye by the reaction with a reducer in combination with a reducer. Therein, a dye mobile in the presence of an alkali upon development is released, and eluted with a processing solution or transferred into a processing sheet, thereby effecting the removal of the dye. Such a way of removing dyes are described in U.S. Pat. No. 4,559,290, U.S. Pat. No. 4,783,396, EP-A2-0220746, *Kokai Giho* 87-6119, and JP-A-8-101487.

Moreover, decolorizable leuco dyes can be used. For instance, JP-A-1-150132 discloses the silver halide photosensitive material containing leuco dyes previously colored with a metal salt of organic acid as a developer. A leuco dye and a developer complex undergo decolorization by reacting thermally or with an alkali, so that the combination of a leuco dye with a developer is preferable when a heat-developable photosensitive material is used in Present Invention (2).

Known leuco dyes can be utilized, and they are described, e.g., in Moriga & Yoshida, *Senryo to Yakuhin* (which means "Dyes and Chemicals"), vol. 9, p. 84, published by Kaseihin Kogyo Kyokai; *Shinpan Senryo Binran* (which means "New Handbook of Dyes"), p. 242, Maruzen (1970); R.Garner, *Reports on the Progress of Appl. Chem.*, vol. 56, p. 199 (1971); *Senryo to Yakuhin*, vol. 19, p. 230, Kaseihin Kogyo Kyokai (1974); *Shikizai* (which means "Coloring Materials"), vol. 62, p. 288 (1989); and *Senryo Kogyo* (which means "Dye Industry"), vol. 32, p. 208.

As for the developer, acid clay developers, phenolformaldehyde resins and metal salts of organic acids are suitably used. Useful examples of a metal salt of organic acid include the metal salts of salicylic acid, metal salts of phenol-salicylic acid-formaldehyde resin, rhodanates, and the metal salts of xanthogenic acid. As for the metal, zinc is preferred over others. As for the oil-soluble zinc salicylates, those described, e.g., in U.S. Pat. No. 3,864,146, U.S. Pat. No. 4,046,941, and JP-B-52-1327 can be employed.

In the present invention, the dyes, particularly those decolorized or removed upon development are used in an amount of 1 mg/m$^2$ to 10 g/m$^2$, more preferably 10 mg/m$^2$ to 1 g/m$^2$, so that the optical density becomes about 1.

The photosensitive material used in Present Invention (2) is preferably hardened with a hardener.

Examples of a hardener include the hardeners described, e.g., in U.S. Pat. Nos. 4,678,739 (column 41) and 4,791,042, JP-A-59-116655, JP-A-62-245261, JP-A-61-18942 and JP-A-4-218044. More specifically, the hardener can be selected from among aldehyde hardeners (such as formaldehyde), aziridine hardeners, epoxy hardeners, vinylsulfone hardeners (such as N,N'-ethylenebis (vinylsulfonylacetamido)ethane), N-methylol hardeners (such as dimethylol urea), boric acid, metaboric acid, and polymeric hardeners (such as the compounds described in JP-A-62-234157).

These hardeners can be used in a proportion of 0.001 to 1 g, preferably 0.005 to 0.5 g, to 1 g of a hydrophilic binder.

In the photosensitive material used in Present Invention (2) can be used various antifoggants, photographic stabilizer and precursors thereof. Specific examples of such agents include the compounds described, e.g., in *RD*, supra, U.S. Pat. Nos. 5,089,378, 4,500,627 and 4,614,702, JP-A-64-13564 (pages 7–9, 57–71 and 81–97), U.S. Pat. Nos. 4,775,610, 4,626,500 and 4,983,494, JP-A-62-174747, JP-A-62-239148, JP-A-1-150135, JP-A-2-110557, JP-A-2-178650, and *RD* No. 17643, pages 24–25 (1978).

Those compounds are used in an amount of $5\times10^{-6}$ to $1'10^{-1}$ mole, preferably $1\times10^{-5}$ to $1\times10^{-2}$ mole, per mole of silver.

As a method of developing the photosensitive material used in Present Invention (2) after exposure, there can be adopted a heat development method, an activator method in which a developing agent is incorporated into a photosensitive material and an alkaline processing solution is used for the development of such a material, and a method of development with a processing solution containing a developing agent and a base.

In Present Invention (2), it is unnecessary to remove the residual silver halide and the developed silver after the formation of dye images by development processing. That is, in Present Invention (2) no additional processing step for removal of the silver halide and the developed silver such as bleacing, fixation, and blixing is necessary after the developemnt step.

The processing of photosensitive materials by application of heat is known in the field of photographic arts. Heat-developable materials and processing thereof are described, e.g., in *Shashin Kogaku no Kiso* (which means "Fundamentals of Photographic Engineering"), pages 553–555 (published by Corona Publishing Co., Ltd. in 1979); *Eizo Joho* (which means "Image Information"), page 40 (April, 1978); *Nebletts Handbook of Photography and Reprography*, 7th Ed., pages 32–33, Van Nostrand and Reinhold Company; U.S. Pat. Nos. 3,152,904, 3,301,678, 3,392,020 and 3,457,075; British Patents 1,131,108 and 1,167,777; and *Research Disclosure*, No. 17029, pages 9–15 (June, 1978).

The term "activator processing" refers to a processing method in which a photosensitive material in which a color developing agent was incorporated previously is development-processed with a processing solution free from a color developing agent. The processing solution used in this case is characterized in that it does not contain any of color developing agents contained in general development-processing solutions; while it may contain other components (e.g., alkali and auxiliary developing agents) present in general development-processing solutions. The activator processing is illustrated in known literatures, e.g., EP-A1-0545491 and EP-A1-0565165.

The method of development with a processing solution containing a developing agent and a base is described, e.g., in *RD* No. 17643, pages 28–29, *RD* No. 18716, page 651, left and right columns, and *RD* No. 307105, pages 880–881.

The color developer used in the development-processing for the photosensitive material of Present Invention (2) is preferably an alkaline water solution in which a color developing agent of aromatic primary amine type is contained as a main component. Although aminophenol compounds are useful as a color developing agent of the foregoing type, p-phenylenediamine compounds are preferred thereto. Typical and suitable examples thereof include the compounds described in EP-A-0556700, page 28, lines 43–52. Such compounds can also be used as a combination of two or more thereof depending on the intended purpose. In general, the color developer further contains pH buffers, such as carbonates, borates and phosphates of alkali metals, and development inhibitors or antifoggants, such as chlorides, bromides, iodides, benzimidazoles, benzothiazoles and mercapto compounds. Furthermore, the color developer can optionally contain additives, with examples including various preservatives, such as hydroxylamine, diethylhydroxylamine, sulfites, hydrazines (e.g., N,N-biscarboxymethylhydrazine), phenyl semicarbazides, trimethanolamine and catecholsulfonic acids; organic solvents, such as ethylene glycol and diethylene glycol; development accelerators, such as benzyl alcohol, polyethylene glycol, quaternary ammonium salts and amines; dye-forming couplers; competing couplers; auxiliary developing agents, such as 1-phenyl-3-pyrazolidone; viscosity imparting agents; and various types of chelating agents, the representatives of which are aminopolycarboxylic acids, aminopolyphosphonic acids, alkylphosphonic acids and phosphonocarboxylic acids, such as ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and the salts thereof.

The pH of a color developer used is generally from 9 to 12. The replenishment rate of such a developer, though it depends on the type of the color photosensitive material processed, is generally at most 3 liter per $m^2$ of the photosensitive material processed. It is also possible to decrease the replenishment rate to at most 500 ml by the use of a replenisher having a low bromide ion concentration. In cases where a replenishment rate is decreased, it is desirable that the contact area of the color developer with air in a processing tank be made small to prevent the evaporation and aerial oxidation of the color developer. The effect produced upon processing by contact of air with the photographic processing solution in a processing tank can be evaluated by an aperture rate defined as the quotient of the contact area of the processing solution with air ($cm^2$) divided by the volume of the processing solution ($cm^3$). It is desirable for the aperture rate to be at most 0.1, preferably from 0.001 to 0.05. The aperture rate can be decreased by laying a screen, such as a floating cover, on the surface of a photographic processing solution put in a processing tank, or using the method of layer a mobile cover as described in JP-A-1-82032 or the slit development method described in JP-A-63-216050. It is desirable to decrease the aperture rate in every processing step, including not only color and black-and-white development steps but also subsequent various steps, such as bleaching, bleach-fix, fixation, washing and stabilization steps. Further, the replenishment rate can also be decreased by using a means for preventing bromide ions from accumulating in a developing solution. The processing time for color development is generally chosen from the range of 2 to 5 minutes, but it is also possible to render the processing time shorter by raising the processing temperature and pH, and using a color developing agent in a high concentration.

When the activator processing method is adopted in Present Invention (2), processing ingredients and processing manners as illustrated below are employed. In Present Invention (2), a photosensitive material is subjected to steps of development (silver development/cross-oxidiation of an incorporated color developing agent) and washing or stabilization. After washing or stabilization steps, a treatment for strengthening the developed color, e.g., a treatment with an alkali, may be taken.

In developing a photosensitive material with an activator processing solution in Present Invention (2), it is desirable to use a compound of the kind which functions as a developing agent of silver halide, and/or, when oxidized by silver development, acts so as to cross-oxidize a color developing agent incorporated in the photosensitive material (namely, an auxiliary developing agent). Suitable examples of such a compound include pyrazolidones, dihydroxybenzene, reductones and aminophenols. Of these compounds, pyrazolidones are preferred over the others. These compounds may be added to a developer, or incorporated in a photosensitive material.

As for the pyrazolidones, 1-phenyl-3-pyrazolidones are preferable. Specific examples thereof include 1-phenyl-3-pyrazolidone, 1-phenyl-4,4-dimethyl-3-pyrazolidone, 1-phenyl- 4-methyl-4-hydroxymethyl-3-pyrazolidone, 1-phenyl-4,4-dihydroxymethyl-3-pyrazolidone, 1-phenyl-5-methyl-3-pyrazolidone, 1-phenyl-5-phenyl-3-pyrazolidone, 1-p-tolyl-4-methyl-4-hydroxymethyl-3-pyrazolidone, 1-p-chlorophenyl-4-methyl-4-hydroxymethyl-3-pyrazolidone, 1-phenyl-2-hydroxymethyl-4,4-dimethyl-3-pyrazolidone, 1-phenyl-2-acetyl-3-pyrazolidone, 1-phenyl-2-hydroxymethyl-5-phenyl-3-pyrazolidone and 1-(2-chlorophenyl)-4-hydroxymethyl-4-methyl-3-pyrazolidone.

As for the dihydroxybenzenes, hydroquinone, chlorohydroquinone, bromohydroquinone, isopropylhydroquinone, methylhydroquinone, 2,3-dichlorohydroquinone, 2,5-dichlorohydroquinone, 2,5-dimethylhydroquinone and potassium hydroquinonemonosulfonate are examples thereof.

As for the reductones, N-methyl-p-aminophenol, N-(β-hydroxyethyl)-p-aminophenol, N-(4-hydroxyphenyl) glycine and 2-methyl-p-aminophenol are examples thereof.

The compounds as recited above are generally used alone, but it is desirable for them to be used in combination of two or more thereof with the intention of heightening the development and cross-oxidation activities.

The amount of those compounds used in a developer ranges between $2.5\times10^{-4}$ and 0.2 mole/l, preferably 0.0025 and 0.1 mole/l, and more preferably 0.001 and 0.05 mole/l.

As for the preservatives which can present in a developer used in Present Invention (2), sodium sulfite, potassium sulfite, lithium sulfite, formaldehyde/sodium bisulfite adduct and hydroxylamine sulfate are examples thereof. These preservatives are sometimes used in an amount of at most 0.1 mole/l, preferably from 0.001 to 0.02 mole/l. When an emulsion having a high chloride content is used for a photosensitive material, the amount of those compounds used is not more than 0.001 mole/l, and it is preferably zero in some cases.

In Present Invention (2), it is desirable to use organic preservatives in place of the foregoing hydroxylamine and sulfite ion.

The term "organic preservative" refers to all organic compounds which can decrease the deterioration speed of the above-recited developing agents when added to a developing solution. In other words, they are organic compounds having the function of preventing developing agents from suffering aerial oxidation or the like. Of such organic compounds, hydroxylamine derivatives (excluding hydroxylamine itself), hydroxamic acids, hydrazines, phenols, α-hydroxyketones, α-aminoketones, sugars, monoamines, diamines, polyamines, quaternary ammonium salts, nitroxy radicals, alcohols, oximes, diamide compounds and condensed-ring type amines can function as especially effective organic preservatives. Specific examples of those compounds are described, e.g., in JP-A-63-4235, JP-A-63-5341, JP-A-63-30845, JP-A-63-21647, JP-A-63-44645, JP-A-63-46454, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, and JP-B-48-30496. In addition to those organic preservatives, various metals as described in JP-A-57-44148 and JP-A-57-53749, the salicylic acids described in JP-A-59-180588, the alkanolamines described in JP-A-54-3532, the polyethyleneimines described in JP-A-56-94349 and the aromatic polyhydroxy compounds described in U.S. Pat. No. 3,746,544 may be added as other preservatives, if needed. In particular, the alkanolamines described in JP-A-4-97355, pages 631–632, and the dialkylhydroxylamines described in the same patent gazette, pages 627–630, are used to advantage. Also, the combination of a dialkylhydroxylamine and/or a hydrazine derivative with an alkanolamine or the combination of a dialkylhydroxylamine with an α-amino acid, such as glycine, described in EP-A1-0530921 can be favorably employed.

The amount of those organic preservatives used is preferably from $1\times10^{-3}$ to $5\times10^{-1}$ mole, more preferably from $1\times10^{-2}$ to $2\times10^{-1}$ mole, per liter of the developing solution.

In Present Invention (2), the developer contains halogen ions, such as chlorine ion, bromine ion and iodine ion. In special cases where an emulsion having a high silver chloride content is used, it is desirable that the developer contain chlorine ion in a concentration of from $3.5\times10^{-3}$ to $3.0\times10^{-1}$ mole/l, preferably from $1\times10^{-2}$ to $2\times10^{-1}$ mole/l, and/or bromine ion in a concentration of from $0.5\times10^{-5}$ to $1.0\times10^{-3}$ mole/l, preferably from $3.0\times10^{-5}$ to $5\times10^{-4}$ mole/l.

Herein, halide ions may be added directly to the developer, or eluted from photosensitive materials with the developer during development-processing.

In case of direct addition to the developer, substances which can be used to supply halogen ions include sodium halides, potassium halides, ammonium halides, lithium halides and magnesium halides.

In cases where the supply of halogen ions is provided by elution from photosensitive materials, the main source of those ions is silver halide emulsions, but their source may be other constituents.

The developer used in Present Invention (2) is preferably adjusted to pH 8 to 13, and more preferably to pH 9 to 12.

In order to retain the pH of the developer in the aforesaid range, it is desired that various pH buffers be used. Suitable examples of pH buffers which can be used include carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxylaminemethane salts, and lysine salts. Of these salts, carbonates, phosphates, tetraborates and hydroxybenzoates are particularly preferred over the others because they are excellent in solubility and buffer capacity in high pH ranges beyond 9.0, and do not have any adverse effect on photographic properties when added to the developer.

Specific examples of these buffers include lithium carbonate, sodium carbonate, potassium carbonate, potassium hydrogen carbonate, tripotassium phosphate, trisodium phosphate, dipotassium phosphate, disodium phosphate, potassium borate, sodium borate, sodium tetraborate, potassium tetraborate, sodium o-hydroxybenzoate (sodium salicylate), and potassium 5-sulfo-2-hydropxybenzoate (potassium 5-sulfosalicylate).

It is desirable that the foregoing buffers be added to the developer in a concentration of at least 0.05 mole/l, particularly from 0.1 to 0.4 mole/l.

In addition, various kinds of chelating agents can be used in the developer as a suspending agent for calcium and magnesium ions, or for the purpose of heightening the stability of the developer. For instance, nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, 1,2-diaminopropanetetraacetic acid, glycol-ether-diaminetetraacetic acid, ethylenediamine-o-hydroxyphenylacetic acid, 2-phosphonobutane-1,2,4-tricarboxylic acid, 1-hydroxyethylidene-1,1-diphosphionic acid, 1,2-dihydroxybenzene-4,6-disulfonic acid, and alkali metal salts of these acids can be used. The chelating agents recited above may be used in combination of two or more thereof, if desired.

Those chelating agents are added in an amount sufficient to block metal ions in the developer. For example, the addition thereof in an amount of from about 0.1 to about 10 g per liter of the developer will suffice for blocking metal ions.

Any antifoggant can be added in Present Invention (2), if needed. Specific examples of an antifoggant which can be used include alkali metal halides, such as sodium chloride, potassium bromide and potassium iodide, and nitrogen-containing heterocyclic compounds. As for the nitrogen-containing heterocyclic compounds, benzotriazole, 5-nitrobenzotriazole, 5-methylbenzotriazole, 5-nitrobenzimidazole, 5-nitroindazole, 2-thiazolylbenzimidazole, indazole, hydroxyazaindolidine, adenine, 1-phenyl-5-mercaptotetrazole and derivatives thereof are typical examples.

The amount of such nitrogen-containing heterocyclic compounds added is from $1\times10^{-5}$ to $1\times10^{-2}$ mole, preferably from $2.5\times10^{-5}$ to $1\times10^{-3}$ mole, per l of the developer.

To the developer, any development accelerator can be added, if needed. Specifically, the thioether compounds described, e.g., in JP-B-37-16088, JP-B-37-5987, JP-B-38-7826, JP-B-44-12380, JP-B-45-9019 and U.S. Pat. No. 3,813,247, the p-phenylenediamine compounds described in JP-A-52-49829 and JP-A-50-15554, the quaternary ammonium salts described, e.g., in JP-A-50-137726, JP-B-44-30074, JP-A-56-156826 and JP-A-52-43429, the amine compounds described, e.g., in U.S. Pat. Nos. 2,494,903, 3,123,182, 4,230,796 and 3,253,919, JP-B-41-11431 and U.S. Pat. Nos. 2,482,546, 2,596,926 and 3,582,346, the polyalkylene oxides described, e.g., in JP-B-37-16088, JP-B-42-25201 and U.S. Pat. No. 3,532,501, and imidazoles can be added as development accelerators, if needed.

It is desirable that the developer contain a brightening agent. In particular, 4,4-diamino-2,2'-disulfostilbene compounds are suitably used as brightening agent. Specifically, commercially available brightening agents, the compounds described in *Senshoku Notes* (which means "Notes on Dyeing"), 19th ed., pages 165–168, and the compounds described in JP-A-4-242943 (pages 3–7) can be employed. These compounds are added in an amount of from 0.1 to 10 g, preferably from 0.5 to 5 g, per liter of the developer.

The processing temperature of the developers applicable to Present Invention (2) ranges from 20° to 50° C., preferably from 30° to 45° C. The processing time thereof is within the range of 5 seconds to 2 minutes, preferably 10 seconds to 1 minute. As for the amount of the replenisher used for development, the smaller, the better. More specifically, the amount replenished is from 15 to 600 ml, preferably from 25 to 200 ml, and more preferably from 35 to 100 ml, per $m^2$ of the photosensitive material processed.

In Present Invention (2), photosensitive materials may undergo washing and/or stabilization processing after development-processing.

The volume of washing water required in the washing process can be determined variously depending on the characteristics of the photosensitive materials to be processed (e.g., on what kinds of couplers are incorporated therein), the end-use purposes of the photosensitive materials to be processed, the temperature of the washing water, the number of washing tanks used (the number of stages), the path of the replenishing water (e.g., whether a current of water flows in the counter direction or not), and other various conditions. Of these conditions, the relation between the number of washing tanks and the volume of washing water in the multistage counter current process can be determined according to the methods described in *Journal of the Society of Motion Picture and Television Engineers*, volume 64, pages 245–253, (May, 1995). According to the multistage counter current process described in the foregoing reference, the volume of washing water can be sharply decreased. However, the process has a disadvantage in that a suspended matter is produced by propagation of bacteria in the tanks due to an increase in the staying time of the water in the tanks, and adheres to photosensitive materials processed therein. As a measure for solving this problem, the method of lowering calcium and magnesium ion concentrations, as described in JP-A-62-288838, can be employed to greater advantage. Further, bactericides such as isothiazolone compounds and thiabendazoles described in JP-A-57-8542, chlorine-containing germicides such as sodium salt of chlorinated isocyanuric acid, and other germicides such as benzotriazoles and those described in Hiroshi Horiguchi, *Bohkin Bohbaizai no Kagaku* (which means "Antibacterial and Moldproof Chemistry"), Sankyo Shuppan (1986), *Biseibutsu no Mekkin Sakkin Bohbai Gijutsu* (which means "Arts of Sterilizing and Pasteurizing Microbes, and Proofing Against Molds"), compiled by Eisei Gijutsukai, published by Kogyo Gijutsu Kai in 1982, and *Bohkin Bohbai Jiten* (which means "Thesaurus of Antibacteria and Antimolds"), complied by Nippon Bohkin Bohbai Gakkai. In the processing of the present photosensitive materials, the pH of washing water ranges between 4 and 9, preferably 5 and 8. The washing water temperature and the washing time can be properly chosen depending on the characteristics and the intended use of the photosensitive materials to be processed. In general, the suitable washing temperature and time can be chosen from the range of 20 seconds to 10 minutes at a temperature ranging from 15° to 45° C., preferably the range of 30 seconds to 5 minutes at a temperature ranging from 25° to 40° C. In place of the washing process, the photosensitive materials can also be processed directly with a stabilizing solution. In this stabilization processing, known methods described in JP-A-57-8543, JP-A-58-14834 and JP-A-60-220345 can be adopted. In some cases, however, the stabilization processing is further carried out subsequently to the aforementioned washing step. For instance, in the photographic processing of color photosensitive materials for photographing use, a stabilizing bath containing a dye stabilizer and a surfactant is used as the final bath. As examples of a dye stabilizer, mention may be made of aldehydes, such as formaldehyde and glutaraldehyde, N-methylol compounds, hexamethylenetetramines and aldehyde-sulfite adducts. To this stabilizing bath also, various chelating agents and antimolds can be added.

When heat-development-processing is adopted in Present invention (2), on the other hand, the following ingredients and methods can be used for effecting the processing.

More specifically, in the photosensitive material according to Present Invention (2), it is desirable to use a base or its precursor for the purpose of promoting the silver development and the dye-forming reaction. As for the precursors of bases, there are known the salts formed by bases and organic acids capable of undergoing decarboxylation upon heating, and the compounds capable of releasing amines by intramolecular nucleophilic substitution reaction, Lossen rearrangement or Beckmann rearrangement. Specific examples of such a precursor of bases are described in U.S. Pat. Nos. 4,514,493 and 4,657,848, and *Kochi Gijutsu* No. 5, pp. 55–86 (published in Mar. 22, 1991, by Azutec Company Inc.). Also, as described in EP-A-0210660 and U.S. Pat. No. 4,740,445, it is effective to adopt the method of producing a base by the use of the combination of a basic metal compound sparingly soluble in water with the so-called complexing compound, or a compound capable of complexing the metal ion, which constitutes the basic metal compound, in water as a medium.

The amount of a base or its precursor used is from 0.1 to 20 g/m$^2$, preferably from 1 to 10 g/m$^2$.

To the photosensitive material according to Present Invention (2), a thermal solvent may be added for the purpose of promoting the heat development. As examples of such a thermal solvent, mention may be made of the polar organic compounds as described in U.S. Pat. Nos. 3,347,675 and 3,667,959. More specifically, amide derivatives (such as benzamide), urea derivatives (such as methyl urea and ethyl urea), the sulfonamide derivatives (such as the compounds described in JP-B-1-40974 and JP-B-4-13701), polyol compounds (such as sorbitols) and polyethylene glycols can be used as thermal solvent.

When a thermal solvent used is insoluble in water, it is desirable for the solvent to be used in the form of solid dispersion. The layer to which a thermal solver is added may be chosen from light-sensitive layers or light-insensitive layers depending on the intended purpose.

The proportion of a thermal solvent added is from 10 to 500 weight %, preferably from 20 to 300 weight %, to the binder in the layer to which the thermal solvent is added.

As for the heating temperature in the heat-development step, through it is generally from about 50° C. to about 250° C., the range of 60° C. to 150° C. is especially useful therefor.

With the intentions of the interception of air upon development by heating, the prevention of vaporization of ingredients from the photosensitive material, the supply of ingredients used for processing to the photosensitive material, and the removal of ingredients which are incorporated in the photosensitive material but become unnecessary after development (such as yellow filter dyes and antihalation dyes) and unnecessary components produced by development, the heating operation in the heat-development step may be carried out in a condition that a material other than the photosensitive material is superposed upon the photosensitive side of the photosensitive material. The material used in this case (a processing sheet) can comprise the same support as used for the photosensitive material, and the binder contained therein can be the same binder as used in the photosensitive material.

To the processing sheet, a mordant may be added for the purpose of removing the foregoing dyes and so on. Specifically, mordants known in the photographic arts, including those described, e.g., in U.S. Pat. No. 4,500,626 (columns 58-59), JP-A-61-88256 (pages 32–41), JP-A-62-244043 and JP-A-62-244036 can be used for the processing sheet. In addition, the dye-accepting high molecular compounds described in U.S. Pat. No. 4,463,079 may also be used.

As examples of the mordant, there are a polymer containing secondary and tertiary amino groups, a polymer having a nitrogen-containing heterocyclic moiety, and a polymer containing these quaternary cation groups, and the molecular weight thereof is from 5,000 to 20,000, and particularly from 10,000 to 50,000.

As the mordant, there are, for example, the vinyl-pyridine polymers and the vinylpyridinium cation polymers disclosed in U.S. Pat. Nos. 2,548,564, 2,484,430, 3,148,061, and 4,756,814; the polymer mordants crosslinkable with gelatin, etc., disclosed in U.S. Pat. Nos. 3,625,694, 3,859,096, and 4,128,538, British Patent 1,277,453, etc.; the aqueous sol type mordants disclosed in U.S. Pat. Nos. 3,958,995, 2,721,852, and 2,798,063, JP-A-54-115228, JP-A-54-145529, JP-A-54-126027, etc.; the water-insoluble mordants disclosed in U.S. Pat. No. 3,898,088; the reactive mordants each capable of causing a covalent bond with a dye disclosed in U.S. Pat. No. 4,168,976; and further the mordants disclosed in U.S. Pat. Nos. 3,709,690, 3,788,855, 3,642,482, 3,488,706, 3,557,066, 3,271,147, and 3,271,148, JP-A-50-71332, JP-A-53-30328, JP-A-52-15528, JP-A-53-125, and JP-A-53-1024.

As other mordant, the mordants described in U.S. Pat. Nos. 2,675,316 and 2,882,156 can be also used.

In the present invention, a development stopping agent is incorporated in the processing material and simultaneously with the development, the development stopping agent may be functioned.

The development stopping agent being used in this case is a compound which, after properly developing, rapidly neutralizes the base or reacts with the base to lower the concentration of the base in the layer and to stop the development or a compound which interacts with silver and a silver salt to restrain the development. Practically, there are an acid precursor releasing an acid by heating, an electrophiolic compound causing a substitution reaction with the base existing by heating, a nitrogen-containing heterocyclic compound, a mercapto compound, and the precursors of them. More specifically, the development stopping agents are described in JP-A-62-253159, pages 31 to 32.

In a case where a processing sheet is used, from the viewpoint of enhancing the freshness keeping quality of the photosensitive material, it is desirable that a base or its precursor be incorporated in a separate sheet.

The processing layer of the processing material being used in the present invention contains at least a base and/or a base precursor as described above.

As the base, an inorganic base or an organic base can be used.

As the inorganic base, there are the alkali metal or alkaline earth metal hydroxides (e.g., potassium hydroxide, sodium hydroxide, lithium hydroxide, calcium hydroxide, magnesium hydroxide, etc.) described in JP-A-62-209448, phosphates (e.g., secondary or tertiary phosphates, etc., such as dipotassium hydrogenphosphate, disodium hydrogenphosphate, sodium ammonium hydrogenphosphate, calcium hydrogenphosphate, etc.), carbonates (e.g., potassium carbonate, sodium carbonate, sodium hydrogencarbonate, magnesium carbonate, etc.), borates (e.g., potassium borate, sodium borate, sodium metaborate, etc.), organic acid salts (e.g., potassium acetate, sodium acetate, potassium oxalate, sodium oxalate, potassium tartrate, sodium tartrate, sodium malate, sodium palmitate, sodium stearate, etc.), the alkali metal or alkaline earth metal acetylides described in JP-A-63-25208, etc.

Also, as the organic base, there are ammonia, aliphatic or aromatic amines [for example, primary amines (e.g., methylamine, ethylamine, butylamine, n-hexylamine, cyclohexylamine, 2-ethylhexylamine, allylamine, ethylenediamine, 1,4-diaminobutane, hexamethylenediamine, aniline, anisidine, p-toluidine, α-naphthylamine, m-phenylenediamine, 1,8-diaminonaphthalene, benzylamine, phenetylamine, ethanolamine, etc.), secondary amines (e.g., dimethylamine, diethylamine, dibutylamine, diallylamine, N-methylaniline, N-methylbenzylamine, N-methylethanolamine, diethanolamine, etc.), tertiary amines (e.g., N-methylmorpholine, N-hydroxyethylmorpholine, N-methylpiperidine, N-hydroxyethylpiperidine, N,N'-dimethylpiperazine, N,N'-dihydroxyethylpiperazine, diazabicyclo[2,2,2]octane, N,N-diethyletlianolamine, N,N-dimethylpropanolamine, N-methyldiethanolamine, N-methyldipropanolamine, triethanolamine, N,N,N',N'-tetramethylethylenediamine, N,N,N',N'-tetrahydroxyethylethylenediamine, N,N,N',N'-tetramethyltrimethylenediamine, N-methylpyrrolidine, etc., described in JP-A-62-170954), polyamines (e.g., diehylenetriamine, triethylenetetramine, polyethyleneimine, polyallylamine, polyvinylbenzylamine, poly-(N,N-diethylaminoethyl methacrylate), poly-(N,N-dimethylvinylbenzylamine, etc.), hydroxyamines (e.g., hydroxylamitne, N-hydroxy-N-methylaniline, etc.), heterocyclic amines (e.g., pyridine, lutidine, imidazole, aminopyridine, N,N-dimethylaminopyridine, indole, quinoline, isoquinoline, poly-4-vinylpyridine, poly-2-vinylpyridine, etc.), etc.], amidines [for example, monoamidines (e.g., acetamidine, imidazotane, 2-methylimidazole, 1,4,5,6-tetrahydropyrimidine, 2-methyl-1,4,5,6-tetrahydropyrimidine, 2-phenyl-1,4,5,6-tetrahydropyrimidine, iminopiperizine, diazabicyclononene, diazibicycloindecene (DBU), etc.), bisamidines, trisamidines, and tetraamidines)], guanidines [for example, water-soluble monoguanidines (e.g., guanidine, dimethylguanidine, tetramethylguanidine, 2-aminoimidazoline, 2-amino-1,4,5-tetrahydropyrimidine, etc.), the water-insoluble mono- and bisguanidines described in JP-A-63-70845, and bis-, tris- and tetraguanidines], the hydroxides of quaternary ammonium (e.g., tetramethylammonium hydroxide, tetrathylamiiornium hydroxide, tetrabutylammonium hydroxide, trimethylbenzylammonium hydroxide, trioctylmethylammonium hydroxide, methylpyridimium hydroxide, etc.), etc.

As the base precursor, a decarboxylation type precursor, a decomposition type precursor, a reaction type precursor, a complex salt-forming type precursor, etc., can be used.

In the present invention, a method of generating a base by the combination of a sparingly water-soluble basic metal compound as a base precursor and a compound (called complexing compound) capable of causing a complex-forming reaction with the metal ion constituting the basic metal compound using water as a medium as described in EP-A1-210660 and U.S. Pat. No. 4,740,445 is effectively employed. In this case, it is desirable that the sparingly water-soluble metal compound is added to the photosensitive material and the complexing compound is added to the processing material but the contrary is possible.

The using amount of the base or the base precursor is from 0.1 g/m$^2$ to 20 g/m$^2$, and preferably from 1 g/m$^2$ to 10 g/m$^2$.

As the binder for the processing layer, the hydrophilic polymer as used for the photosensitive material can be used.

The processing material is preferably hardened by a hardener, as in the photosensitive material. As the hardeners, those used for the photosensitive material can also be used.

Also, a physically developing nucleus and a silver halide solvent are incorporated in the processing material and simultaneously with the development, the silver halide in the photosensitive material may be solubilized and fixed in the processing material.

The physically developing nucleus has a function of reducing a soluble silver salt diffused from the photosensitive material to convert them to physically developed silver and fixing the physically developed silver to the processing layer. As the physically developing nucleus, colloid particles of a heavy metal such as zinc, mercury, lead, cadmium, iron, chromium, nickel, tin, cobalt, copper, ruthenium, etc.; a noble metal such as palladium, platinum, silver, gold, etc.; or a chalcogen compound of the foregoing metal and sulfur, selenium, tellurium, etc., which are known as a physically developing nucleus, can be used.

The physically developing nucleus material is obtained by reducing the corresponding metal ion with a reducing agent such as ascorbic acid, sodium boronhydride, hydroquinone, etc., to form a metal colloid dispersion, or by mixing a soluble sulfide and a selenide solution or a telluride solution to form a colloid dispersion of a water-insoluble metal sulfide, metal selenide, or metal telluride. It is preferred that the dispersion is formed in a hydrophilic binder such as gelatin.

A preparation method of colloid silver particles is described in U.S. Pat. No. 2,688,601, etc. If necessary, a desalting method of removing excessive salts, which is known in a preparation method of a silver halide emulsion may be applied in the case of preparing the colloid silver particles.

The sizes of these physically developing nuclei being used are preferably from 2 nm to 200 nm.

The physically developing nucleus is incorporated in the processing layer in an amount of usually from $10^{-3}$ mg/m$^2$ to 100 mg/m$^2$, and preferably from $10^{-2}$ mg/m$^2$ to 10 mg/m$^2$.

The physically developing nucleus can be prepared separately and added to a coating liquid but the physically developing nucleus may be prepared by reacting, for example, silver nitrate and sodium sulfite or gold chloride and a reducing agent, etc., in a coating liquid containing a hydrophilic binder.

As the physically developing nucleus, silver, silver sulfide, palladium sulfide, etc., is preferably used. In the case of using the physically developed silver transferred to a complexing agent sheet as an image, palladium sulfide, silver sulfide, etc., is preferably used in the points that Dmin is low and Dmax is high.

As a silver halide solvent, a known material can be used. For example, thiosulfates such as sodium thiosulfate, ammonium thiosulfate, etc.; sulfites such as sodium sulfite, sodium hydrogensulfite, etc.; thiocyanates such as potassium thiocyanate, ammonium thiocyanate, etc.; the thioether compounds such as 1,8-di-3,6-dithiaoctane, 2,2'-thiodiethanol, 6,9-dioxa-3,12-dithiatetradecane-1,14-diol, etc., as described in JP-B-47-11386; the compounds each having a 5-membered or 6-membered imido ring such as uracil, hydantoin, etc., as described in Japanese Patent Application No. 6-325350; and the compounds shown by following general formula (I) described in JP-A-53-144319 can be used.

The trimethyltriazolium thiolate compounds and meso-ion thiolate compounds described in *Analytica Chemica Acta*, Vol. 248, pages 604 to 614(1991) are preferably used. Also, the compounds capable of stabilizing by fixing silver halides describes in Japanese Patent Application No. 6-206331 can also be used as the silver halide solvents in this invention.

General Formula (I):

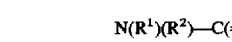

$$N(R^1)(R^2)—C(=S)—X—R^3$$

wherein X represents a sulfur atom or an oxygen atom; $R^1$ and $R^2$, which may be the same or different, each represents an aliphatic group, an aryl group, a heterocyclic residue, or an amino group and $R^3$ represents an aliphatic group or an aryl group, said $R^1$ and $R^2$ or said $R^2$ and $R^3$ may combine each other to form a 5-membered or 6-membered heterocyclic ring.

The compound shown by the above general formula may be used together with the silver halide solvent described above.

In the compounds described above, the sulfites and the compounds each having a 5-membered or 6-membered imido ring such as uracil and hydantoin are particularly preferred. In particular, it is preferred to add uracil or hydantoin as the potassium salt thereof in the point that lowering of the luster of processing material is prevented.

The content of the total silver halide solvents in the processing layer is from 0.01 mmol/m$^2$ to 50 mmol/m$^2$, preferably from 0.1 mmol/m$^2$ to 30 mmol/m$^2$, and more preferably from 1 mmol/m$^2$ to 20 mmol/m$^2$. Also, the content of the silver halide solvent is from 1/20 to 20 times, preferably from 1/10 to 10 times, and more preferably from 1/3 to 3 times by mole ratio to the coated silver amount of the photosensitive material.

The silver halide solvent may be added to a solvent such as water, methanol, ethanol, acetone, dimethylformamide, methylpropyl glycol, etc., or an alkaline or acidic aqueous solution, or the silver halide solvent may be added to a coating liquid as the solid fine particle dispersion thereof.

Also, by incorporating the polymer having the repeating unit of vinylimidazole and/or vinylpyrolidone as the constituting component described in Japanese Patent Application No. 6-325350 to the processing layer, the density of the silver images in the photosensitive material can be increased.

The processing material may have various auxiliary layers such as a protective layer, a subbing layer, a back layer, etc., as the case of the photosensitive material.

It is preferred that the processing material is composed of a continuous web having formed thereon a processing layer.

The continuous web of the processing material in this case is the form having a length of the processing material, which is sufficiently longer than the long side length of the photosensitive material being processed, the processing material being used at processing without being cut and the length of the processing material being able to process plural photosensitive materials. In general, the continuous web of the processing material is that the length of the processing material is from 5 times to 1,000 times the width of the processing material. The width of the processing material may be optional but it is preferred that the width thereof is wider than the width of the photosensitive material being processed.

Also, an embodiment of processing plural photosensitive materials disposed side by side, that is, plural photosensitive materials disposed in the width direction of the processing material is preferred. In this case, it is preferred that the width of the processing material is at least the value of [(the width of the photosensitive material)×(the number of the simultaneously processing photosensitive materials)].

Such a continuous web processing material is particularly effective in the case that the length of the photosensitive material is at least 50 cm and the case that plural photosensitive materials are continuously processed.

Also, when such a continuous web processing material is used, after development, the photosensitive materials can be easily separated from the processing material.

It is preferred that the continuous processing material is supplied from a delivery roll and wound round a winding roll for being wasted. In the case of the photosensitive material having a particularly large size, the waste is easy.

As described above, the continuous web type processing material greatly improves the handling property as compared to a conventional sheet form processing material.

As for the thermal solvent, on the other hand, it may be incorporated in either or both of the photosensitive material and the processing sheet.

When heat development is performed using a processing sheet, a solvent may be used for the purpose of promoting the development, the transfer of ingredients for processing use and the diffusion of unnecessary matters. Solvents usable for such purposes are described, e.g., in U.S. Pat. No. 4,704,345, U.S. Pat. No. 4,740,445 and JP-A-61-238056.

In this method, the heating temperature is appropriately below the boiling point of a solvent used. In the case of using water as the solvent, a desirable heating temperature is from 50° C. to 100° C.

As examples of a solvent used for acceleration of the development and/or the diffusion transfer of ingredients for processing use, mention may be made of water, a basic water solution containing an inorganic alkali metal salt or an organic base (examples of these bases include those recited in the description of an image formation accelerator), low boiling solvents, and mixed solutions of low boiling solvents with water or the aforementioned basic water solutions. Further, these solvents may contain a surfactant, an antifoggant, a compound with which a sparingly water-soluble metal salt can be complexed, antimolds and antibacterial agents.

As the solvent used in such a heat development step, water is preferred, and any types of water may be employed. Specifically, distilled water, tap water, well water, mineral water and so on can be used. In an apparatus used for heat development of the photosensitive material of the type which is combined with an image-receiving element, water may be used only once and then discarded, or water may be circulated and used repeatedly. In the latter case, the water used comes to contain ingredients eluted from the material. Also, the apparatus and water as described, e.g., in JP-A-63-144354, JP-A-63-144355, JP-A-62-38460 and JP-A-3-210555 may be employed.

The solvents as recited above can be supplied to the photosensitive material, the processing sheet or both of them. It is adequate to use a solvent in an amount lower than the weight of the solvent having a volume corresponding to the maximum swelling volume of the total coated layers.

In the present invention, as a process of developing the photosensitive material photographed using a camera, etc., after applying water corresponding to the amount of from 0.1 to 1 time the amount required for maximally swelling the total coated layers of the photosensitive material and the processing material excluding back layer(s) to the photosensitive material or the processing material, the photosensitive material is superposed on the processing material such that the photosensitive layer faces the processing layer, and they are heated to a temperature of from 60° C. to 100° C. and for a time of from 5 seconds to 60 seconds.

In the present invention, the photosensitive material and the processing material are superposed to each other in the state that the photosensitive material and/or the processing material is swelled with water and they are heated. The state of the layers at swelled is unstable and thus, it is important to restrain the amount of water to the range described above for preventing the occurrence of local coloring unevenness.

The amount of water required for maximally swelling the layers can be obtained by immersing the photosensitive material or the processing material having the coated layers to be measured in water being used, measuring the layer thickness when the layers are sufficiently swelled, and after calculating the maximum swelled amount, reducing the weight of the coated layers from the calculated value. Also, an example of the measurement method of the swelling degree is described in *Photographic Science Engineering*, Vol. 16, p. 449(1072).

As a method of applying water, there is a method of immersing the photosensitive material or the processing material in water and removing excessive water with a squeeze roller. In this case, however, it is preferred to apply a definite amount of water to the photosensitive material or the processing material by coating only. Also, a method of spraying water by a water-coating apparatus having a nozzle wherein plural nozzle holes spraying water are linearly disposed along the direction crossing the transporting direction of the photosensitive material or the processing material at a definite interval and an actuator displacing the foregoing nozzle to the photosensitive material and the processing material on the transporting passage is particularly preferred.

As for the method of supplying water, the methods described, e.g., in JP-A-62-253159 (page 5) and JP-A-63-85544 are used to advantage. In addition, it is possible to adopt the method in which a solvent previously microencapsulated or made into the form of hydrate is incorporated into the photosensitive material, the processing sheet, or both of them.

The temperature of the supplied water is preferably from 30° C. to 60° C., as described in JP-A-63-85544 cited above.

In cases where the heat development is carried out in the presence of a small amount of water or a solvent, as described in EP-A-0210660 and U.S. Pat. No. 4,740,445, it is effective to adopt the method of producing a base by the use of the combination of a basic metal compound sparingly water-soluble with the so-called complexing compound, or a compound capable of complexing the metal ion, which constitutes the basic metal compound, in water as a medium. In this case, it is desirable from the viewpoint of freshness keeping quality that the sparingly water-soluble basic metal compound and the complexing compound be incorporated in the photosensitive material and the processing sheet, respectively.

As for the way of heating adopted in the development step, the heating can be effected, e.g., by contact with a heated block or plate, with a heating means such, as a heating plate, a hot presser, a heating roller, a heating drum, a halogen lamp heater, an infrared lamp heater or a far infrared lamp heater, or by passing through a high temperature atmosphere.

In superposing the photosensitive material and the processing sheet upon each other, the methods described in JP-A-62-253159 and JP-A-61-147244 (page 27) can be applied.

For the processing of the photosensitive element used in Present Invention (2), any of conventional apparatuses for heat development can be used. For instance, the apparatuses described in JP-A-59-75247, JP-A-59-177547, JP-A-59-181353, JP-A-60-18951, JP-A-U-62-25944, and Japanese Patent Application Nos. 4-277517, 4-243072, 4-244693, 6-164421 and 6-164422 can be used to advantage.

As for the commercial apparatuses on the market, the apparatuses made by Fuji Photo Film Co., Ltd., e.g., Pictrostat 100, Pictrostat 200, Pictrostat 300, Pictrostat 330, Pictrostat 50, Pictrography 3000 and Pictrography 2000, can be applied.

The photosensitive material and/or the processing sheet used in Present Invention (2) may be provided with an electrically conductive heat-generating element layer as a heating means for heat development. As for the heat-generating element, those described in JP-A-61-145544 can be applied to this invention.

The photosensitive material used in Present Invention (2) can contain various surfactants for a wide variety of purposes, for instance, as a coating aid, improvements in releasability and slippability, prevention of generation of static charges, acceleration of development, and so on. Specific examples of such surfactants are described, e.g., in *Kochi Gijutsu* No. 5, pp. 136–138 (published in Mar. 22, 1991, by Azutec Company Inc.), JP-A-62-173463 and JP-A-62-183457.

Also, organic fluorinated compounds may be added to the photosensitive material with the intentions of making improvements in slippability and releasability, preventing static charges from generating, and so on. Typical examples of an organic fluorinated compound usable for such intentions include fluorine-containing surfactants as described in JP-B-57-9053 (columns 8-17), JP-A-61-20944 and JP-A-62-135826, and hydrophobic fluorine-containing compounds, such as oily fluorinated compounds, including fluorine-containing oils, and solid fluorinated compound resins such as a tetrafluoroethylene resin.

It is desirable that the photosensitive material be endowed with lubricity. A lubricant-containing layer is preferably provided on both the photosensitive layer side and the backing layer side. An appropriate lubricity for the photosensitive material ranges between 0.25 to 0.01, expressed in terms of coefficient of kinematic friction. The aforesaid range of this coefficient is the value determined under a condition that a photosensitive material is conveyed at a speed of 60 cm/min (in the atmosphere of 25° C., 60% RH) as a stainless steel ball having a diameter of 5 mm is brought into contact therewith. Even when the material to be brought into contact with is replaced by a photosensitive layer surface in the foregoing evaluation, the value obtained is on almost the same level as the above range.

As examples of a usable lubricant, mention may be made of polyorganosiloxanes, higher fatty acid amides, metal salts of higher fatty acids and higher fatty acid esters of higher alcohols. As for the polyorganosiloxanes which can be used, polydimethylsiloxane, polydiethylsiloxane, polystyrylmethylsiloxane and polymethylphenylsiloxane are specific examples thereof. Suitable layers to which such lubricants are added are the outermost emulsion layer and a backing layer. In particular, polydimethylsiloxane and the esters having a long-chain alkyl group are preferred as lubricant.

In Present Invention (2), an antistatic agent is used to advantage. As examples of an antistatic agent, mention may be made of carboxylic acids and the salts thereof, sulfonate-containing high polymers, cationic high polymers and ionic surface active compounds.

Most suitable antistatic agents are crystalline metal oxides having a volume resistivity of no higher than $10^7$ Ωm, preferably no higher than $10^5$ Ωm, and a grain size of from 0.001 to 1.0 μm, which each are constituted of one or more of a metal oxide selected from the group consisting of ZnO, $TiO_2$, $SnO_2$, $Al_2O_3$, $In_2O_3$, $SiO_2$, MgO, BaO, $MoO_3$ and $V_2O_5$, finely divided compound oxides which comprise the metal oxides recited above respectively (wherein cationic elements, other than those present in the foregoing metal oxides, are Sb, P, B, In, S, Si and C), sol-state metal oxides, and finely divided compound oxides comprising such sol-state metal oxides. The content of such an antistatic agent in the photosensitive material is desirably from 5 to 500 mg/m$^2$, and particularly desirably from 10 to 350 mg/m$^2$. An appropriate ratio of a conductive crystalline oxide or compound oxide thereof to a binder is from 1/300 to 100/1, preferably from 1/100 to 100/5.

In constituent layers of the photosensitive material and the processing sheet (including a backing layer), various polymer latexes can be incorporated with the intentions of improvements in physical properties as a film, such as dimensional stabilization, prevention of curling, prevention of adhesion, prevention of cracking and prevention of sensitization or desensitization due to application of pressure. Specifically, any of polymer latexes described in JP-A-62-245258, JP-A-62-136648, JP-A-62-110066 and so on can be used. In particular, the use of polymer latexes having a low glass transition point (below 40° C.) in a mordanting layer can prevent the mordanting layer from cracking; while the use of polymer latexes having a high glass transition point in a backing layer can have an excellent effect on the prevention of curling.

For the photosensitive material used in Present Invention (2), it is preferable to contain a matting agent. The matting agent may be present on either the emulsion layer side or the backing layer side, but preferably in the outermost layer on the emulsion layer side. Either a matting agent soluble in a processing solution or a matting agent insoluble therein may be used, but preferably both of them are used together. Examples of a matting agent include polymethylmethacrylate particles, methylmethacrylate/methacrylic acid (9/1 or 5/5 by mole) copolymer particles and polystyrene particles. An appropriate particle size thereof ranges between 0.8 to 10 μm. The matting agent can have greater effect the narrower particle size distribution it has. Specifically, it is desirable that at least 90% of the total particles have their individual sizes within the range of 0.9 to 1.1 times as large as the average particle size. For enhancement of matting effect, it is favorable to add fine particles having a size smaller than 0.8 μm in addition. As examples of such fine particles, mention may be made of polymethylmethacrylate particles (0.2 μm), methylmethacrylate/methacrylic acid (9/1 by mole) copolymer particles (0.3 μm), polystyrene particles (0.25 μm) and colloidal silica (0.03 μm).

Suitable examples of a matting agent are described in JP-A-61-88256 (page 29). Further, the compounds described in JP-A-63-274944 and JP-A-63-274952, such as benzoguanamine resin beads, polycarbonate resin beads and AS resin beads, can be used as matting agent. Also, the compounds described in *RD*, supra, can be employed.

Supports of the photosensitive material and the processing sheet used in Present Invention (2) are chosen from those which can withstand processing temperatures. In general, photographic supports, including various types of paper and synthetic polymer films, as described in *Shashin Kogaku no Kiso—Gin-en Shashin Hen*—(which means "Fundamentals of Photographic Engineering—The Volume of Silver Salt Photography—"), pages 223–240, compiled by Japan Photographic Society, published by Corona Publishing Co., Ltd., in 1979, can be used. Specific examples of such photographic supports include films of polyethylene terephthalate, polyethylene naphthalate, polycarbonate, polyvinyl chloride, polystyrene, polypropylene, polyimide and celluloses (e.g., triacetyl cellulose).

These types of polymer films can be used alone, or a paper laminated with a synthetic polymer, such as polyethylene, on one side or both sides can be used as a support.

Other supports which can be employed are those described, e.g., in JP-A-62-253159 (pages 29–31), JP-A-1-161236 (pages 14–17), JP-A-63-316848, JP-A-2-22651, JP-A-3-56955, and U.S. Pat. No. 5,001,033.

In cases where requirements for heat resistance and anticurling characteristics are severe, the supports described in JP-A-6-41281, JP-A-6-43581, JP-A-6-51426, JP-A-6-51437, JP-A-6-51442, JP-A-6-82961, JP-A-6-82960, JP-A-6-82959, JP-A-6-67346, JP-A-6-202277, JP-A-6-175282, JP-A-6-118561, JP-A-7-219129 and JP-A-7-219144, and Japanese Patent Application Nos. 4-253545, 4-221538 and 5-21625 are suitable for the photosensitive material.

Also, the support constituted mainly of a syndiotactic styrene polymer can be used to advantage.

In order to make a support adhere to a constituent layer of the photosensitive material, it is desirable that the support be subjected to a surface treatment. As for the surface treatment, surface activating treatments, such as agent treatment, mechanical treatment, corona discharge treatment, flame treatment, UV irradiation treatment, radio-frequency treatment, glow discharge treatment, active plasma treatment, laser treatment, mixed acid treatment and ozone oxidation treatment, are examples thereof. Of these surface treatments, UV irradiation treatment, flame treatment, corona treatment and glow treatment are preferred over the others.

Further, subbing methods are described below: A subbing layer may have one constituent layer, or two or more constituent layers. Examples of a binder used in a subbing layer include not only copolymers using, as starting materials for the synthesis, monomers selected from among vinyl chloride, vinylidene chloride, butadiene, methacrylic acid, acrylic acid, itaconic acid, maleic anhydride and the like; but also polyethyleneimine, epoxy resins, grafted gelatins, nitrocellulose and gelatin. As for the compound capable of swelling the support, resorcinol and p-chlorophenol are examples thereof. As examples of a gelatin hardener usable in the subbing layer, mention may be made of chromium salts (e.g., chrome alum), aldehydes (e.g., formaldehyde, glutaraldehyde), isocyanates, active halogen-containing compounds (e.g., 2,4-dichloro-6-hydroxy-s-triazine), epichlorohydrin resins and active vinylsulfone compounds. Further, the subbing layer may contain as a matting agent $SiO_2$, $TiO_2$, or fine particles of an inorganic substance or a methylmethacrylate copolymer (0.01–10 μm in particle size).

Furthermore, it is desirable to use the support provided with a magnetic recording layer, such as those described in JP-A-4-124645, JP-A-5-40321, JP-A-6-35092, JP-A-6-317875 and Japanese Patent Application No. 5-58221, since photographic information can be recorded thereon.

The magnetic recording layer is provided by coating on a support a composition containing a magnetic powder-dispersed binder in water or an organic solvent.

Suitable examples of a magnetic-powder include powders of ferromagnetic iron oxides, such as $\gamma$-$Fe_2O_3$, Co-coated $\gamma$-$Fe_2O_3$, Co-coated magnetite, Co-containing magnetite, ferromagnetic chromium dioxide, ferromagnetic metals, ferromagnetic alloys, and hexagonal Ba-ferrite, Sr-ferrite, Pb-ferrite and Ca-ferrite. Of these powders, Co-coated ferromagnetic iron oxide powders, such as Co-coated $\gamma$-$Fe_2O_3$ powder, is preferred over the other powders. Such magnetic powders may have any of shapes including a needle-like shape, a shape like rice grains, a spherical shape, a cubic shape and a tabular shape. The specific surface area ($S_{BET}$) of such a powder is preferably at least 20 $m^2/g$, and particularly preferably at least 30 $m^2/g$. The saturation magnetization of a ferromagnetic powder ($\sigma_s$) is preferably from $3.0\times10^4$ to $3.0\times10^5$ A/m, and particularly preferably from $4.0\times10^4$ to $2.5\times10^5$ A/m. The ferromagnetic powders may be subjected to surface treatment with silica and/or alumina, or an organic material. Further, the surface of the magnetic powders may be treated with a silane coupling agent or a titanium coupling agent as disclosed in JP-A-6-161032. In addition, the magnetic powders described in JP-A-4-259911 and JP-A-5-81652, whose surfaces are coated with an inorganic or organic substance, can also be used.

As a binder for magnetic powders can be used the resins described in JP-A-4-219569, including thermoplastic resins, thermosetting resins, radiation-curable resins, reactive resins, acid-decomposable, alkali-decomposable or biodegradable resins, natural polymers (e.g., cellulose derivatives, sugar derivatives) and mixtures of two or more of those resins. The glass transition temperature (Tg) of those resins ranges between −40° C. to 300° C., and the weight-average molecular weight thereof ranges between $0.2\times10^4$ to $1.00\times10^6$. Suitable examples of such resins include vinyl copolymers; cellulose derivatives, such as cellulose diacetate, cellulose triacetate, cellulose acetate propionate, cellulose acetate butyrate and cellulose tripropionate; acrylic resins and polyvinyl acetal resins. Also, gelatin is used to advantage. In particular, cellulose di-(or tri-)acetate is preferred over the others. The binders used for magnetic powders can be subjected to curing treatment by addition of a cross-linking agent of epoxy, aziridine or isocyanate type. As examples of a cross-linking agent of the isocyanate type, mention may be made of isocyanates, such as tolylenediisocyanate, 4,4'-diphenylmethanediisocyanate, hexamethylenediisocyanate and xylylenediisocyanate, the reaction products of these isocyanates with polyhydric alcohols (e.g., the reaction product of 3 moles of tolylenediisocyanate with 1 mole of trimethylol propane), and polyisocyanates produced by condensation of those isocyanates, which are described, e.g., in JP-A-6-59357.

In dispersing the aforementioned magnetic powders into the foregoing binders, as described in JP-A-6-35092, it is desirable to use a kneader, a pin-type mill, an annular-type mill or the like, and their combination as well. Therein, the dispersants described in JP-A-5-88283 and other known dispersants can be used. The magnetic recording layer has a thickness of from 0.1 to 10 μm, preferably from 0.2 to 5 μm, and more preferably from 0.3 to 3 μm. An appropriate ratio of the magnetic powder to the binder is within the range of 0.5:100 to 60:100 by weight, preferably 1:100 to 30:100 by weight. A suitable coverage of the magnetic powder is from 0.005 to 3 $g/m^2$, preferably from 0.01 to 2 $g/m^2$, and more preferably from 0.02 to 0.5 $g/m^2$. It is desirable that the magnetic recording layer has a transmission yellow density of from 0.01 to 0.50, preferably from 0.03 to 0.20, and particularly preferably from 0.04 to 0.15. The magnetic recording layer can be provided on the back surface of a photographic support throughout or in the form of stripes by the use of a coating or printing technique. As for the coating method usable for formation of the magnetic recording layer, air-doctor, blade, air-knife, squeegee, impregnation, reverse roll, transfer roll, gravure, kiss, cast, spray, dip, bar and extrusion coating methods are examples thereof. Further, the coating compositions described, e.g., in JP-A-5-341436 can be used to advantage.

To the magnetic recording layer, functions of enhancing the lubricity, controlling the curling properties, preventing the generation of static charges and adhesiveness and polishing a head may be imparted. These functions, on the other hand, may be given to a functional layer provided separately. For the purpose of fulfilling those functions, it is desirable to use abrasives at least one component of which is non-spherical inorganic grains having Mohs' hardness of at least 5. As for the nonspherical inorganic grains, fine powders of aluminum oxide, chromium oxide, silicon dioxide, titanium dioxide, silicon carbide, titanium carbide and diamond are examples thereof. These abrasives may undergo surface treatment with a silane coupling agent or a titanium coupling agent. These grains may be added to the magnetic recording layer, or coated on the magnetic recording layer (e.g., as a protective layer or a lubricant layer). As a binder used for coating those grains, although any of the binders illustrated above may be employed, the same binder as used in the magnetic recording layer is preferred. Specific examples of a photosensitive material provided with a magnetic recording layer are described in U.S. Pat. Nos. 5,336,589, 5,250,404, 5,229,259 and 5,215,874, and European Patent 466,130.

Polyester supports suitable for the foregoing photosensitive material provided with a magnetic recording layer are described below, and for details of the photosensitive material, including the processing, cartridge and examples therefor, the descriptions in *Kohai Giho* Kogi No. 94-6023 (published by Hatsumei Kyokai in Mar. 15, 1994) can be referred to. Polyesters are produced using diols and aromatic dicarboxylic acids as essential components. As for the aromatic dicarboxylic acid, 2,6-, 1,5-, 1,4- and 2,7-naphthalenedicarboxylic acids, terephthalic acid, isophthalic acid and phthalic acid are examples thereof; while examples of a diol include which can be used include diethylene glycol, triethylene glycol, cyclohexanedimethanols, bisphenol A and bisphenol. As examples of a polymer produced by polycondensation of those components, mention may be made of homopolymers, such as polyethylene terephthalate, polyethylene naphthalates and polycyclohexanedimethanol terephthalates. Favorable polymers are, however, the polyesters in which 50–100 mole % of the aromatic dicarboxylate units are 2,6-naphthalenedicarboxylaLe units. In particular, polyethylene 2,6-naphthalate is preferred over the others. The average molecular weight of a polyester as recited above is from about 5,000 to about 200,000, and the Tg thereof is not lower than 50° C., preferably not tower than 90° C.

In order to render a polyester support hard to curl, the polyester support is subjected to heat treatment. The temperature at which the heat treatment is carried out ranges between 40° C. and a temperature of no higher than fig, preferably the temperature of Tg −20° C. and a temperature of no higher than Tg. As far as the treatment temperature is within the aforesaid range, the temperature may be maintained constant during the heat treatment, or the heat treatment may be carried out as the temperature is lowered. The heat treatment time is within the range of 0.1 to 1,500 hours, preferably 0.5 to 200 hours. In performing the heat treatment, the support may have a form of roll, or a form of travelling web. With the intention of improvement in surface conditions, roughness may be imparted to the support surface, e.g., by coating electrically conductive inorganic fine grains (e.g., $SnO_2$, $Sb_2O_5$). Further, it is desirable to design so that only the edge part of a support is somewhat thickened by applying roulette thereto, whereby a cut-end line of the support can be prevented from being impressed on the core part of the support roll. These heat treatments may be carried out at any stage, e.g., after the formation of a film support, after the surface treatment, after the coating of a backing layer (e.g., an antistatic agent, a lubricant), or after the coating of a subbing layer. Preferably, those heat treatments are performed after coating an antistatic agent.

Into a polyester as recited above, an ultraviolet absorbent may be kneaded. Further, dyes or pigments sold for polyester use on the market, e.g., Diaresin produced by Mitsubishi Chemical Industries, Ltd., and Kayaset produced by Nippon Kayaku Co., Ltd., can be kneaded into polyesters with the intention of prevention of light piping.

The thickness of the support which is used for the processing material of this invention is optional but a thin thickness is preferred, and the particularly preferred thickness is from 4 μm to 40 μm. In this case, since the amount of the processing material per unit volume is increased, the rolls for the processing material described above can be compacted.

There is no particular restriction on the material for the support and a material capable of enduring the processing temperature is used. In general, there are the photographic supports such as papers, synthetic polymers (films), etc., described in *Shashin Kogaku no Kiso* (*Foundation of Photographic Engineering*)—Silver Salt Photographic Chapter—, pages 223 to 240, edited by The Society of Photographic Science and Technology of Japan, published by Corona Publishing Co., Ltd., 1979. Practically, polyethylene terephthalate, polyethylene naphthalate, polycarbonate, polyvinyl chloride, polystyrene, polypropylene, polyimide, celluloses (e.g., triacetyl cellulose), the films of the foregoing polymers containing a pigment such as titanium oxide, etc., a synthetic paper prepared with polypropylene, etc., a mixed synthetic paper prepared with a synthetic resin pulp such as polyethylene, etc., and a natural pulp, a Yankee paper, a baryta paper, a coated paper (in particular, a cast coated paper), etc., are used.

These materials can be used singly or may be used as a support having laminated one surface or both the surfaces thereof with a synthetic polymer such as polyethylene.

As other supports, the supports described in JP-A-62-253159, pages 29 to 31, JP-A-1-161236, pages 14 to 17, JP-A-63-316848, JP-A-2-22651, JP-A-3-56955, U.S. Pat. No. 5,001,033, etc., can be used.

Also, the support constituted mainly of a syndiotactic styrene polymer can be used to advantage.

On the surface of the support described above may be coated a hydrophilic binder and a semiconductive metal oxide such as alumina sol, tin oxide, etc., or an antistatic agent such as carbon black, etc. The support vapor-deposited with aluminum can be preferably used.

Now, a film cartridge in which a photosensitive material can be charged is illustrated below.

The main material of a cartridge used in Present Invention (2) may be metal or synthetic plastics.

Suitable plastic materials are polystyrene, polyethylene, polypropylene, polyphenyl ether and the like. The cartridge may further contain various types of antistatic agents. Examples of an antistatic agent which can be used to advantage include carbon black, metal oxide particles, surfactants of nonionic, anionic, cationic and betaine types, and polymers. The cartridges which have undergone antistatic treatment are described in JP-A-1-312537 and JP-A-1-312538. In particular, it is preferable for the cartridge to have resistivity of not higher than $10^{12}$ Ω under the condition of 25° C.—25% RH. In general, a plastic cartridge is made from a plastic into which carbon black and pigments are kneaded in order to provide light-shielding properties. The size of cartridge may be a current 135-size, or in order to adapt to the minimization of cameras, the diameter of a cartridge may be reduced to no greater than 22 mm. Additionally, the diameter of a current 135-size cartridge is 25 mm. The volume of a cartridge case is desirably not larger than 30 $cm^3$, preferably not larger than 25 $cm^3$. The total weight of plastics used for a cartridge and the case thereof is desirably from 5 to 15 g.

Further, the cartridge used herein may have a structure such that a film is sent out by rotating a spool. Also, the cartridge may have a structure such that the top end of a film is tucked into the cartridge proper, and the film top end is sent outward from the port part of the cartridge by revolving the shaft of a spool in the film sending direction. These structures are disclosed in U.S. Pat. Nos. 4,834,306 and 5,226,613.

As for the method of printing color papers and heat developable materials by the use of the aforementioned photosensitive materials for photographing use, the methods described in JP-A-5-241251, JP-A-5-19364 and JP-A-5-19363 can be adopted.

The present invention will now be illustrated in greater detail by reference to the following examples. However, the invention should not be construed as being limited to these examples.

EXAMPLE 1

Production of Color Negative Film and Print Formation by Digital Processing

Preparation of Zinc Hydroxide Dispersion

Zinc hydroxide having an average grain size of 0.2 μm in an amount of 12.5 and a dispersant constituted of 1 g of carboxymethyl cellulose and 0.1 g of sodium polyacrylate were added to 100 ml of a 4% water solution of gelatin, and ground for 30 minutes using glass beads having an average size of 0.75 mm in a mill. Then, the glass beads were removed therefrom, and a dispersion of zinc hydroxide was obtained.

Preparation of Electron Transmitter Dispersion

The electron transmitter illustrated below in an amount of 10 g and a dispersant constituted of 0.5 g of polyethylene glycol nonyl phenyl ether and 0.5 g of the following anionic surfactant were added to a 5% water solution of gelatin, and ground for 60 minutes using glass beads having an average size of 0.75 mm in a mill. Then, the glass beads were removed therefrom, and a dispersion of electron transmitter was obtained.

Electron Transmitter

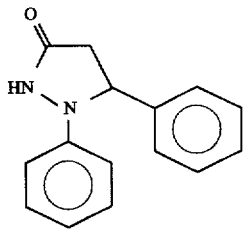

Anionic Surfactant

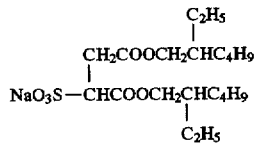

Preparation of Gelatin Dispersions of Hydrophobic Additives

Gelatin dispersions of cyan dye-providing compound, magenta dye-providing compound, yellow dye-providing compound and electron donor were prepared according to their respective formulae shown in Table 1. More specifically, in preparing each dispersion, ingredients to constitute an oily phase were mixed and dissolved by heating to about 60° C. to make a homogeneous solution, and thereto a solution of ingredients to constitute an aqueous phase which was in advance heated to about 60° C. was added with stirring. The resultant mixture was dispersed at 12000 r.p.m. for 13 minutes by means of a homogenizer, and further a prescribed amount of water was added thereto with stirring. Thus, a homogeneous dispersion was obtained.

TABLE 1

| Ingredients | Cyan | Magenta | Yellow | Electron Donor |
|---|---|---|---|---|
| [Oily Phase] | | | | |
| Reducible Dye-providing Compound (1) | 0.95 g | — | — | — |
| Reducible Dye-providing Compound (2) | 6.19 g | — | — | — |
| Reducible Dye-providing Compound (3) | — | 15.5 g | — | — |
| Reducible Dye-providing Compound (4) | — | — | 9.77 g | — |
| Electron Donor (1) | 4.36 g | 5.73 g | 4.21 g | — |
| Electron Donor (2) | — | — | — | 13.9 g |
| Electron Donor (3) | — | 0.26 g | 0.54 g | — |
| Precursor of Electron Transmitter | 1.42 g | 1.42 g | 0.86 g | — |
| Compound (1) | 0.18 g | 0.22 g | 0.21 g | — |
| Compound (2) | 1.53 g | 1.94 g | — | — |
| Compound (3) | 1.52 g | 1.94 g | — | — |
| Precursor of Development Inhibitor | — | — | — | 2.63 g |
| High Boiling Solvent (1) | 1.91 g | 1.94 g | 3.67 g | — |
| High Boiling Solvent (2) | 7.60 g | 7.73 g | 3.67 g | 2.93 g |
| High Boiling Solvent (3) | — | — | — | 2.94 g |
| Surfactant (2) | 1.55 g | 0.52 g | 1.50 g | 0.45 g |
| Ethyl Acetate | 34.5 ml | 34.5 ml | 25.0 ml | 18.0 ml |
| Methyl Ethyl Ketone | 47.5 ml | 47.5 ml | — | — |
| [Aqueous Phase] | | | | |
| Lime-processed Gelatin | 10.0 g | 10.0 g | 10.0 g | 10.0 g |
| Citric Acid | — | — | — | 0.06 g |
| Sodium Hydrogen Sulfite | — | 0.04 g | — | 0.15 g |
| Water | 150 ml | 150 ml | 120 ml | 100 ml |
| Water added | 140 ml | 160 ml | 125 ml | 65 ml |

TABLE 1-continued
Dye-providing Compound (1)
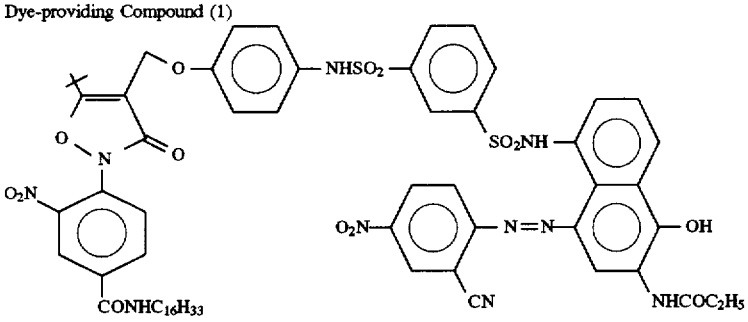
Dye-providing Compound (2)
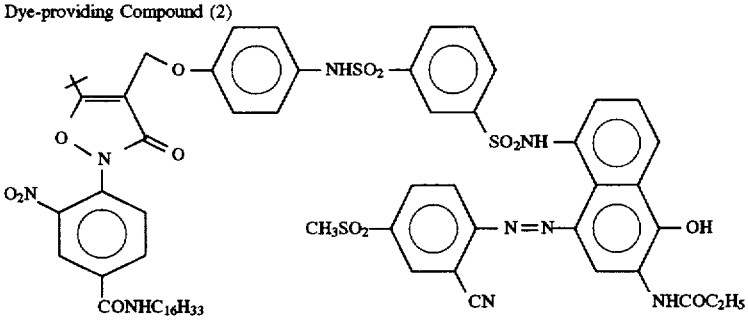
Dye-providing Compound (3)
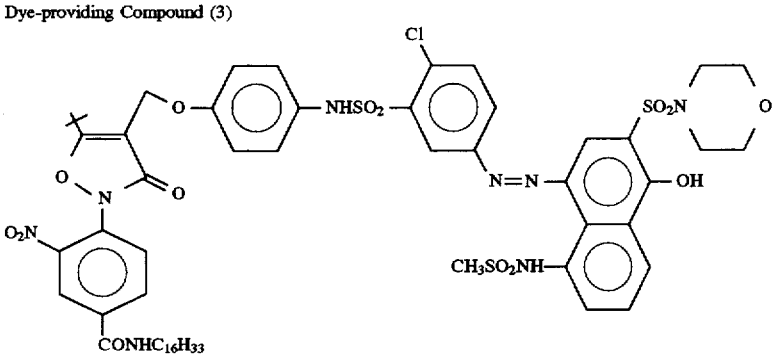
Dye-providing Compound (4)
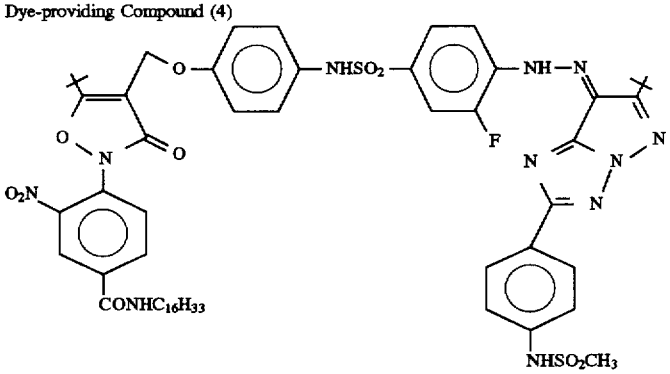
Electron Donor (1)
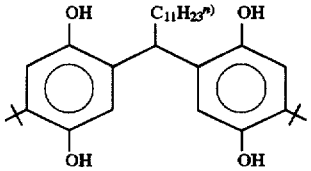

TABLE 1-continued
Electron Donor (2)
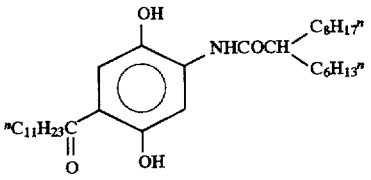
Electron Donor (3)
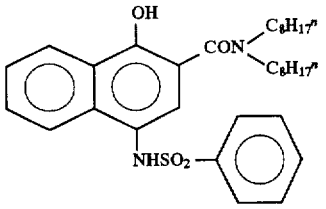
Precursor of Electron Transmitter
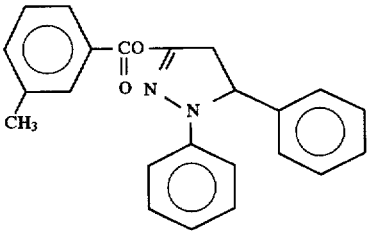
Compound (1)
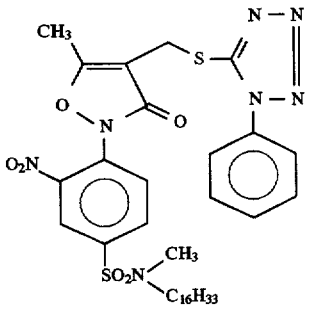
Compound (2)
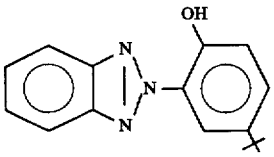
Compound (3)
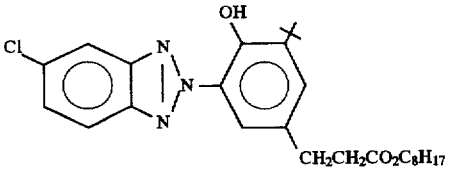
Precursor of Development Inhibitor TABLE 1-continued

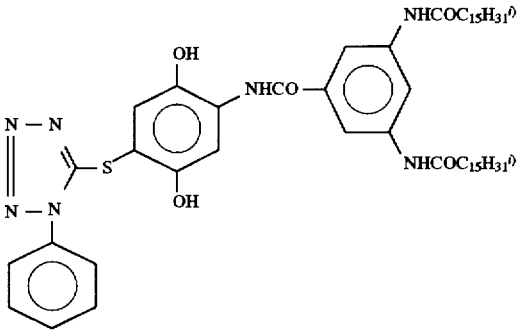

High Boiling Solvent (1)

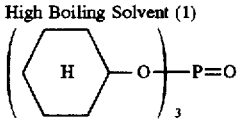

High Boiling Solvent (2)

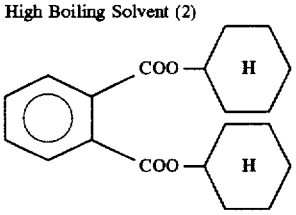

High Boiling Solvent (3)

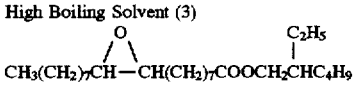

Surfactant (2)

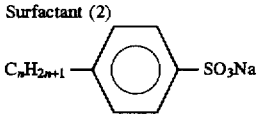

(n = about 12.6)

In the next place, the processes of preparing light-sensitive silver halide emulsions are described below:

Preparation of Light-Sensitive Emulsion (1) [for Red-Sensitive Emulsion Layer]

To a vigorously stirred aqueous gelatin solution (prepared by adding to 700 ml of water 20 g of gelatin, 0.5 g of potassium bromide, 2.5 g of sodium chloride and 15 mg of Chemical Agent (A) illustrated below, and keeping the resultant mixture at 42° C.), a silver nitrate solution (Soln. (I)) and a halide solution (Soln. (II)) set forth in Table 2 were added simultaneously over a 8-minute period at a constant flow rate. Further thereto, a dispersion of dyes in an aqueous gelatin solution (which contained in 160 ml of water 1.9 g of gelatin, 127 mg of Dye (a) illustrated below, 253 mg of Dye (b) illustrated below and 8 mg of Dye (c) illustrated below, and was kept at 35° C.) was added after an 8-minute lapse from the conclusion of the addition of Soln. (I) and Soln. (II). Two minutes later, the other silver nitrate solution (Soln. (III)) and the other halide solution (Soln. (IV)) set forth in Table 2 were furthermore added thereto simultaneously at a constant flow rate over a 32-minute period.

After performing washing and subsequent desalting steps in conventional manners, the emulsion obtained was admixed with 22 g of lime-processed ossein gelatin and the following Chemical Agent (B), adjusted to pH 6.2 and pAg 7.8, and then chemically sensitized at 68° C. to the optimum extent by adding thereto 4-hydroxy-6-methyl-1,3,3a,7-tetrazaindene first, and then sodium thiosulfate and chloroauric acid. Further, the thus sensitized emulsion was admixed with Antifoggant (1) illustrated hereinafter, 80 mg of Chemical Agent (C) and 3 g of Chemical-Agent (D), and then cooled. Thus, 635 g of a monodisperse cubic silver chlorobromide emulsion having an average grain size of 0.21 μm was obtained.

TABLE 2

Chemical Agent (A)

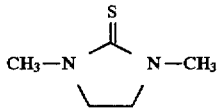

Chemical Agent (B)

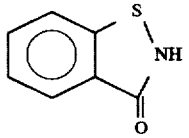

Chemical Agent (C)

TABLE 2-continued

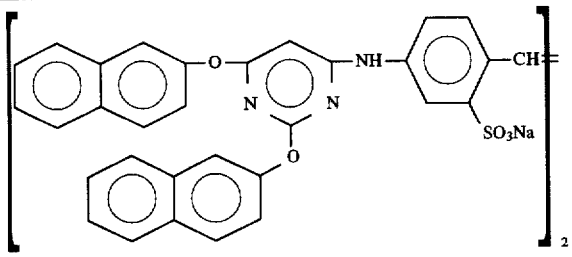

Chemical Agent (D)

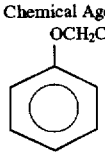

| Ingredient | Soln. (I) | Soln. (II) | Soln. (III) | Soln. (IV) |
|---|---|---|---|---|
| $AgNO_3$ | 20.0 g | — | 80.0 g | — |
| $NH_4NO_3$ | 0.19 g | — | 0.19 g | — |
| KBr | — | 9.9 g | — | 45.1 g |
| NaCl | — | 2.1 g | — | 5.4 g |
| Water to make | 110 ml | 110 ml | 250 ml | 250 ml |

Dye (a)

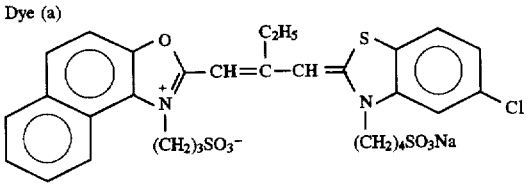

Dye (b)

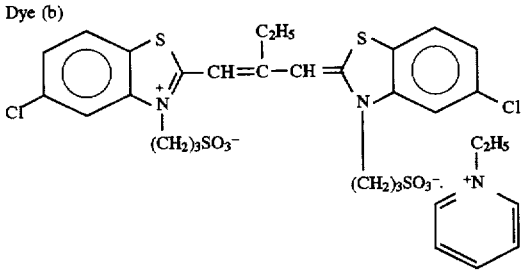

Dye (c)

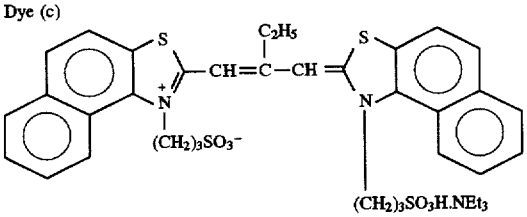

Preparation of Light-Sensitive Emulsion (2) [for Red-Sensitive Emulsion Layer]

To a vigorously stirred aqueous gelatin solution (prepared by adding to 700 ml of water 20 g of gelatin, 0.3 g of potassium bromide, 9 g of sodium chloride and 15 mg of Chemical Agent (A) illustrated above, and keeping the resultant mixture at 53° C.), a silver nitrate solution (Soln. (I)) and a halide solution (Soln. (II)) set forth in Table 3 were added simultaneously over a 10-minute period at a constant flow rate. Further thereto, a dispersion of dyes in an aqueous gelatin solution (which contained in 115 ml of water 1.2 g of gelatin, 77 mg of Dye (a) illustrated above, 153 mg of Dye (b) illustrated above and 5 mg of Dye (c) illustrated above, and was kept at 45° C.) was added after an 6-minute lapse from the conclusion of the addition of Soln. (I) and Soln. (II). Four minutes later, the other silver nitrate solution (Soln. (III)) and the other halide solution (Soln. (IV)) set forth in Table 3 were furthermore added thereto simultaneously at a constant flow rate over a 30-minute period.

After performing washing and subsequent desalting steps in conventional manners, the emulsion obtained was admixed with 33 g of lime-processed ossein gelatin and the foregoing Chemical Agent (B), adjusted to pH 6.2 and pAg 7.8, and then chemically sensitized at 68° C. to the optimum extent by adding thereto 4-hydroxy-6-methyl-1,3,3a,7-tetrazaindene first, and then sodium thiosulfate and chloroauric acid. Further, the thus sensitized emulsion was admixed with Antifoggant (1) illustrated hereinafter, 80 mg of Chemical Agent (C) and 3 g of Chemical Agent (D), and then cooled. Thus, 635 g of a monodisperse cubic silver chlorobromide emulsion having an average grain size of 0.45 μm was obtained.

TABLE 3

| Ingredient | Soln. (I) | Soln. (II) | Soln. (III) | Soln. (IV) |
|---|---|---|---|---|
| $AgNO_3$ | 20.0 g | — | 80.0 g | — |
| $NH_4NO_3$ | 0.19 g | — | 0.19 g | — |
| KBr | — | 12.2 g | — | 42.0 g |
| NaCl | — | 2.6 g | — | 5.2 g |
| Water to make | 120 ml | 120 ml | 225 ml | 225 ml |

Preparation of Light-Sensitive Emulsion (3) [for Green-Sensitive Emulsion Layer]

To a vigorously stirred aqueous gelatin solution (prepared by adding to 690 ml of water 20 g of gelatin, 0.5 g of potassium bromide, 5 g of sodium chloride and 15 mg of Chemical Agent (A) illustrated above, and keeping the resultant mixture at 41° C.), a silver nitrate solution (Soln. (I)) and a halide solution (Soln. (II)) set forth in Table 4 were added simultaneously over a 8-minute period at a constant flow rate. Ten minutes later, the other silver nitrate solution (Soln. (III)) and the other halide solution (Soln. (IV)) set forth in Table 4 were further added thereto simultaneously at a constant flow rate over a 32-minute period. After a 1-minute lapse from the conclusion of the addition of Soln. (III) and Soln. (IV), furthermore thereinto was poured a methanol solution of dye (which contained 280 mg of Dye (d) illustrated below in 47 ml of methanol, and was kept at 30° C.).

After performing washing and subsequent desalting steps in conventional manners, the emulsion obtained was admixed with 22 g of lime-processed ossein gelatin, 50 mg of Chemical Agent (B) illustrated hereinbefore and 3 g of Chemical Agent (D) illustrated hereinbefore, adjusted to pH 6.0 and pAg 7.1, and then chemically sensitized at 60° C. to the optimum extent by adding thereto 4-hydroxy-6-methyl-1,3,3a,7-tetrazaindene first, and then sodium thiosulfate. Further, the thus sensitized emulsion was admixed with Antifoggant (1) illustrated hereinafter, and then cooled. Thus, 635 g of a monodisperse cubic silver chlorobromide emulsion having an average grain size of 0.23 mm was obtained.

TABLE 4

| Ingredient | Soln. (I) | Soln. (II) | Soln. (III) | Soln. (IV) |
|---|---|---|---|---|
| $AgNO_3$ | 20.0 g | — | 80.0 g | — |
| $NH_4NO_3$ | 0.06 g | — | 0.06 g | — |
| KBr | — | 4.9 g | — | 22.6 g |
| NaCl | — | 4.5 g | — | 16.6 g |
| $K_2IrCl_4$ | — | 0.008 mg | — | — |
| Water to make | 110 ml | 110 ml | 240 ml | 240 ml |

Dye (d)

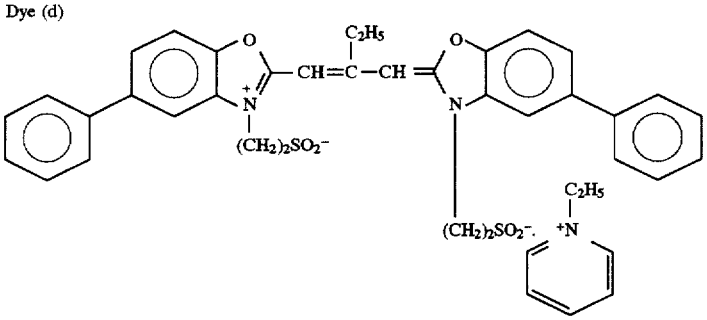

Preparation of Light-Sensitive Emulsion (4) [for Green-Sensitive Emulsion Layer]

To a vigorously stirred aqueous gelatin solution (prepared by adding to 710 ml of water 20 g of gelatin, 0.3 g of potassium bromide, 9 g of sodium chloride and 7.5 mg of Chemical Agent (A) illustrated hereinbefore, and keeping the resultant mixture at 63° C.), a silver nitrate solution (Soln. (I)) and a halide solution (Soln. (II)) set forth in Table 5 were added simultaneously over a 10-minute period at a constant flow rate. Ten minutes later, the other silver nitrate solution (Soln. (III)) and the other halide solution (Soln. (IV)) set forth in Table 5 were further added thereto simultaneously at a constant flow rate over a 20-minute period. After a 1-minute lapse from the conclusion of the addition of Soln. (III) and Soln. (IV), furthermore thereinto was poured a methanol solution of dyes (which contained 210 mg of Dye (d-1) and 42.7 mg of Dye (d-2) illustrated below in 35 ml of methanol, and was kept at 46° C.).

After performing washing and subsequent desalting steps in conventional manners, the emulsion obtained was admixed with 33 g of lime-processed ossein gelatin, 50 mg of Chemical Agent (B) illustrated hereinbefore and 3 g of Chemical Agent (D) illustrated hereinbefore, adjusted to pH 6.0 and pAg 7.2, and then chemically sensitized at 60° C. to the optimum extent by adding thereto 4-hydroxy-6-methyl-1,3,3a,7-tetrazaindene first, and then sodium thiosulfate and chloroauric acid. Further, the thus sensitized emulsion was admixed with Antifoggant (1) illustrated hereinafter, and then cooled. Thus, 635 g of a monodisperse cubic silver chlorobromide emulsion having an average grain size of 0.45 μm was obtained.

TABLE 5

| Ingredient | Soln. (I) | Soln. (II) | Soln. (III) | Soln. (IV) |
|---|---|---|---|---|
| $AgNO_3$ | 25.0 g | — | 75.0 g | — |
| $NH_4NO_3$ | 0.06 g | — | 0.06 g | — |
| KBr | — | 6.2 g | — | 21.1 g |
| NaCl | — | 5.6 g | — | 15.5 g |
| $K_4[Fe(CN)_6]$ | — | — | — | 4 mg |
| Water to make | 120 ml | 120 ml | 225 ml | 225 ml |

Dye (d-1)

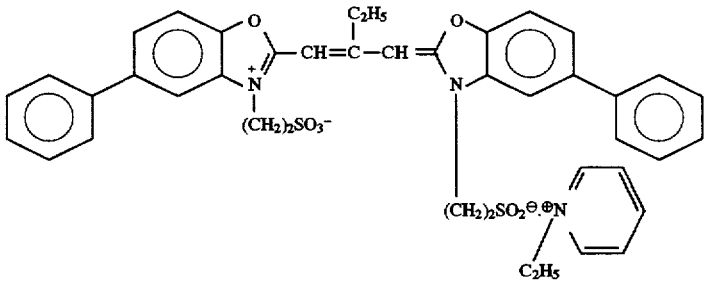

TABLE 5-continued

Dye (d-2)

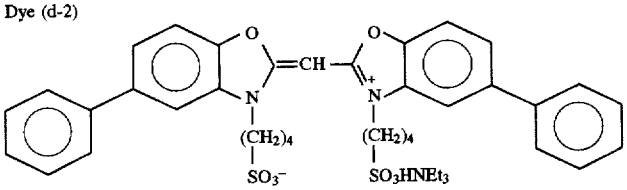

Preparation of Light-Sensitive Emulsion (5) [for Blue-Sensitive Emulsion Layer]

To a vigorously stirred aqueous gelatin solution (prepared by adding to 690 ml of water 20 g of gelatin, 0.5 g of potassium bromide, 5 g of sodium chloride and 15 mg of Chemical Agent (A) illustrated hereinbefore, and keeping the resultant mixture at 46° C.), a silver nitrate solution (Soln. (I)) and a halide solution (Soln. (II)) set forth in Table 6 were added simultaneously over a 8-minute period at a constant flow rate. Ten minutes later, the other silver nitrate solution (Soln. (III)) and the other halide solution (Soln. (IV)) set forth in Table 6 were further added thereto simultaneously at a constant flow rate over a 18-minute period. After a 1-minute lapse from the conclusion of the addition of Soln. (III) and Soln. (IV), furthermore thereinto was poured an aqueous solution of dyes (which contained 225 mg of Dye (e) and 225 mg of Dye (f) illustrated below in the mixture of 95 ml of water with 5 ml of methanol, and was kept at 30° C.).

After performing washing and subsequent desalting steps in conventional manners, the emulsion obtained was admixed with 22 g of lime-processed ossein gelatin, 50 mg of Chemical Agent (B) illustrated hereinbefore and 3 g of Chemical Agent (D) illustrated hereinbefore, adjusted to pH 6.0 and pAg 7.7, and then chemically sensitized at 65° C. to the optimum extent by adding thereto 4-hydroxy-6-methyl-1,3,3a,7-tetrazaindene first, and then sodium thiosulfate. Further, the thus sensitized emulsion was admixed with Antifoggant (1) illustrated hereinafter, and then cooled. Thus, 635 g of a monodisperse cubic silver chlorobromide emulsion having an average grain size of 0.27 μm was obtained.

TABLE 6

| Ingredient | Soln. (I) | Soln. (II) | Soln. (III) | Soln. (IV) |
|---|---|---|---|---|
| $AgNO_3$ | 20.0 g | — | 80.0 g | — |
| $NH_4NO_3$ | 0.06 g | — | 0.06 g | — |
| KBr | — | 9.9 g | — | 45.0 g |
| NaCl | — | — | — | 7.6 g |
| $K_4[Fe(CN)_6]$ | — | — | — | 7 mg |
| Water to make | 110 ml | 110 ml | 240 ml | 240 ml |

Dye (e)

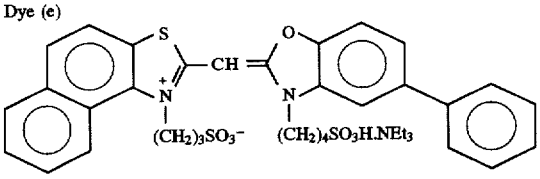

TABLE 6-continued

Dye (f)

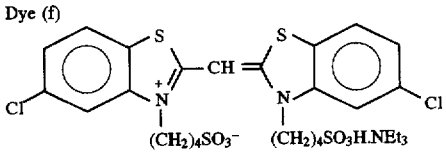

Preparation of Light-Sensitive Emulsion (6) [for Blue-Sensitive Emulsion Layer]

To a vigorously stirred aqueous gelatin solution (prepared by adding to 710 ml of water 20 g of gelatin, 0.3 g of potassium bromide, 9 g of sodium chloride and 15 mg of Chemical Agent (A) illustrated hereinbefore, and keeping the resultant mixture at 59° C.), a silver nitrate solution (Soln. (I)) and a halide solution (Soln. (II)) set forth in Table 7 were added simultaneously over a 8-minute period at a constant flow rate. Ten minutes later, the other silver nitrate solution (Soln. (III)) and the other halide solution (Soln. (IV)) set forth in Table 7 were further added thereto simultaneously at a constant flow rate over a 18-minute period. After a 1-minute lapse from the conclusion of the addition of Soln. (III) and Soln. (IV), furthermore thereinto was poured an aqueous solution of dyes (which contained 113 mg of Dye (e) and 113 mg of Dye (f) illustrated above in the mixture of 82 ml of water with 6 ml of methanol, and was kept at 40° C.).

After performing washing and subsequent desalting steps in conventional manners, the emulsion obtained was admixed with 33 g of lime-processed ossein gelatin, 50 mg of Chemical Agent (B) illustrated hereinbefore and 3 g of Chemical Agent (D) illustrated hereinbefore, adjusted to pH 6.0 and pAg 7.7, and then chemically sensitized at 65° C. to the optimum extent by adding thereto $^4$-hydroxy-6-methyl-1,3,3a,7-tetrazaindene first, and then sodium thiosulfate and chloroauric acid. Further, the thus sensitized emulsion was admixed with Antifoggant (1) illustrated hereinafter, and then cooled. Thus, 635 g of a monodisperse cubic silver chlorobromide emulsion having an average grain size of 0.47 μm was obtained.

TABLE 7

| Ingredient | Soln. (I) | Soln. (II) | Soln. (III) | Soln. (IV) |
|---|---|---|---|---|
| $AgNO_3$ | 20.0 g | — | 80.0 g | — |
| $NH_4NO_3$ | 0.06 g | — | 0.06 g | — |
| KBr | — | 10.0 g | — | 45.0 g |
| NaCl | — | 4.2 g | — | 5.5 g |
| Water to make | 100 ml | 100 ml | 260 ml | 260 ml |

Photosensitive Material 101 was produced so as to have the constitution shown in Table 8 using the above-described dispersions and emulsions, and further additives illustrated hereinafter. As for the coverage rate set forth in Table 8, the figure corresponding to each silver halide emulsion represents the coverage rate based on silver.

TABLE 8

Constitution of Photosensitive Material 101

| Ordinal number of layer | Name of layer | Ingredients | Coverage rate (mg/m²) |
|---|---|---|---|
| 7th | Protective layer II | Acid-processed gelatin | 340 |
| | | PMMA latex (size: 3μ) | 15 |
| | | Colloidal silver | 0.8 |
| | | Surfactant (3) | 8 |
| | | Fluorine-containing Surfactant | 5 |
| | | Calcium nitrate | 6 |
| 6th | Protective layer I | Lime-processed gelatin | 640 |
| | | Zinc hydroxide | 420 |
| | | Electron Donor (2) | 87 |
| | | Precursor of Development Inhibitor | 16 |
| | | High Boiling Solvent (2) | 18 |
| | | High Boiling Solvent (3) | 18 |
| | | Dextran | 18 |
| | | Water-soluble Polymer (1) | 3 |
| | | Surfactant (4) | 20 |
| | | Surfactant (2) | 3 |
| 5th | Blue-sensitive emulsion layer | Light-sensitive silver halide emulsion (5) | 440 |
| | | Light-sensitive silver halide emulsion (6) | 135 |
| | | Reducible Dye-providing Compound (4) | 300 |
| | | Gelatin | 615 |
| | | Electron Donor (1) | 127 |
| | | Electron Donor (3) | 16 |
| | | Precursor of Electron Transmitter | 26 |
| | | Compound (1) | 6 |
| | | High Boiling Solvent (1) | 110 |
| | | High Boiling Solvent (2) | 110 |
| | | Surfactant (2) | 45 |
| | | Antifoggant (1) | 1.2 |
| | | Water-soluble Polymer (1) | 23 |
| 4th | Interlayer | Lime-processed gelatin | 530 |
| | | Electron Donor (2) | 140 |
| | | Precursor of Development Inhibitor | 27 |
| | | High Boiling Solvent (2) | 30 |
| | | High Boiling Solvent (3) | 30 |
| | | Surfactant (2) | 4 |
| | | Electron Transmitter | 67 |
| | | Dextran | 36 |
| | | Hardener | 43 |
| | | Surfactant (4) | 10 |
| | | Water-soluble Polymer (1) | 20 |
| 3rd | Green-sensitive emulsion layer | Light-sensitive silver halide emulsion (3) | 280 |
| | | Light-sensitive silver halide emulsion (4) | 110 |
| | | Reducible Dye-providing Compound (3) | 366 |
| | | Lime-processed gelatin | 460 |
| | | Electron Donor (1) | 136 |
| | | Electron Donor (3) | 6 |
| | | Precursor of Electron Transmitter | 34 |
| | | Compound (1) | 6 |
| | | Compound (2) | 46 |
| | | Compound (3) | 46 |
| | | High Boiling Solvent (1) | 46 |
| | | High Boiling Solvent (2) | 183 |
| | | Antifoggant (1) | 1.0 |
| | | Water-soluble Polymer (1) | 16 |
| | | Surfactant (2) | 8 |
| 2nd | Interlayer | Lime-processed gelatin | 1060 |
| | | Zinc hydroxide | 700 |
| | | Electron Donor (2) | 140 |
| | | Precursor of Development Inhibitor | 27 |
| | | High Boiling Solvent (2) | 30 |
| | | High Boiling Solvent (3) | 30 |
| | | Surfactant (2) | 5 |
| | | Dextran | 30 |
| | | Water-soluble Polymer (1) | 5 |
| | | Surfactant (4) | 33 |
| 1st | Red-sensitive emulsion layer | Light-sensitive silver halide emulsion (1) | 145 |
| | | Light-sensitive silver halide emulsion (2) | 80 |
| | | Reducible Dye-providing Compound (1) | 188 |
| | | Reducible Dye-providing Compound (2) | 128 |
| | | Lime-processed gelatin | 322 |
| | | Electron Donor (1) | 90 |
| | | Precursor of Electron Transmitter | 29 |
| | | Compound (1) | 4 |
| | | Compound (2) | 31 |
| | | Compound (3) | 31 |
| | | High Boiling Solvent (1) | 39 |
| | | High Boiling Solvent (2) | 158 |
| | | Antifoggant (1) | 0.7 |
| | | Water-soluble Polymer (1) | 12 |
| | | Surfactant (2) | 22 |
| Support: | Polyethylene naphthalate base provided with a gelatin subbing layer (thickness: 100 μm) | | |

Surfactant (3)

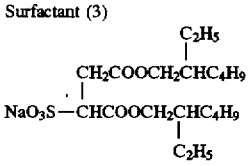

Surfactant (4)

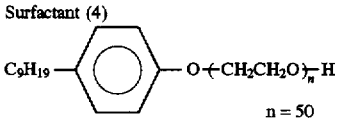

Antifoggant (1)

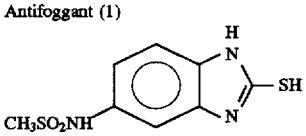

Fluorine-containing Surfactant

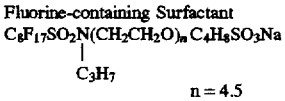

Water-soluble Polymer (1)

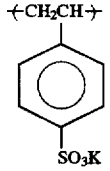

Hardener (1)

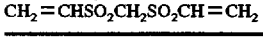

Processing Sheet R101 was formed in the following manner:

Preparation of Dispersion of Additive (2)

In 100 g of High Boiling Solvent (1), 1 g of an Additive (2) and 1.2 g of anionic Surfactant (3) were dissolved under heating at 50° C. Separately, 60 g of lime-processed gelatin was swollen with 300 ml of water purified by ion exchangers, and then dissolved therein at 70° C., followed by addition of antiseptics thereto. These solutions were mixed at 40° C., and dispersed in the form of emulsion by means of an ultrasonic dispersing apparatus. Thus, an emulsified dispersion of Additive (2) having an average particle size of 0.1–1M was obtained.

The thus prepared dispersion and ingredients set forth in Table 9 were coated so as to have a constitution shown in Table 9 on Support A having a constitution shown in Table 10, thereby producing Processing Sheet R101.

TABLE 9

Constitution of Processing Sheet R101

| Ordinal No. of Layer | Ingredients | Coverage Rate (mg/m²) |
|---|---|---|
| 4th | Acid-processed gelatin | 220 |
| | Water-soluble Polymer (2) | 60 |
| | Water-soluble Polymer (3) | 200 |
| | Additive (1) | 80 |
| | Colloidal silver | 5 |
| | Potassium nitrate | 12 |
| | Matting Agent (1) | 10 |
| | Anionic Surfactant (1) | 7 |
| | Anionic Surfactant (2) | 7 |
| | Amphoteric Surfactant (1) | 10 |
| 3rd | Lime-processed gelatin | 240 |
| | Water-soluble Polymer (3) | 24 |
| | Hardener (2) | 180 |
| | Anionic Surfactant (3) | 9 |
| 2nd | Lime-processed gelatin | 2400 |
| | Water-soluble Polymer (3) | 120 |
| | Water-soluble Polymer (4) | 2400 |
| | Water-soluble Polymer (5) | 700 |
| | Water-soluble Polymer (6) | 600 |
| | Additive (2) | 20 |
| | Guanidine picolinate | 2910 |
| | Potassium quinolinate | 225 |
| | Sodium quinolinate | 180 |
| | Anionic Surfactant (3) | 24 |
| 1st | Gelatin | 280 |
| | Water-soluble Polymer (2) | 12 |
| | Anionic Surfactant (1) | 14 |
| | Hardener (2) | 185 |
| Support: | PET Support A (thickness: 63 μm) | |

TABLE 10

Constitution of Support A

| Name of Layer | Ingredient | Coverage Rate (mg/m²) |
|---|---|---|
| Front Surface Layer | Gelatin | 100 |
| Polymer Layer | Polyethylene terephthalate | 62500 |
| Back Surface Layer | Copolymer of methylmethacrylate, styrene, 2-ethylhexylacrylate and methacrylic acid | 1000 |
| | PMMA latex (average particle size: 12μ) | 120 |
| | total: | 63720 |

Water-soluble Polymer (2)
κ-Carrageenan
Water-soluble Polymer (3)
Sumikagel L5H (trade name, produced by Sumitomo Chemical Co., Ltd.)
Water-soluble Polymer (4)

TABLE 10-continued

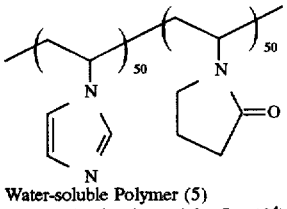

Water-soluble Polymer (5)
Dextran (molecular weight: $7 \times 10^4$)
Water-soluble Polymer (6)
MP Polymer MP102 (trade name, produced by Kuraray Co., Ltd.)
Additive (1)

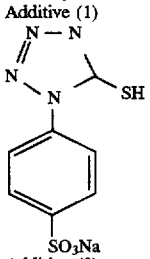

Additive (2)

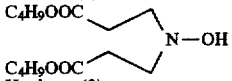

Hardener (2)

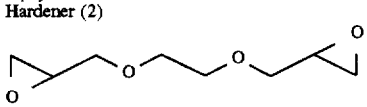

Anionic Surfactant (1)

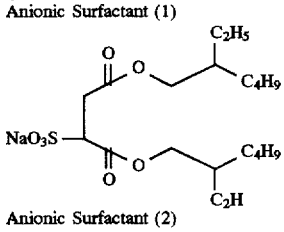

Anionic Surfactant (2)

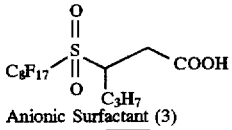

Anionic Surfactant (3)

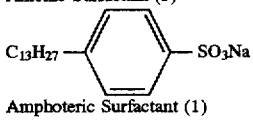

Amphoteric Surfactant (1)

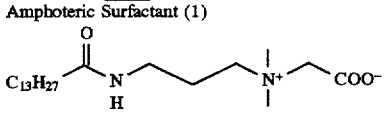

Matting Agent (1)
SYLOID 79 (trade name, produced by Fuji Davison)

Photosensitive Material 101 was cut into pieces having the form of 35mm-size roll film for general color negative, and subjected to a perforation operation. Then, a camera was loaded with this film, and figure photographs were taken therewith.

The photosensitive material exposed was dipped in water kept at 40° C. for 2.5 seconds, and then squeegeed with a roller. Immediately thereafter, the photosensitive material was brought into face-to-face contact with Processing Sheet R101.

The thus superposed matter was heated for 17 seconds by the use of a heating drum whose temperature was controlled so that the water-absorbed surface of the photosensitive material had a temperature of 80° C., and then the processing sheet was peeled from the photosensitive material. As a result, negative images of the photographed figures were obtained on the photosensitive material.

After the processing, the image information of the photosensitive material was read with a negative film scanner using diffused light as reading light (Topaz, made by Linotype.Hel Co., Ltd.), and transferred to Macintosh Quadra 840AV, made by Apple Computer. The digital information thus obtained was subjected to image processing, and transmitted to PICTROGRAPHY 3000 (made by Fuji Photo Film Co., Ltd.). In this apparatus, image formation was performed using the heat developable photosensitive material No. 107 described in Example 1 of JP-A-6-337510 and a sheet having the same constitution as the foregoing Processing Sheet R101 as an image receiving material. Thus, Print 1 having figure images was obtained.

Another image formation was carried out in the same manner as described above, except that a drum scanner designed so as to use specular light as reading light (CELSIS 360, made by Crosfield Co., Ltd.) was employed for reading the image formation of the processed photosensitive material. Thus, Print 2 having figure images was obtained.

Compared with Print 2, Print 1 underwent less deterioration in graininess due to residual silver halide and developed silver, so that Print 1 proved to be excellent as print.

EXAMPLE 2

Production of Color Positive Film and Print Formation by Digital Processing

The process of producing a color positive film and the method of printing a positive image obtained by photographing are illustrated below.

Preparation of Gelatin Dispersion of Compound (d)

A homogeneous solution of Compound (d) was prepared by weighing out 0.4 g of Compound (d), 1.2 g of High Boiling Solvent (1), 0.12 g of Compound (f), 0.25 g of Compound (g), 0.05 g of Compound (h) and 0.2 g of Surfactant (11), adding thereto 9.5 ml of ethyl acetate, and heating them to about 60° C. This solution and 29.1 g of a 18% solution of lime-processed gelatin were mixed with stirring. The resultant mixture was dispersed at 10000 r.p.m. for 10 minutes by means of a homogenizer. The dispersion thus obtained was diluted with 18.5 ml of water. This dispersion was named Dispersion of Compound (d).

Compound (d)

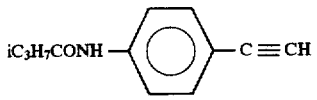

High Boiling Solvent (1)

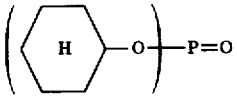

-continued

Compound (f)

$C_{26}H_{46.9}Cl_{7.1}$

Compound (g)

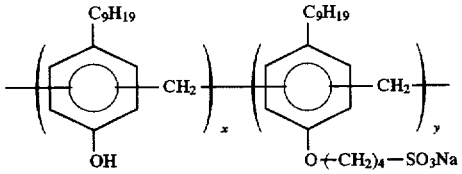

x/y = 58/42

Surfactant (11)

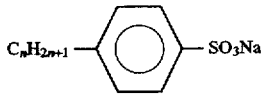

n = 12.6

Compound (h)

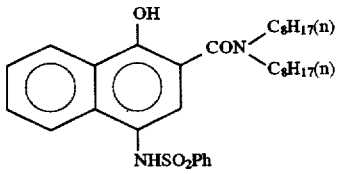

Gelatin dispersions of dye-providing compounds were prepared in the following manners, respectively:

A homogeneous solution of cyan dye-providing compounds was prepared by weighing out 7.3 g of Cyan Dye-providing Compound (A1), 11.0 g of Cyan Dye-providing Compound (A2), 0.8 g of Surfactant (11), 1 g of Compound (h), 2.2 g of Compound (i), 7 g of High Boiling Solvent (1) and 3 g of High Boiling Solvent (2), adding thereto 26 ml of ethyl acetate and 1.2 ml of water, and heating them to about 60° C. This solution, 65 g of a 16% solution of lime-processed gelatin and 87 ml of water were mixed with stirring. The resultant mixture was dispersed at 10000 r.p.m. for 10 minutes by means of a homogenizer. The dispersion thus obtained was diluted with 216 ml of water. This dispersion was named Dispersion of Cyan Dye-providing Compounds.

Cyan Dye-providing Compound (Al)

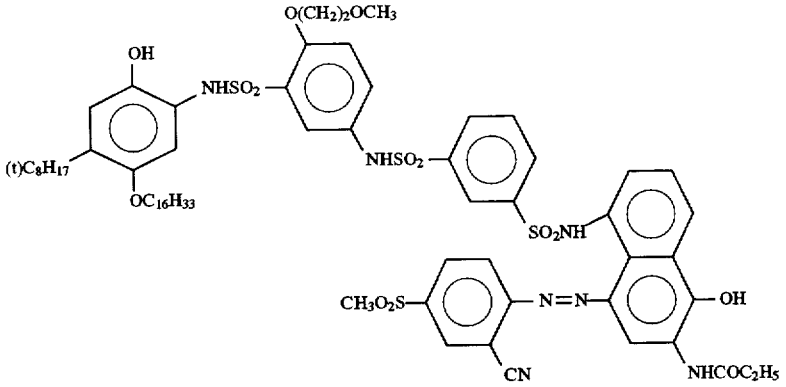

Cyan Dye-providing Compound (A2)

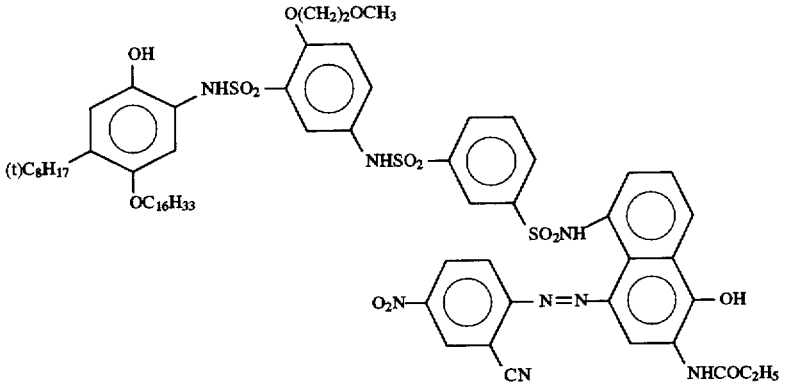

Compound (i)

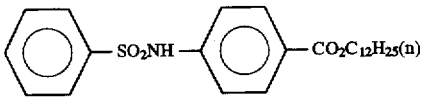

High Boiling Solvent (2)

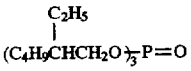

A homogeneous solution of magenta dye-providing compound was prepared by weighing out 4.50 g of Magenta Dye-providing Compound (B), 0.05 g of Compound (m), 0.05 g of Compound (h), 0.094 g of Surfactant (11) and 2.25 g of High Boiling Solvent (2), adding thereto 10 ml of ethyl acetate, and heating them to about 60° C. This solution, 15.2 g of a 16% solution of lime-processed gelatin and 23.5 ml of water were mixed with stirring. The resultant mixture was dispersed at 10000 r.p.m. for 10 minutes by means of a homogenizer. The dispersion thus obtained was diluted with 42 ml of water. This dispersion was named Dispersion of Magenta Dye-providing Compound.

Magenta Dye-providing Compound (B)

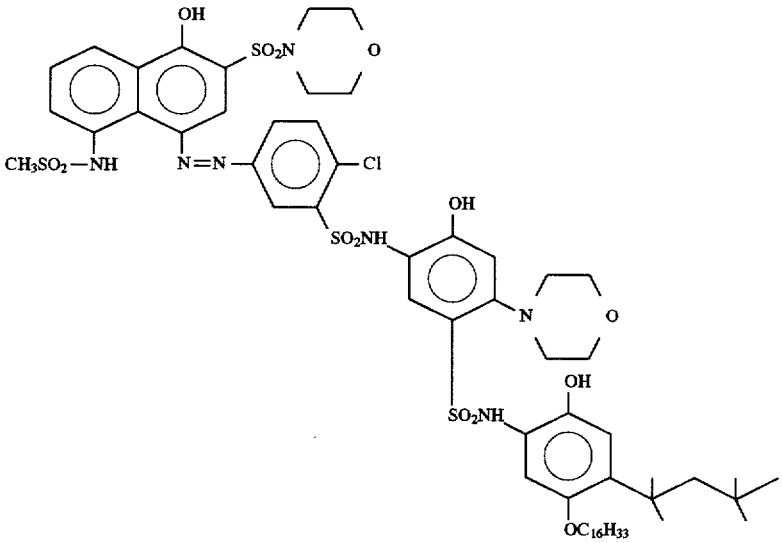

Compound (m)

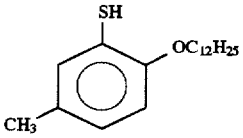

A homogeneous solution of yellow dye-providing compound was prepared by weighing out 15 g of Yellow Dye-providing Compound (C), 2.3 g of Compound (d), 0.9 g of Compound (h), 0.88 g of Surfactant (11), 3.9 g of Compound (j), 1.9 g of Compound (k) and 16.9 g of High Boiling Solvent (l), adding thereto 49 ml of ethyl acetate, and heating them to about 60° C. This solution, 63.5 g of a 16% solution of lime-processed gelatin and 103 ml of water were mixed with stirring. The resultant mixture was dispersed at 10000 r.p.m. for 10 minutes by means of a homogenizer. The dispersion thus obtained was diluted with 94 ml of water. This dispersion was named Dispersion of Yellow Dye-providing Compound.

Yellow Dye-providing Compound (C)

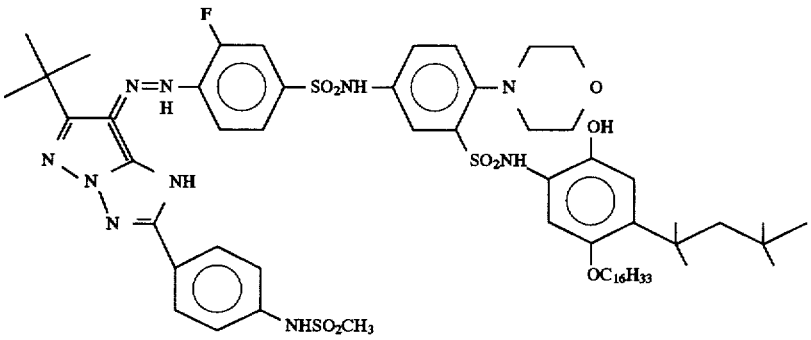

Compound (j)

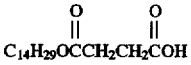

-continued

Compound (k)

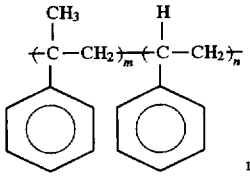

m/n = about 9/1

Using the above-described dispersions, a heat-developable Photosensitive Material 102 was produced so as to have the constitution shown in Table 11. As for the coverage rate set forth in Table 11, the figure corresponding to each silver halide emulsion represents the coverage rate based on silver.

TABLE 11

Constitution of Photosensitive Material 102

| Ordinal number of layer | Name of layer | Ingredients | Coverage rate ($g/m^2$) |
|---|---|---|---|
| 7th | Protective layer | Acid-processed gelatin | 0.387 |
| | | PMMA Matting agent | 0.017 |
| | | Surfactant (12) | 0.006 |
| | | Surfactant (13) | 0.016 |
| 6th | Interlayer | Gelatin | 0.763 |
| | | Zinc hydroxide | 20.558 |
| | | Compound (d) | 0.036 |
| | | Compound (f) | 0.011 |
| | | Compound (g) | 0.022 |
| | | Compound (h) | 0.005 |
| | | High Boiling Solvent (1) | 0.107 |
| | | $Ca(NO_3)_2$ | 0.012 |
| | | Surfactant (13) | 0.022 |
| | | Water-soluble Polymer (1) | 0.003 |
| 5th | Blue-sensitive emulsion | Silver Halide Emulsion (6) | 0.200 |
| | | Silver Halide Emulsion (5) | 0.199 |
| | | Gelatin | 0.532 |
| | | Yellow Dye-providing Compound (C) | 0.348 |
| | | Compound (d) | 0.054 |
| | | Compound (h) | 0.021 |
| | | Compound (j) | 0.091 |
| | | Compound (k) | 0.045 |
| | | High Boiling Solvent (1) | 0.391 |
| | | Surfactant (11) | 0.021 |
| | | Water-soluble Polymer (1) | 0.006 |
| 4th | Interlayer | Gelatin | 0.467 |
| | | Zinc Hydroxide | 20.341 |
| | | Surfactant (13) | 0.001 |
| | | Compound (d) | 0.022 |
| | | Compound (f) | 0.007 |
| | | Compound (g) | 0.014 |
| | | Compound (h) | 0.003 |
| | | High Boiling Solvent (1) | 0.066 |
| | | $Ca(NO_3)_2$ | 0.008 |
| | | Surfactant (11) | 0.014 |
| | | Water-soluble Polymer (1) | 0.002 |
| 3rd | Green-sensitive emulsion layer | Silver Halide Emulsion (4) | 0.134 |
| | | Silver Halide Emulsion (3) | 0.100 |
| | | Gelatin | 0.311 |
| | | Magenta Dye-providing Compound (B) | 0.357 |
| | | Compound (m) | 0.004 |
| | | Compound (h) | 0.004 |
| | | High Boiling Solvent (2) | 0.178 |
| | | Surfactant (11) | 0.010 |
| | | Water-soluble Polymer (1) | 0.008 |
| 2nd | Interlayer | Gelatin | 0.513 |
| | | Surfactant (12) | 0.069 |
| | | Surfactant (13) | 0.007 |
| | | Compound (d) | 0.022 |

TABLE 11-continued

| | | | |
|---|---|---|---|
| | | Compound (f) | 0.007 |
| | | Compound (g) | 0.014 |
| | | Compound (h) | 0.003 |
| | | High Boiling Solvent (1) | 0.066 |
| | | $Ca(NO_3)_2$ | 0.004 |
| | | Water-soluble Polymer (1) | 0.020 |
| 1st | Red-sensitive emulsion | Silver halide emulsion (2) | 0.090 |
| | | Silver halide emulsion (1) | 0.070 |
| | | Gelatin | 0.294 |
| | | Cyan Dye-providing Compound (A1) | 0.141 |
| | | Cyan Dye-providing Compound (A2) | 0.211 |
| | | Compound (i) | 0.041 |
| | | Compound (h) | 0.020 |
| | | High Boiling Solvent (1) | 0.060 |
| | | High Boiling Solvent (2) | 0.138 |
| | | Surfactant (11) | 0.015 |
| | | Water-soluble Polymer (1) | 0.017 |
| | | Hardener (1) | 0.035 |

Support: Polyethylene naphthalate base provided with a gelatin subbing layer (thickness: 100 μm)

Surfactant (11)

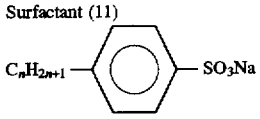

n = 12.6

Surfactant (12)

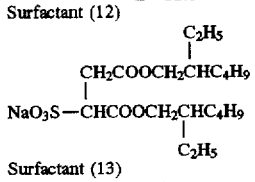

Surfactant (13)

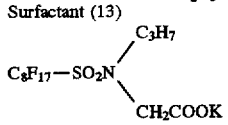

Photosensitive Material 102 was cut into pieces having the form of general 35 mm-size color reversal film, and subjected to a perforation operation. Then, a camera was loaded with this film, and figure photographs were taken therewith.

The photosensitive material exposed was dipped in water kept at 40° C. for 2.5 seconds, and then squeegeed with a roller. Immediately thereafter, the photosensitive material was brought into face-to-face contact with Processing Sheet R101.

The thus superposed matter was heated for 30 seconds by the use of a heating drum whose temperature was controlled so that the water-absorbed surface of the photosensitive material had a temperature of 83° C., and then the processing sheet was peeled from the photosensitive material. As a result, positive images of the photographed figures were obtained on the photosensitive material.

After the processing, the image information of the photosensitive material was read with a negative film scanner using diffused light as reading light (e.g., Topaz, made by Linotype.Hel Co., Ltd.), and transferred to Macintosh Quadra 840AV, made by Apple Computer. The digital information thus obtained was subjected to image processing, and transmitted to PICTROGRAPHY 3000 (made by Fuji Photo Film Co., Ltd.). Thus, Print 3 having figure images was obtained.

Another image formation was carried out in the same manner as described above, except that a drum scanner designed so as to use specular light as reading light (CELSIS 360, made by Crosfield Co., Ltd.) was employed for reading the image formation of the processed photosensitive material. Thus, Print 4 having figure images was obtained.

Compared with Print 4, Print 3 underwent less deterioration in graininess due to residual silver halide and developed silver, so that Print 3 proved to be excellent as print.

Additionally, in the photosensitive material used herein, a difference in absorbance between each of the coloring materials and the dye provided thereby was not greater than 8% at the maximum absorption wavelength of the dye.

EXAMPLE 3

Activator Processing and Print Formation by Projection Exposure

The figure-photographed film obtained using the photosensitive material 102 was processed with the following activator solution for 1 minute at 40° C.

Activator Solution

| | |
|---|---|
| Tetramethylammonium hydroxide (25%) | 80 ml |
| Water to make | 1 l |
| pH adjusted to | 13.3 |

Figure images were printed on a reversal color paper, Fuji Chrome Paper Type 35, via the positive images obtained above. Then, the print obtained was subjected to RP303 processing. Thus, images of excellent color reproduction were obtained.

EXAMPLE 4

A water solution containing 30 g of inert gelatin and 6 g of potassium bromide in 1 l of distilled water was stirred at 75° C., and thereto 35 ml of a water solution in which 5.0 g of silver nitrate was dissolved and 35 ml of a water solution in which 3.2 g of potassium bromide and 0.98 g of potassium iodide were dissolved were added simultaneously over a 30-second period at a flow rate of 70 ml/minute. Thereafter, the pAg was raised to 10, and ripened for 30 minutes to prepare a seed emulsion.

Further thereto, a prescribed portion of 1 l of a water solution containing 145 g of silver nitrate and a water solution containing a potassium bromide-potassium iodide mixture were added in equimolecular amounts at a definite temperature and a definite pAg with an addition speed close to the critical growth speed, thereby making a tabular core emulsion. Furthermore thereto, the residual portion of the water solution of silver nitrate and a water solution containing a potassium bromide-potassium iodide mixture different in composition from the mixture used in the preparation of the core emulsion were added in equimolecular amounts with an addition speed close to the critical growth speed, and thereby covering of each core grain was effected. Thus, a core/shell type tabular silver iodobromide Emulsion (1) shown in Table 12 was prepared.

TABLE 12

| Emulsion (1) | |
|---|---|
| Aspect ratio | 1.2 |
| Average grain size | 0.88 μm |
| Average grain thickness | 0.72 μm |
| Average iodide content | 7.6 mol % |
| Percentage of grains having an aspect ratio of 2 or more to 1,000 emulsion grains | 21.3% |

*the aspect ratio determined by averaging the data of 1,000 emulsion grains.

Additionally, emulsion grains having a diameter smaller than 0.1 μm were not observed in Emulsion (1).

A sample described below was produced using Emulsion (1) prepared above. Specifically, on a cellulose triacetate film support provided with a subbing layer was coated various photographic constituent layers having compositions illustrated below to prepare a multilayer color photosensitive material (Sample No. 104).

[Layer Structure]

Main ingredients used in each layer are classified as follows;

ExC: Cyan couplers UV: Ultraviolet absorbents

ExM: Magenta couplers HBS: High boiling solvents

ExY: Yellow couplers H: Gelatin hardeners

ExS: Sensitizing dyes

Each figure on the right side designates the coverage rage ($g/m^2$) of the ingredient corresponding thereto. As for the silver halide emulsion, the figure represents the coverage rate based on silver. As for the sensitizing dye, the figure represents the coverage rate expressed in mole per mole of silver halide present in the same layer.

Sample No. 104

| | |
|---|---|
| First layer (antihalation layer): | |
| Black colloidal silver | silver 0.09 |
| Gelatin | 1.60 |
| ExM-1 | 0.12 |
| ExF-1 | $2.0 \times 10^{-3}$ |
| S-1 | 0.15 |
| S-2 | 0.02 |
| Second layer (interlayer): | |
| Silver iodobromide Emulsion K | silver 0.065 |
| ExC-2 | 0.04 |
| Polyethylacrylate latex | 0.20 |
| Gelatin | 1.04 |
| Third layer (low-speed red-sensitive emulsion layer) | |
| Silver iodobromide Emulsion A | silver 0.20 |
| Silver iodobromide Emulsion B | silver 0.20 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.11 |
| ExC-5 | 0.020 |
| ExC-6 | 0.010 |
| Cpd-2 | 0.025 |
| S-1 | 0.10 |
| Gelatin | 0.87 |

-continued

| | |
|---|---|
| Fourth layer (medium-speed red-sensitive emulsion layer): | |
| Silver iodobromide Emulsion C | silver 0.60 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.095 |
| ExC-5 | 0.015 |
| ExC-6 | 0.0070 |
| Cpd-2 | 0.023 |
| S-1 | 0.10 |
| Gelatin | 0.75 |
| Fifth layer (high-speed red-sensitive emulsion layer): | |
| Emulsion (1) | silver 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.70 |
| ExC-3 | 0.045 |
| ExC-6 | 0.020 |
| ExC-7 | 0.010 |
| ExC-9 | 0.040 |
| Cpd-2 | 0.050 |
| S-1 | 0.022 |
| Gelatin | 1.10 |
| Sixth layer (interlayer): | |
| Cpd-1 | 0.090 |
| S-1 | 0.050 |
| Polyethylacrylate latex | 0.15 |
| Gelatin | 1.10 |
| Seventh layer (low-speed green-sensitive emulsion layer) | |
| Silver iodobromide Emulsion D | silver 0.15 |
| Silver iodobromide Emulsion E | silver 0.10 |
| Silver iodobromide Emulsion F | silver 0.10 |
| ExS-4 | $3.0 \times 10^{-5}$ |
| ExS-5 | $2.1 \times 10^{-4}$ |
| ExS-6 | $8.0 \times 10^{-4}$ |
| ExC-10 | $5.0 \times 10^{-3}$ |
| ExM-2 | 0.20 |
| ExM-3 | 0.050 |
| ExM-6 | 0.040 |
| ExM-7 | 0.12 |
| ExY-1 | 0.010 |
| S-1 | 0.30 |
| Gelatin | 1.40 |
| Eighth layer (medium-speed green-sensitive emulsion layer): | |
| Silver iodobromide Emulsion G | silver 0.80 |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-3 | 0.015 |
| ExM-4 | 0.030 |
| ExM-5 | 0.035 |
| ExM-6 | 0.015 |
| ExM-8 | 0.035 |
| ExY-1 | 0.018 |
| ExY-4 | 0.010 |
| ExY-5 | 0.040 |
| S-1 | 0.100 |
| Gelatin | 0.85 |
| Ninth layer (high-speed green-sensitive emulsion layer): | |
| Emulsion (1) | silver 1.25 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExC-10 | $5.0 \times 10^{-3}$ |

-continued

| | |
|---|---|
| ExM-1 | 0.020 |
| ExM-9 | 0.040 |
| Cpd-3 | 0.040 |
| S-1 | 0.200 |
| Polyethylacrylate latex | 0.15 |
| Gelatin | 1.33 |
| Tenth layer (yellow filter layer): | |
| Yellow colloidal silver | silver 0.015 |
| ExC-11 | 0.050 |
| Cpd-1 | 0.10 |
| Oil-soluble dye ExF-2 | 0.010 |
| S-1 | 0.30 |
| Gelatin | 0.80 |
| Eleventh layer (low-speed blue-sensitive emulsion layer) | |
| Silver iodobromide Emulsion H | silver 0.09 |
| Silver iodobromide Emulsion I | silver 0.09 |
| ExS-7 | $8.6 \times 10^{-4}$ |
| ExC-8 | $7.0 \times 10^{-3}$ |
| ExY-1 | 0.050 |
| ExY-2 | 0.22 |
| ExY-3 | 0.55 |
| ExY-4 | 0.020 |
| Cpd-2 | 0.10 |
| Cpd-3 | $4.0 \times 10^{-3}$ |
| S-1 | 0.28 |
| Gelatin | 1.20 |
| Twelfth layer (high-speed blue-sensitive emulsion layer): | |
| Silver iodobromide Emulsion J | silver 1.00 |
| ExS-7 | $4.0 \times 10^{-4}$ |
| ExY-2 | 0.10 |
| ExY-3 | 0.11 |
| ExY-4 | 0.010 |
| Cpd-2 | 0.10 |
| Cpd-3 | $1.0 \times 10^{-3}$ |
| S-1 | 0.070 |
| Gelatin | 0.70 |
| Thirteenth layer (first protective layer): | |
| UV-1 | 0.15 |
| UV-2 | 0.075 |
| UV-3 | 0.065 |
| UV-4 | 0.080 |
| S-1 | $5.0 \times 10^{-2}$ |
| S-2 | $5.0 \times 10^{-2}$ |
| Gelatin | 1.4 |
| Fourteenth layer (second protective layer): | |
| Silver iodobromide Emulsion K | silver 0.10 |
| H-1 | 0.40 |
| B-1 (diameter: 1.7 μm) | $5.0 \times 10^{-2}$ |
| B-2 (diameter: 1.7 μm) | 0.15 |
| B-3 | 0.05 |
| HS-1 | 0.25 |
| Gelatin | 0.70 |

In addition to the foregoing ingredients, each constituent layer contained properly W-1–W-4, B-4–B-6, F-1–F-17, an iron salt, a lead salt, a gold salt, a platinum salt, a palladium salt, an iridium salt or/and a rhodium salt in order to make improvements in keeping quality, processability, pressure resistance, antimold and antibacterial properties, antistatic properties and coatability.

The features of the emulsions used herein are shown in Table 13.

TABLE 13

| Emulsion | Average AgI content (mol %) | Average grain Diameter (μm) (sphere equivalent) | Average Diameter/ thickness ratio |
|---|---|---|---|
| A | 1.7 | 0.60 | 1.0 |
| B | 3.5 | 0.75 | 1.0 |
| C | 8.9 | 0.85 | 1.5 |
| D | 1.7 | 0.60 | 1.0 |
| E | 3.5 | 0.75 | 1.0 |
| F | 8.8 | 0.80 | 1.2 |
| G | 8.8 | 0.80 | 1.5 |
| H | 1.7 | 0.60 | 1.0 |
| I | 8.8 | 0.85 | 1.2 |
| J | 14.0 | 1.55 | 1.5 |
| K | 1.0 | 0.07 | 1.0 |

Additionally, (1) Emulsions J and K are the emulsions characterized by having undergone the reduction sensitization with thiourea dioxide and thiosulfonic acid in the course of grain formation according to Example of JP-A-2-191938; (2) Emulsions A to I are the emulsions characterized by having undergone the gold sensitization, the sulfur sensitization and the selenium sensitization in the presence of the spectral sensitizing dyes used in combination therewith (described hereinabove) and sodium thiocyanate according to Examples of JP-A-3-237450; and (3) Emulsion J is the core/shell type emulsion described in JP-A-60-143331, which has a high iodide content in the core part.

The structural formulae of the compounds used herein are illustrated below:

ExC-1

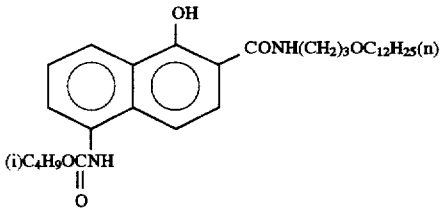

ExC-2

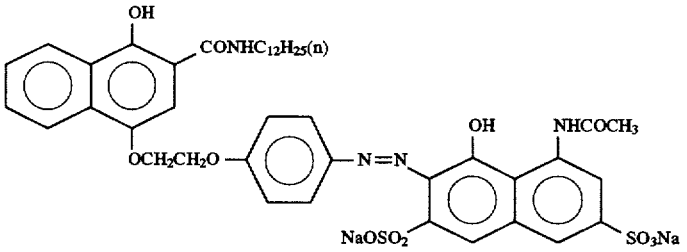

ExC-3

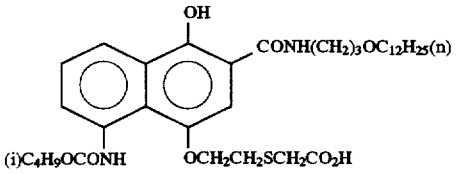

ExC-4

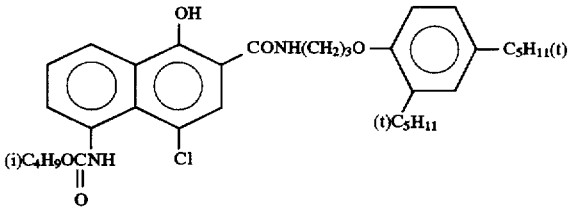

-continued
ExC-5
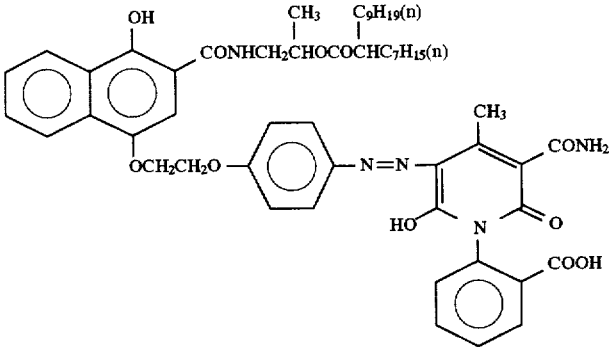
ExC-6
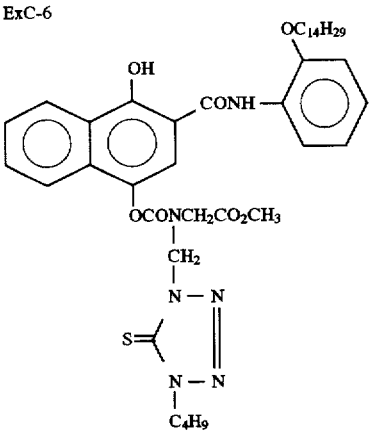
ExC-7
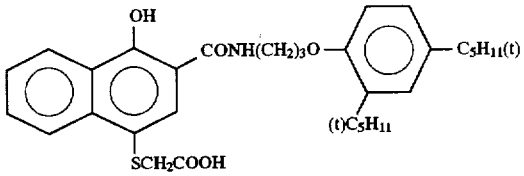
ExC-8
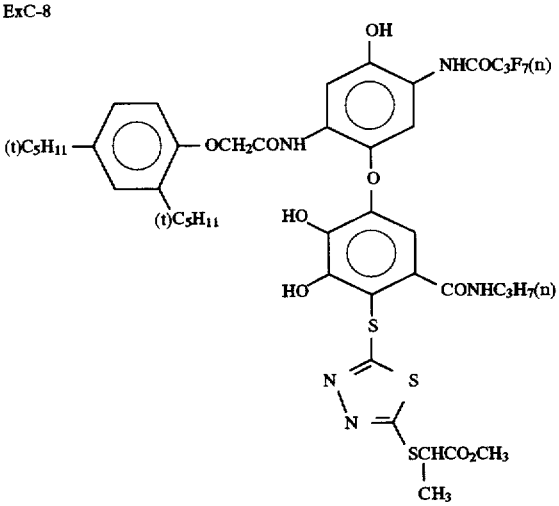

-continued
ExM-1
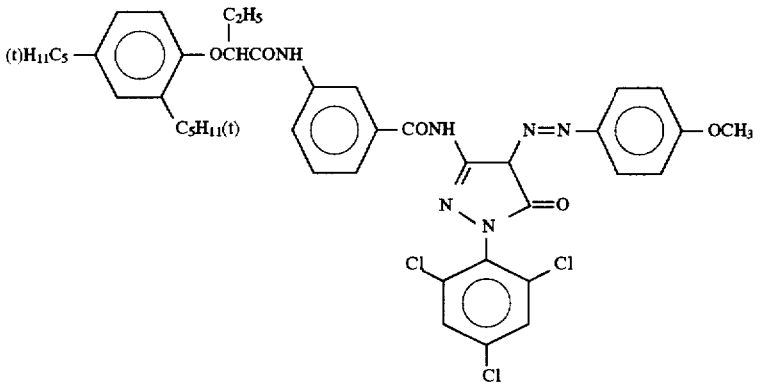
ExC-9
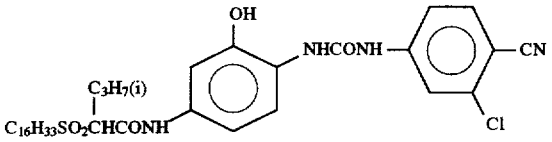
ExC-10
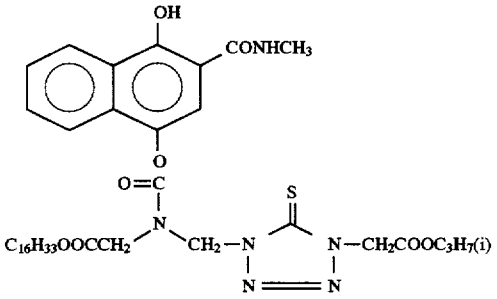
ExC-11
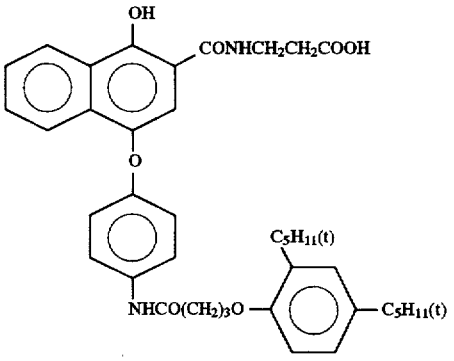
ExM-2
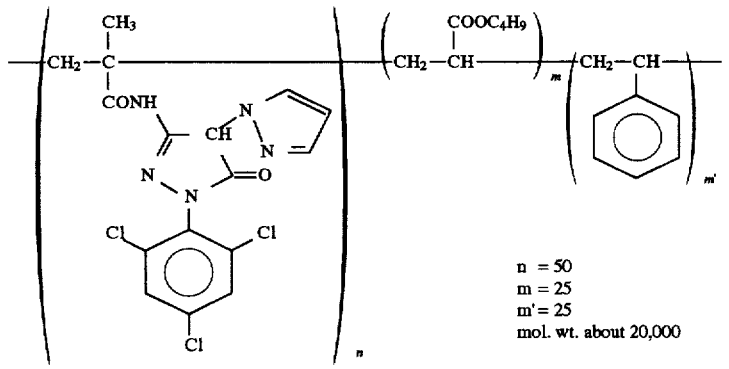
n = 50
m = 25
m' = 25
mol. wt. about 20,000

-continued
ExM-3
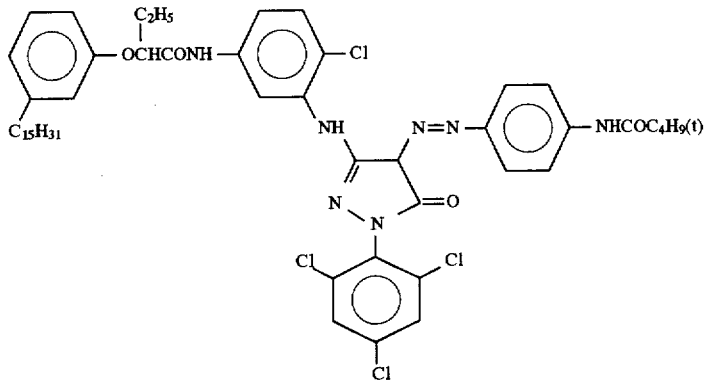
ExM-4
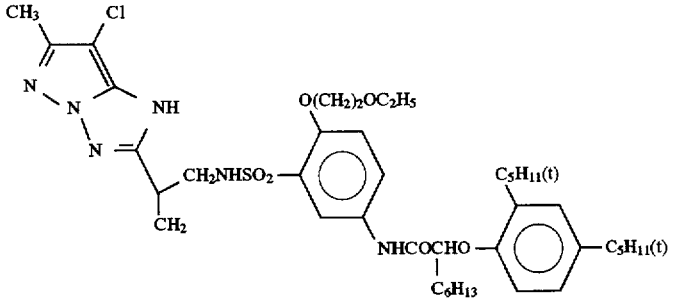
ExM-5
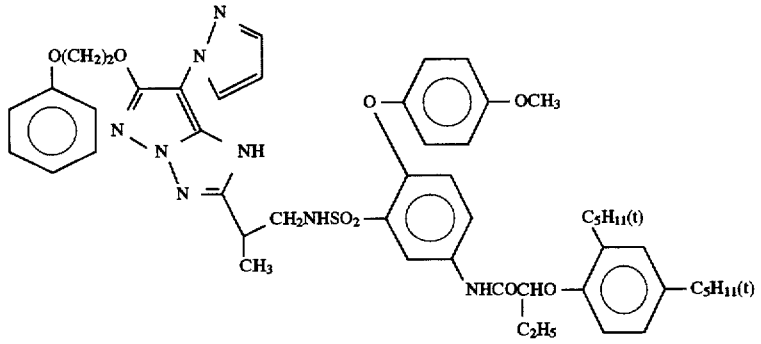
ExY-1
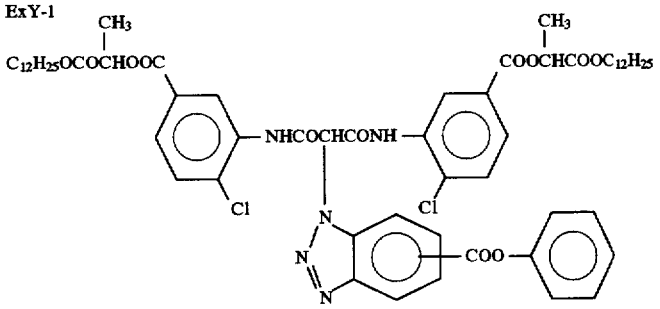

-continued
ExM-6
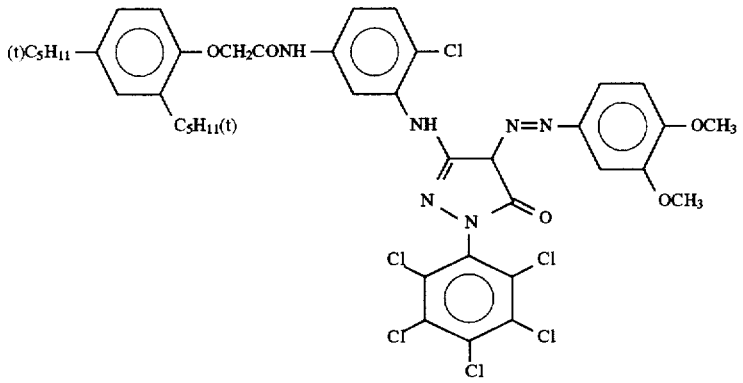
ExM-7
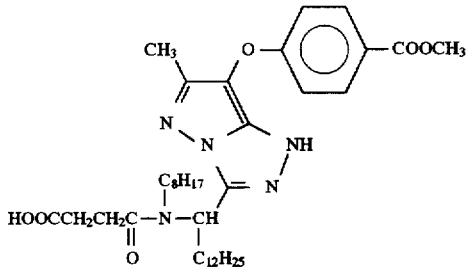
ExM-8
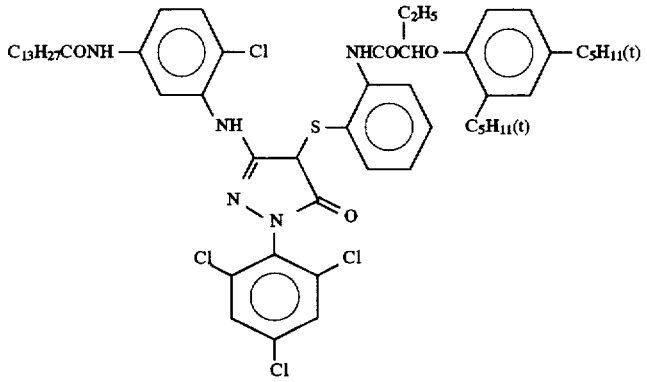
ExM-9 (Coupler described in JP-B-2-60167)
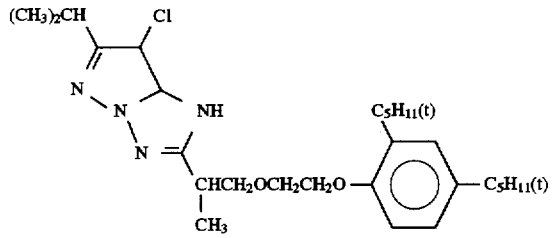
ExY-2
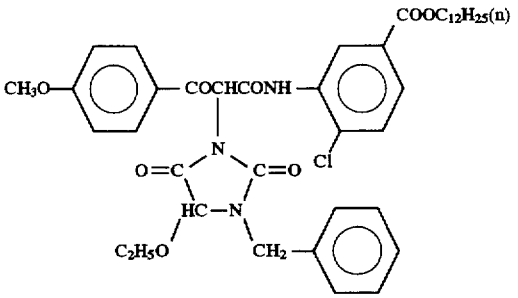

-continued
ExY-3
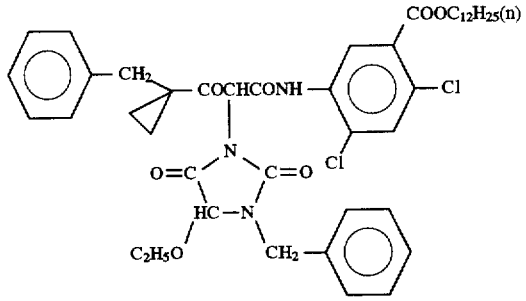
ExY-4
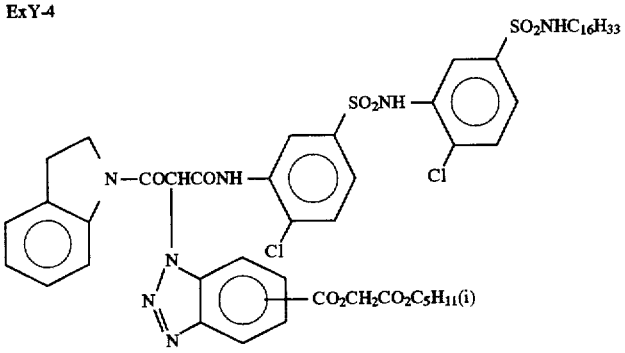
ExY-5
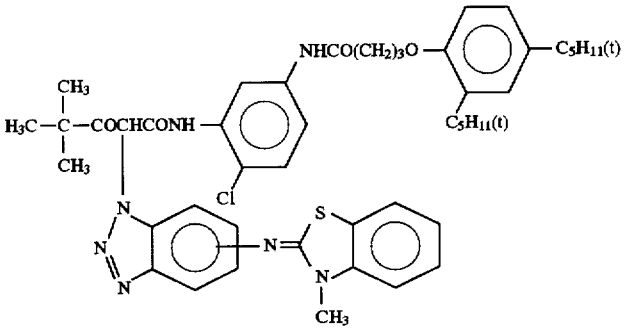
ExF-1
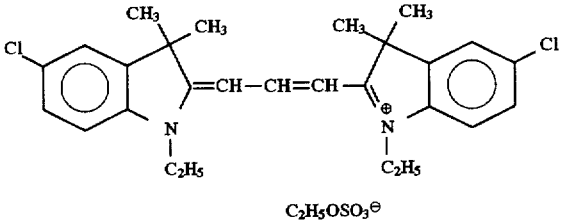
ExF-2
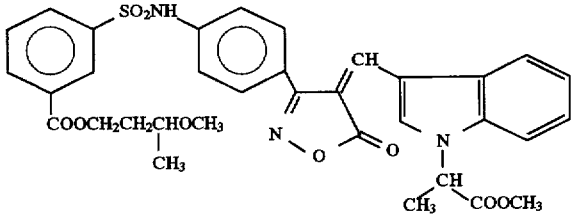
Cpd-1
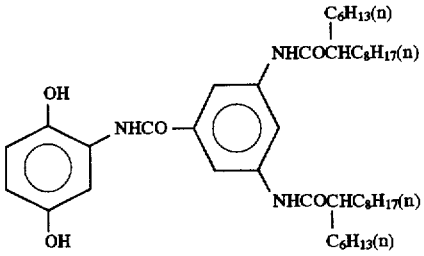
Cpd-2
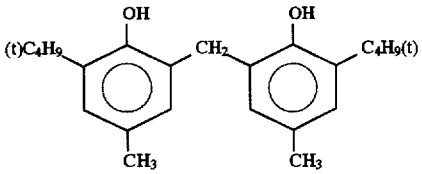

Cpd-3
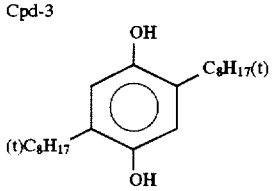
-continued
UV-1
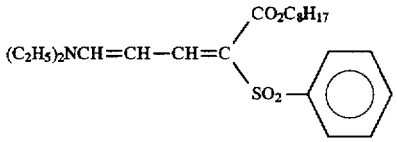
UV-2
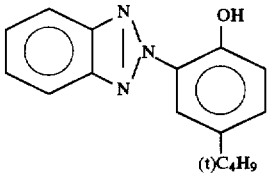
UV-3
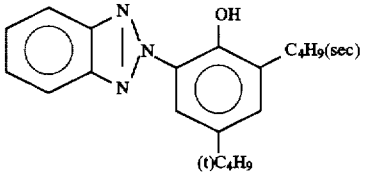
UV-4
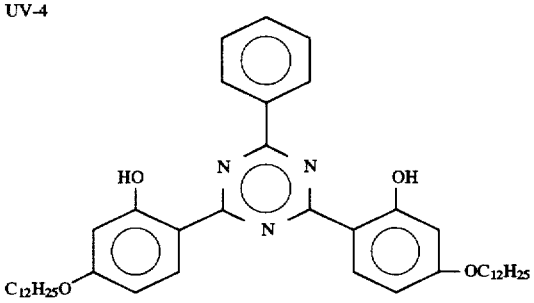
ExS-1
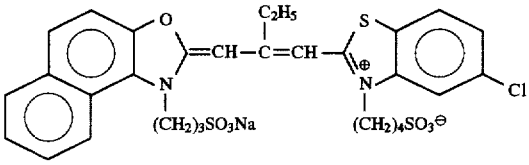
ExS-2
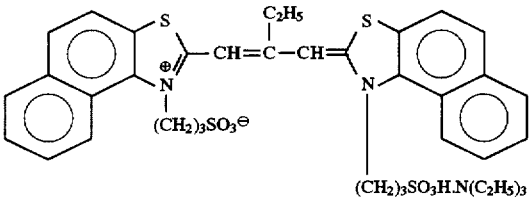
ExS-3
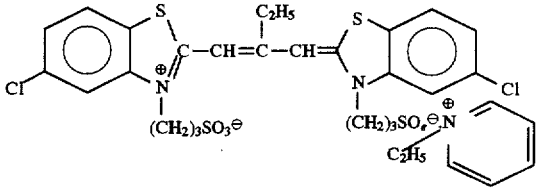
ExS-4
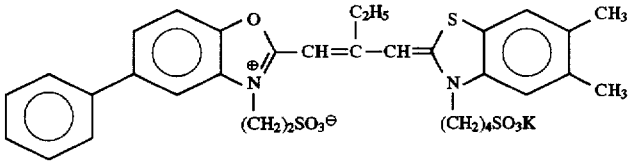
ExS-5
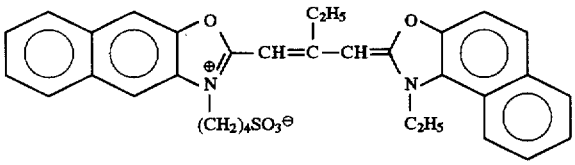
ExS-6
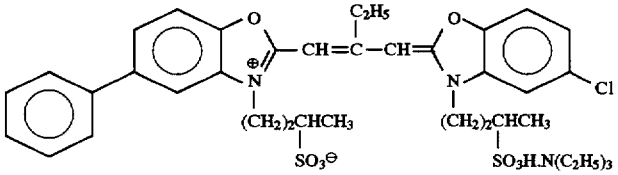

ExS-7
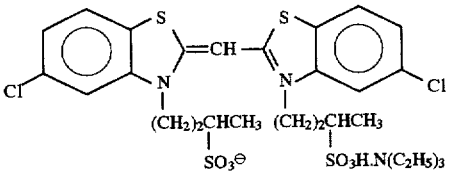
-continued
HS-1 2:1 (by weight) Mixture of
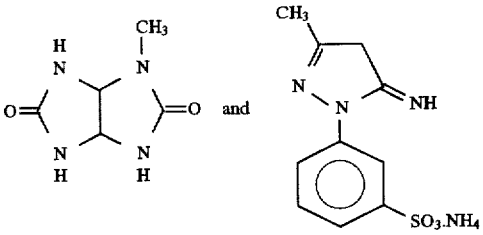
H-1
$CH_2{=}CH{-}SO_2{-}CH_2{-}CONH{-}CH_2$
$CH_2{=}CH{-}SO_2{-}CH_2{-}CONH{-}CH_2$
B-1
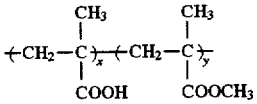
x/y = 10/90
B-2
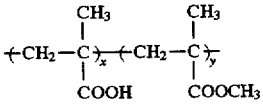
x/y = 40/60
B-3
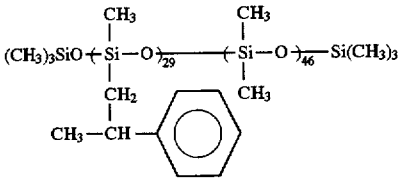
B-4
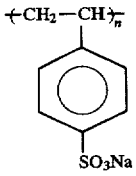
B-5
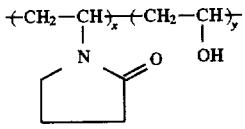
x/y = 70/30
B-6
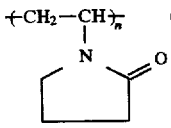
(mol. wt. about 10,000)
W-1
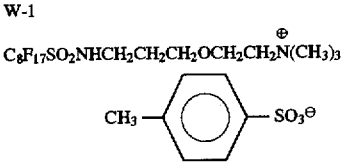
W-2
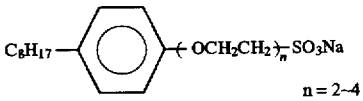
n = 2~4
W-3
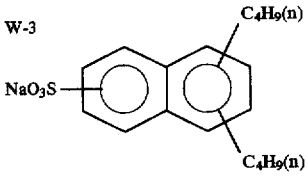
W-4
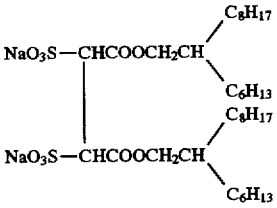
F-1
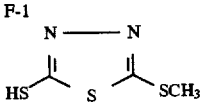

-continued
F-2
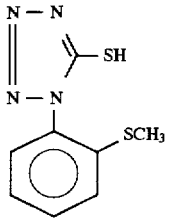
F-3
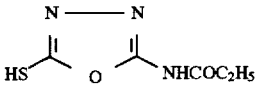
F-4
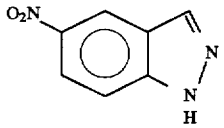
F-5
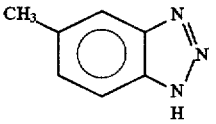
F-6
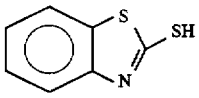
F-7
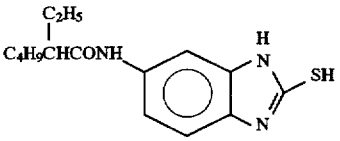
F-8
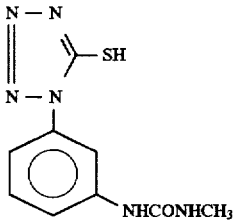
F-9
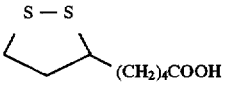
F-10
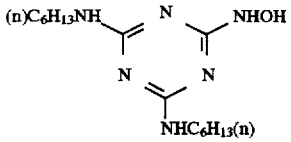
F-11
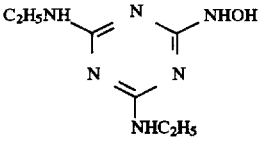
F-12
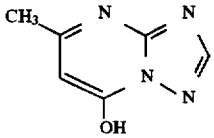
F-13
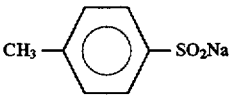
F-14
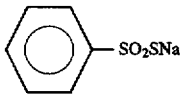
F-15
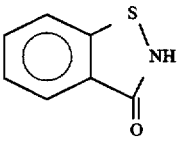
F-16
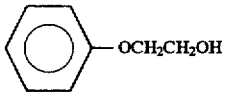
F-17
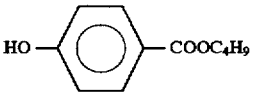

S-1

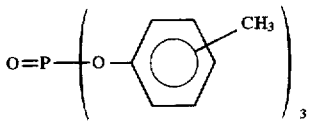

-continued

S-2

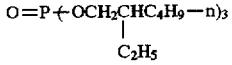

The thus produced photosensitive material, Sample No. 104, was cut into pieces in the form of general 35 mm-size negative roll film, and subjected to a perforation operation. Then, a camera was loaded with this film, and photographs of persons and Macbeth chart were taken therewith.

This sample was subjected to trial manual processing in accordance with the following color processing steps.

| Processing Step | Processing Time | Processing Temperature |
|---|---|---|
| Color development | 3 min. 5 sec. | 38.0° C. |
| Stop | 30 sec. | 38.0° C. |
| Washing | 1 min. | 38.0° C. |
| Drying | 1 min. 30 sec. | 60° C. |

The composition of each processing solution is described below.

| | |
|---|---|
| Color Developer: | |
| Diethylenetriaminepentaacetic acid | 2.0 g |
| 1-Hydroxyethylidene-1,1-diphosphonic acid | 2.0 g |
| Sodium sulfite | 3.9 g |
| Potassium carbonate | 37.5 g |
| Potassium bromide | 1.4 g |
| Potassium iodide | 1.3 mg |
| Hydroxylamine sulfate | 2.4 g |
| 2-Methyl-4-(N-ethyl-N-(β-hydroxyethyl)-amino)aniline sulfate | 4.5 g |
| Water to make | 1.0 l |
| pH adjusted to (with potassium hydroxide and sulfuric acid) | 10.05 |
| Stop Solution: | |
| Acetic acid | 30 g |
| Water to make | 1.0 |

At the conclusion of the processing, negative images of the photographed figures and Macbeth chart were obtained on the photosensitive material Sample No. 104.

In analogy with general negative films, the thus processed negative film was used in the exposure of a color paper, Fuji Color Paper SUPER FAV (produced by Fuji Photo Film Co., Ltd.), with an automatic color printer, Model 12C4510 (made by Fuji Photo Film Co., Ltd.), and the color paper thus exposed was subjected to the standard processing using an processing apparatus, Minilabo Champion FA120 (made by Fuji Photo Film Co., Ltd.), and a processing agent for color paper use, CP40FAII.

Despite the presence of residual silver halide and developed silver in the negative film, prints of satisfactory quality were obtained, and each person's skin color and every color on the Macbeth chart were reproduced in a desirable condition.

Further, in analogy with general negative films, the image information of the negative film obtained herein was converted into output by means of PICTROSTAT 330 (made by Fuji Photo Film Co., Ltd.) through the optical reading operation with the NSE unit thereof. In this case also, good prints were obtained in spite of the presence of residual silver halide and developed silver in the negative film. In other words, each person's skin color and every color on the Macbeth chart were reproduced in a desirable condition.

Furthermore, the image information of the processed photosensitive material was read with a negative film scanner using diffused light as reading light (e.g., Topaz, made by Linotype.Hel Co., Ltd.), and transferred to Macintosh Quadra 840AV, made by Apple Computer. The digital information thus obtained was subjected to image processing, and transmitted to PICTROGRAPHY 3000 (made by Fuji Photo Film Co., Ltd.). Thus, good figure prints was obtained.

EXAMPLE 5

A photosensitive material (Sample No. 105) was produced in the same manner as the photosensitive material Sample No. 104, except that the compositions of the first, the sixth and the tenth layers were changed to those described below.

Each figure on the right side designates the coverage rage ($g/m^2$) of the ingredient corresponding thereto.

| | |
|---|---|
| First Layer | |
| Gelatin | 1.60 |
| Solid disperse dye ExF-3 | 0.080 |
| Solid disperse dye ExF-4 | 0.070 |
| Solid disperse dye ExF-5 | 0.030 |
| Solid disperse dye ExF-6 | 0.120 |
| Sixth Layer | |
| Gelatin | 1.10 |
| Cpd-1 | 0.090 |
| S-2 | 0.050 |
| Polyethylacrylate latex | 0.15 |
| Solid disperse dye ExF-5 | 0.050 |
| Tenth Layer | |
| Gelatin | 0.80 |
| Cpd-1 | 0.10 |
| S-2 | 0.10 |
| Solid disperse dye ExF-6 | 0.090 |
| Solid disperse dye ExF-7 | 0.090 |

Preparation of Dispersions of Organic Solid Disperse Dyes

The above dye ExF-3 was dispersed in the following manner: 21.7 ml of water, 3 ml of a 5% water solution of sodium p-octylphenoxyethoxyethoxyethanesulfonate and 0.5 g of a 5% water solution of p-octylphenoxypolyoxyethylene ether (polymerization degree: 10) were placed in a 700 ml of pot mill, and thereto 5.0 g of Dye ExF-3 and 500 ml of zirconium oxide beads (diameter: 1 mm) were added. The contents were subjected to a 2-hour dispersing operation with a BO type vibration ball mill, made by Chuo Koki. At the conclusion of the dispersing operation, the contents were taken out, and thereto 8 g of a 12.5% water-solution of gelatin was added. By the removal of the beads by filtration, a gelatin dispersion of Dye ExF-3 was obtained. The average particle size of the thus finely divided dye was 0.44 μm.

Similarly to the above, solid dispersions of ExF-4, ExF-6 and ExF-7 were obtained respectively, and the average particle sizes of the finely divided dyes therein were 0.24 μm, 0.45 μm and 0.52 μm, respectively. As for the Dye ExF-5, the dispersion thereof was performed by the micro-precipitation method described in Example 1 of EP-A-0549498, and the average particle size was 0.06 μm.

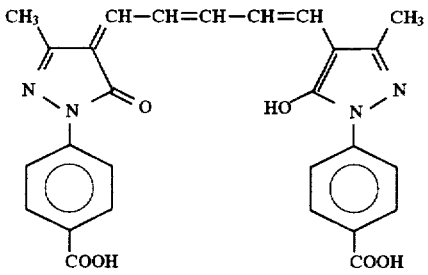
ExF-3

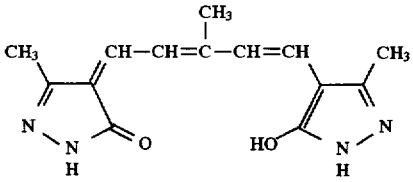
ExF-4

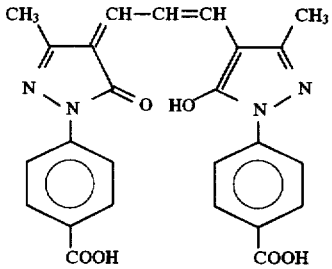
ExF-5

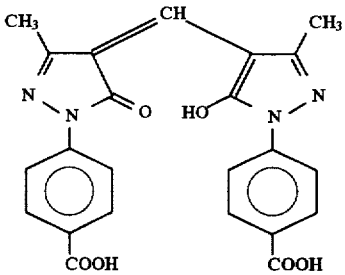
ExF-6

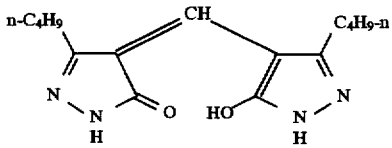
ExF-7

The thus produced photosensitive material, Sample No. 105, was cut into pieces in the form of general color negative film, and subjected to a perforation operation. Then, a camera was loaded with this film, and photographs were taken therewith, followed by the color processing similar to the case of the photosensitive material Sample No. 104.

In analogy with general negative films, the thus processed negative film was used in the exposure of a color paper, Fuji Color Paper SUPER FAV (produced by Fuji Photo Film Co., Ltd.), with an automatic color printer, Model 12C4510 (made by Fuji Photo Film Co., Ltd.), and the color paper thus exposed was subjected to the standard processing using an processing apparatus, Minilabo Champion FA120 (made by Fuji Photo Film Co., Ltd.), and a processing agent for color paper use, CP40FAII.

Despite the presence of residual silver halide and developed silver in the negative film, prints of satisfactory quality were obtained, and each person's skin color and every color on the Macbeth chart were reproduced in a desirable condition. Moreover, the prints obtained herein had higher saturation, compared with those obtained from the photosensitive material Sample No. 104.

Further, in analogy with general negative films, the image information of the negative film obtained herein was converted into output by means of PICTROSTAT 330 (made by Fuji Photo Film Co., Ltd.) through the optical reading operation with the NSE unit thereof. In this case also, good prints were obtained in spite of the presence of residual silver halide and developed silver in the negative film. In other words, each person's skin color and every color on the Macbeth chart were reproduced in a desirable condition. Moreover, the prints obtained herein had higher saturation, compared with those obtained from the photosensitive material Sample No. 104.

Furthermore, the image information of the processed photosensitive material was read with a negative film scanner using diffused light as reading light (e.g., Topaz, made by Linotype.Hel Co., Ltd.), and transferred to Macintosh Quadra 840AV, made by Apple Computer. The digital information thus obtained was subjected to image processing, and transmitted to PICTROGRAPHY 3000 (made by Fuji Photo Film Co., Ltd.). Thus, good figure prints was obtained. Moreover, the prints obtained herein had higher saturation, compared with those obtained from the photosensitive material Sample No. 104.

EXAMPLE 6

A multilayer color photosensitive material having the layer structure described below was prepared (Sample No. 106).

Coating compositions used were prepared in the following manners.

Preparation of Coating Composition for First Layer

A yellow coupler (Y-1) in the amount of 27.8 g, 4.0 g of ETA-1 and 20.5 g of a reducing agent for coloration (I-1) were dissolved in a mixed solvent consisting of 52 g of a solvent (Solv-1) and 73 ml of ethyl acetate, and then dispersed in an emulsified condition into 420 ml of a 12% aqueous gelatin solution containing 10% sodium dodecylbenzenesulfonate and citric acid to prepare emulsified Dispersion L.

(Y-1) Yellow Coupler

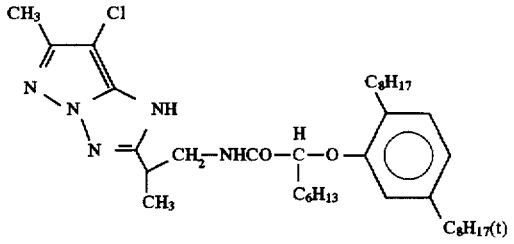

-continued

ETA-1

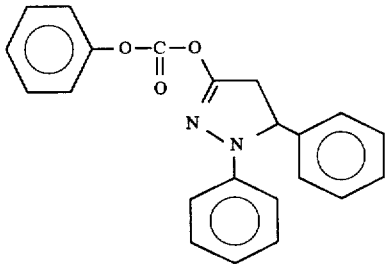

(I-1)

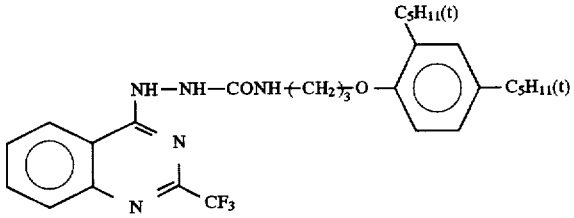

(Solv-1) Solvent

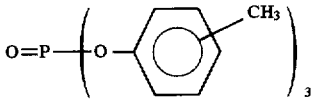

On the other hand, two kinds of silver chlorobromide emulsions [both of which had a cubic crystal form, one of which had an average grain size of 0.88 μm and a variation coefficient of 0.08 with respect to the grain size distribution (large-sized emulsion), the other of which had an average grain size of 0.70 μm and a variation coefficient of 0.10 with respect to the grain size distribution (small-sized emulsion), and both of which contained 0.3 mole % of silver bromide in which the bromide was localized in part of the grain surface] were prepared. These emulsions were mixed in a ratio of 3:7 by mole on a silver basis to obtain a silver chlorobromide Emulsion L. During the making of Emulsion L, the following blue-sensitive Sensitizing Dyes 1, 2 and 3 were added to the large-sized emulsion in the same amount of $1.4\times10^{-4}$ mole per mole of silver, and to the small-sized emulsion in the same amount of $1.7\times10^{-4}$ mole per mole of silver. Further, the Emulsion L was chemically sensitized with a sulfur sensitizer and a gold sensitizer. The silver chlorobromide Emulsion L was homogeneously mixed with the foregoing emulsified Dispersion L to prepare the coating composition for the first layer.

Blue-sensitive Sensitizing Dye 1

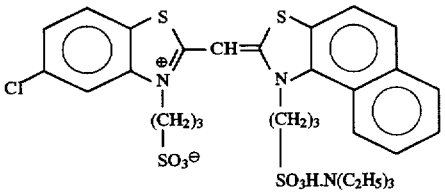

-continued

Blue-sensitive Sensitizing Dye 2

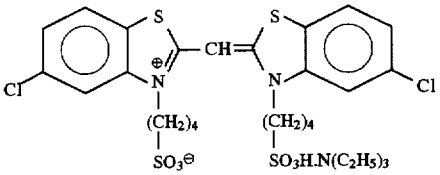

Blue-sensitive Sensitizing Dye 3

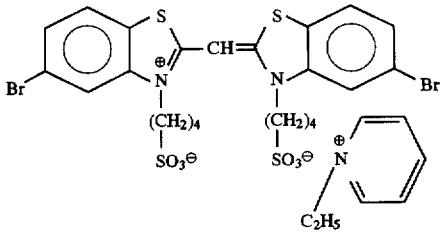

Coating compositions for the third and fifth layers were prepared in the following manners respectively, in analogy with that for the first layer.

More specifically, two kinds of silver chlorobromide emulsions [both of which had a cubic crystal form, one of which had an average grain size of 0.50 μm and a variation coefficient of 0.09 with respect to the grain size distribution (large-sized emulsion), the other of which had an average grain size of 0.41 μm and a variation coefficient of 0.11 with respect to the grain size distribution (small-sized emulsion), and both of which contained 0.8 mole % of silver bromide in which the bromide was localized in part of the grain surface] were prepared. These emulsions were mixed in a ratio of 1:4 by mole on a silver basis to obtain a silver chlorobromide Emulsion M. During the making of Emulsion M, the following green-sensitive Sensitizing Dye 1 was added to the large-sized emulsion in the amount of $3.0\times10^{-4}$ mole per mole of silver, and to the small-sized emulsion in the amount of $3.6\times10^{-4}$ mole per mole of silver; the following green-sensitive Sensitizing Dye 2 was added to the large-sized emulsion in the amount of $4.0\times10^{-5}$ mole per mole of silver, and to the small-sized emulsion in the amount of $7.0\times10^{-5}$ mole per mole of silver; and the following green-sensitive Sensitizing Dye 3 was added to the large-sized emulsion in the amount of $2.0\times10^{-4}$ mole per mole of silver, and to the small-sized emulsion in the amount of $2.8\times10^{-4}$ mole per mole of silver. The silver chlorobromide Emulsion M was homogeneously mixed with an emulsified Dispersion M containing Coupler (M-1) for magenta coloration prepared in a similar manner as the foregoing emulsified Dispersion L to prepare the coating composition for the third layer.

Green-sensitive Sensitizing Dye 1

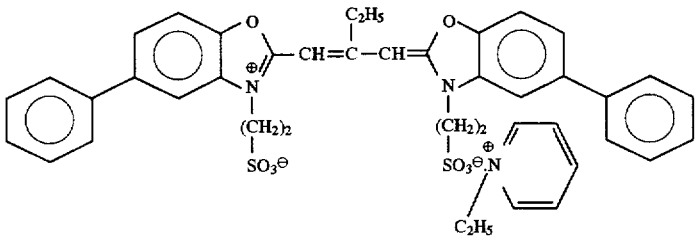

Green-sensitive Sensitizing Dye 2

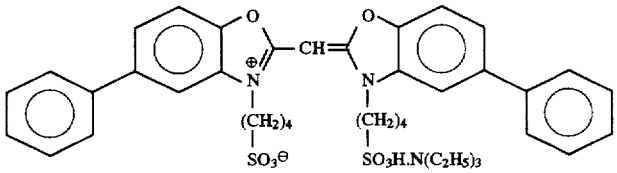

Green-sensitive Sensitizing Dye 3

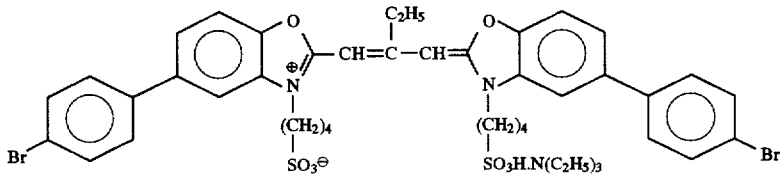

(M-1) Magenta Coupler

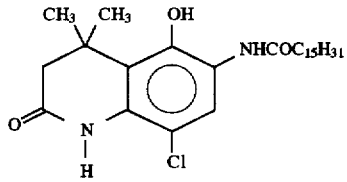

In addition, two kinds of silver chlorobromide emulsions [both of which had a cubic crystal form, one of which had an average grain size of 0.50 μm and a variation coefficient of 0.09 with respect to the grain size distribution (large-sized emulsion), the other of which had an average grain size of 0.41 μm and a variation coefficient of 0.11 with respect to the grain size distribution (small-sized emulsion), and both of which contained 0.8 mole % of silver bromide in which the bromide was localized in part of the grain surface] were prepared. These emulsions were mixed in a ratio of 1:4 by mole on a silver basis to obtain a silver chlorobromide emulsion. During the making of the emulsion, the following red-sensitive Sensitizing Dye 1 was added to the large-sized emulsion in the amount of $5.0\times10^{-5}$ mole per mole of silver, and to the small-sized emulsion in the amount of $6.0\times10^{-5}$ mole per mole of silver; and the following red-sensitive Sensitizing Dye 2 was added to the large-sized emulsion in the amount of $5.0\times10^{-5}$ mole per mole of silver, and to the small-sized emulsion in the amount of $6.0\times10^{-5}$ mole per mole of silver.

Red-sensitive Sensitizing Dye 1

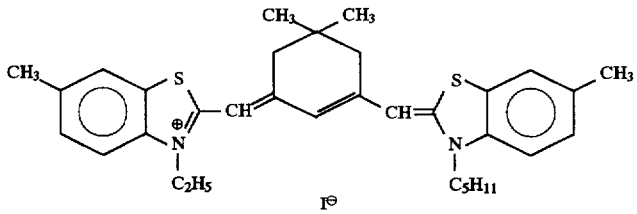

-continued

Red-sensitive Sensitizing Dye 2

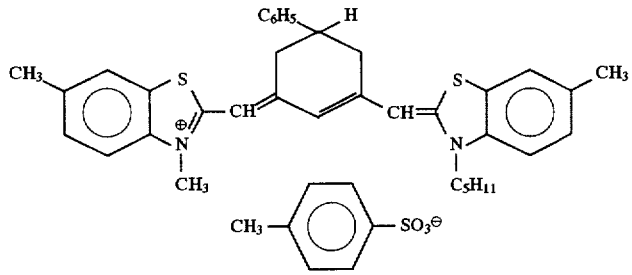

Further, the following compound A was added in the amount of $2.6\times10^{-3}$ mole per mole of silver.

Compound A

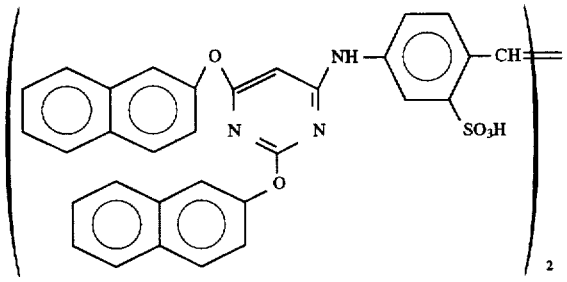

The thus prepared silver chlorobromide Emulsion N was homogeneously mixed with an emulsified Dispersion N containing Coupler (C-1) for cyan coloration prepared in a similar manner as the foregoing emulsified Dispersion L to prepare the coating composition for the fifth layer.

(C-1) Cyan Coupler

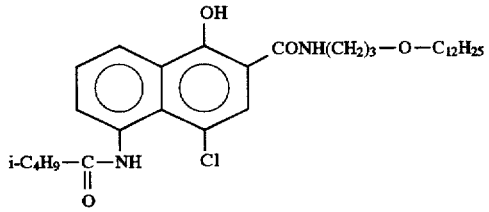

Coating solutions for the second, sixth and seventh layers were prepared so as to have their respective compositions shown below.

In each layer, sodium salt of 1-hydroxy-3,5-dichloro-s-triazine was used as gelatin hardener.

In addition, Cpd-4 and Cpd-5 were added to all layers so that their coverage rates were 25 mg/m$^2$ and 50 mg/m$^2$, respectively.

Further, 1-(5-methylureidophenyl)-5-mercaptotetrazole was added to the blue-sensitive emulsion layer, the green-sensitive emulsion layer and the red-sensitive emulsion layer in the amounts of $8.5\times10^{-5}$ mole, $9.0\times10^{-4}$ mole and $2.5\times10^{-4}$ mole, respectively, per mole of silver halide. Furthermore, 4-hydroxy-6-methyl-1,3,3a,7-tetraazaindene was added to the blue-sensitive emulsion layer and the green-sensitive emulsion layer in the amounts of $1\times10^{-4}$ mole and $2\times10^{-4}$ mole, respectively, per mole of silver halide.

In addition, the irradiation preventing dyes illustrated hereinafter were added to each emulsion layer in order to inhibit an irradiation phenomenon from occurring.

[Layer Structure]

The composition of each constituent layer is described below. Each figure on the right side designates the coverage rate (g/m$^2$) of the ingredient corresponding thereto. As for the silver halide emulsion, the figure represents the coverage rate based on silver.

Support:

Polyethylene naphthalate film subbed with gelatin

| | |
|---|---|
| First layer (blue-sensitive emulsion layer): | |
| The foregoing Emulsion L | 0.20 |
| Gelatin | 1.54 |
| Yellow coupler (Y-1) | 0.35 |
| Reducing agent for coloration (I-1) | 0.26 |
| Solvent (Solv-1) | 0.78 |
| ETA-1 | 0.05 |
| Second layer (color stain inhibiting layer): | |
| Gelatin | 1.00 |
| Color stain inhibitor (Cpd-1) | 0.08 |
| Solvent (Solv-1) | 0.25 |
| Solvent (Solv-2) | 0.15 |
| Solvent (Solv-3) | 0.13 |
| Third layer (green-sensitive emulsion layer): | |
| The foregoing Emulsion M | 0.20 |
| Gelatin | 1.55 |
| Magenta coupler (M-1) | 0.34 |
| Reducing agent for coloration (I-1) | 0.26 |
| Solvent (Solv-4) | 0.78 |
| ETA-1 | 0.05 |
| Fourth layer (color stain inhibiting layer): | |
| Gelatin | 1.00 |
| Color stain inhibitor (Cpd-1) | 0.08 |
| Solvent (Solv-1) | 0.25 |
| Solvent (Solv-2) | 0.15 |
| Solvent (Solv-3) | 0.13 |
| Fifth layer (red-sensitive emulsion layer): | |
| The foregoing Emulsion N | 0.20 |
| Gelatin | 1.50 |
| Cyan coupler (C-1) | 0.29 |
| Reducing agent for coloration (I-1) | 0.26 |
| Solvent (Solv-1) | 0.78 |
| ETA-1 | 0.05 |
| Sixth layer (ultraviolet absorbing layer): | |
| Gelatin | 0.60 |
| Ultraviolet absorbent (UV-5 | 0.57 |
| Color image stabilizer (Cpd-2) | 0.06 |
| Solvent (Solv-1) | 0.05 |

-continued

| Seventh layer (protective layer): | |
|---|---|
| Gelatin | 1.00 |
| Acryl-modified polyvinyl alcohol (modification degree: 17%) | 0.05 |
| Liquid paraffin | 0.02 |
| Surfactant (Cpd-3) | 0.01 |

The structural formulae of the compounds used herein are illustrated below:

(Cpd-1) Color stain inhibitor

1:1:1 (by weight) Mixture of (1), (2) and (3);

(1)

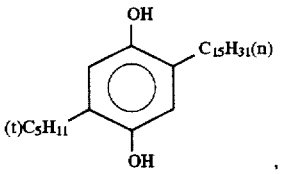

(2)

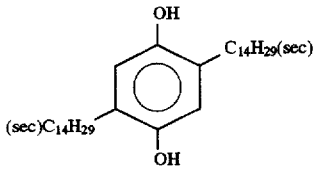

(3)

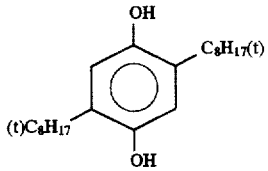

(Cpd-2) Color image stabilizer

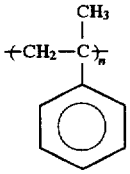

number-average molecular weight: 600

(Cpd-3) Surfactant

2:1:1 (by weight) Mixture of (1), (2) and (3);

(1)

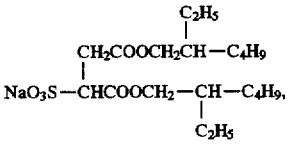

(2)

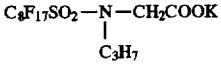

(3)

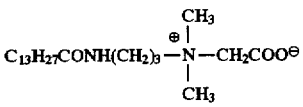

-continued (Solv-2) Solvent

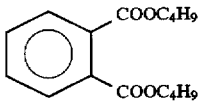

(Solv-3) Solvent

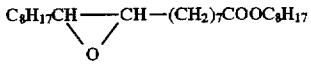

(Solv-4) Solvent $O{=}P{+}OC_6H_{13}(n))_3$

Irradiation Preventing Dyes (10 mg/m²)

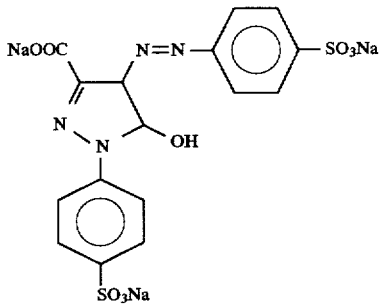

(10 mg/m²)

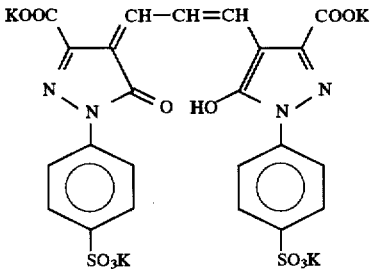

(40 mg/m²)

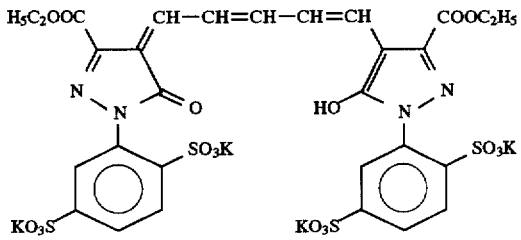

および

(20 mg/m²)

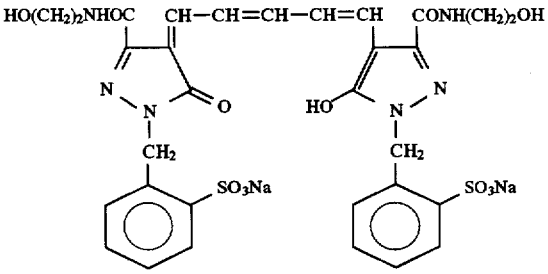

-continued (Cpd-4) Antiseptic

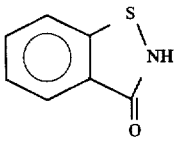

(Cpd-5) Antiseptic

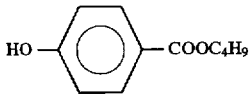

(UV-5) Ultraviolet absorbent

1:2:2:3:1 (by weight) Mixture of (1), (2), (3), (4) and (5);

(1)

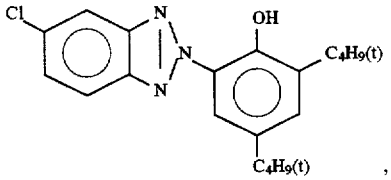

(2)

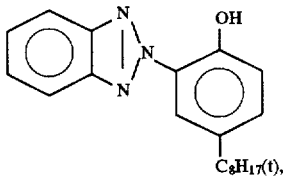

(3)

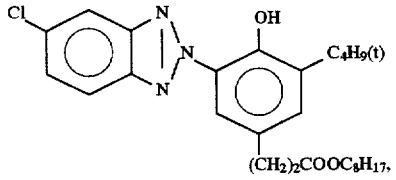

(4)

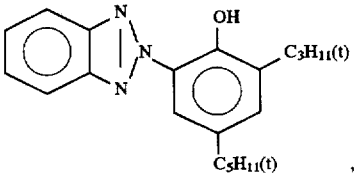

(5)

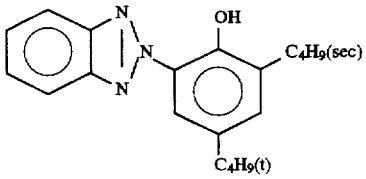

[Activator Development]

The thus produced photosensitive material, Sample No. 106, was cut into pieces in the form of general color negative film, and subjected to a perforation operation. Then, a camera was loaded with this film, and photographs of persons were taken therewith.

The thus exposed photosensitive material was processed in accordance with the following steps.

| Processing Step | Processing Temperature | Processing Time |
|---|---|---|
| Activator development | 40° C. | 1 min. |
| Stop | 40° C. | 30 sec. |
| Washing | 40° C. | 1 sec. |
| Drying | 60° C. | 2 min. |

Both of the following activator solutions (1) and (2) were tested in the activator development. The results obtained were, however, almost the same.

| | |
|---|---|
| Activator Solution (1) | |
| Tetramethylammonium hydroxide (25%) | 0.15 mol/l |
| N,N'-dimethylguanidine | 0.10 mol/l |
| Sodium hydrogen carbonate to adjust to | pH 12.5 (25° C.) |
| Activator Solution (2) | |
| Water | 80 ml |
| Potassium phosphate | 40 g |
| Disodium N,N-bis(sulfonatoethyl)hydroxylamine | 10 g |
| KCl | 5 g |
| Hydroxyethylidene-1,1-disulfonic acid (30%) | 40 ml |
| Water to make | 1000 ml |
| pH adjusted (with potassium hydroxide) to | 12.5 (at 25° C.) |
| Stop Solution | |
| Acetic acid | 30 g |
| Water to make | 1000 ml |

At the conclusion of the processing, negative images of the photographed figures were obtained on the photosensitive material, Sample No. 106.

In analogy with general negative films, the thus processed negative film was used in the exposure of a color paper, Fuji Color Paper SUPER FAV (produced by Fuji Photo Film Co., Ltd.), with an automatic color printer, Model 12C4510 (made by Fuji Photo Film Co., Ltd.), and the color paper thus exposed was subjected to the standard processing using an processing apparatus, Minilabo Champion FA120 (made by Fuji Photo Film Co., Ltd.), and a processing agent for color paper use, CP40FAII.

Despite the presence of residual silver halide and developed silver in the negative film, prints of satisfactory quality were obtained, and each person's skin color and every color on the Macbeth chart were reproduced in a desirable condition.

Further, in analogy with general negative films, the image information of the negative film obtained herein was converted into output by means of PICTROSTAT 330 (made by Fuji Photo Film Co., Ltd.) through the optical reading operation with the NSE unit thereof. In this case also, good prints were obtained in spite of the presence of residual silver halide and developed silver in the negative film. In other words, each person's skin color and every color on the Macbeth chart were reproduced in a desirable condition.

Furthermore, the image information of the processed photosensitive material was read with a negative film scanner using diffused light as reading light (e.g., Topaz, made by Linotype.Hel Co., Ltd.), and transferred to Macintosh Quadra 840AV, made by Apple Computer. The digital information thus obtained was subjected to image processing, and transmitted to PICTROGRAPHY 3000 (made by Fuji Photo Film Co., Ltd.). Thus, good figure prints was obtained.

EXAMPLE 7

Dye compositions were prepared in the form of emulsified dispersion, and used as additives.

The combination of leuco dye(s) with the developer thereof and, if needed, Oil (1) were weighed out, and thereto ethyl acetate was added. The resulting mixture was heated at about 60° C. to converted into a homogeneous solution. A 100 ml portion of the solution was admixed with 1.0 g of Surfactant (21) and 190 ml of a 6.6% aqueous lime-processed gelatin solution heated at about 60° C., and dispersed thereinto at 10000 r.p.m. for 10 minutes by means of a homogenizer.

The dispersions of two types of dyes were prepared respectively in the above-described manner using the ingredients shown in Table 14.

TABLE 14

| Ingredient | Yellow Filter Dye | Antihalation Dye |
|---|---|---|
| Leuco Dye Y | 5.32 g | — |
| Leuco Dye B | — | 4.5 g |
| Leuco Dye M | — | 0.58 g |
| Developer | 30.2 g | 15.1 g |
| Oil (1) | — | 10 g |
| Ethyl Acetate | 60 ml | 75 ml |

Leuco Dye Y

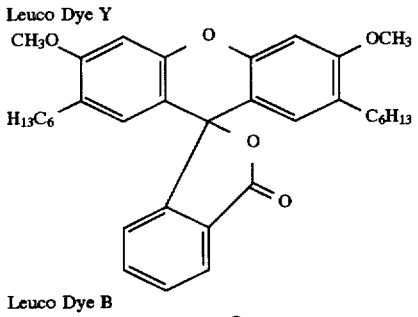

Leuco Dye B

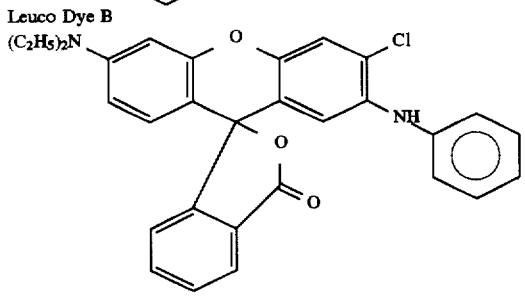

Leuco Dye M

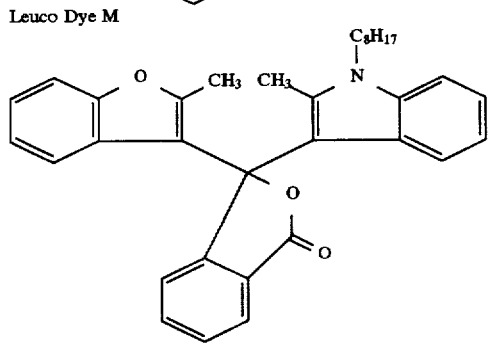

TABLE 14-continued

Developer

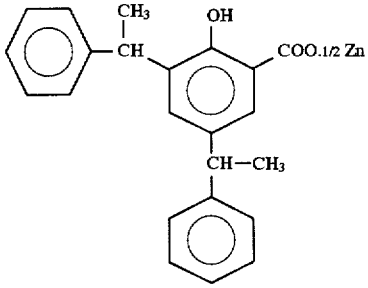

Surfactant (21)

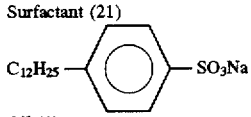

Oil (1)
$C_{26}H_{46.9}C_{17.1}$

In the next place, the processes of preparing light-sensitive silver halide emulsions are described below:

Preparation of Light-Sensitive Emulsion (1) [for Red-Sensitive Emulsion Layer]

To a vigorously stirred aqueous gelatin solution (prepared by adding to 700 ml of water 20 g of gelatin, 0.5 g of potassium bromide, 2.5 g of sodium chloride and 15 mg of Chemical Agent (A) illustrated below, and keeping the resultant mixture at 42° C.), a silver nitrate solution (Soln. (I)) and a halide solution (Soln. (II)) set forth in Table 15 were added simultaneously over a 8-minute period at a constant flow rate. Further thereto, a dispersion of dyes in an aqueous gelatin solution (which contained in 160 ml of water 1.9 g of gelatin, 127 mg of Dye. (a) illustrated below, 253 mg of Dye (b) illustrated below and 8 mg of Dye (c) illustrated below, and was kept at 35° C.) was added after an 8-minute lapse from the conclusion of the addition of Soln. (I) and Soln. (II). Two minutes later, the other silver nitrate solution (Soln. (III)) and the other halide solution (Soln. (IV)) set forth in Table 15 were furthermore added thereto simultaneously at a constant flow rate over a 32-minute period.

After performing washing and subsequent desalting steps in conventional manners, the emulsion obtained was admixed with 22 g of lime-processed ossein gelatin and 50 mg of Chemical Agent (B) illustrated below, adjusted to pH 6.2 and pAg 7.8, and then chemically sensitized at 68° C. to the optimum extent by adding thereto 4-hydroxy-6-methyl-1,3,3a,7-tetrazaindene first, and then sodium thiosulfate and chloroauric acid. Further, the thus sensitized emulsion was admixed with Antifoggant (1) illustrated below, 80 mg of Chemical Agent (C) and 3 g of Chemical Agent (D), and then cooled. Thus, 635 g of a monodisperse cubic silver chlorobromide emulsion having an average grain size of 0.21 μm was obtained.

TABLE 15

| Ingredient | Soln. (I) | Soln. (II) | Soln. (III) | Soln. (IV) |
|---|---|---|---|---|
| $AgNO_3$ | 20.0 g | — | 80.0 g | — |
| $NH_4NO_3$ | 0.19 g | — | 0.19 g | — |
| KBr | — | 9.9 g | — | 45.1 g |

TABLE 15-continued

| | | | | |
|---|---|---|---|---|
| NaCl | — | 2.1 g | — | 5.4 g |
| Water to make | 110 ml | 110 ml | 250 ml | 250 ml |

Chemical Agent (A)

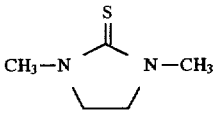

Chemical Agent (B)

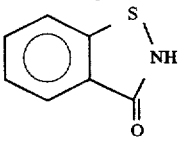

Chemical Agent (C)

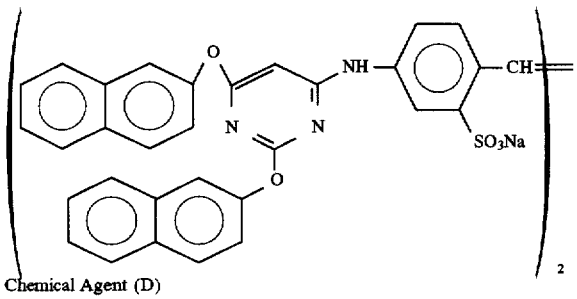

Chemical Agent (D)

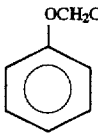

Dye (a)

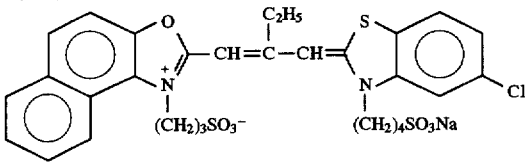

Dye (b)

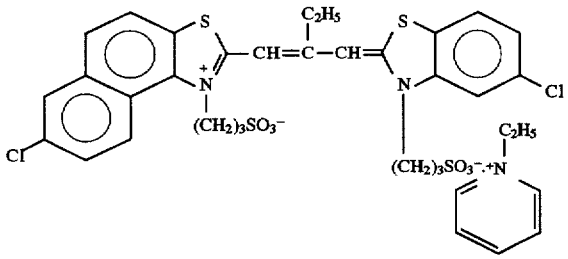

Dye (c)

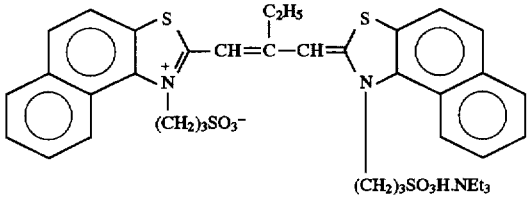

Antifoggant (1)

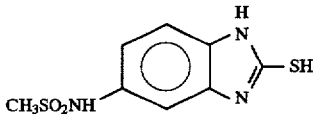

Preparation of Light-Sensitive Emulsion (2) [for Red-Sensitive Emulsion Layer]

To a vigorously stirred aqueous gelatin solution (prepared by adding to 700 ml of water 20 g of gelatin, 0.3 g of potassium bromide, 9 g of sodium chloride and 15 mg of Chemical Agent (A) illustrated above, and keeping the resultant mixture at 53° C.), a silver nitrate solution (Soln. (I)) and a halide solution (Soln. (II)) set forth in Table 16 were added simultaneously over a 10-minute period at a constant flow rate. Further thereto, a dispersion of dyes in an aqueous gelatin solution (which contained in 115 ml of water 1.2 g of gelatin, 77 mg of Dye (a) illustrated above, 153 mg of Dye (b) illustrated above and 5 mg of Dye (c) illustrated above, and was kept at 45° C.) was added after an 6-minute lapse from the conclusion of the addition of Soln. (I) and Soln. (II). Four minutes later, the other silver nitrate solution (Soln. (III)) and the other halide solution (Soln. (IV)) set forth in Table 16 were furthermore added thereto simultaneously at a constant flow rate over a 30-minute period.

After performing washing and subsequent desalting steps in conventional manners, the emulsion obtained was admixed with 33 g of lime-processed ossein gelatin and 50 mg of the foregoing Chemical Agent (B), adjusted to pH 6.2 and pAg 7.8, and then chemically sensitized at 68° C. to the optimum extent by adding thereto 4-hydroxy-6-methyl-1,3, 3a,7-tetrazaindene first, and then sodium thiosulfate and chloroauric acid. Further, the thus sensitized emulsion was admixed with the foregoing Antifoggant (1), 80 mg of Chemical Agent (C) and 3 g of Chemical Agent (D), and then cooled. Thus, 635 g of a monodisperse cubic silver chlorobromide emulsion having an average grain size of 0.45 μm was obtained.

TABLE 16

| Ingredient | Soln. (I) | Soln. (II) | Soln. (III) | Soln. (IV) |
|---|---|---|---|---|
| $AgNO_3$ | 20.0 g | — | 80.0 g | — |
| $NH_4NO_3$ | 0.19 g | — | 0.19 g | — |
| KBr | — | 12.2 g | — | 42.0 g |
| NaCl | — | 2.6 g | — | 5.2 g |
| Water to make | 120 ml | 120 ml | 225 ml | 225 ml |

Preparation of Light-Sensitive Emulsion (3) [for Green-Sensitive Emulsion Layer]

To a vigorously stirred aqueous gelatin solution (prepared by adding to 690 ml of water 20 g of gelatin, 0.5 g of potassium bromide, 5 g of sodium chloride and 15 mg of Chemical Agent (A) illustrated hereinabove, and keeping the resultant mixture at 41° C.), a silver nitrate solution (Soln. (I)) and a halide solution (Soln. (II)) set forth in Table 17 were added simultaneously over a 8-minute period at a constant flow rate. Ten minutes later, the other silver nitrate solution (Soln. (III)) and the other halide solution (Soln. (IV)) set forth in Table 17 were further added thereto simultaneously at a constant flow rate over a 32-minute period. After a 1-minute lapse from the conclusion of the addition of Soln. (III) and Soln. (IV), furthermore thereinto was poured a methanol solution of dye (which contained 2810 mg of Dye (d-1) illustrated below and 57.3 mg of Dye (d-2) illustrated below in 47 ml of methanol, and was kept at 30° C.).

After performing washing and subsequent desalting steps in conventional manners, the emulsion obtained was admixed with lime-processed ossein gelatin, 50 mg of Chemical Agent (B) illustrated hereinabove and 3 g of Chemical Agent (D) illustrated hereinabove, adjusted to pH 6.2 and pAg 7.8, and then chemically sensitized at 60° C. to the optimum extent by adding thereto 4-hydroxy-6-methyl-1,3,3a,7-tetrazaindene first, and then sodium thiosulfate. Further, the thus sensitized emulsion was admixed with the foregoing Antifoggant (1), and then cooled. Thus, 635 g of a monodisperse cubic silver chlorobromide emulsion having an average grain size of 0.23 μm was obtained.

TABLE 17

| Ingredient | Soln. (I) | Soln. (II) | Soln. (III) | Soln. (IV) |
|---|---|---|---|---|
| $AgNO_3$ | 20.0 g | — | 80.0 g | — |
| $NH_4NO_3$ | 0.06 g | — | 0.06 g | — |
| KBr | — | 4.9 g | — | 22.6 g |
| NaCl | — | 4.5 g | — | 16.6 g |
| $K_2IrCl_4$ | — | 0.008 mg | — | — |
| Water to make | 110 ml | 110 ml | 240 ml | 240 ml |

Dye (d-1)

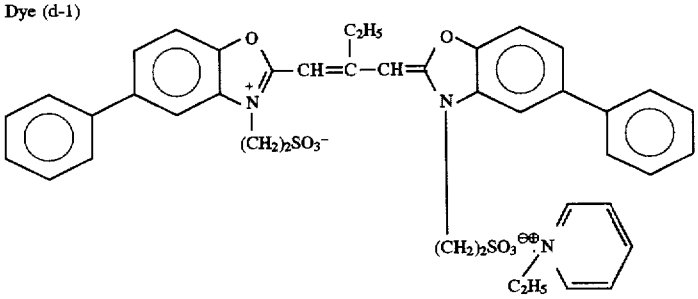

Dye (d-2)

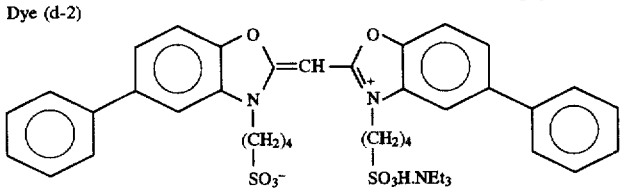

Preparation of Light-Sensitive Emulsion (4) [for Green-Sensitive Emulsion Layer]

To a vigorously stirred aqueous gelatin solution (prepared by adding to 710 ml of water 20 g of gelatin, 0.3 g of potassium bromide, 9 g of sodium chloride and 7.5 mg of Chemical Agent (A) illustrated hereinbefore, and keeping the resultant mixture at 63° C.), a silver nitrate solution (Soln. (I)) and a halide solution (Soln. (II)) set forth in Table 18 were added simultaneously over a 10-minute period at a constant flow rate. Ten minutes later, the other silver nitrate solution (Soln. (III)) and the other halide solution (Soln. (IV)) set forth in Table 18 were further added thereto simultaneously at a constant flow rate over a 20-minute period. After a 1-minute lapse from the conclusion of the addition of Soln. (III) and Soln. (IV), furthermore thereinto was poured a methanol solution of dyes (which contained 210 mg of Dye (d-1) and 42.7 mg of Dye (d-2) illustrated above in 35 ml of methanol, and was kept at 46° C.).

After performing washing and subsequent desalting steps in conventional manners, the emulsion obtained was admixed with 33 g of lime-processed ossein gelatin, 50 mg of Chemical Agent (B) illustrated hereinbefore and 3 g of Chemical Agent (D) illustrated hereinbefore, adjusted to pH 6.0 and pAg 7.2, and then chemically sensitized at 60° C. to the optimum extent by adding thereto 4-hydroxy-6-methyl-1,3,3a,7-tetrazaindene first, and then sodium thiosulfate and chloroauric acid. Further, the thus sensitized emulsion was admixed with Antifoggant (1) illustrated hereinbefore, and then cooled. Thus, 635 g of a monodisperse cubic silver chlorobromide emulsion having an average grain size of 0.45 μm was obtained.

TABLE 18

| Ingredient | Soln. (I) | Soln. (II) | Soln. (III) | Soln. (IV) |
|---|---|---|---|---|
| $AgNO_3$ | 25.0 g | — | 75.0 g | — |
| $NH_4NO_3$ | 0.06 g | — | 0.06 g | — |
| KBr | — | 6.2 g | — | 21.1 g |
| NaCl | — | 5.6 g | — | 15.5 g |
| $K_4[Fe(CN)_6]$ | — | — | — | 4 mg |
| Water to make | 120 ml | 120 ml | 225 ml | 225 ml |

Preparation of Light-Sensitive Emulsion (5) [for Blue-Sensitive Emulsion Layer]

To a vigorously stirred aqueous gelatin solution (prepared by adding to 690 ml of water 20 g of gelatin, 0.5 g of potassium bromide, 5 g of sodium chloride and 15 mg of Chemical Agent (A) illustrated hereinbefore, and keeping the resultant mixture at 46° C.), a silver nitrate solution (Soln. (I)) and a halide solution (Soln. (II)) set forth in Table 19 were added simultaneously over a 8-minute period at a constant flow rate. Ten minutes later, the other silver nitrate solution (Soln. (III)) and the other halide solution (Soln. (IV)) set forth in Table 19 were further added thereto simultaneously at a constant flow rate over a 18-minute period. After a 1-minute lapse from the conclusion of the addition of Soln. (III) and Soln. (IV), furthermore thereinto was poured an aqueous solution of dyes (which contained 225 mg of Dye (e) and 225 mg of Dye (f) illustrated below in the mixture of 95 ml of water with 5 ml of methanol, and was kept at 30° C.).

After performing washing and subsequent desalting steps in conventional manners, the emulsion obtained was admixed with 22 g of lime-processed ossein gelatin, 50 mg of Chemical Agent (B) illustrated hereinbefore and 3 g of Chemical Agent (D) illustrated hereinbefore, adjusted to pH 6.0 and pAg 7.7, and then chemically sensitized at 65° C. to the optimum extent by adding thereto 4-hydroxy-6-methyl-1,3,3a,7-tetrazaindene first, and then sodium thiosulfate. Further, the thus sensitized emulsion was admixed with Antifoggant (1) illustrated hereinbefore, and then cooled. Thus, 635 g of a monodisperse cubic silver chlorobromide emulsion having an average grain size of 0.27 μm was obtained.

TABLE 19

| Ingredient | Soln. (I) | Soln. (II) | Soln. (III) | Soln. (IV) |
|---|---|---|---|---|
| $AgNO_3$ | 20.0 g | — | 80.0 g | — |
| $NH_4NO_3$ | 0.06 g | — | 0.06 g | — |
| KBr | — | 9.9 g | — | 45.0 g |
| NaCl | — | — | — | 7.6 g |
| $K_4[Fe(CN)_6]$ | — | — | — | 7 mg |
| Water to make | 110 ml | 110 ml | 240 ml | 240 ml |

Dye (e)

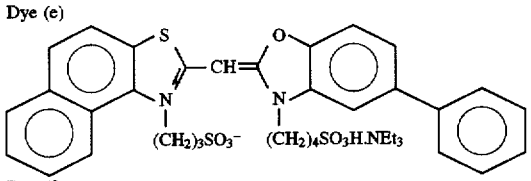

Dye (f)

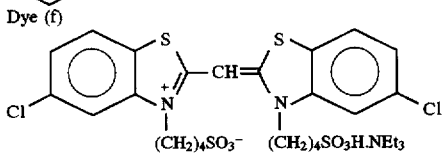

Preparation of Light-Sensitive Emulsion (6) [for Blue-Sensitive Emulsion Layer]

To a vigorously stirred aqueous gelatin solution (prepared by adding to 710 ml of water 20 g of gelatin, 0.3 g of potassium bromide, 9 g of sodium chloride and 15 mg of Chemical Agent (A) illustrated hereinbefore, and keeping the resultant mixture at 59° C.), a silver nitrate solution (Soln. (I)) and a halide solution (Soln. (II)) set forth in Table 20 were added simultaneously over a 8-minute period at a constant flow rate. Ten minutes later, the other silver nitrate solution (Soln. (III)) and the other halide solution (Soln. (IV)) set forth in Table 20 were further added thereto simultaneously at a constant flow rate over a 18-minute period. After a 1-minute lapse from the conclusion of the addition of Soln. (III) and Soln. (IV), furthermore thereinto was poured an aqueous solution of dyes (which contained 113 mg of Dye (e) and 113 mg of Dye (f) illustrated above in the mixture of 82 ml of water with 6 ml of methanol, and was kept at 40° C.).

After performing washing and subsequent desalting steps in conventional manners, the emulsion obtained was admixed with 33 g of lime-processed ossein gelatin, 50 mg of Chemical Agent (B) illustrated hereinbefore and 3 g of Chemical Agent (D) illustrated hereinbefore, adjusted to pH 6.0 and pAg 7.7, and then chemically sensitized at 65° C. to the optimum extent by adding thereto 4-hydroxy-6-methyl-1,3,3a,7-tetrazaindene first, and then sodium thiosulfate and chloroauric acid. Further, the thus sensitized emulsion was admixed with Antifoggant (1) illustrated hereinbefore, and then cooled. Thus, 635 g of a monodisperse cubic silver chlorobromide emulsion having an average grain size of 0.47 μm was obtained.

TABLE 20

| Ingredient | Soln. (I) | Soln. (II) | Soln. (III) | Soln. (IV) |
|---|---|---|---|---|
| $AgNO_3$ | 20.0 g | — | 80.0 g | — |
| $NH_4NO_3$ | 0.06 g | — | 0.06 g | — |
| KBr | — | 10.0 g | — | 45.0 g |
| NaCl | — | 4.2 g | — | 5.5 g |
| Water to make | 100 ml | 100 ml | 260 ml | 260 ml |

Preparation of Zinc Hydroxide Dispersion

A zinc hydroxide powder having a primary grain size of 0.2 μm in an amount of 31 g and a dispersant constituted of 1.6 g of carboxymethyl cellulose and 0.4 g of sodium polyacrylate were admixed with 8.5 g of lime-processed ossein gelatin and 158.5 ml of water, and ground for 1 hour using glass beads in a mill. Then, the glass beads were removed therefrom, and 188 g of a dispersion of zinc hydroxide was obtained.

Preparation of Emulsified Dispersions of Couplers

Emulsified dispersions of cyan, magenta and yellow couplers were prepared according to their respective formulae shown in Table 21. More specifically, in preparing each dispersion, ingredients to constitute an oily phase were mixed and dissolved by heating to about 60° C. to make a homogeneous solution, and thereto a homogeneous solution of ingredients to constitute an aqueous phase which was in advance heated to about 60° C. was added with stirring. The resultant mixture was admixed and dispersed in one liter stainless steel container at 10,000 r.p.m. for 20 minutes by means of a dissolver equipped with a disperser having a diameter of 5 cm. Further, warm water was added thereto in the amount shown in Table 21 and stirred for 10 minutes at 2,000 r.p.m.

TABLE 21

Constitution of Coupler Emulsion

| Ingredients | Yellow | Magenta | Cyan |
|---|---|---|---|
| [Oily Phase] | | | |
| Yellow Coupler (Y-2) | 5.82 g | — | — |
| Magenta Coupler (M-2) | — | 5.15 g | — |
| Cyan Coupler (C-2) | — | — | 4.95 g |
| Developing Agent (A) | 2.31 g | — | — |
| Developing Agent (B) | — | 1.88 g | — |
| Developing Agent (C) | — | — | 2.36 g |
| High Boiling Solvent (6) | 3.5 g | 3.5 g | 3.5 g |
| Antifoggant (5) | 0.005 g | 0.005 g | 0.005 g |
| Ethyl Acetate | 7 ml | 7 ml | 7 ml |
| Cyclohexanone | 2 ml | — | 2 ml |
| [Aqueous Phase] | | | |
| Surfactant (21) | 0.25 g | 0.25 g | 0.25 g |
| Gelatin | 3.26 g | 3.26 g | 3.26 g |
| Water | 37.5 ml | 37.5 ml | 37.5 ml |
| Water added after emulsification | 25 ml | 26 ml | 24 ml |

Antifoggant (5) was added in the form of a 1% ethanol solution, Surfactant (21) was added in the form of a 5% water solution, and gelatin was added in the form of 14% water solution heated to 50° C.
Developing Agent (A)
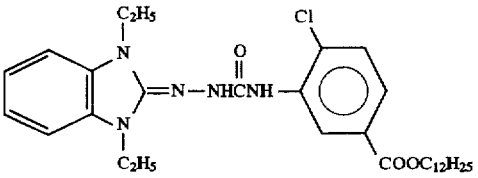
Devloping Agent (B)
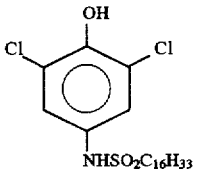
Yellow Coupler Y-2
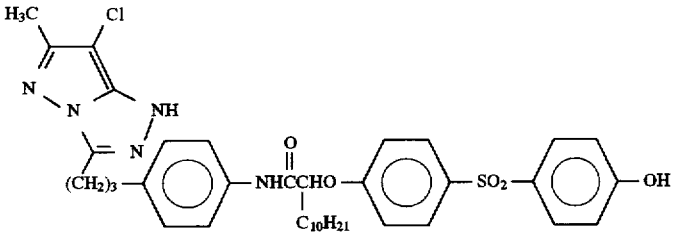
Magenta Coupler M-2
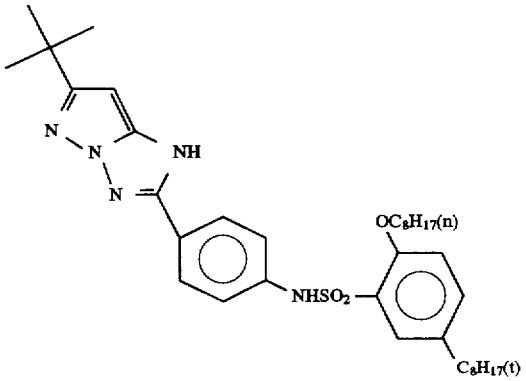
Cyan Coupler C-2
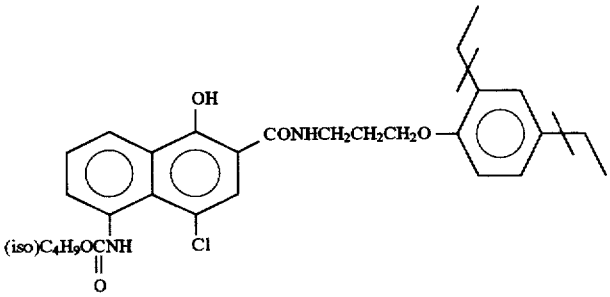

-continued

Developing Agent (C)

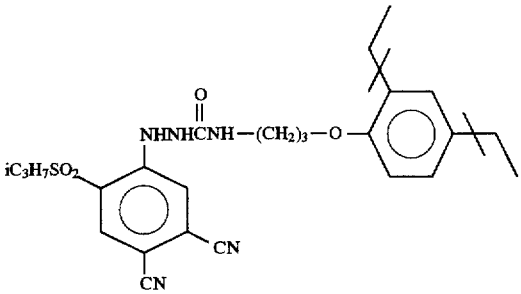

High Boiling Solvent (6)

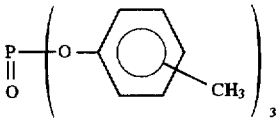

Antifoggant (5)

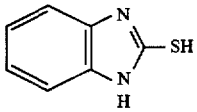

A heat developable color photosensitive material having a multilayer structure shown in Table 22 (Sample No. 107) was produced using the aforementioned materials.

TABLE 22

Constitution of Photosensitive Material 107

| Ordinal number of layer | Name of layer | Ingredients | Coverage rate (mg/m$^2$) |
|---|---|---|---|
| 8th | Protective layer | lime-processed gelatin | 1000 |
| | | Matting agent (silica) | 200 |
| | | Surfactant (22) | 18 |
| | | Surfactant (23) | 5 |
| | | Hardener (1) | 210 |
| | | Water-soluble polymer | 90 |
| 7th | Interlayer | Lime-processed gelatin | 1000 |
| | | Surfactant (22) | 10 |
| | | Surfactant (23) | 6 |
| | | Zinc hydroxide | 1300 |
| | | Water-soluble Polymer (10) | 6 |
| 6th | Yellow color developing layer | Lime-processed gelatin | 2000 |
| | | Blue-sensitive silver halide emulsion (1) | 500* |
| | | Blue-sensitive silver halide emulsion (2) | 800* |
| | | Yellow coupler (Y-2) | 1400 |
| | | Developing agent (A) | 570 |
| | | Antifoggant (5) | 1.5 |
| | | High Boiling Solvent (6) | 1000 |
| | | Surfactant (21) | 61 |
| | | Water-soluble Polymer (10) | 25 |
| 5th | Interlayer | Lime-processed gelatin | 970 |
| | | Surfactant (22) | 50 |
| | | Surfactant (23) | 300 |
| | | Zinc hydroxide | 400 |
| | | Leuco Dye Y | 250 |
| | | Developer | 1420 |
| | | Surfactant (21) | 45 |
| | | Water-soluble Polymer (10) | 60 |
| 4th | Magenta color developing layer | Lime-processed gelatin | 1560 |
| | | Green-sensitive silver halide emulsion (3) | 230* |
| | | Green-sensitive silver halide emulsion (4) | 461* |
| | | Magenta Coupler (M-2) | 1140 |
| | | Developing agent (B) | 420 |
| | | Antifoggant | 1.0 |
| | | High Boiling Solvent (6) | 880 |

TABLE 22-continued

Constitution of Photosensitive Material 107

| Ordinal number of layer | Name of layer | Ingredients | Coverage rate (mg/m$^2$) |
|---|---|---|---|
| | | Surfactant (21) | 55 |
| | | Water-soluble Polymer (10) | 20 |
| 3rd | Interlayer | Lime-processed gelatin | 970 |
| | | Surfactant (22) | 50 |
| | | Surfactant (23) | 300 |
| | | Zinc hydroxide | 400 |
| | | Water-soluble Polymer (10) | 60 |
| 2nd | Cyan color developing layer | Lime-processed gelatin | 2000 |
| | | Red-sensitive silver halide emulsion (5) | 400* |
| | | Red-sensitive silver halide emulsion (6) | 250* |
| | | Cyan coupler (C-2) | 920 |
| | | Developing agent (C) | 440 |
| | | Antifoggant (5) | 1 |
| | | High boiling solvent (6) | 680 |
| | | Surfactant (21) | 46 |
| | | Water-soluble Polymer (10) | 15 |
| 1st | AH layer | Lime-processed gelatin | 1000 |
| | | Leuco dye B | 221 |
| | | Leuco dye M | 28 |
| | | Developer | 740 |
| | | Oil (1) | 491 |
| | | Surfactant (21) | 46 |

Surfactant (22)

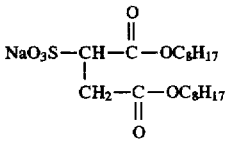

Surfactant (23)

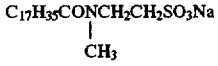

TABLE 22-continued

Constitution of Photosensitive Material 107

| Ordinal number of layer | Name of layer | Ingredients | Coverage rate (mg/m²) |
|---|---|---|---|
| Water-soluble Polymer (10) | | | |
| | | 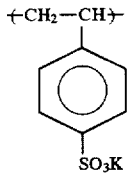 | |
| Hardener (1) | | | |
| | | $CH_2{=}CHSO_2CH_2SO_2CH{=}CH_2$ | |

Support: Transparent PET base (thickness: 102 μm)
*: silver basis

The thus produced photosensitive material Sample No. 107 was cut into pieces having the form of general 35 mm-size negative film, and subjected to a perforation operation. Then, a camera was loaded with this film, and photographs of persons and Macbeth chart were taken therewith.

This sample was processed with a PICTROSTAT 300.

More specifically, the photosensitive material 107 thus exposed was fixed on the photosensitive material side of the donor film of the PICTROSTAT 300 with the emulsion face of the photosensitive material 107 turned upwards, and therewith the cassette of the donor film was loaded. The resulting cassette was set in the magazine D of the PICTROSTAT 300. The exposure function of the PICTROSTAT 300 was suspended in advance, and the magazine R thereof was loaded with Processing Sheet R102 having the constitution shown in Table 23 and Table A. The donor film covered with the exposed photosensitive material was dipped in water kept at 40° C. for 2.5 seconds, and then squeegeed with a roller. Immediately thereafter, the photosensitive material was brought into face-to-face contact with Processing Sheet R102.

The thus superposed matter was heated for 17 seconds by the use of a heating drum whose temperature was controlled so that the water-absorbed surface of the photosensitive material had a temperature of 80° C., and then the processing sheet was peeled from the photosensitive material. As a result, negative images of the photographed figures were obtained on the photosensitive material.

The constitution of Processing Sheet R102 used herein was shown in Table 23.

TABLE 23

Constitution of Processing Sheet R102

| Ordinal No. of Layer | Ingredients | Coverage Rate (mg/m²) |
|---|---|---|
| 4th | Acid-processed gelatin | 220 |
| | Water-soluble Polymer (2) | 60 |
| | Water-soluble Polymer (3) | 200 |
| | Additive (1) | 80 |
| | Palladium sulfide | 3 |

TABLE 23-continued

Constitution of Processing Sheet R102

| Ordinal No. of Layer | Ingredients | Coverage Rate (mg/m²) |
|---|---|---|
| | Potassium nitrate | 12 |
| | Matting Agent (1) | 10 |
| | Anionic Surfactant (1) | 7 |
| | Anionic Surfactant (2) | 7 |
| | Amphoteric Surfactant (1) | 10 |
| 3rd | Lime-processed gelatin | 240 |
| | Water-soluble Polymer (3) | 24 |
| | Hardener (2) | 180 |
| | Anionic Surfactant (3) | 9 |
| 2nd | Lime-processed gelatin | 2400 |
| | Water-soluble Polymer (3) | 360 |
| | Water-soluble Polymer (5) | 700 |
| | Water-soluble Polymer (6) | 600 |
| | High Boiling Solvent (7) | 2000 |
| | Additive (2) | 20 |
| | Hydantion potassium | 260 |
| | Guanidine picolinate | 2910 |
| | Potassium quinolinate | 225 |
| | Sodium quinolinate | 180 |
| | Anionic Surfactant (3) | 24 |
| 1st | Gelatin | 280 |
| | Water-soluble Polymer (2) | 12 |
| | Anionic Surfactant (1) | 14 |
| | Hardener (2) | 185 |
| Support: | PET Support A (thickness: 63 μm) | |

TABLE A

Constitution of Support A

| Name of Layer | Ingredient | Coverage Rate (mg/m²) |
|---|---|---|
| Front Subbing Layer | Gelatin | 100 |
| Polymer Layer | Polyethylene terephthalate | 62500 |
| Back Subbing Layer | Copolymer of methylmethacrylate, styrene, 2-ethylhexylacrylate and methacrylic acid | 1000 |
| | PMMA latex (average particle size: 12μ) | 120 |
| | total: | 63720 |

Water-soluble Polymer (2): κ-Carrageenan
Water-soluble Polymer (3): Sumikagel L5H (trade name, produced by Sumitomo Chemical Co., Ltd.)
Water-soluble Polymer (5): Dextran (molecular weight: $7 \times 10^4$)
Water-soluble Polymer (6): MP polymer, MP102 (trade name, produced by Kuraray Co., Ltd.)

Additive (1)

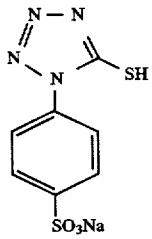

Additive (2)

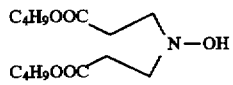

TABLE A-continued

| Constitution of Support A | | |
|---|---|---|
| Name of Layer | Ingredient | Coverage Rate (mg/m$^2$) |
| Hardener (2) | 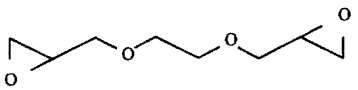 | |
| Anionic Surfactant (1) | 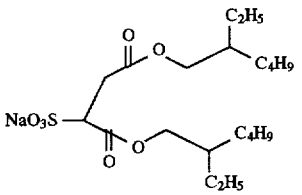 | |
| Anionic Surfactant (2) | 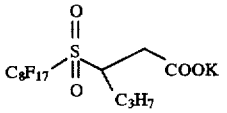 | |
| Anionic Surfactant (3) | 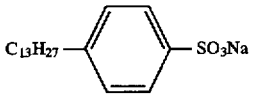 | |
| Amphoteric Surfactant (1) | 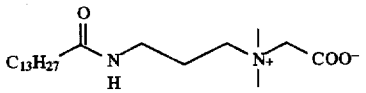 | |
| High Boiling Solvent (7) | Enpara 40 (trade name, produced by Ajinomoto Co., Ltd.) | |
| Matting Agent (1) | SYLOID 79 (trade name, produced by Fuji Davisson) | |

At the conclusion of the processing, negative images of the photographed figures were obtained on the photosensitive material, Sample No. 107.

In analogy with general negative films, the thus processed negative film was used in the exposure of a color paper, Fuji Color Paper SUPER FAV (produced by Fuji Photo Film Co., Ltd.), with an automatic color printer, Model 12C4510 (made by Fuji Photo Film Co., Ltd.), and the color paper thus exposed was subjected to the standard processing using an processing apparatus, Minilabo Champion FA120 (made by Fuji Photo Film Co., Ltd.), and a processing agent for color paper use, CP40FAII.

Despite the presence of residual silver halide and developed silver in the negative film, prints of satisfactory quality were obtained, and each person's skin color and every color on the Macbeth chart were reproduced in a desirable condition.

Further, in analogy with general negative films, the image information of the negative film obtained herein was converted into output by means of PICTROSTAT 330 (made by Fuji Photo Film Co., Ltd.) through the optical reading operation with the NSE unit thereof. In this case also, good prints in sharpness, graininess, etc. were obtained in spite of the presence of residual silver halide and developed silver in the negative film. In other words, each person's skin color and every color on the Macbeth chart were reproduced in a desirable condition.

In this case, all the operations, from photographing to printing operations, was performed without using any of processing solutions required for conventional color photography.

In addition, the image information of the processed photosensitive material was read with a negative film scanner using diffused light as reading light (Topaz, made by Linotype.Hel Co., Ltd.), and transferred to Macintosh Quadra 840AV, made by Apple Computer. The digital information thus obtained was subjected to image processing, and transmitted to PICTROGRAPHY 3000 (made by Fuji Photo Film Co., Ltd.). Thus, good prints having figure images, which are excellent in sharpness and graininess, etc. were obtained.

EXAMPLE 8

Preparation of Photosensitive Silver Halide Emulsion

To an aqueous gelatin solution (containing 30 g of inert gelatin and 2 g of potassium bromide in 1,000 ml of water) stirred well was added ammonia.ammonium nitrate as a solvent followed by heating, and then 1,000 ml of an aqueous solution containing 1 mol of silver nitrate and 1,000 ml of an aqueous solution containing 1 mol of potassium bromide and 0.03 mol of potassium iodide were simultaneously added thereto over a period of 78 minutes. After washing with water and desalting, inert gelatin was added and redispersed to provide a silver iodobromide emulsion having a sphere-corresponding diameter of 0.76 μm and an iodine-content of 3 mol %. The sphere-corresponding diameter was measured by Model TA-II made by Coulter Co.

To the foregoing silver halide emulsion were added potassium thiocyanate, chloroauric acid, and sodium thiosulfate at 56° C. and the emulsion was most suitably chemically sensitized. To the silver halide emulsion was added a sensitizing dye corresponding to each spectral sensitivity at the preparation of the coating liquid to impart a color sensitivity.

Preparation of Zinc Hydroxide Dispersion

A mixture of 31 g of the powder of zinc hydroxide having a particle size of the primary particles of 0.2 μm, 1.6 g of carboxymethyl cellulose as a dispersing agent, 0.4 g of sodium polyacrylic acid, 8.5 g of lime-treated ossein gelatin, and 158.5 ml of water was dispersed by a mill using glass beads for one hour. After dispersing, the glass beads were removed by filtration to provide 188 g of the dispersion of zinc hydroxide.

Preparation of Emulsified Dispersion of Color Developing Agent and Coupler

Each of the oil-phase component and the aqueous component having the compositions shown in Table 24 below was dissolved to provide uniform solution of 60° C. The oil-phase component was combined with the aqueous component and dispersed in a one liter stainless steel container by a dissolver equipped with a disperser having a diameter of 5 cm at 10,000 rpm for 20 minutes. To the dispersion was added warm water of the amount shown in Table 24 below as post addition water and the mixture was mixed at 2,000 rpm for 10 minutes.

Thus, the emulsified dispersions of cyan, magenta, and yellow three color couplers were prepared.

TABLE 24

Constitution of Coupler Emulsion

| Ingredients | Cyan | Magenta | Yellow |
|---|---|---|---|
| [Oily Phase] | | | |
| Cyan Coupler (1) | 5.63 g | — | — |
| Magenta Coupler (2) | — | 6.87 g | — |
| Yellow Coupler (3) | — | — | 7.86 g |
| Developing Agent (4) | 5.11 g | 5.11 g | 5.11 g |
| Antifoggant (5) | 3.0 mg | 1.0 mg | 10.0 mg |
| High Boiling Solvent (6) | 5.37 g | 5.99 g | 6.49 g |
| Ethyl Acetate | 24.0 ml | 24.0 ml | 24.0 ml |
| [Aqueous Phase] | | | |
| Gelatin | 12.0 g | 12.0 g | 12.0 g |
| Surfactant (7) | 0.60 g | 0.60 g | 0.60 g |
| Water | 138.0 ml | 138.0 ml | 138.0 ml |
| Water added after emulsification | 180.0 ml | 180.0 ml | 180.0 ml |

Cyan Coupler (1)

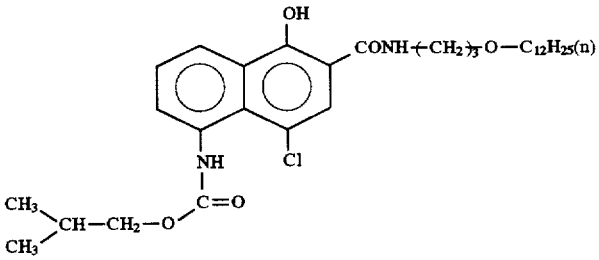

Magenta Coupler (2)

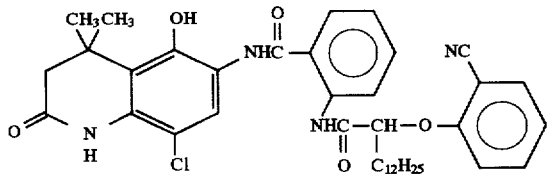

Yellow Coupler (3)

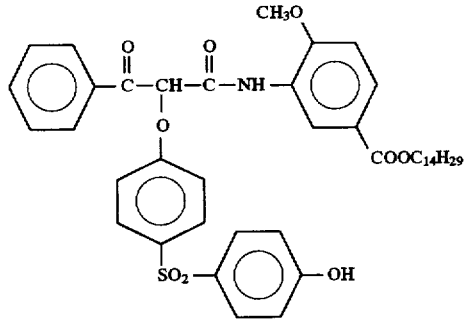

TABLE 24-continued

Constitution of Coupler Emulsion

| Ingredients | Cyan | Magenta | Yellow |
|---|---|---|---|

Developing Agent (4)

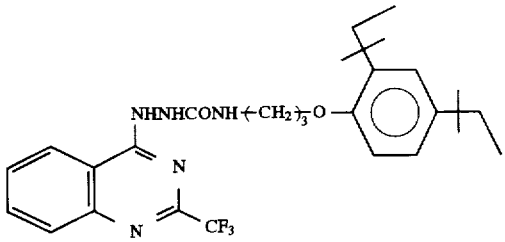

Antifoggant (5)

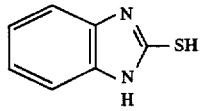

High Boiling Solvent (6)

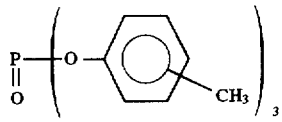

Surfactant (7)

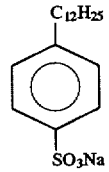

Preparation of Yellow Filter and Antihalation Layer Dye Compositions

The dye composition was prepared as an emulsified dispersion as shown below and added.

To a leuco dye, a developer, and, if necessary, a high-boiling organic solvent was added ethyl acetate, and the mixture was dissolved by heating to about 60° C. to form a uniform solution. To 100 ml of the solution were added 1.0 g of Surfactant (7) and 190 ml of an aqueous solution of 6.6% lime-treated gelatin heated to about 60° C. and the mixture was dispersed by a homogenizer at 10,000 rpm for 10 minutes.

Thus, two kinds of dye dispersions shown in Table 25 below were prepared.

TABLE 25

| Ingredient | Yellow Filter Dye | Antihalation Dye |
|---|---|---|
| Leuco Dye Y | 5.32 g | — |
| Leuco Dye B | — | 4.5 g |
| Leuco Dye M | — | 0.58 g |
| Developer | 30.2 g | 15.1 g |
| Oil (1) | — | 10 g |
| Ethyl Acetate | 60 ml | 75 ml |

Leuco Dye Y

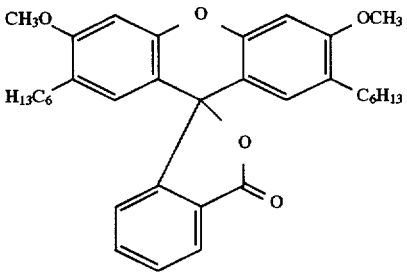

Developer

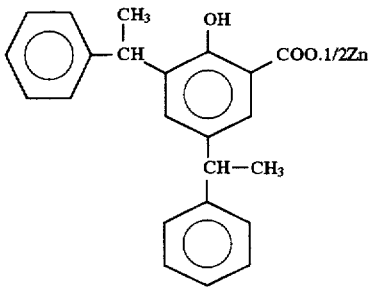

Leuco Dye B

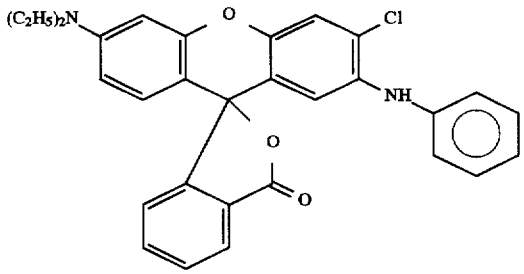

Surfactant (7)

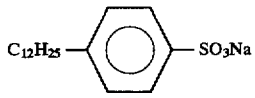

TABLE 25-continued

| Ingredient | Yellow Filter Dye | Antihalation Dye |
|---|---|---|
| Leuco Dye M | | |
| Oil (1) | | |
| $C_{26}H_{16.9}Cl_{7.1}$ | | |

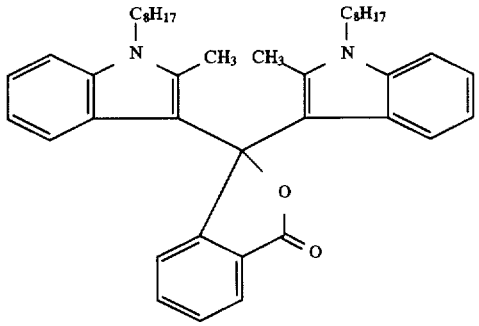

Using the materials thus obtained, a photosensitive material 201 of a multilayer structure shown in Table 26 and Table 27 below was prepared.

TABLE 26

Constitution of Photosensitive Material 201

| Ordinal number of layer | Name of layer | Ingredients | Coverage rate (mg/m²) |
|---|---|---|---|
| 8th | Protective layer | lime-processed gelatin | 1000 |
| | | Matting agent (silica) | 100 |
| | | Surfactant (8) | 100 |
| | | Surfactant (9) | 300 |
| | | Water-soluble polymer | 20 |
| 7th | Interlayer | Lime-processed gelatin | 400 |
| | | Surfactant (9) | 15 |
| | | Zinc hydroxide | 1200 |
| | | Water-soluble Polymer (10) | 15 |
| 6th | Yellow color developing layer | Lime-processed gelatin | 1450 |
| | | Light-sensitive silver halide emulsion | 800* |
| | | Sensitizing dye (12) | 3.65 |
| | | Yellow coupler (3) | 629 |
| | | Developing agent (4) | 409 |
| | | Antifoggant (5) | 0.8 |
| | | High Boiling Solvent (6) | 519 |
| | | Surfactant (7) | 48 |
| | | Water-soluble Polymer (10) | 20 |
| 5th | Interlayer (Yellow filter) | Lime-processed gelatin | 1000 |
| | | Leuco Dye Y | 250 |
| | | Surfactant (9) | 8 |
| | | Water-soluble Polymer (10) | 5 |
| | | Hardener (11) | 65 |
| 4th | Magenta color developing layer | Lime-processed gelatin | 1800 |
| | | Light-sensitive silver halide emulsion | 500* |
| | | Sensitizing Dye (13) | 0.07 |
| | | Sensitizing Dye (14) | 0.71 |
| | | Sensitizing Dye (15) | 0.19 |
| | | Magenta Coupler (2) | 423 |
| | | Developing agent (4) | 281 |
| | | Antifoggant (5) | 0.06 |

TABLE 27

| Ordinal number of layer | Name of layer | Ingredients | Coverage rate (mg/m²) |
|---|---|---|---|
| 4th | Magenta color developing layer | High Boiling Solvent (6) | 330 |
| | | Surfactant (7) | 33 |
| | | Water-soluble Polymer (10) | 14 |
| 3rd | Interlayer | Lime-processed gelatin | 1000 |
| | | Surfactant (9) | 8 |
| | | Zinc hydroxide | 1200 |
| | | Water-soluble Polymer (10) | 5 |
| 2nd | Cyan color developing layer | Lime-processed gelatin | 720 |
| | | Light-sensitive silver halide emulsion | 350* |
| | | Sensitizing dye (16) | 1.52 |
| | | Sensitizing dye (17) | 1.03 |
| | | Sensitizing dye (18) | 0.05 |
| | | Cyan coupler (1) | 250 |
| | | Developing agent (4) | 204 |
| | | Antifoggant (5) | 0.12 |
| | | High boiling solvent (6) | 215 |
| | | Surfactant (7) | 24 |
| | | Water-soluble Polymer (10) | 10 |
| 1st | AH layer | Lime-processed gelatin | 1000 |
| | | Leuco dye B | 221 |
| | | Leuco dye M | 28 |
| | | Developer | 740 |
| | | Oil (1) | 491 |
| | | Surfactant (1) | 46 |

Surfactant (8)

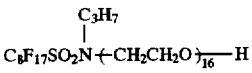

Surfactant (9)

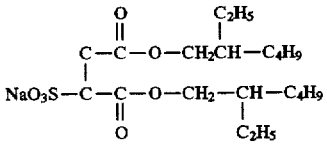

Water-soluble Polymer (10)

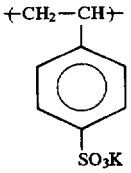

Hardener (11)

$CH_2=CH-SO_2-CH_2-SO_2-CH=CH_2$

Sensitizing Dye (12)

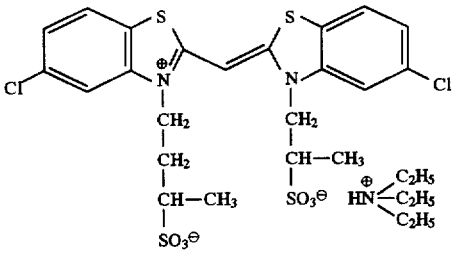

TABLE 27-continued

| Ordinal number of layer | Name of layer | Ingredients | Coverage rate (mg/m²) |
|---|---|---|---|

Sensitizing Dye (13)

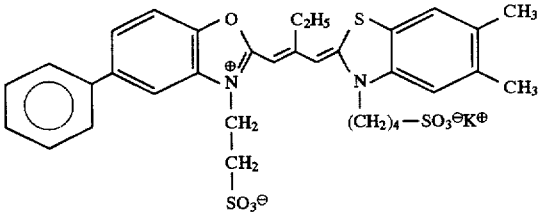

Sensitizing Dye (14)

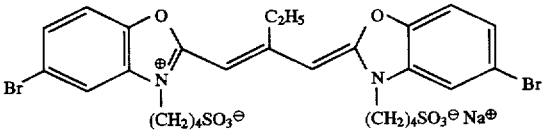

Sensitizing Dye (15)

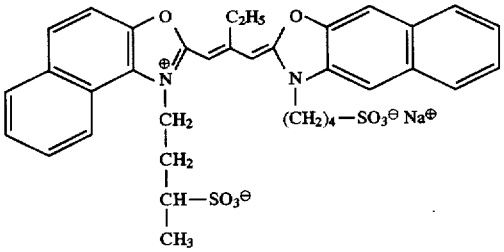

Sensitizing Dye (16)

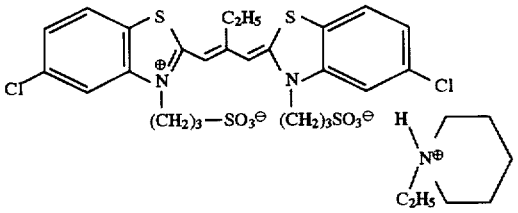

Sensitizing Dye (17)

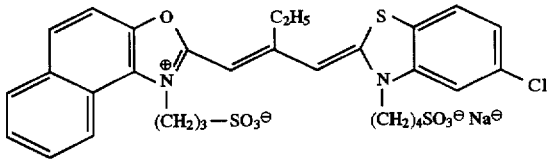

TABLE 27-continued

| Ordinal number of layer | Name of layer | Ingredients | Coverage rate (mg/m²) |
|---|---|---|---|
| Sensitizing Dye (18) | | | |

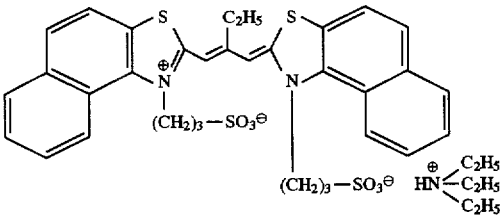

Support: Transparent PET base (thickness: 100 μm)
*: silver basis

Furthermore, a processing material R-1 having the content shown in Table 28 and Table 29 was prepared.

TABLE 28

| Ordinal number of layer | Name of layer | Ingredients | Coverage rate (mg/m²) |
|---|---|---|---|
| 4th | Protective layer | Acid-processed gelatin | 220 |
| | | Water-soluble polymer (19) | 60 |
| | | Water-soluble polymer (20) | 200 |
| | | Additive (21) | 80 |
| | | Palladium sulfate | 3 |
| | | Potassium nitrate | 12 |
| | | Surfactant (9) | 7 |
| | | Surfactant (23) | 7 |
| | | Surfactant (24) | 10 |
| 3rd | Interlayer | Lime-processed gelatin | 240 |
| | | Water-soluble polymer (20) | 24 |
| | | Hardener (25) | 180 |
| | | Surfactant (7) | 9 |
| 2nd | Base generating layer | Lime-processed gelatin | 2400 |
| | | Water-soluble polymer (20) | 360 |
| | | Water-soluble polymer (26) | 700 |
| | | Water-soluble polymer (27) | 600 |
| | | High-boiling Solvent (28) | 2000 |
| | | Additive (29) | 20 |
| | | Potassium hydantoin | 260 |
| | | Guanidine picolinate | 2910 |
| | | Potassium quinolinate | 225 |
| | | Sodium quinolinate | 180 |
| | | Surfactant (7) | 24 |
| 1st | Subbing layer | Lime-processed gelatin | 280 |
| | | Water-soluble polymer (19) | 12 |
| | | Surfactant (9) | 14 |
| | | Hardener (25) | 185 |

Support: Transparent PET base (thickness: 63 μm)

TABLE 29

Constitution of Support A

| Name of Layer | Ingredient | Coverage Rate (mg/m²) |
|---|---|---|
| Front Subbing Layer | Lime-processed Gelatin | 100 |
| Polymer Layer | Polyethylene terephthalate | 62500 |

TABLE 29-continued

Constitution of Support A

| Name of Layer | Ingredient | Coverage Rate (mg/m²) |
|---|---|---|
| Back Subbing Layer | Copolymer of methylmethacrylate, styrene, 2-ethylhexylacrylate and methacrylic acid | 1000 |
| | PMMA latex | 120 |

Water-soluble Polymer (19): κ-Carrageenan
Water-soluble Polymer (20): Sumikagel L5H (trade name, produced by Sumitomo Chemical Co., Ltd.)

Additive (21)

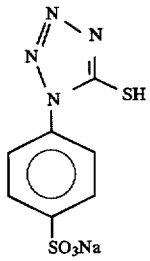

Matting Agent (22): SYLOID 79 (trade name, produced by Fuji Davison)

Surfactant (23):

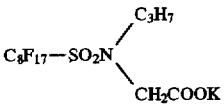

Surfactant (24):

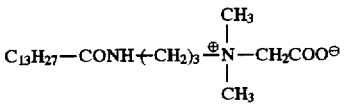

Hardener (25):

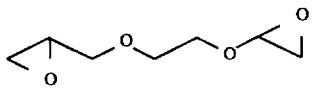

Water-soluble Polymer (26): Dextran (molecular weight: $7 \times 10^4$)
Water-soluble Polymer (27): MP polymer, MP102 (trade name, produced by Kuraray Co., Ltd.)
High Boiling Solvent (28): Enpara 40 (trade name, produced by Ajinomoto Co., Ltd.)

Additive (29):

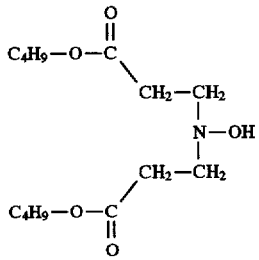

The photosensitive material 201 thus prepared was cut into an ordinary 135 negative film size, perforated, mounted in a camera, and photographed a person and a Machbeth chart.

After applying 15 ml/m$^2$ of water (corresponding to 45% of the maximum swelling amount) of 40° C. to the photographed photosensitive material, the photosensitive material was superposed on the processing material R-1 and they were heated by a heat drum of 83° C. from the back surface of the photosensitive material for 20 seconds. When the processing material R-1 was separated from the photosensitive material 201, a negative image was obtained on the photosensitive material.

The image was read by a CCD line scanner (Topaz, made by Linotype.Hel Co. Ltd.,) and when after image processing on a personal computer, the image was output by a heat developing printer (PICTROGRAPHY 3000, trade name, manufactured by Fuji Photo Film Co., Ltd.), a print of a person image having good graininess and sharpness as conventional photograph was obtained.

EXAMPLE 9

By following the same procedure as Example 8 except that the combination of the color developing agent and the couplers used for the photosensitive material 201 were changed as shown in Table 30 below, photosensitive materials 202 to 205 were prepared. In addition, the using amount of each material was same as that of the photosensitive material 201.

TABLE 30

| Photosensitive | RL | | GL | | BL | |
|---|---|---|---|---|---|---|
| Material | Agent | Coupler | Agent | Coupler | Agent | Coupler |
| 102 | D-1 | C-48 | D-1 | C-22 | D-34 | C-77 |
| 103 | D-1 | C-48 | D-24 | C-27 | D-34 | C-77 |
| 104 | D-34 | C-119 | D-24 | C-27 | D-46 | C-100 |
| 105 | D-34 | C-119 | D-24 | C-27 | D-27 | C-96 |

When the photosensitive materials 202 to 205 obtained were used for photographing and processed, a negative image was obtained on each of the photosensitive materials and when each image was read as in Example 8 and after image processing, the image was output by a heat developing printer (PICTROGRAPHY 3000), a good image was obtained.

Also, after allowing to stand the photosensitive materials 201 to 205 for 3 days under the circumstances of 45° C. and 80% RH, when the same processing was carried out, a good image could be obtained in each case.

According to the present invention, by simple heat development processing, color images having excellent graininess and sharpness could be quickly obtained.

What is claimed is:

1. A method of forming color images comprising the steps of:

(1) carrying out imagewise exposure of a photosensitive material which comprises a transparent support having provided thereon at least three light-sensitive layers, which each comprise light-sensitive silver halide, a color developing agent, a coupler and a binder, and which have their individual sensitivities in different wavelength regions, the absorption wavelength region of each dye formed by reacting the color developing agent with the coupler being different from each other;

(2) providing said photosensitive material or a processing material with water in an amount corresponding to the amount of from 0.1 to 1 times the amount required for maximally swelling the total coated layers of said photosensitive material and said processing material excluding a back layer, wherein said processing material comprises on a support a processing layer containing at least a base and/or a base precursor;

(3) then superposing said photosensitive material on said processing material such that the photosensitive layer faces the processing layer;

(4) heating the material to a temperature of from 60° C. to 100° C. for a time of from 5 seconds to 60 seconds to form an image based on at least three color non-diffusible dyes on said photosensitive material; and (5) forming color images in a separate recording material based on the image information obtained in the step (4).

2. The method of forming color images according to claim 1, wherein the color developing agent is at least one compound of the compounds represented by the following general formulae (I) to (V):

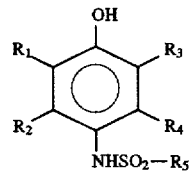

(I)

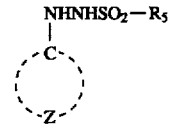

(II)

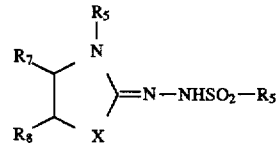

(III)

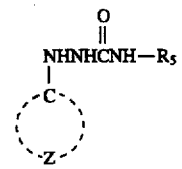

(IV)

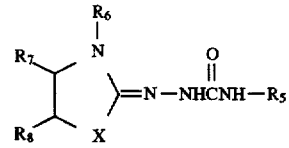

(V)

wherein, $R_1$, $R_2$, $R_3$, and $R_4$ each represents a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group, or an acyloxy group; $R_5$ represents a substituted or unsubstituted alkyl group, a substituted or unsubstituted aryl group, or a substituted or unsubstituted heterocyclic group; Z represents an atomic group forming an aromatic ring (including a heterocyclic aromatic ring) and when Z is a benzene ring, the total value of the Hammett's constant ($\sigma$) of the substituent is at least 1; $R_6$ represents a substituted or unsubstituted alkyl group; X represents an oxygen atom, a sulfur atom, a selenium atom, or an alkyl-substituted or aryl-substituted tertiary nitrogen atom; and $R_7$ and $R_8$ each represents a hydrogen atom or a substituent and $R_7$ and $R_8$ may combine each other to form a double bond or a ring.

* * * * *